US012629570B2

(12) United States Patent
Greaney et al.

(10) Patent No.: US 12,629,570 B2
(45) **Date of Patent: *May 19, 2026**

(54) GOLF CLUB HEAD AND GOLF CLUB

(71) Applicant: Taylor Made Golf Company, Inc., Carlsbad, CA (US)

(72) Inventors: Mark Vincent Greaney, Vista, CA (US); John Francis Lorentzen, El Cajon, CA (US); Matthew Greensmith, Vista, CA (US); Craig Richard Slyfield, San Diego, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 470 days.

This patent is subject to a terminal disclaimer.

(21) Appl. No.: 18/226,294

(22) Filed: Jul. 26, 2023

(65) Prior Publication Data

US 2024/0042286 A1 Feb. 8, 2024

Related U.S. Application Data

(63) Continuation of application No. 17/566,833, filed on Dec. 31, 2021, now Pat. No. 11,752,404, which is a (Continued)

(51) Int. Cl.
*A63B 53/04* (2015.01)

(52) U.S. Cl.
CPC ..... *A63B 53/0466* (2013.01); *A63B 53/0408* (2020.08); *A63B 53/0412* (2020.08); *A63B 2209/00* (2013.01)

(58) Field of Classification Search
CPC ..... A63B 53/0466; A63B 53/0408; A63B 53/0412; A63B 2209/00

(Continued)

(56) References Cited

U.S. PATENT DOCUMENTS 1,518,316 A 12/1924 Ellingham
1,526,438 A 2/1925 Scott (Continued)

FOREIGN PATENT DOCUMENTS

DE 9012884 U1 11/1990
EP 0982052 A1 3/2000

(Continued)

OTHER PUBLICATIONS

Callaway Golf World's Straightest Driver: FT-i Driver downloaded from www.callawaygolf.com/ft%2Di/driver.aspx?lang=en on Apr. 5, 2007.

(Continued)

*Primary Examiner* — Sebastiano Passaniti
(74) *Attorney, Agent, or Firm* — Dawsey Co., LPA; David J. Dawsey

(57) ABSTRACT

A golf club head and golf club having large head dimensions, and large face characteristics, as well as unique mass property attributes driven by relationships not often considered in conventional club head design, to achieve a resistance to squaring the club head during a golf swing that is comfortable to the novice golfer, while increasing stability during off-center impacts and obtaining preferred launch characteristics. This is achieved in part via establishing a club head configuration and associated weight distribution to yield a center of gravity location that results in a preferred magnitude of Delta1 and Delta2 values, CG angle, moments of inertia, and associated ratios, relationships, and club head mass property characteristics influenced by these variables to achieve improved performance.

32 Claims, 94 Drawing Sheets

Related U.S. Application Data continuation of application No. 17/143,527, filed on Jan. 7, 2021, now Pat. No. 11,213,728, which is a continuation of application No. 16/258,848, filed on Jan. 28, 2019, now Pat. No. 10,888,746, which is a continuation of application No. 15/263,929, filed on Sep. 13, 2016, now Pat. No. 10,195,497.

(58) Field of Classification Search
USPC ..... 473/324–350, 287–292
See application file for complete search history.

(56) References Cited

U.S. PATENT DOCUMENTS 1,538,312 A 5/1925 Beat
1,592,463 A 7/1926 Marker
1,658,581 A 2/1928 Tobia
1,704,119 A 3/1929 Buhrke
1,970,409 A 8/1934 Wiedemann
D107,007 S 11/1937 Cashmore
2,214,356 A 9/1940 Wettlaufer
2,225,930 A 12/1940 Sexton
2,360,364 A 10/1944 Reach
2,460,435 A 2/1949 Schaffer
2,681,523 A 6/1954 Sellers
3,064,980 A 11/1962 Steiner
3,466,047 A 9/1969 Rodia
3,486,755 A 12/1969 Hodge
3,556,533 A 1/1971 Hollis
3,589,731 A 6/1971 Chancellor, Jr.
3,606,327 A 9/1971 Gorman
3,610,630 A 10/1971 Glover
3,652,094 A 3/1972 Glover
3,672,419 A 6/1972 Fischer
3,692,306 A 9/1972 Glover
3,743,297 A 7/1973 Dennis
3,897,066 A 7/1975 Belmont
3,976,299 A 8/1976 Lawrence et al.
3,979,122 A 9/1976 Belmont
3,979,123 A 9/1976 Belmont
3,984,103 A 10/1976 Nix
4,008,896 A 2/1977 Gordos
4,043,563 A 8/1977 Churchward
4,052,075 A 10/1977 Daly
4,076,254 A 2/1978 Nygren
4,085,934 A 4/1978 Churchward
4,121,832 A 10/1978 Ebbing
4,165,874 A 8/1979 Lezatte et al.
4,214,754 A 7/1980 Zebelean
4,240,631 A 12/1980 MacDougall
4,261,566 A 4/1981 MacDougall
4,262,562 A 4/1981 MacNeill
D259,698 S 6/1981 MacNeill
4,340,229 A 7/1982 Stuff, Jr.
4,411,430 A 10/1983 Dian
4,423,874 A 1/1984 Stuff, Jr.
4,432,549 A 2/1984 Zebelean
4,438,931 A 3/1984 Motomiya
4,530,505 A 7/1985 Stuff
D284,346 S 6/1986 Masters
4,602,787 A 7/1986 Sugioka et al.
4,607,846 A 8/1986 Perkins
4,679,791 A 7/1987 Hull
4,712,798 A 12/1987 Preato
4,730,830 A 3/1988 Tilley
4,736,093 A 4/1988 Braly
4,754,977 A 7/1988 Sahm
4,795,159 A 1/1989 Nagamoto
4,819,939 A 4/1989 Kobayashi
4,867,457 A 9/1989 Lowe
4,867,458 A 9/1989 Sumikawa et al.
4,869,507 A 9/1989 Sahm
4,895,371 A 1/1990 Bushner
4,957,294 A 9/1990 Long
4,962,932 A 10/1990 Anderson
4,994,515 A 2/1991 Washiyama et al.
5,039,267 A 8/1991 Wollar
5,050,879 A 9/1991 Sun et al.
5,058,895 A 10/1991 Igarashi
RE33,735 E 11/1991 Rumble et al.
5,244,210 A 9/1993 Au
5,253,869 A 10/1993 Dingle et al.
D343,558 S 1/1994 Latraverse et al.
5,316,305 A 5/1994 McCabe
5,320,005 A 6/1994 Hsiao
5,328,176 A 7/1994 Lo
5,385,348 A 1/1995 Wargo
5,410,798 A 5/1995 Lo
5,421,577 A 6/1995 Kobayashi
5,429,365 A 7/1995 McKeighen
5,439,222 A 8/1995 Kranenberg
5,441,274 A 8/1995 Clay
5,447,309 A 9/1995 Vincent
D365,615 S 12/1995 Shimatani
5,482,280 A 1/1996 Yamawaki
5,509,659 A 4/1996 Igarashi
5,518,243 A 5/1996 Redman
5,533,730 A 7/1996 Ruvang
5,571,053 A 11/1996 Lane
5,620,379 A 4/1997 Borys
5,624,331 A 4/1997 Lo et al.
5,629,475 A 5/1997 Chastonay
5,632,694 A 5/1997 Lee
5,669,827 A 9/1997 Nagamoto
5,683,309 A 11/1997 Reimers
5,709,613 A 1/1998 Sheraw
5,718,641 A 2/1998 Lin
5,720,674 A 2/1998 Galy
D392,526 S 3/1998 Nicely
5,746,664 A 5/1998 Reynolds, Jr.
5,755,627 A 5/1998 Yamazaki et al.
5,769,737 A 6/1998 Holladay et al.
5,776,011 A 7/1998 Su et al.
RE35,955 E 11/1998 Lu
5,851,160 A 12/1998 Rugge et al.
5,873,791 A 2/1999 Allen
D409,463 S 5/1999 McMullin
5,908,356 A 6/1999 Nagamoto
5,911,638 A 6/1999 Parente et al.
D412,547 S 8/1999 Fong
5,935,019 A 8/1999 Yamamoto
5,935,020 A 8/1999 Stites et al.
5,941,782 A 8/1999 Cook
5,947,840 A 9/1999 Ryan
5,954,596 A 9/1999 Noble et al.
5,967,905 A 10/1999 Nakahara et al.
5,997,415 A 12/1999 Wood
6,015,354 A 1/2000 Ahn et al.
6,019,686 A 2/2000 Gray
6,023,891 A 2/2000 Robertson et al.
6,032,677 A 3/2000 Blechman et al.
6,056,649 A 5/2000 Imai
6,080,068 A 6/2000 Takeda
6,089,994 A 7/2000 Sun
6,139,445 A 10/2000 Werner et al.
6,149,533 A 11/2000 Finn
6,162,133 A 12/2000 Peterson
6,238,303 B1 5/2001 Fite
6,244,974 B1 6/2001 Hanberry, Jr.
6,270,422 B1 8/2001 Fisher
6,277,032 B1 8/2001 Smith
6,296,579 B1 10/2001 Robinson
6,299,547 B1 10/2001 Kosmatka
6,332,848 B1 12/2001 Long et al.
6,334,817 B1 1/2002 Ezawa et al.
6,338,683 B1 1/2002 Kosmatka
6,340,337 B2 1/2002 Hasebe et al.
6,348,014 B1 2/2002 Chiu
6,354,962 B1 3/2002 Galloway et al.
6,379,265 B1 4/2002 Hirakawa et al.
6,383,090 B1 5/2002 Doherty et al.
6,390,933 B1 5/2002 Galloway et al.
6,398,666 B1 6/2002 Evans et al.
6,409,612 B1 6/2002 Evans et al.

(56) References Cited

U.S. PATENT DOCUMENTS 6,425,832 B2 7/2002 Cackett et al.
6,428,425 B1 8/2002 Naruo et al.
6,435,982 B1 8/2002 Galloway et al.
6,436,142 B1 8/2002 Paes et al.
6,440,009 B1 8/2002 Guibaud et al.
6,471,604 B2 10/2002 Hocknell et al.
6,491,592 B2 12/2002 Cackett et al.
6,514,154 B1 2/2003 Finn
6,524,197 B2 2/2003 Boone
6,527,649 B1 3/2003 Neher et al.
6,530,848 B2 3/2003 Gillig
6,547,676 B2 4/2003 Cackett et al.
6,565,448 B2 5/2003 Cameron et al.
6,565,452 B2 5/2003 Helmstetter et al.
6,569,040 B2 5/2003 Bradstock
6,572,489 B2 6/2003 Miyamoto et al.
6,575,845 B2 6/2003 Galloway et al.
6,582,321 B2 6/2003 Galloway et al.
6,582,323 B2 6/2003 Soracco et al.
6,602,149 B1 8/2003 Jacobson
6,605,007 B1 8/2003 Bissonnette et al.
6,607,452 B2 8/2003 Helmstetter et al.
6,612,938 B2 9/2003 Murphy et al.
6,620,056 B2 9/2003 Galloway et al.
6,641,487 B1 11/2003 Hamburger
6,648,773 B1 11/2003 Evans
6,669,571 B1 12/2003 Cameron et al.
6,669,578 B1 12/2003 Evans
6,669,580 B1 12/2003 Cackett et al.
6,676,536 B1 1/2004 Jacobson
6,719,645 B2 4/2004 Kouno
6,739,982 B2 5/2004 Murphy et al.
6,739,983 B2 5/2004 Helmstetter et al.
6,743,118 B1 6/2004 Soracco
6,757,572 B1 6/2004 Forest
6,758,763 B2 7/2004 Murphy et al.
6,773,360 B2 8/2004 Willett et al.
6,800,038 B2 10/2004 Willett et al.
6,824,475 B2 11/2004 Burnett et al.
6,832,961 B2 12/2004 Sano
6,860,818 B2 3/2005 Mahaffey et al.
6,860,823 B2 3/2005 Lee
6,860,824 B2 3/2005 Evans
6,875,129 B2 4/2005 Erickson et al.
6,878,073 B2 4/2005 Takeda
6,881,159 B2 4/2005 Galloway et al.
6,902,497 B2 6/2005 Deshmukh et al.
6,904,663 B2 6/2005 Willett et al.
6,926,619 B2 8/2005 Helmstetter et al.
6,939,247 B1 9/2005 Schweigert et al.
6,960,142 B2 11/2005 Bissonnette et al.
6,964,617 B2 11/2005 Williams
6,974,393 B2 12/2005 Caldwell et al.
6,979,270 B1 12/2005 Allen
6,988,960 B2 1/2006 Mahaffey et al.
6,991,558 B2 1/2006 Beach et al.
6,997,820 B2 2/2006 Willett et al.
6,997,821 B2 2/2006 Galloway et al.
7,004,852 B2 2/2006 Billings
7,025,692 B2 4/2006 Erickson et al.
7,029,403 B2 4/2006 Rice et al.
7,056,228 B2 6/2006 Beach et al.
7,059,973 B2 6/2006 Erickson et al.
7,070,517 B2 7/2006 Cackett et al.
7,140,974 B2 11/2006 Chao et al.
7,153,220 B2 12/2006 Lo
7,163,468 B2 1/2007 Gibbs et al.
7,166,038 B2 1/2007 Williams et al.
7,166,040 B2 1/2007 Hoffman et al.
7,169,060 B2 1/2007 Stevens et al.
7,186,190 B1 3/2007 Beach et al.
7,189,169 B2 3/2007 Billings
7,198,575 B2 4/2007 Beach et al.
7,223,180 B2 5/2007 Willett et al.
7,247,103 B2 7/2007 Beach et al.
7,252,600 B2 8/2007 Murphy et al.
7,255,654 B2 8/2007 Murphy et al.
7,258,626 B2 8/2007 Gibbs et al.
7,278,927 B2 10/2007 Gibbs et al.
7,407,447 B2 8/2008 Beach
7,419,441 B2 9/2008 Hoffman
7,448,963 B2 11/2008 Beach et al.
7,621,823 B2 11/2009 Beach et al.
7,628,713 B2 12/2009 Tavares
7,713,143 B2 5/2010 Evans
7,731,603 B2 6/2010 Beach et al.
7,736,245 B2 6/2010 Hasegawa
7,753,806 B2 7/2010 Beach et al.
7,771,291 B1 8/2010 Willett et al.
7,798,914 B2 9/2010 Noble et al.
7,850,542 B2 12/2010 Cackett et al.
7,938,742 B2 5/2011 Galloway et al.
8,012,038 B1 9/2011 Beach et al.
8,012,039 B2 9/2011 Greaney et al.
8,096,897 B2 1/2012 Beach
8,128,508 B2 3/2012 Sato
8,262,507 B1 9/2012 Willett et al.
8,353,786 B2 1/2013 Beach et al.
8,444,504 B2 5/2013 Chao et al.
8,579,725 B1 11/2013 Willett et al.
8,647,216 B2 2/2014 Beach et al.
8,663,029 B2 3/2014 Beach et al.
8,747,250 B2 6/2014 Chao et al.
8,777,776 B2 7/2014 Wahl et al.
8,801,541 B2 8/2014 Beach et al.
8,827,831 B2 9/2014 Burnett et al.
8,876,627 B2 11/2014 Beach et al.
8,900,072 B1 12/2014 Willett et al.
9,033,821 B2 5/2015 Beach et al.
9,089,745 B2 7/2015 Greaney et al.
9,174,099 B2 11/2015 Greaney et al.
9,192,824 B1 11/2015 Frame et al.
9,199,138 B2 12/2015 Willett et al.
9,216,326 B2 12/2015 Beach et al.
9,216,331 B2 12/2015 Greensmith et al.
9,220,953 B2 12/2015 Beach et al.
9,259,625 B2 2/2016 Sargent et al.
9,278,262 B2 3/2016 Sargent et al.
9,278,267 B2 3/2016 Chao et al.
9,358,436 B2 6/2016 Sargent et al.
9,399,157 B2 7/2016 Greensmith
9,409,066 B2 8/2016 Lin
9,427,637 B2 8/2016 Beach
9,452,324 B2 9/2016 Beach
9,452,325 B2 9/2016 DeShiell
9,452,327 B2 9/2016 Willett
9,457,243 B2 10/2016 Lorentzen
9,468,816 B2 10/2016 Barelmann
9,468,817 B2 10/2016 Beach
9,474,947 B2 10/2016 Willett
9,504,886 B2 11/2016 Albertsen
9,561,413 B2 2/2017 Nielson
9,566,479 B2 2/2017 Albertsen
9,566,482 B2 2/2017 Beach
9,610,482 B2 4/2017 Burnett
9,623,295 B2 4/2017 Willett
9,630,068 B2 4/2017 Beach
9,656,131 B2 5/2017 Burnett
9,662,545 B2 5/2017 Beach
9,675,849 B2 6/2017 Beach
9,682,291 B2 6/2017 Chao
9,682,294 B2 6/2017 Burnett
9,694,252 B2 7/2017 Beach
9,694,253 B2 7/2017 Greaney
9,700,763 B2 7/2017 Harbert
9,700,769 B2 7/2017 Beach
9,707,457 B2 7/2017 Mata
9,750,991 B2 9/2017 Chao
9,764,204 B2 9/2017 Beach
9,776,053 B2 10/2017 Burnett
9,789,372 B2 10/2017 Beach
9,795,846 B2 10/2017 Sargent
9,814,953 B2 11/2017 Sargent
9,844,708 B2 12/2017 Greaney

(56) References Cited

U.S. PATENT DOCUMENTS

| | | | | |
|---|---|---|---|---|
| 9,849,353 | B2 | 12/2017 | Beach et al. | |
| 9,861,864 | B2 | 1/2018 | Beach | |
| 9,868,036 | B1 | 1/2018 | Kleinert | |
| 9,914,027 | B1 | 3/2018 | Harbert | |
| 9,919,190 | B2 | 3/2018 | Beach | |
| 9,943,734 | B2 | 4/2018 | James | |
| 10,016,662 | B1 | 7/2018 | Wester | |
| 10,035,049 | B1 | 7/2018 | Neilson | |
| 10,035,054 | B2 | 7/2018 | Willett et al. | |
| 10,046,212 | B2 | 8/2018 | Sargent | |
| 10,065,083 | B2 | 9/2018 | Beach | |
| 10,076,688 | B1 | 9/2018 | Harbert | |
| 10,086,240 | B1 | 10/2018 | Hoffman | |
| 10,112,085 | B2 | 10/2018 | Beach | |
| 10,150,016 | B2 | 12/2018 | Willett | |
| 10,183,202 | B1 | 1/2019 | Harbert | |
| 10,195,497 | B1 | 2/2019 | Greaney et al. | |
| 10,220,270 | B2 | 3/2019 | Beach et al. | |
| 10,556,158 | B1 | 2/2020 | Harbert | |
| 10,569,144 | B2 | 2/2020 | Nielson | |
| 10,576,338 | B2 | 3/2020 | Beach et al. | |
| 10,646,755 | B1 | 5/2020 | Kleinert | |
| 10,688,352 | B2 | 6/2020 | Harbert | |
| 10,835,790 | B2 | 11/2020 | Willett et al. | |
| 10,843,048 | B1 | 11/2020 | Hoffman | |
| 10,874,914 | B2 | 12/2020 | Johnson | |
| 10,874,918 | B2 | 12/2020 | Beach et al. | |
| 10,888,746 | B1 | 1/2021 | Greaney et al. | |
| 11,213,728 | B2 | 1/2022 | Greaney et al. | |
| 11,278,773 | B2 | 3/2022 | Beach et al. | |
| 11,278,777 | B2 | 3/2022 | Willett et al. | |
| 11,752,404 | B2 * | 9/2023 | Greaney | A63B 60/00 473/345 |
| 11,975,247 | B2 * | 5/2024 | Greaney | A63B 53/0466 |
| 2001/0049310 | A1 | 12/2001 | Cheng et al. | |
| 2002/0022535 | A1 | 2/2002 | Takeda | |
| 2002/0072434 | A1 | 6/2002 | Yabu | |
| 2002/0137576 | A1 | 9/2002 | Dammen | |
| 2002/0160854 | A1 | 10/2002 | Beach et al. | |
| 2003/0130059 | A1 | 7/2003 | Billings | |
| 2004/0087388 | A1 | 5/2004 | Beach et al. | |
| 2004/0242343 | A1 | 12/2004 | Chao et al. | |
| 2004/0248667 | A1 | 12/2004 | Cackett et al. | |
| 2005/0059508 | A1 | 3/2005 | Burnett | |
| 2005/0101404 | A1 | 5/2005 | Long et al. | |
| 2005/0239575 | A1 | 10/2005 | Chao et al. | |
| 2005/0239576 | A1 | 10/2005 | Stites et al. | |
| 2006/0058112 | A1 | 3/2006 | Haralason et al. | |
| 2006/0154747 | A1 | 7/2006 | Beach | |
| 2007/0105647 | A1 | 5/2007 | Beach et al. | |
| 2007/0105648 | A1 | 5/2007 | Beach et al. | |
| 2007/0105649 | A1 | 5/2007 | Beach et al. | |
| 2007/0105650 | A1 | 5/2007 | Beach et al. | |
| 2007/0105651 | A1 | 5/2007 | Beach et al. | |
| 2007/0105652 | A1 | 5/2007 | Beach et al. | |
| 2007/0105653 | A1 | 5/2007 | Beach et al. | |
| 2007/0105654 | A1 | 5/2007 | Beach et al. | |
| 2007/0105655 | A1 | 5/2007 | Beach et al. | |
| 2007/0129167 | A1 | 6/2007 | Matsunaga | |
| 2008/0261717 | A1 | 10/2008 | Hoffman et al. | |
| 2008/0280698 | A1 | 11/2008 | Hoffman et al. | |
| 2009/0017938 | A1 | 1/2009 | Yokota | |
| 2009/0088271 | A1 | 4/2009 | Beach et al. | |
| 2009/0105010 | A1 | 4/2009 | De La Cruz et al. | |
| 2009/0286611 | A1 | 11/2009 | Beach et al. | |
| 2010/0216570 | A1 | 8/2010 | Beach et al. | |
| 2010/0273572 | A1 | 10/2010 | Beach et al. | |
| 2011/0177880 | A1 | 7/2011 | Schweigert | |
| 2013/0190102 | A1 * | 7/2013 | Greaney | A63B 53/0466 473/331 |
| 2014/0128176 | A1 | 5/2014 | Chao | |
| 2014/0155194 | A1 | 6/2014 | Beach et al. | |
| 2014/0171216 | A1 | 6/2014 | Lin et al. | |
| 2014/0235369 | A1 | 8/2014 | Willett et al. | |
| 2014/0256464 | A1 | 9/2014 | Chao et al. | |
| 2014/0274446 | A1 | 9/2014 | Greaney et al. | |
| 2014/0274457 | A1 | 9/2014 | Beach et al. | |
| 2014/0295990 | A1 | 10/2014 | Beach et al. | |
| 2014/0323236 | A1 | 10/2014 | Burnett et al. | |
| 2014/0323239 | A1 | 10/2014 | Beach et al. | |
| 2015/0018115 | A1 | 1/2015 | Beach et al. | |
| 2015/0024870 | A1 | 1/2015 | Beach et al. | |
| 2015/0038258 | A1 | 2/2015 | Beach et al. | |
| 2015/0038262 | A1 | 2/2015 | DeShiell et al. | |
| 2015/0045138 | A1 | 2/2015 | Beach et al. | |
| 2015/0105177 | A1 | 4/2015 | Beach et al. | |
| 2015/0148149 | A1 | 5/2015 | Beach et al. | |
| 2015/0151174 | A1 | 6/2015 | Greaney et al. | |
| 2015/0165284 | A1 | 6/2015 | Willett et al. | |
| 2015/0174460 | A1 | 6/2015 | Beach et al. | |
| 2015/0182818 | A1 | 7/2015 | James et al. | |
| 2015/0182822 | A1 | 7/2015 | Burnett et al. | |
| 2015/0224374 | A1 | 8/2015 | Greaney et al. | |
| 2015/0246269 | A1 | 9/2015 | Lorentzen et al. | |
| 2015/0306471 | A1 | 10/2015 | Albertsen et al. | |
| 2015/0375070 | A1 | 12/2015 | Beach et al. | |
| 2016/0001146 | A1 | 1/2016 | Sargent et al. | |
| 2016/0008682 | A1 | 1/2016 | Beach et al. | |
| 2016/0008687 | A1 | 1/2016 | Sargent et al. | |
| 2016/0016054 | A1 | 1/2016 | Burnett et al. | |
| 2016/0023060 | A1 | 1/2016 | Harbert et al. | |
| 2016/0023061 | A1 | 1/2016 | Beach et al. | |
| 2016/0023062 | A1 | 1/2016 | Willett | |
| 2016/0023063 | A1 | 1/2016 | Willett et al. | |
| 2016/0023065 | A1 | 1/2016 | Albertsen et al. | |
| 2016/0059093 | A1 | 3/2016 | Nielson et al. | |
| 2016/0059094 | A1 | 3/2016 | Mata et al. | |
| 2016/0067562 | A1 | 3/2016 | Beach et al. | |
| 2016/0136488 | A1 | 5/2016 | Willett et al. | |
| 2016/0136490 | A1 | 5/2016 | Sargent et al. | |
| 2016/0144249 | A1 | 5/2016 | Burnett et al. | |
| 2016/0184662 | A1 | 6/2016 | Barelmann et al. | |
| 2016/0243414 | A1 | 8/2016 | Greaney et al. | |
| 2020/0324177 | A1 | 10/2020 | Harbert | |
| 2021/0170244 | A1 | 6/2021 | Willett et al. | |

FOREIGN PATENT DOCUMENTS

| | | | |
|---|---|---|---|
| EP | 1001175 | A2 | 11/2000 |
| EP | 1125601 | A1 | 8/2001 |
| GB | 194823 | A | 3/1923 |
| JP | H06126004 | A | 5/1994 |
| JP | H06304271 | A | 11/1994 |
| JP | 06343721 | A | 12/1994 |
| JP | H07275411 | A | 10/1995 |
| JP | H08243194 | A | 9/1996 |
| JP | H0928844 | A | 2/1997 |
| JP | H09173510 | A | 7/1997 |
| JP | H09308717 | A | 12/1997 |
| JP | H05317465 | A | 7/1998 |
| JP | H10216272 | A | 8/1998 |
| JP | H10234891 | A | 9/1998 |
| JP | H10234902 | A | 9/1998 |
| JP | H10277187 | A | 10/1998 |
| JP | H11104277 | A | 4/1999 |
| JP | H11299937 | A | 11/1999 |
| JP | 2000176056 | A | 6/2000 |
| JP | 2000300701 | A | 10/2000 |
| JP | 2001120692 | A | 5/2001 |
| JP | 2001238988 | A | 9/2001 |
| JP | 2001321466 | A | 11/2001 |
| JP | H09327534 | A | 3/2002 |
| JP | 2002143350 | A | 5/2002 |
| JP | 2002315854 | A | 10/2002 |
| JP | 2003290396 | A | 10/2003 |
| JP | 2004135730 | A | 5/2004 |
| JP | 2004261451 | A | 9/2004 |
| JP | 2004267438 | A | 9/2004 |
| JP | 2005160947 | | 6/2005 |
| JP | 2001170229 | A | 11/2005 |
| JP | 2005305169 | A | 11/2005 |
| JP | 2006149449 | A | 6/2006 |
| JP | 2007500066 | A | 7/2007 |
| JP | H10277182 | A | 10/2007 |

(56) References Cited

FOREIGN PATENT DOCUMENTS

| | | | |
|---|---|---|---|
| JP | 2008005912 | A | 1/2008 |
| JP | 2004222911 | A | 7/2008 |
| JP | 2009061264 | A | 3/2009 |
| JP | 2006204604 | A | 12/2009 |
| JP | 2007029588 | A | 4/2010 |
| JP | 2004358225 | A | 10/2010 |
| JP | 2003102877 | A | 10/2011 |
| JP | 2007151758 | A | 2/2012 |
| JP | 2009018049 | A | 11/2012 |
| JP | 2008220665 | A | 12/2012 |
| WO | WO1988002642 | A1 | 4/1988 |
| WO | WO2001066199 | A1 | 9/2001 |
| WO | WO2002062501 | A2 | 8/2002 |
| WO | WO2003061773 | A1 | 7/2003 |

OTHER PUBLICATIONS

Jackson, Jeff ;The Modern Guide to Golf Clubmaking Ohio: Dynacraft Golf Products Inc. copyright 1994 p. 237.

Nike Golf Sasquatch 460 downloaded from www.nike.com/nikegolf/index.htm on Apr. 5, 2007.

Nike Golf Sasquatch Sumo Squared Driver downloaded from www.nike.com/nikegolf/index.htm on Apr. 5, 2007.

Office action from the Japanese Patent Office in Patent Application No. 2008-247526 dated Nov. 20, 2012 (machine translation).

Taylor Made Golf Company Inc. R7 460 Drivers downloaded from www.tavlormadegolf.com/product detail.asp?pID-I4section=overview on Apr. 5, 2007.

Titleist 907DI downloaded from www.tees2greens.com/forum/Uploads/Images/7ade3521-192b-46I I-870b-395d.jpg on Feb. 1, 2007.

* cited by examiner

-18° ORIENTATION

0° ORIENTATION

+18° ORIENTATION

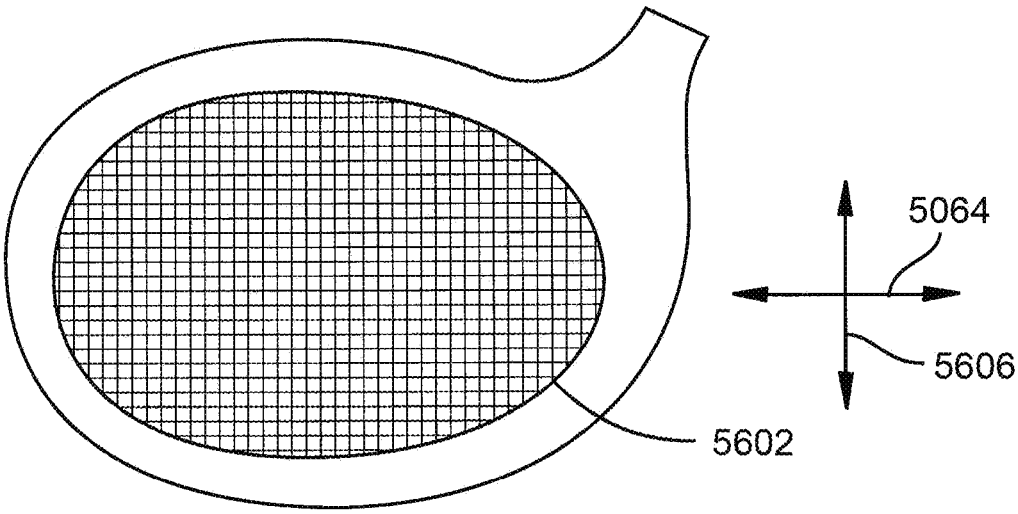
FIG. 50
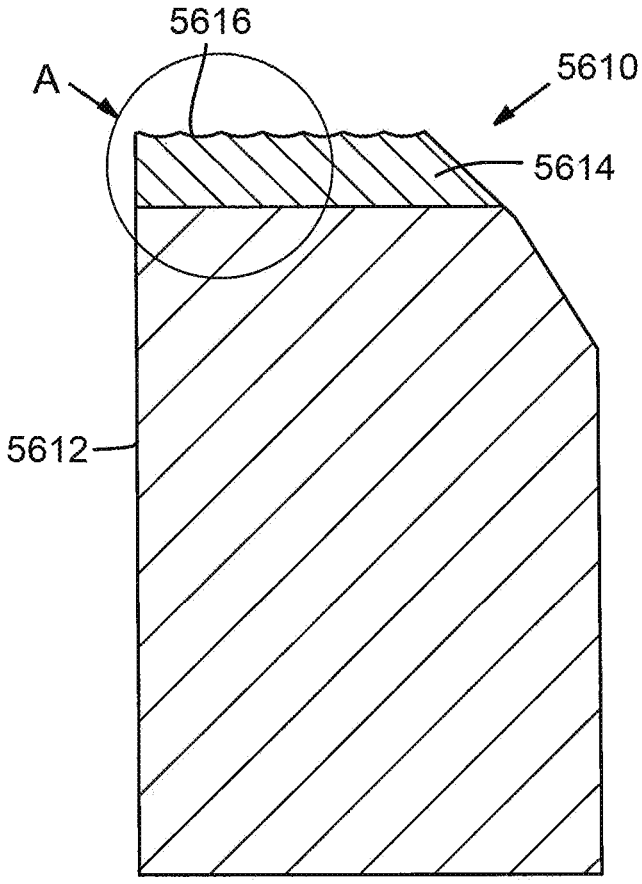
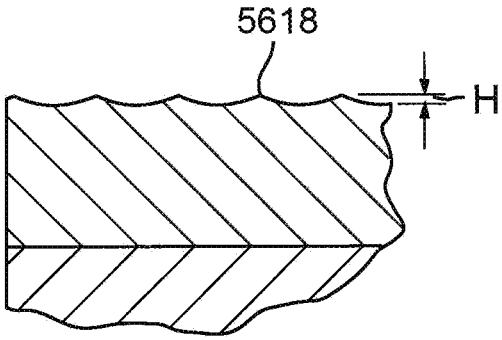
FIG. 52
FIG. 51

| L | ΣA | Ra (mm) | Ra (μm) | Ry (μm) | RPC / cm | Ry / Ra |
|---|---|---|---|---|---|---|
| 0.20 | 9.19E-04 | 4.60E-03 | 4.60 | 25.00 | 100.14 | 5.43 |

| L | ΣA | Ra (mm) | Ra (μm) | Ry (μm) | RPC / cm | Ry / Ra |
|---|---|---|---|---|---|---|
| 0.20 | 9.18E-04 | 4.60E-03 | 4.60 | 18.00 | 50.10 | 3.91 |

| L | ΣA | Ra (mm) | Ra (μm) | Ry (μm) | RPC / cm | Ry / Ra |
|---|---|---|---|---|---|---|
| 0.20 | 1.75E-03 | 8.75E-03 | 8.75 | 25.00 | 100.00 | 2.86 |

| X | Y | L | Ra (μm) | Ry (μm) | RPC / cm | Ry / Ra | Volume (mm^3/mm^2) |
|---|---|---|---|---|---|---|---|
| 0.075 | 0.025 | 0.20 | 11.72 | 25.00 | 50.00 | 2.13 | 0.002344 |

0.005" Ball End Mill

| A1 | A2 | ΣArea | Length |
|---|---|---|---|
| 0.003478 | 0.000152 | 0.003629 | 0.290334 |

| V (Area/mm) | Ra | Ry | Ry / Ra | RPc | V / Ra |
|---|---|---|---|---|---|
| 0.0125 | 4.61 | 25.00 | 5.42 | 69.00 | 2.71E-03 |

| | | | | Area / mm | Ra | Ry | Ry / Ra | RPc | V / Ra |
|---|---|---|---|---|---|---|---|---|---|
| 0.002193 | 0.000538 | 0.00273 | 0.325532 | 0.0084 | 4.45 | 19.00 | 4.27 | 123.07 | 1.89E-03 |

0.000269 0.001924 0.002193 0.234516

| Area / mm | Ra | Ry | Ry / Ra | RPc | V / Ra |
|---|---|---|---|---|---|
| 0.0094 | 4.01 | 19.00 | 4.74 | 128.12 | 2.33E-03 |

| X | Y | S | Ra | Ry | RPc | Ry / Ra |
|---|---|---|---|---|---|---|
| 0.127 | 0.02 | 0.30 | 9.8 | 20.0 | 33.3 | 2.05 |
| 0.127 | 0.04 | 0.65 | 12.6 | 40.0 | 15.4 | 3.18 |
| 0.127 | 0.06 | 1.00 | 13.3 | 60.0 | 10.0 | 4.51 |
| 0.154 | 0.02 | 0.65 | 7.2 | 20.0 | 15.4 | 2.77 |
| 0.154 | 0.04 | 1.00 | 10.4 | 40.0 | 10.0 | 3.84 |
| 0.154 | 0.06 | 0.30 | 30.0 | 60.0 | 33.3 | 2.00 |
| 0.180 | 0.02 | 1.00 | 5.9 | 20.0 | 10.0 | 3.39 |
| 0.180 | 0.04 | 0.30 | 19.2 | 40.0 | 33.3 | 2.08 |
| 0.180 | 0.06 | 0.65 | 24.0 | 60.0 | 15.4 | 2.50 |

| L | ΣA | Ra (mm) | Ra (μm) | Ry (μm) | RPC / cm | Ry / Ra |
|---|---|---|---|---|---|---|
| 0.23 | 9.38E-04 | 4.01E-03 | 4.01 | 19.00 | 128.12 | 4.74 |

| L | ΣA | Ra (mm) | Ra (μm) | Ry (μm) | RPC / cm | Ry / Ra |
|---|---|---|---|---|---|---|
| 0.33 | 1.45E-03 | 4.45E-03 | 4.45 | 19.00 | 123.07 | 4.27 |

| L | ΣA | Ra (mm) | Ra (μm) | Ry (μm) | RPC / cm | Ry / Ra |
|---|---|---|---|---|---|---|
| 0.25 | 4.03E-03 | 1.61E-02 | 16.07 | 54.00 | 39.91 | 3.36 |

| L | ΣA | Ra (mm) | Ra (μm) | Ry (μm) | RPC / cm | Ry / Ra |
|---|---|---|---|---|---|---|
| 0.29 | 1.34E-03 | 4.67E-03 | 4.67 | 25.00 | 69.97 | 5.35 |

| L | ΣA | Ra (mm) | Ra (μm) | Ry (μm) | RPC / cm | Ry / Ra |
|---|---|---|---|---|---|---|
| 0.22 | 1.34E-03 | 6.10E-03 | 6.10 | 25.00 | 91.34 | 4.10 |

| L | ΣA | Ra (mm) | Ra (μm) | Ry (μm) | RPC / cm | Ry / Ra |
|---|---|---|---|---|---|---|
| 0.29 | 1.34E-03 | 4.61E-03 | 4.61 | 25.00 | 69.00 | 5.42 |

| L | ΣA | Ra (mm) | Ra (μm) | Ry (μm) | RPC / cm | Ry / Ra |
|---|---|---|---|---|---|---|
| 0.20 | 6.00E-04 | 3.00E-03 | 3.00 | 60.00 | 100.00 | 20.00 |

| L | ΣA | Ra (mm) | Ra (μm) | Ry (μm) | RPC / cm | Ry / Ra |
|---|---|---|---|---|---|---|
| 0.20 | 6.00E-03 | 3.00E-02 | 30.00 | 60.00 | 100.00 | 2.00 |

| L | ΣA | Ra (mm) | Ra (μm) | Ry (μm) | RPC / cm | Ry / Ra |
|---|---|---|---|---|---|---|
| 0.20 | 1.75E-03 | 8.75E-02 | 8.75 | 25.00 | 100.00 | 2.86 |

| X | Y | S | Ra | Ry | RPC / cm | Ry / Ra | Volume (mm^3/mm^2) |
|---|---|---|---|---|---|---|---|
| 0.075 | 0.025 | 0.2 | 11.71875 | 25 | 50 | 2.13 | 0.002344 |

| L | ΣA | Ra (mm) | Ra (μm) | Ry (μm) | RPC / cm | Ry / Ra |
|---|---|---|---|---|---|---|
| 0.20 | 3.00E-03 | 1.50E-02 | 15.03 | 60.00 | 100.20 | 3.99 |

| L | ΣA | Ra (mm) | Ra (μm) | Ry (μm) | RPC / cm | Ry / Ra |
|---|---|---|---|---|---|---|
| 0.20 | 1.54E-03 | 7.71E-03 | 7.71 | 29.93 | 50.06 | 3.88 |

| L | ΣA | Ra (mm) | Ra (μm) | Ry (μm) | RPC / cm | Ry / Ra |
|---|---|---|---|---|---|---|
| 0.20 | 1.02E-03 | 5.11E-03 | 5.11 | 19.92 | 50.09 | 3.90 |

| L | ΣA | Ra (mm) | Ra (μm) | Ry (μm) | RPC / cm | Ry / Ra |
|---|---|---|---|---|---|---|
| 0.20 | 1.52E-03 | 7.63E-03 | 7.63 | 29.88 | 50.09 | 3.92 |

| L | ΣA | Ra (mm) | Ra (μm) | Ry (μm) | RPC / cm | Ry / Ra |
|---|---|---|---|---|---|---|
| 0.30 | 2.29E-03 | 7.66E-03 | 7.66 | 29.88 | 33.40 | 3.90 |

| L | ΣA | Ra (mm) | Ra (μm) | Ry (μm) | RPC / cm | Ry / Ra |
|---|---|---|---|---|---|---|
| 1.00 | 7.67E-03 | 7.69E-03 | 7.69 | 29.88 | 10.02 | 3.89 |

| L | ΣA | Ra (mm) | Ra (μm) | Ry (μm) | RPC / cm | Ry / Ra |
|---|---|---|---|---|---|---|
| 0.20 | 7.66E-04 | 3.84E-03 | 3.84 | 14.94 | 50.10 | 3.89 |

| L | ΣA | Ra (mm) | Ra (μm) | Ry (μm) | RPC / cm | Ry / Ra |
|---|---|---|---|---|---|---|
| 0.20 | 9.18E-04 | 4.60E-03 | 4.60 | 17.93 | 50.10 | 3.90 |

| L | ΣA | Ra (mm) | Ra (μm) | Ry (μm) | RPC / cm | Ry / Ra |
|---|---|---|---|---|---|---|
| 0.20 | 1.27E-03 | 6.37E-03 | 6.37 | 24.90 | 50.09 | 3.91 |

| L | ΣA | Ra (mm) | Ra (μm) | Ry (μm) | RPC / cm | Ry / Ra |
|---|---|---|---|---|---|---|
| 0.20 | 2.00E-03 | 1.00E-03 | 10.01 | 20.00 | 50.00 | 2.00 |

| L | ΣA | Ra (mm) | Ra (μm) | Ry (μm) | RPC / cm | Ry / Ra |
|---|---|---|---|---|---|---|
| 0.30 | 2.71E-03 | 9.03E-03 | 9.03 | 20.00 | 33.33 | 2.21 |

| L | ΣA | Ra (mm) | Ra (μm) | Ry (μm) | RPC / cm | Ry / Ra |
|---|---|---|---|---|---|---|
| 0.30 | 3.39E-03 | 1.13E-02 | 11.33 | 25.00 | 33.37 | 2.21 |

| L | ΣA | Ra (mm) | Ra (μm) | Ry (μm) | RPC / cm | Ry / Ra |
|---|---|---|---|---|---|---|
| 0.20 | 3.00E-03 | 1.50E-02 | 15.02 | 30.00 | 50.07 | 2.00 |

| L | ΣA | Ra (mm) | Ra (μm) | Ry (μm) | RPC / cm | Ry / Ra |
|---|---|---|---|---|---|---|
| 0.20 | 1.53E-03 | 7.63E-03 | 7.63 | 30.00 | 50.00 | 3.93 |

| L | ΣA | Ra (mm) | Ra (μm) | Ry (μm) | RPC / cm | Ry / Ra |
|---|---|---|---|---|---|---|
| 0.10 | 1.50E-03 | 1.50E-03 | 15.02 | 30.00 | 100.16 | 2.00 |

| L | ΣA | Ra (mm) | Ra (μm) | Ry (μm) | RPC / cm | Ry / Ra |
|---|---|---|---|---|---|---|
| 0.20 | 2.42E-03 | 1.21E-02 | 12.14 | 30.00 | 50.07 | 2.47 |

| L | ΣA | Ra (mm) | Ra (μm) | Ry (μm) | RPC / cm | Ry / Ra |
|---|---|---|---|---|---|---|
| 0.20 | 2.83E-03 | 1.42E-02 | 14.17 | 30.00 | 50.07 | 2.12 |

| L | ΣA | Ra (mm) | Ra (μm) | Ry (μm) | RPC / cm | Ry / Ra |
|---|---|---|---|---|---|---|
| 0.20 | 1.13E-03 | 5.68E-03 | 5.68 | 19.98 | 50.10 | 3.52 |

| L | ΣA | Ra (mm) | Ra (μm) | Ry (μm) | RPC / cm | Ry / Ra |
|---|---|---|---|---|---|---|
| 0.40 | 2.99E-03 | 7.50E-03 | 7.50 | 30.00 | 25.05 | 4.00 |

| L | ΣA | Ra (mm) | Ra (μm) | Ry (μm) | RPC / cm | Ry / Ra |
|---|---|---|---|---|---|---|
| 0.20 | 1.50E-03 | 7.50E-03 | 7.50 | 30.00 | 50.10 | 4.00 |

| L | ΣA | Ra (mm) | Ra (μm) | Ry (μm) | RPC / cm | Ry / Ra |
|---|---|---|---|---|---|---|
| 0.20 | 8.74E-04 | 4.37E-03 | 4.37 | 25.00 | 100.13 | 5.72 |

| L | ΣA | Ra (mm) | Ra (μm) | Ry (μm) | RPC / cm | Ry / Ra |
|---|---|---|---|---|---|---|
| 0.20 | 1.14E-03 | 5.72E-03 | 5.72 | 25.00 | 100.16 | 4.37 |

| L | ΣA | Ra (mm) | Ra (μm) | Ry (μm) | RPC / cm | Ry / Ra |
|---|---|---|---|---|---|---|
| 0.20 | 9.53E-04 | 4.77E-03 | 4.77 | 25.00 | 100.14 | 5.24 |

| L | ΣA | Ra (mm) | Ra (μm) | Ry (μm) | RPC / cm | Ry / Ra |
|---|---|---|---|---|---|---|
| 0.40 | 2.24E-03 | 5.61E-03 | 5.61 | 25.00 | 50.09 | 4.46 |

| L | ΣA | Ra (mm) | Ra (μm) | Ry (μm) | RPC / cm | Ry / Ra |
|---|---|---|---|---|---|---|
| 0.20 | 9.19E-04 | 4.60E-03 | 4.60 | 25.00 | 100.14 | 5.43 |

| L | ΣA | Ra (mm) | Ra (μm) | Ry (μm) | RPC / cm | Ry / Ra |
|---|---|---|---|---|---|---|
| 0.10 | 4.73E-04 | 4.74E-03 | 4.74 | 18.70 | 100.17 | 3.95 |

| L | ΣA | Ra (mm) | Ra (μm) | Ry (μm) | RPC / cm | Ry / Ra |
|---|---|---|---|---|---|---|
| 0.20 | 9.18E-04 | 4.60E-03 | 4.60 | 18.00 | 50.10 | 3.91 |

| L | ΣA | Ra (mm) | Ra (μm) | Ry (μm) | RPC / cm | Ry / Ra |
|---|---|---|---|---|---|---|
| 0.20 | 1.27E-03 | 6.37E-03 | 6.37 | 25.00 | 100.18 | 3.92 |

| L | ΣA | Ra (mm) | Ra (μm) | Ry (μm) | RPC / cm | Ry / Ra |
|---|---|---|---|---|---|---|
| 0.20 | 6.39E-04 | 3.20E-03 | 3.20 | 12.50 | 100.20 | 3.91 |

| | Ra | Ry | Rz | Rz / Ra |
|---|---|---|---|---|
| 40 grit | 6.325 | 42.336 | 30.171 | 4.77 |
| 120 grit | 4.391 | 32.462 | 22.827 | 5.20 |
| 180 grit | 3.469 | 24.091 | 18.584 | 5.36 |

GOLF CLUB HEAD AND GOLF CLUB

CROSS-REFERENCE TO RELATED APPLICATIONS

This application is a continuation of U.S. nonprovisional application Ser. No. 17/566,833, filed on Dec. 31, 2021, which is a continuation of U.S. nonprovisional application 17,143,527, filed on Jan. 7, 2021, now U.S. Pat. No. 11,213,728, which is a continuation of U.S. nonprovisional application 16,258,848, filed on Jan. 28, 2019, now U.S. Pat. No. 10,888,746, which is a continuation of U.S. nonprovisional application Ser. No. 15/263,929, filed on Sep. 13, 2016, now U.S. Pat. No. 10,195,497, all of which is incorporated by reference as if completely written herein.

FIELD

The present application is directed to embodiments of golf clubs and golf club heads, particularly oversized club heads.

BACKGROUND

Golf club head manufacturers and designers seek to improve certain performance characteristics such as forgiveness, playability, feel, and sound. In addition, the aesthetic of the golf club head must be maintained while the performance characteristics are enhanced. Golf club manufacturers often must choose to improve one performance characteristic at the expense of another. In fact, the incorporation of new technologies that improve performance may necessitate changes to other aspects of a golf club head so that the features work together rather than reduce the associated benefits. Further, it is often difficult to identify the tradeoffs and changes that must be made to ensure aspects of the club head work together to achieve the desired performance.

In general, "forgiveness" is defined as the ability of a golf club head to compensate for mis-hits where the golf club head strikes a golf ball outside of the ideal contact location. Furthermore, "playability" can be defined as the ease in which a golfer can use the golf club head for producing accurate golf shots. Moreover, "feel" is generally defined as the sensation a golfer feels through the golf club upon impact, such as a vibration transferring from the golf club to the golfer's hands. The "sound" of the golf club is also important to monitor because certain impact sound frequencies are undesirable to the golfer.

The United States Golf Association (USGA) regulations constrain golf club head shapes, sizes, and moments of inertia. Due to these constraints, golf club manufacturers and designers struggle to produce a club having maximum size and moment of inertia characteristics while maintaining other desirable head characteristics, and designers have narrowed their research box to focus on ways to improve performance within these constraints. However, once a designer makes the decision to design outside of these USGA constraints, they are faced with a myriad of design considerations that do not arise when operating within the comfortable constraints they have worked within for years. In fact, many of the technical relationships found to improve performance while operating within the constraints do not improve, and may negatively influence, performance of a golf club head that is significantly larger. The disclosed embodiments tackle these issues.

With the ever-increasing popularity and competitiveness of golf, substantial effort and resources are currently being expended to improve golf clubs so that increasingly more golfers can have more enjoyment and more success at playing golf Much of this improvement activity has been in the realms of sophisticated materials and club-head engineering. For example, modem "wood-type" golf clubs (notably, "drivers," "fairway woods," and "utility clubs"), with their sophisticated shafts and non-wooden club-heads, bear little resemblance to the "wood" drivers, low-loft long-irons, and higher numbered fairway woods used years ago. These modem wood-type clubs are generally called "metal-woods."

An exemplary metal-wood golf club such as a fairway wood or driver typically includes a hollow shaft having a lower end to which the club-head is attached. Most modem versions of these club-heads are made, at least in part, of a light-weight but strong metal such as titanium alloy. The club-head comprises a body to which a strike plate (also called a face plate) is attached or integrally formed. The strike plate defines a front surface or strike face that actually contacts the golf ball.

The current ability to fashion metal-wood club-heads of strong, light-weight metals and other materials has allowed the club-heads to be made hollow. Use of materials of high strength and high fracture toughness has also allowed club-head walls to be made thinner, which has allowed increases in club-head size, compared to earlier club-heads. Larger club-heads tend to provide a larger "sweet spot" on the strike plate and to have higher club-head inertia, thereby making the club-heads more "forgiving" than smaller club-heads. Characteristics such as size of the sweet spot are determined by many variables including the shape profile, size, and thickness of the strike plate as well as the location of the center of gravity (CG) of the club-head.

The distribution of mass around the club-head typically is characterized by parameters such as rotational moment of inertia (MOI) and CG location. Club-heads typically have multiple rotational MOIs, each associated with a respective Cartesian reference axis (x, y, z) of the club-head. A rotational MOI is a measure of the club-head's resistance to angular acceleration (twisting or rotation) about the respective reference axis. The rotational MOIs are related to, inter alia, the distribution of mass in the club-head with respect to the respective reference axes. Each of the rotational MOIs desirably is maximized as much as practicable to provide the club-head with more forgiveness.

Another factor in modem club-head design is the face plate. Impact of the face plate with the golf ball results in some rearward instantaneous deflection of the face plate. This deflection and the subsequent recoil of the face plate are expressed as the club-head's coefficient of restitution (COR). A thinner face plate deflects more at impact with a golf ball and potentially can impart more energy and thus a higher rebound velocity to the struck ball than a thicker or more rigid face plate. Because of the importance of this effect, the COR of clubs is limited under United States Golf Association (USGA) rules.

Regarding the total mass of the club-head as the club-head's mass budget, at least some of the mass budget must be dedicated to providing adequate strength and structural support for the club-head. This is termed "structural" mass. Any mass remaining in the budget is called "discretionary" or "performance" mass, which can be distributed within the club-head to address performance issues, for example.

Some current approaches to reducing structural mass of a club-head are directed to making at least a portion of the club-head of an alternative material. Whereas the bodies and face plates of most current metal-woods are made of titanium alloy, several "hybrid" club-heads are available that are made, at least in part, of components formed from both graphite/epoxy-composite (or another suitable composite material) and a metal alloy. For example, in one group of these hybrid club-heads a portion of the body is made of carbon-fiber (graphite)/epoxy composite and a titanium alloy is used as the primary face-plate material. Other club-heads are made entirely of one or more composite materials. Graphite composites have a density of approximately 1.5 g/cm$^3$, compared to titanium alloy which has a density of 4.5 g/cm$^3$, which offers tantalizing prospects of providing more discretionary mass in the club-head.

Composite materials that are useful for making club-head components comprise a fiber portion and a resin portion. In general the resin portion serves as a "matrix" in which the fibers are embedded in a defined manner. In a composite material for club-heads, the fiber portion is configured as multiple fibrous layers or plies that are impregnated with the resin component. The fibers in each layer have a respective orientation, which is typically different from one layer to the next and precisely controlled. The usual number of layers is substantial, e.g., fifty or more. During fabrication of the composite material, the layers (each comprising respectively oriented fibers impregnated in uncured or partially cured resin; each such layer being called a "prepreg" layer) are placed superposedly in a "lay-up" manner. After forming the prepreg lay-up, the resin is cured to a rigid condition.

Conventional processes by which fiber-resin composites are fabricated into club-head components utilize high (and sometimes constant) pressure and temperature to cure the resin portion in a minimal period of time. The processes desirably yield components that are, or nearly are, "net-shape," by which is meant that the components as formed have their desired final configurations and dimensions. Making a component at or near net-shape tends to reduce cycle time for making the components and to reduce finishing costs. Unfortunately, at least three main defects are associated with components made in this conventional fashion: (a) the components exhibit a high incidence of composite porosity (voids formed by trapped air bubbles or as a result of the released gases during a chemical reaction); (b) a relatively high loss of resin occurs during fabrication of the components; and (c) the fiber layers tend to have "wavy" fibers instead of straight fibers. Whereas some of these defects may not cause significant adverse effects on the service performance of the components when the components are subjected to simple (and static) tension, compression, and/or bending, component performance typically will be drastically reduced whenever these components are subjected to complex loads, such as dynamic and repetitive loads (i.e., repetitive impact and consequent fatigue).

Manufacturers of metal wood golf club-heads have more recently attempted to manipulate the performance of their club heads by designing what is generically termed a variable face thickness profile for the striking face. It is known to fabricate a variable-thickness composite striking plate by first forming a lay-up of prepreg plies, as described above, and then adding additional "partial" layers or plies that are smaller than the overall size of the plate in the areas where additional thickness is desired (referred to as the "partial ply" method). For example, to form a projection on the rear surface of a composite plate, a series of annular plies, gradually decreasing in size, are added to the lay-up of prepreg plies.

Unfortunately, variable-thickness composite plates manufactured using the partial ply method are susceptible to a high incidence of composite porosity because air bubbles tend to remain at the edges of the partial plies (within the impact zone of the plate). Moreover, the reinforcing fibers in the prepreg plies are ineffective at their ends. The ends of the fibers of the partial plies within the impact zone are stress concentrations, which can lead to premature delamination and/or cracking. Furthermore, the partial plies can inhibit the steady outward flow of resin during the curing process, leading to resin-rich regions in the plate. Resin-rich regions tend to reduce the efficacy of the fiber reinforcement, particularly since the force resulting from golf-ball impact is generally transverse to the orientation of the fibers of the fiber reinforcement.

Typically, conventional CNC machining is used during the manufacture of composite face plates, such as for trimming a cured part. Because the tool applies a lateral cutting force to the part (against the peripheral edge of the part), it has been found that such trimming can pull fibers or portions thereof out of their plies and/or induce horizontal cracks on the peripheral edge of the part. As can be appreciated, these defects can cause premature delamination and/or other failure of the part.

While durability limits the application of non-metals in striking plates, even durable plastics and composites exhibit some additional deficiencies. Conventional metallic striking plates include a fine ground striking surface (and may include a series of horizontal grooves for some metalwoods and most all irons) that tends to promote a preferred ball spin in play under wet conditions. This fine ground surface appears to provide a relief volume for water present at a striking surface/ball impact area so that impact under wet conditions produces a ball trajectory and shot characteristics similar to those obtained under dry conditions. While non-metals suitable for striking plates are durable, these materials generally do not provide a durable roughened, grooved, or textured striking surface such as provided by conventional clubs and that is needed to maintain club performance under various playing conditions. Accordingly, improved striking plates, striking surfaces, and golf clubs that include such striking plates and surfaces and associated methods are needed.

SUMMARY

An oversized golf club head and golf club having a large volume, large head dimensions, and/or large face characteristics, as well as unique mass property attributes driven by relationships not often considered in conforming club head design, to achieve a resistance to squaring the oversized club head during a golf swing that is comfortable to the novice golfer, a feel similar to a non-oversized golf club, stability during off-center impacts, and preferred launch characteristics. This is achieved in part via establishing a club head configuration and associated center of gravity location that results in a preferred magnitude of Delta1 and Delta2 values, CG angle, moments of inertia, and associated ratios, relationships, and club head mass property characteristics influenced by these variables, to account for the significant scale of the oversized club head and achieve improved performance. The foregoing and other features and advantages of the invention will become more apparent from the following detailed description, which proceeds with reference to the accompanying figures.

Some disclosed examples pertain to composite articles, and in particular a composite face plate for a golf club-head, and methods for making the same. In certain embodiments, a composite face plate for a club-head is formed with a cross-sectional profile having a varying thickness. The face plate comprises a lay-up of multiple, composite prepreg plies. The face plate can include additional components, such as an outer polymeric or metal layer (also referred to as a cap) covering the outer surface of the lay-up and forming the striking surface of the face plate. In other embodiments, the outer surface of the lay-up can be the striking surface that contacts a golf ball upon impact with the face plate.

In order to vary the thickness of the lay-up, some of the prepreg plies comprise elongated strips of prepreg material arranged in a crisscross, overlapping pattern so as to add thickness to the composite lay-up in one or more regions where the strips overlap each other. The strips of prepreg plies can be arranged relative to each other in a predetermined manner to achieve a desired cross-sectional profile for the face plate. For example, in one embodiment, the strips can be arranged in one or more clusters having a central region where the strips overlap each other. The lay-up has a projection or bump formed by the central overlapping region of the strips and desirably centered on the sweet spot of the face plate. A relatively thinner peripheral portion of the lay-up surrounds the projection. In another embodiment, the lay-up can include strips of prepreg plies that are arranged to form an annular projection surrounding a relatively thinner central region of the face plate, thereby forming a cross-sectional profile that is reminiscent of a "volcano."

The strips of prepreg material desirably extend continuously across the finished composite part; that is, the ends of the strips are at the peripheral edge of the finished composite part. In this manner, the longitudinally extending reinforcing fibers of the strips also extend continuously across the finished composite part such that the ends of the fibers are at the periphery of the part. In addition, the lay-up can initially be formed as an "oversized" part in which the reinforcing fibers of the prepreg material extend into a peripheral sacrificial portion of the lay-up. Consequently, the curing process for the lay-up can be controlled to shift defects into the sacrificial portion of the lay-up, which subsequently can be removed to provide a finished part with little or no defects. Moreover, the durability of the finished part is increased because the free ends of the fibers are at the periphery of the finished part, away from the impact zone.

The sacrificial portion desirably is trimmed from the lay-up using water-jet cutting. In water-jet cutting, the cutting force is applied in a direction perpendicular to the prepreg plies (in a direction normal to the front and rear surfaces of the lay-up), which minimizes damage to the reinforcing fibers.

In one representative embodiment, a golf club-head comprises a body having a crown, a heel, a toe, and a sole, and defining a front opening. The head also includes a variable-thickness face insert closing the front opening of the body. The insert comprises a lay-up of multiple, composite prepreg plies, wherein at least a portion of the plies comprise a plurality of elongated prepreg strips arranged in a criss-cross pattern defining an overlapping region where the strips overlap each other. The lay-up has a first thickness at a location spaced from the overlapping region and a second thickness at the overlapping region, the second thickness being greater than the first thickness.

In another representative embodiment, a golf club-head comprises a body having a crown, a heel, a toe, and a sole, and defining a front opening. The head also includes a variable-thickness face insert closing the front opening of the body. The insert comprises a lay-up of multiple, composite prepreg plies, the lay-up having a front surface, a peripheral edge surrounding the front surface, and a width. At least a portion of the plies comprise elongated strips that are narrower than the width of the lay-up and extend continuously across the front surface. The strips are arranged within the lay-up so as to define a cross-sectional profile having a varying thickness.

In another representative embodiment, a composite face plate for a club-head of a golf club comprises a composite lay-up comprising multiple prepreg layers, each prepreg layer comprising at least one resin-impregnated layer of longitudinally extending fibers at a respective orientation. The lay-up has an outer peripheral edge defining an overall size and shape of the lay-up. At least a portion of the layers comprises a plurality of composite panels, each panel comprising a set of one or more prepreg layers, each prepreg layer in the panels having a size and shape that is the same as the overall size and shape of the lay-up. Another portion of the layers comprises a plurality of sets of elongated strips, the sets of strips being interspersed between the panels within the lay-up. The strips extend continuously from respective first locations on the peripheral edge to respective second locations on the peripheral edge and define one or more areas of increased thickness of the lay-up where the strips overlap within the lay-up.

In another representative embodiment, a method for making a composite face plate for a club-head of a golf club comprises forming a lay-up of multiple prepreg composite plies, a portion of the plies comprising elongated strips arranged in a criss-cross pattern defining one or more areas of increased thickness in the lay-up where one or more of the strips overlap each other. The method can further include at least partially curing the lay-up, and shaping the at least partially cured lay-up to form a part having specified dimensions and shape for use as a face plate or part of a face plate for a club-head.

In still another representative embodiment, a method for making a composite face plate for a club-head of a golf club comprises forming a lay-up of multiple prepreg plies, each prepreg ply comprising at least one layer of reinforcing fibers impregnated with a resin. The method can further include at least partially curing the lay-up, and water-jet cutting the at least partially cured lay-up to form a composite part having specified dimensions and shape for use as a face plate or part of a face plate in a club-head.

In some examples, golf club heads comprise a club body and a striking plate secured to the club body. The striking plate includes a face plate and a cover plate secured to the face plate and defining a striking surface, wherein the striking surface includes a plurality of scoreline indentations. In some examples, an adhesive layer secures the cover plate to the face plate. In other alternative embodiments, the scoreline indentations are at least partially filled with a pigment selected to contrast with an appearance of an impact area of the striking surface and the cover plate is metallic and has a thickness between about 0.25 mm and 0.35 mm. In further examples, the scoreline indentations are between about 0.05 and 0.09 mm deep. In other representative examples, a ratio of a scoreline indentation width to a cover plate thickness is between about 2.5 and 3.5, and the face plate is formed of a titanium alloy. In some examples, the scoreline indentations include transition regions having radii of between about 0.2 mm and 0.6 mm, and the cover plate includes a rim configured to extend around a perimeter of the face plate. According to some embodiments, the face plate is a composite face plate and the club body is a wood-type club body.

Cover plates for a golf club face plate comprise a titanium alloy sheet having bulge and roll curvatures, and including a plurality of scoreline indentations. A scoreline indentation depth D is between about 0.05 mm and 0.12 mm, and a titanium alloy sheet thickness T is between about 0.20 mm and 0.40 mm.

In further examples, golf club heads comprise a club body and a striking plate secured to the club body. The striking plate includes a metallic cover having a plurality of impact resistant scoreline indentations situated on a striking surface. In some examples, the metallic cover is between about 0.2 mm and 1.0 mm thick and the scoreline indentations have depths between about 0.1 mm and 0.02 mm. In further examples, the scoreline indentations have a depth D and the metallic cover has a thickness T such that a ratio D T is between about 0.15 and 0.30 or between about 0.20 and 0.25. In additional examples, the face plate is a variable thickness face plate.

Methods comprise selecting a metallic cover sheet and trimming the metallic cover sheet so as to conform to a golf club face plate. The metallic cover sheet provides a striking surface for a golf club. A plurality of scoreline indentations are defined in the striking surface, wherein the metallic cover sheet has a thickness T between about 0.1 mm and 0.5 mm, and the scoreline indentations have a depth D such that a ratio D T is between about 0.1 and 0.4. In additional examples, a rim is formed on the cover sheet and is configured to cover a perimeter of the face plate. In typical examples, the metallic sheet is a titanium alloy sheet and is trimmed after formation of the scoreline indentations. In some examples, the scoreline indentations are formed in an impact area of the striking surface or outside of an impact area of the striking surface.

According to some examples, golf club heads (wood-type or iron-type) comprise a club body and a striking plate secured to the club body. The striking plate includes a composite face plate having a front surface and a polymer cover layer secured to the front surface of the face plate, the polymer cover layer having a textured striking surface. In some embodiments, a thickness of the cover layer is between about 0.1 mm and about 2.0 mm or about 0.2 mm and 1.2 mm, or the thickness of the cover layer is about 0.4 mm. In further examples, the striking face of the composite face plate has an effective Shore D hardness of at least about 75, 80, or 85. In additional representative examples, the textured striking surface has one or more of a mean surface roughness between about 1 μm and 10 μm, a mean surface feature frequency of at least about 2/mm, or a surface profile kurtosis greater than about 1.5, 1.75, or 2.0. In additional embodiments, the textured striking surface has a mean surface roughness of less than about 4.5 μm, a mean surface feature frequency of at least about 3/mm, and a surface profile kurtosis greater than about 2 as measured in a top-to-bottom direction, a toe-to-heel direction, or along both directions. In some examples, the striking surface is textured along a top-to-bottom direction or a toe-to-heel direction only. In other examples, the striking surface is textured along an axis that is tilted with respect to a toe-to-heel and a top-to-bottom direction.

Methods comprise providing a face plate for a golf club and a cover layer for a front surface of the face plate. A striking surface of the cover layer is patterned so as to provide a roughened or textured striking surface. According to some examples, the roughened striking surface is patterned to include a periodic array of surface features that provide a mean roughness less than about 5 μm and a mean surface feature frequency along at least one axis substantially parallel to the striking surface of at least 2/mm. In other examples, the striking surface of the cover layer is patterned with a mold. In further examples, the striking surface is patterned by pressing a fabric against the cover layer, and subsequently removing the fabric. In a representative example, the cover layer is formed of a thermoplastic and the fabric is applied as the cover layer is formed.

Golf club heads comprise a face plate having a front surface and a control layer situated on the front surface of the face plate, wherein the control layer has a striking surface having a surface roughness configured to provide a ball spin similar to a conventional metal face under wet conditions. In some examples, the control layer is a polymer layer. In further examples, the control layer is a polymer layer having a thickness of between about 0.3 mm and 0.5 mm, and the surface roughness of the striking surface is substantially periodic along at least one axis that is substantially parallel to the striking surface. In a representative examples, the striking surface of the face plate has a Shore D hardness of at least about 75, 80, or more preferably, at least about 85. The polymer layer can be a thermoset or thermoplastic material. In representative examples, the polymer layer is a SURLYN ionomer or similar material, or a urethane, preferably a non-yellowing urethane.

Also disclosed herein is a golf club head comprising a roughened striking surface that includes a surface profile having at least one peak, at least one valley, and a transition segment between the peak and the valley, wherein the at least one peak, the at least one valley, and the transition segment together define a mean line, and a substantial portion of the transition segment is near to, or on, the mean line. According to another embodiment, there is disclosed herein a golf club head comprising a roughened striking surface that defines a machined surface profile having a predetermined ratio of $R_y/R_a$ that minimizes $R_a$ while maintaining $R_y$. Also disclosed herein are methods for making golf clubs having the above-described striking surfaces.

Also disclosed are golf club heads having a ball-striking surface comprising an asymmetric surface texture, and related methods for making the same.

In further examples, golf club heads are provided having a body that includes a crown, a sole, a heel, and a toe, with the body defining an internal cavity having a front opening. A striking plate is attached to the body at the front opening, with the striking plate comprising a composite face plate having a front surface and a cover layer attached to the front surface of the face plate. The cover layer defines a forward facing striking surface having a peripheral edge, a center zone, an impact zone, and a peripheral zone. In several of the foregoing examples, the club head defines a striking surface area of at least 4,000 $mm^2$, such as at least 5,000 $mm^2$.

The center zone has no scorelines, and is defined by an outer border constituting a center zone circle having a diameter Dcz, with the center of the center zone circle corresponding with a USGA center face location. The center zone circle diameter Dcz is between 1 mm to 10 mm, such as between 3 mm to 8 mm, such as between 3 mm to 6 mm. The impact zone surrounds but does not include the center zone and is defined by an outer border constituting a rectangle having its center at the USGA center face location and having upper and lower sides aligned parallel to an address position ground plane and heel and toe sides aligned perpendicular to the address position ground plane, with the upper and lower sides each having a length of 45 mm and the heel and toe sides each having a length of 30 mm. The impact zone has an impact zone area, Aiz. The impact zone is provided with a plurality of scorelines having a scoreline area, Asliz, such that the ratio Asliz/Aiz is at least 0.10, such as at least 0.17, or such as at least 0.20. The peripheral zone surrounds but does not include the impact zone and extends to the peripheral edge, with the peripheral zone having a peripheral zone area, Apz.

In some examples, the peripheral zone is provided with a plurality of scorelines having a scoreline area, Aslpz, such that the ratio Aslpz/Apz is at least 0.10, such as at least 0.17, or such as at least 0.20.

In some examples, the cover layer has an average thickness of between 0.2 mm to 0.75 mm throughout at least the center zone and impact zone, and a plurality of scorelines in the impact zone have an average depth that is between 0.1 mm and 0.4 mm. In some further examples, a ratio of the average depth of the plurality of scorelines in the impact zone to the average thickness of the cover layer in the impact zone is between 0.2 to 0.9, such as between 0.5 to 0.8, or such as between 0.6 to 0.8.

In some examples, a ratio of the scoreline width to the width of the land area between adjacent scorelines is between 1:3 and 1:5, such as between 1:3 and 1:4, for at least 50% of the scorelines in the impact zone. In other examples, the ratio of the scoreline width to the width of the land area between adjacent scorelines is between 1:3 and 1:5, such as between 1:3 and 1:4, for at least 75% of the scorelines in the impact zone. In still other examples, a ratio of the scoreline width to the width of the land area between adjacent scorelines is between 1:3 and 1:5, such as between 1:3 and 1:4, for at least 50% of the scorelines in the peripheral zone. In still other examples, the ratio of the scoreline width to the width of the land area between adjacent scorelines is between 1:3 and 1:5, such as between 1:3 and 1:4, for at least 75% of the scorelines in the peripheral zone.

BRIEF DESCRIPTION OF THE DRAWINGS

Without limiting the scope of the present invention as claimed below and referring now to the drawings and figures:

FIGS. 50-52 illustrate another representative striking plate that includes a cover layer having a roughened striking surface;

Figure 1:
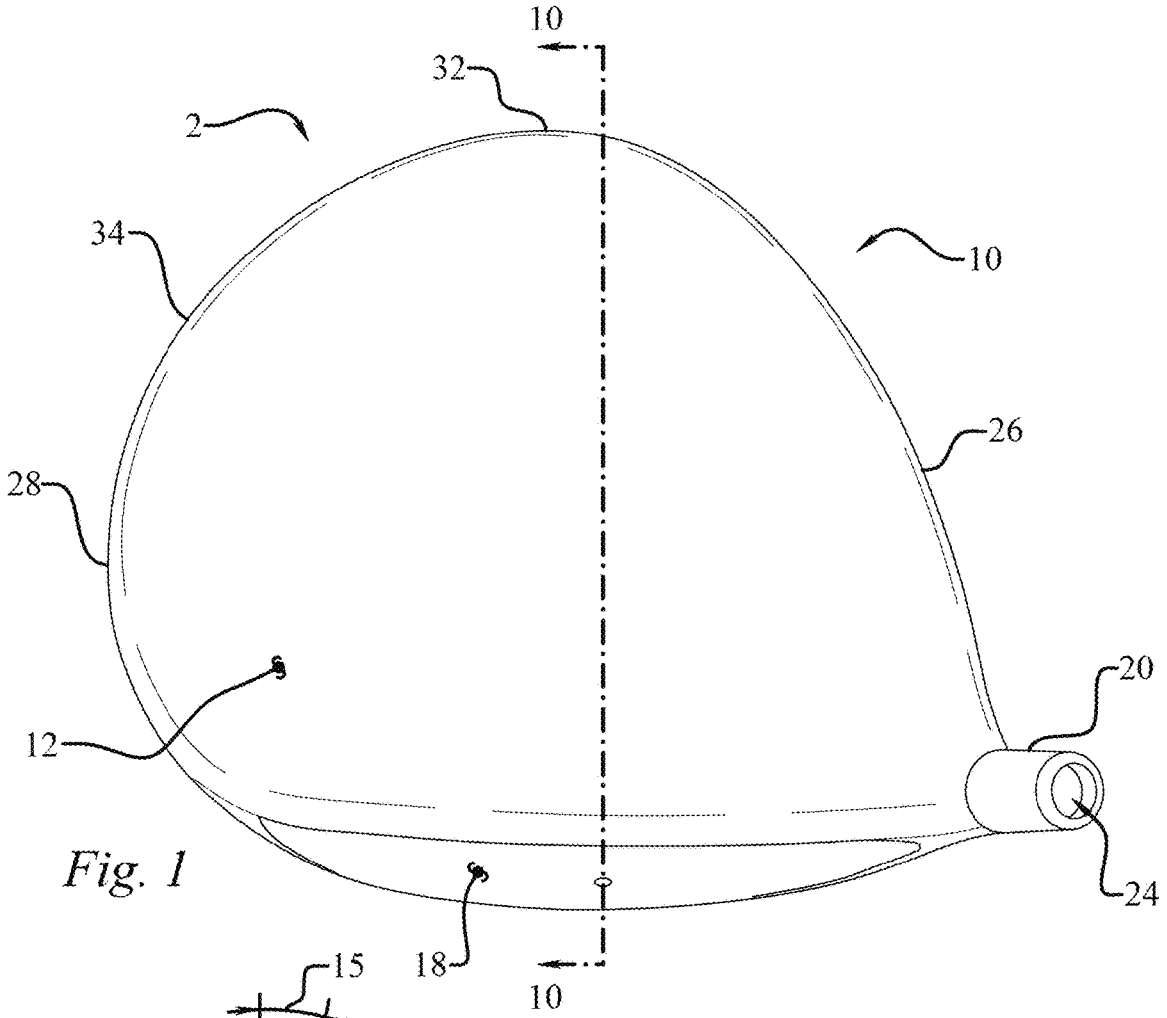
FIG. 1 is a top plan view of an embodiment of an oversized golf club head.

These drawings are provided to assist in the understanding of the exemplary embodiments of the invention as described in more detail below and should not be construed as unduly limiting the invention. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION

The inventive features include all novel and non-obvious features disclosed herein both alone and in novel and non-obvious combinations with other elements. As used herein, the phrase "and/or" means "and", "or" and both "and" and "or". As used herein, the singular forms "a," "an," and "the" refer to one or more than one, unless the context clearly dictates otherwise. As used herein, the term "includes" means "comprises." The preferred embodiments of the invention accomplish the stated objectives by new and novel arrangements of elements and configurations, materials, and methods that are configured in unique and novel ways and which demonstrate previously unavailable but preferred and desirable capabilities. The description set forth below in connection with the drawings is intended merely as a description of the presently preferred embodiments of the invention, and is not intended to represent the only form in which the present invention may be constructed or utilized. The description sets forth the designs, materials, functions, means, and methods of implementing the invention in connection with the illustrated embodiments. It is to be understood, however, that the same or equivalent functions, features, and material properties may be accomplished by different embodiments that are also intended to be encompassed within the spirit and scope of the invention. The present disclosure is described with reference to the accompanying drawings with preferred embodiments illustrated and described. The disclosure may, however, be embodied in many different forms and should not be construed as limited to the embodiments set forth herein; rather, these embodiments are provided so that this disclosure will be thorough and complete, and will fully convey the scope of the disclosure to those skilled in the art. Like numbers refer to like elements throughout the disclosure and the drawings. In the figures, the thickness of certain lines, layers, components, elements or features may be exaggerated for clarity. All publications, patent applications, patents, and other references mentioned herein are incorporated herein by reference in their entireties. Even though the embodiments of this disclosure are particularly suited as oversized golf club heads and oversized golf clubs and reference is made specifically thereto, it should be immediately apparent that embodiments of the present disclosure are applicable to non-oversized club heads as well.

The following disclosure describes embodiments of golf club heads for oversized metalwood type golf clubs. Several of the golf club heads incorporate features that provide the golf club heads and/or golf clubs with oversized volume and/or dimensions and unique relationships providing improved performance associated with club head constructions that provide unique and preferential mass properties for an oversized club head 2, as well as unique dimensional configurations, unique face designs, higher coefficients of restitution ("COR") and characteristic times ("CT"), and/or impart preferred launch conditions upon a golf ball, including, but not limited to, decreased backspin rates, relative to other golf club heads that have come before. The disclosure makes reference to the accompanying drawings which form a part hereof, wherein like numerals designate like parts throughout. The drawings illustrate specific embodiments, but other embodiments may be formed and structural changes may be made without departing from the intended scope of this disclosure. Directions and references (e.g., up, down, top, bottom, left, right, rearward, forward, heelward, toeward, etc.) may be used to facilitate discussion of the drawings but are not intended to be limiting. For example, certain terms may be used such as "up," "down,", "upper," "lower," "horizontal," "vertical," "left," "right," and the like. These terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same object. Accordingly, the following detailed description shall not to be construed in a limiting sense and the scope of property rights sought shall be defined by the appended claims and their equivalents.

Normal Address Position

Club heads and many of their physical characteristics disclosed herein will be described using "normal address position" as the club head reference position, unless otherwise indicated.

Figure 2:
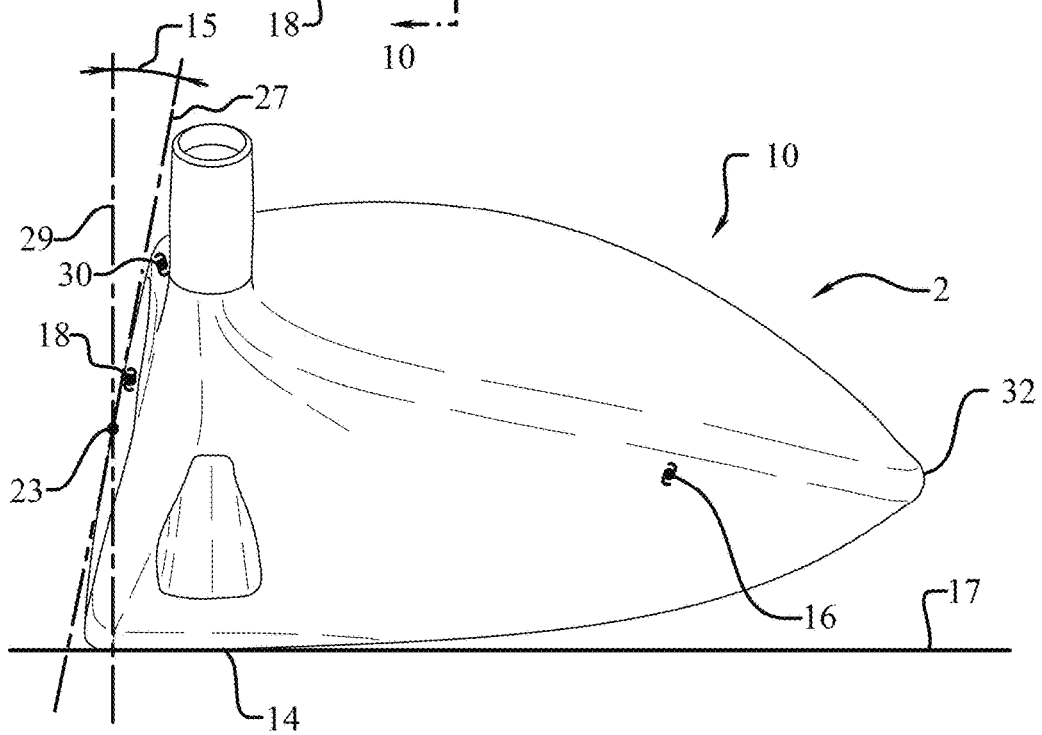
FIG. 2 is a side elevation view of an embodiment of an oversized golf club head.
Figure 3:
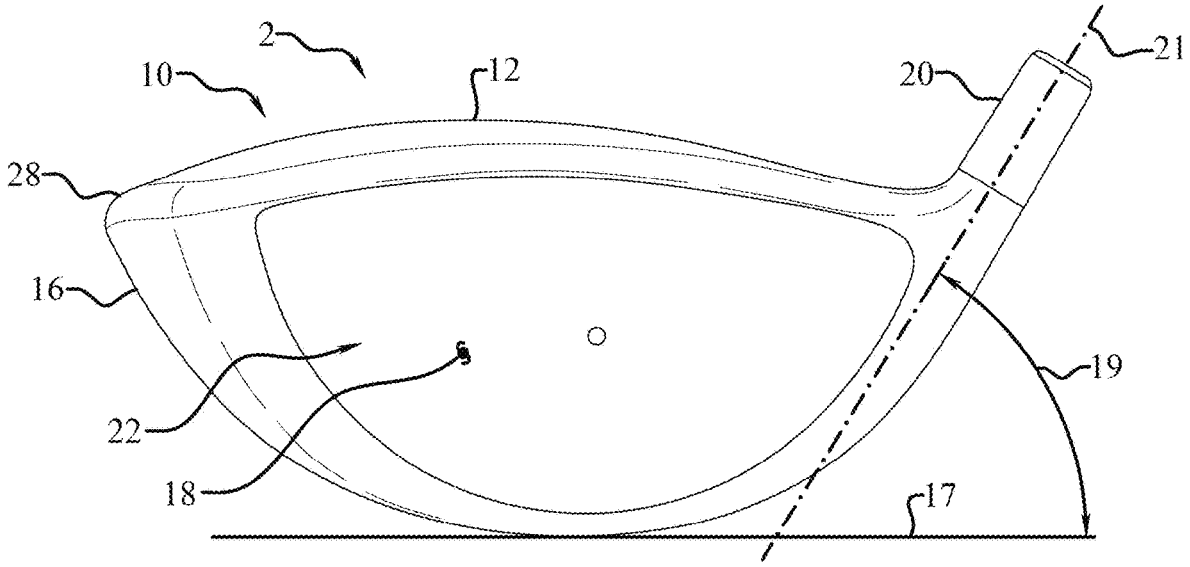
FIG. 3 is a front elevation view of an embodiment of an oversized golf club head.
Figure 4:
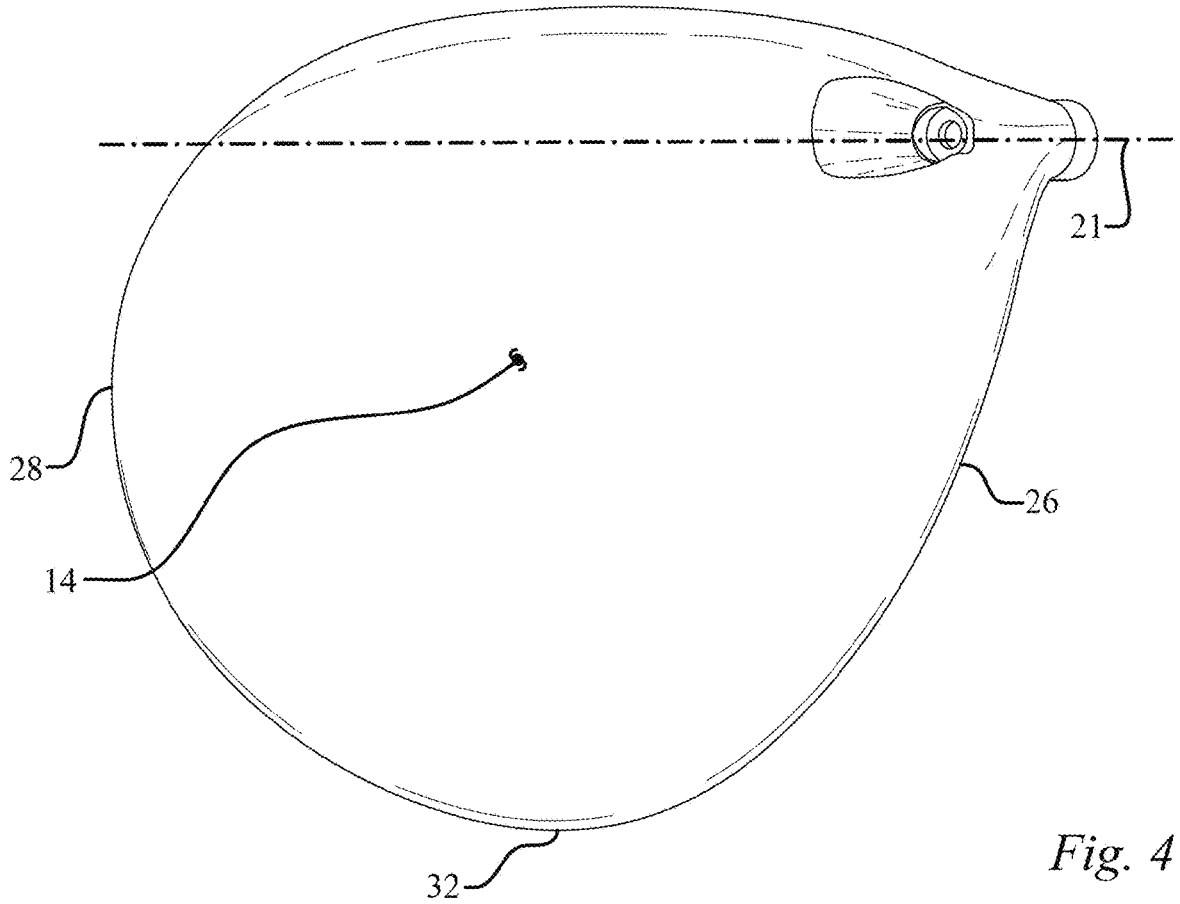
FIG. 4 is a bottom plan view of an embodiment of an oversized golf club head.
Figure 5:
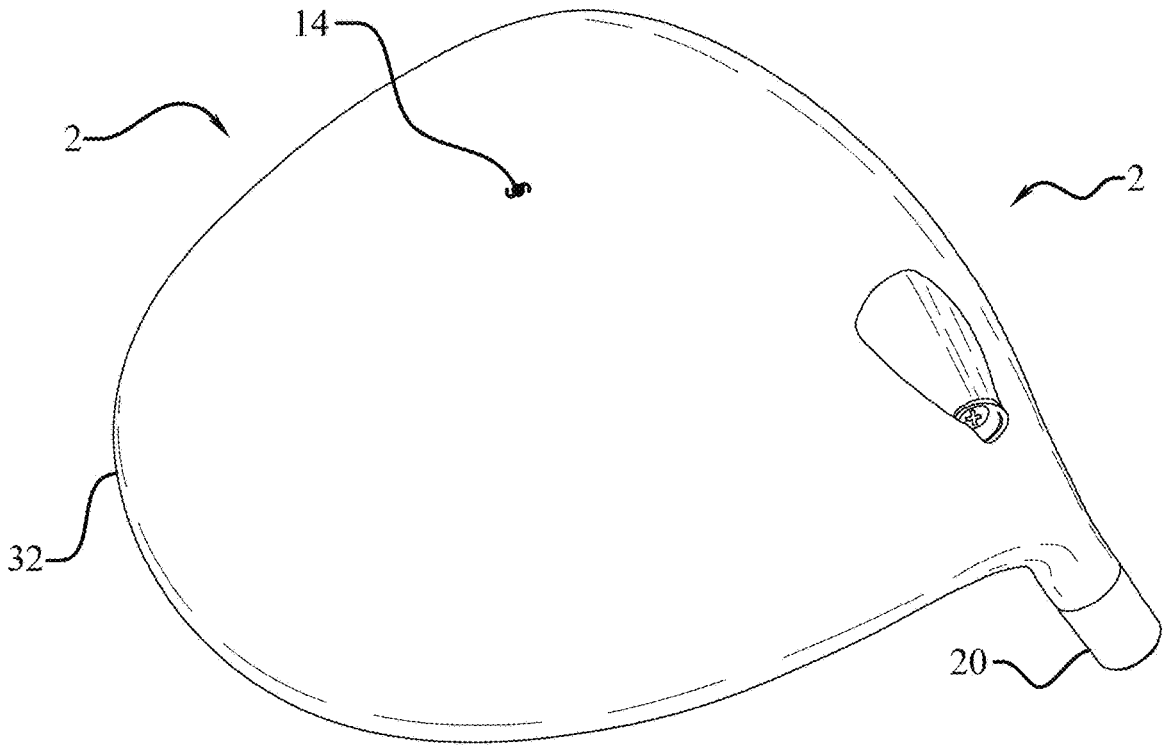
FIG. 5 is a bottom perspective view of an embodiment of an oversized golf club head.

FIGS. 1-4 illustrate one embodiment of a golf club head at normal address position. FIG. 1 illustrates a top plan view of the club head 2, FIG. 2 illustrates a side elevation view from the toe side of the club head 2, FIG. 3 illustrates a front elevation view, and FIG. 4 illustrates a bottom plan view of the club head 2. By way of preliminary description, the club head 2 includes a hosel 20 and a ball striking club face 18. At normal address position, the club head 2 rests on the ground plane 17, a plane parallel to the ground.

As used herein, "normal address position" means the club head position wherein a vector normal to the club face 18 substantially lies in a first vertical plane (i.e., a vertical plane is perpendicular to the ground plane 17), the centerline axis 21 of the club shaft substantially lies in a second vertical plane, and the first vertical plane and the second vertical plane substantially perpendicularly intersect.

Club Head Generally

A golf club head, such as the oversized golf club head 2, includes a hollow body 10 defining a crown portion 12, a sole portion 14 and a skirt portion 16. A striking face, or face portion, 18 attaches to the body 10, or may be formed with a portion of the body 10. The body 10 can include a hosel 20, which defines a hosel bore 24 adapted to receive a golf club shaft and/or a shaft sleeve. The body 10 further includes a heel portion 26, a toe portion 28, a front portion 30, and a rear portion 32.

The oversized club head 2 also has a volume, typically measured in cubic-centimeters ($cm^3$), often abbreviated as "cc", equal to the volumetric displacement of the oversized club head 2, assuming any apertures are sealed by a substantially planar surface. (See United States Golf Association "Procedure for Measuring the Club Head Size of Wood Clubs," Revision 1.0, Nov. 21, 2003). In some implementations, the oversized golf club head 2 has a volume between approximately 500 $cm^3$ and approximately 1100 $cm^3$, and a total mass between approximately 185 g and approximately 215 g, as will be described in greater detail within the "Oversized Golf Club Heads and Golf Clubs" section. Additional specific implementations having additional specific values for volume and mass are described elsewhere herein.

As used herein, "crown" means an upper portion of the oversized club head 2 above a peripheral outline 34 of the oversized club head 2 as viewed from a top-down direction and rearward of the topmost portion of the striking face 18, as seen in FIG. 1. As used herein, "sole" means a lower portion of the oversized club head 2 extending upwards from a lowest point of the oversized club head 2 when the oversized club head 2 is at the normal address position. Further, the sole 14 can define a substantially flat portion extending substantially horizontally relative to the ground 17 when in the normal address position. In some implementations, the bottommost portion of the sole 14 extends substantially parallel to the ground 17 between approximately 5% and approximately 70% of the depth Dch of the body 10. In some implementations, an adjustable mechanism is provided on the sole 14 to "decouple" the relationship between face angle and hosel/shaft loft, i.e., to allow for separate adjustment of square loft and face angle of the oversized club head 2. For example, some embodiments of the oversized club head 2 include an adjustable sole portion that can be adjusted relative to the body 10 to raise and lower the rear end of the oversized club head 2 relative to the ground. The oversized club head 2 may include adjustability aspects disclosed in U.S. patent application Ser. No. 14/734,181, which is incorporated herein by reference. As used herein, "skirt" means a side portion of the oversized club head 2 between the crown 12 and the sole 14 that extends across the periphery 34 of the oversized club head 2, excluding the face 18, from the toe portion 28, around the rear portion 32, to the heel portion 26.

As used herein, "striking surface" means a front or external surface of the striking face 18 configured to impact a golf ball (not shown). As will be described later in greater detail, in some embodiments the striking face or face portion 18 can be a striking plate attached to the body 10 using conventional attachment techniques, such as welding, and in other embodiments the face portion 18 may include an insert, which may be metallic or non-metallic, and in even further embodiment the face portion 18 is formed integral with a portion of one or more of the crown 12, sole 14, and skirt. Thus, one embodiment incorporates a cup-face construction whereby the face portion 18 is integrally formed, by casting, forging, stamping, or pressing, with a return portion that forms a portion of one or more of the crown 12, sole 14, and skirt. In a further embodiment at least 50% of the perimeter of the face portion 18 has an associated return portion and at least a portion of the return portion extends away from the face portion 18 a return distance that is at least ½ inch, while in another embodiment the return distance is no more than 2 inches. The striking surface 18 may have a bulge and roll curvature, disclosed in great detail later herein.

The body 10 may comprise a polymeric material, a metal alloy (e.g., an alloy of titanium, an alloy of steel, an alloy of aluminum, and/or an alloy of magnesium), a composite material, such as a graphitic composite, a ceramic material, or any combination thereof (e.g., a metallic sole and skirt with a composite, magnesium, or aluminum crown). Embodiments of the oversized club head 2 may include any of the materials and configurations disclosed in U.S. patent application Ser. Nos. 14/717,864, 15/233,805, 15/087,002, and 62/205,601, which is incorporated herein by reference. In some embodiments the crown 12, sole 14, and skirt 16 may be integrally formed using techniques such as molding, cold forming, casting, and/or forging and the striking face 18 can be attached to the crown 12, sole 14, and skirt 16 by known means, while in other embodiments the striking face 18 is integrally formed with a portion of the crown 12, sole 14, and/or skirt 16. For example, in some embodiments, the body 10 can be formed from a cup-face structure, with a wall or walls extending rearward from the edges of the inner striking face surface and the remainder of the body formed as a separate piece that is joined to the walls of the cup-face by welding, cementing, adhesively bonding, or other technique known to those skilled in the art.

Figure 7:
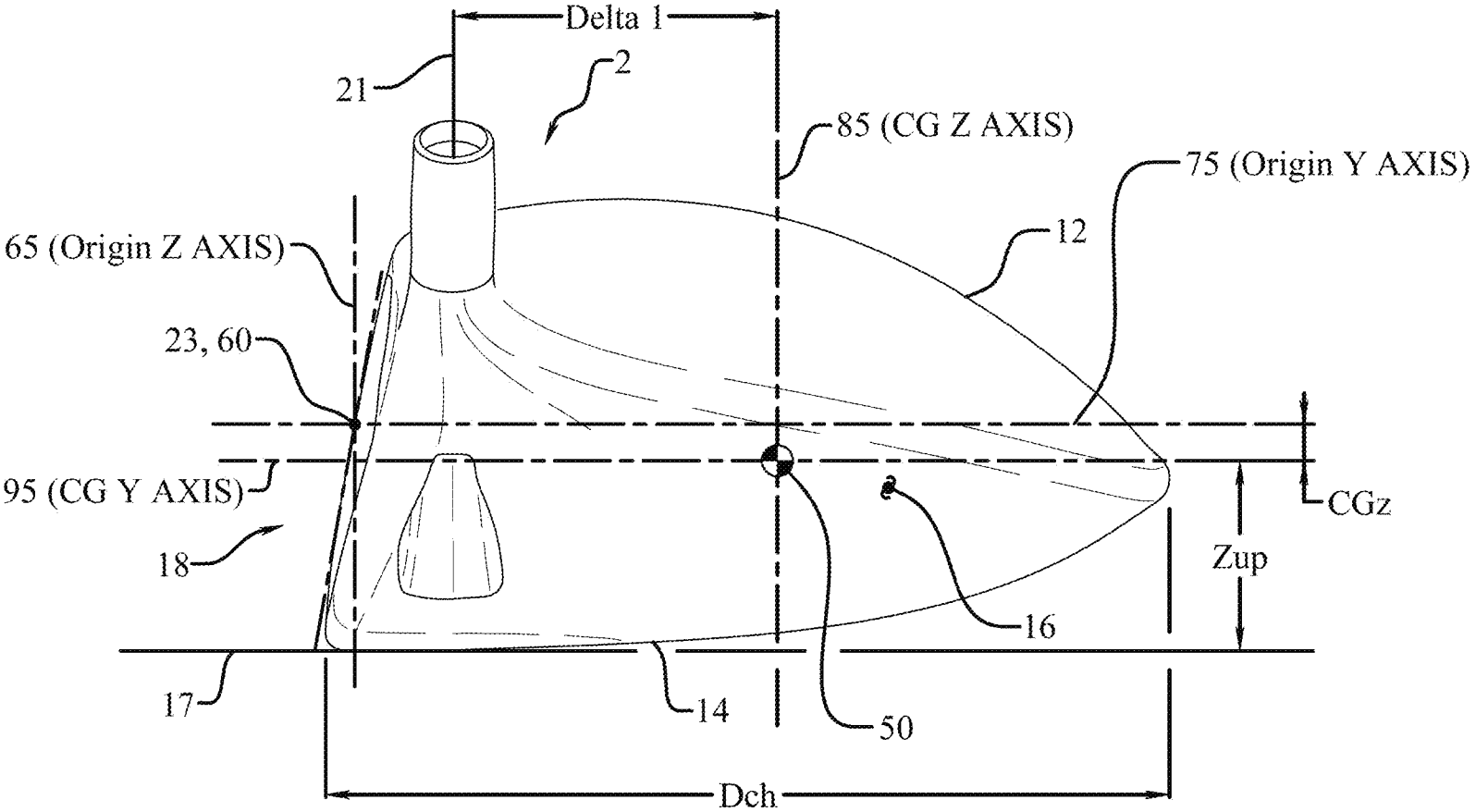
FIG. 7 is a side elevation view of an embodiment of an oversized golf club head.
Figure 8:
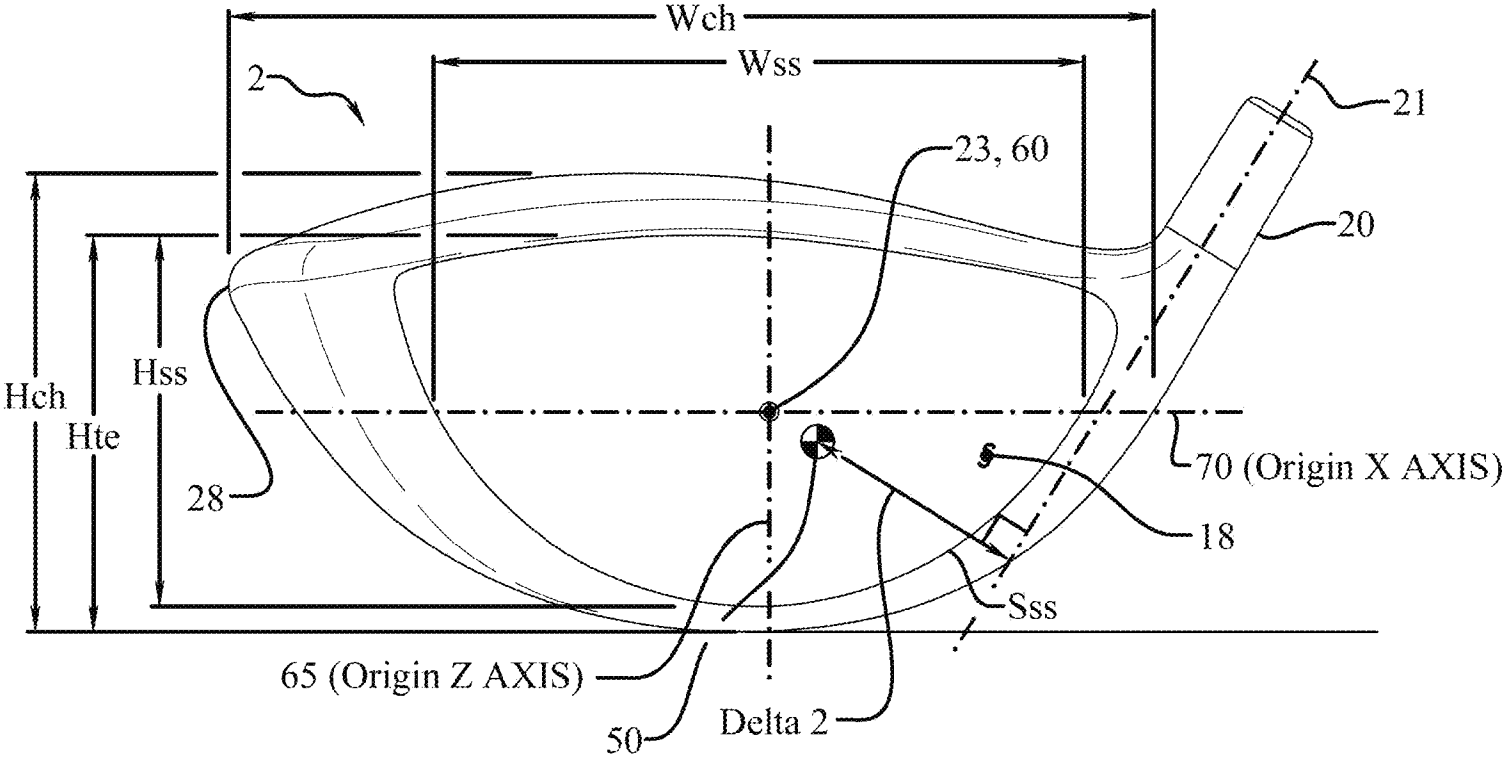
FIG. 8 is a front elevation view of an embodiment of an oversized golf club head.

Referring to FIGS. 7 and 8, the ideal impact location 23 of the golf club head 2 is disposed at the geometric center of the face 18. The ideal impact location 23 is typically defined as the intersection of the midpoints of a height Hss and a width Wss of the face 18. Both Hss and Wss are determined using the striking face curve Sss. The striking face curve is bounded on its periphery by all points where the face transitions from a substantially uniform bulge radius (face heel-to-toe radius of curvature) and a substantially uniform roll radius (face crown-to-sole radius of curvature) to the body. In the illustrated example, Hss is the distance from the periphery proximate to the sole portion of Sss to the periphery proximate to the crown portion of Sss measured in a vertical plane (perpendicular to ground) that extends through the geometric center of the face 18 (e.g., this plane is substantially normal to the x-axis). Further, as seen in FIG. 8, the face 18 has a top edge elevation, Hte, measured from the ground plane. Similarly, Wss is the distance from the periphery proximate to the heel portion of Sss to the periphery proximate to the toe portion of Sss measured in a horizontal plane (e.g., substantially parallel to ground) that extends through the geometric center of the face (e.g., this plane is substantially normal to the z-axis). See USGA "Procedure for Measuring the Flexibility of a Golf Clubhead," Revision 2.0 for the methodology to measure the geometric center of the striking face. Additional specific implementations having additional specific values for face height Hss, face width Wss, and total striking surface area are described elsewhere herein.

In some embodiments, the striking face 18 is made of a composite material such as described in U.S. patent application Ser. Nos. 14/210,000, 14/154,513, 14/620,079, 14/184,585, and U.S. Pat. No. 9,174,099, and others disclosed herein, which are incorporated herein by reference. In other embodiments, the striking face 18 is made from a metal alloy (e.g., an alloy of titanium, steel, aluminum, and/or magnesium), ceramic material, or a combination of composite, metal alloy, and/or ceramic materials. Examples of titanium alloys include alpha alloys including, but not limited to, Ti-5AL-2SN-ELI, Ti-8AL-1MO-1V, Ti-9AL-1MO-1V; near-alpha alloys including, but not limited to, Ti-6Al-2Sn-4Zr-2Mo, Ti-5Al-5Sn-2Zr-2Mo, IMI 685, Ti 1100, Ti-8Al-1Mo-1V, Ti-9AL-1MO-1V; alpha and beta alloys including, but not limited to, Ti-6Al-4V, Ti-6Al-4V-ELI, Ti-6Al-6V-2Sn; and beta and near beta alloys including, but not limited to, Ti-10V-2Fe-3Al, Ti-13V-11 Cr-3Al, Ti-8Mo-8V-2Fe-3Al, Beta C, Ti-15-3. Additional examples of titanium alloys include 3-2.5, 6-4, SP700, 15-3-3-3, 10-2-3, or other alpha/near alpha, alpha-beta, and beta/near beta titanium alloys. Examples of steel alloys include 304, 410, 450, or 455 stainless steel. In several specific embodiments, the golf club head includes a body 10 that is formed of a metal (e.g., titanium), a metal alloy (e.g., an alloy of titanium, an alloy of aluminum, and/or an alloy of magnesium), a composite material, such as a graphitic composite, a ceramic material, an injection molded material, such as those disclosed in U.S. patent application Ser. No. 14/717,864, which is incorporated herein by reference, or any combination thereof.

When at normal address position as seen in FIG. 3, the oversized club head 2 is disposed at a lie-angle 19 relative to the club shaft axis 21 and the club face 18 has a loft angle 15. The lie-angle 19 refers to the angle between the centerline axis 21 of the club shaft and the ground plane 17 at the normal address position. Referring to FIG. 2, loft-angle 15 refers to the angle between a tangent line to the club face 18 and a vector normal to the ground plane 29 at normal address position.

A club shaft and/or shaft sleeve is received within the hosel bore 24 and is aligned with the centerline axis 21. In some embodiments, a connection assembly is provided that allows the shaft to be easily disconnected from the oversized club head 2. In still other embodiments, the connection assembly provides the ability for the user to selectively adjust the loft-angle 15 and/or lie-angle 19 of the golf club. For example, in some embodiments, a sleeve is mounted on a lower end portion of the shaft and is configured to be inserted into the hosel bore 24.

In one embodiment the sleeve has an upper portion defining an upper opening that receives the lower end portion of the shaft, and a lower portion having a plurality of longitudinally extending, angularly spaced external splines located below the shaft and adapted to mate with complimentary splines in the hosel opening 24. The lower portion of the sleeve defines a longitudinally extending, internally threaded opening adapted to receive a screw for securing the shaft assembly to the club head 2 when the sleeve is inserted into the hosel opening 24. The oversized club head 2 may include a shaft connection assembly as disclosed in U.S. patent application Ser. Nos. 14/876,694 and 14/587,573, which are incorporated herein by reference, and some embodiments are described later herein. In another embodiment, in lieu of the splines, the upper portion of the sleeve has at least one alignment feature, sometimes referred to as tangs, that cooperates with a corresponding feature, or features, along the exterior perimeter of the hosel entrance, which may include a notch, or notches, that extend all the way through the hosel sidewall or only partially into the interior, or exterior, of the hosel sidewall. In one particular embodiment a ferrule is integrally formed as part of the sleeve and at least two tangs extend from the ferrule to cooperate with at least two notches formed in the end of the hosel.

In another embodiment the connection assembly includes at least one external shim, or wedge member, that fits around, and cooperates with, a portion of the sleeve, outside of the club head, and cooperates with a portion of the hosel, thereby permitting a user to adjust the loft, lie, and/or face angle of the golf club head, either dependently or independently without requiring the user to remove the shaft completely from the hosel. In one embodiment the at least one external shim is a tubular adjustment piece having non-parallel upper and lower surfaces, which encircles a central portion of the shaft sleeve so that the upper surface cooperates with an upper end of the shaft sleeve to releasably fix the tubular adjustment piece to the shaft sleeve. A fastener secures the shaft sleeve to the club head and brings a portion of the at least one external shim into engagement with a portion of the club head, which in a further embodiment prevents rotation of the at least one external shim and by default the shaft sleeve. In an embodiment the shim is a cylindrical adjustment piece with an upper surface that is not parallel with its lower surface, such that it has an angle α and tilts the shaft sleeve when the shim is sandwiched between the upper portion of the shaft sleeve, or another shim, and the hosel. The shim may include a first plurality of teeth that are sized to mate with matching alignment features on the hosel, and a second plurality of teeth sized to mate with matching alignment features on another shim. In still a further embodiment the at least one external shim may be a portion of a hosel sleeve, whereby a portion of the hosel sleeve extends into the hosel and possesses a central bore for receiving the shaft sleeve, while the external shim portion remains external to the club head.

Golf Club Head Coordinates

Figure 6:
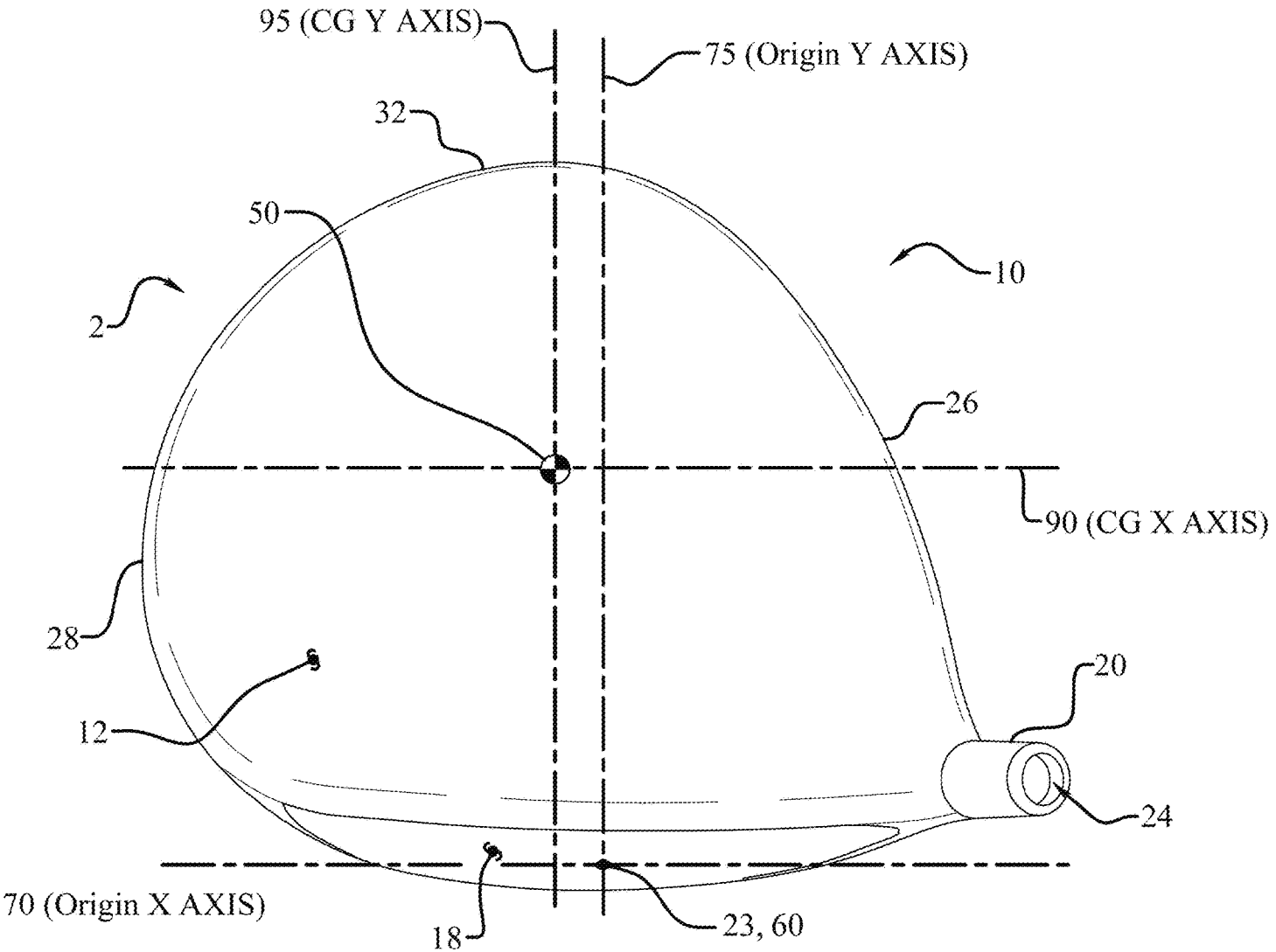
FIG. 6 is a top plan view of an embodiment of an oversized golf club head.

Referring to FIGS. 6-8, a club head origin coordinate system can be defined such that the location of various features of the oversized club head 2 including a club head center-of-gravity (CG) 50. A club head origin 60 is illustrated on the club head 2 positioned at the ideal impact location 23, or geometric center, of the face 18.

The head origin coordinate system defined with respect to the head origin 60 includes three axes: a z-axis 65, seen in FIG. 7, extending through the head origin 60 in a generally vertical direction relative to the ground 17 when the oversized club head 2 is at the normal address position; an x-axis 70, seen in FIG. 6, extending through the head origin 60 in a toe-to-heel direction generally parallel to the face 18, e.g., generally tangential to the face 18 at the ideal impact location 23, and generally perpendicular to the z-axis 65; and a y-axis 75, seen in FIG. 7, extending through the head origin 60 in a front-to-back direction and generally perpendicular to the x-axis 70 and to the z-axis 65. The x-axis 70 and the y-axis 75 both extend in generally horizontal directions relative to the ground 17 when the oversized club head 2 is at normal address position. The x-axis 70 extends in a positive direction from the origin 60 to the heel 26 of the oversized club head 2. The y-axis 75 extends in a positive direction from the origin 60 towards the rear portion 32 of the oversized club head 2. The z-axis 65 extends in a positive direction from the origin 60 towards the crown 12. Thus, if the oversized club head CG 50 is located 5 mm toward the heel from the head origin 60, and 5 mm below the head origin 60, and 25 mm behind the head origin 60, the head origin x-axis (CGx) coordinate would be 5 mm, the head origin y-axis (CGy) coordinate would be 25 mm, and the head origin z-axis (CGz) coordinate would be −5 mm.

An alternative, above ground, oversized club head coordinate system places the origin 60 at the intersection of the z-axis 65 and the ground plane 17, providing positive z-axis coordinates for every oversized club head feature. As used herein, "Zup" means the CG z-axis location determined according to the above ground coordinate system. Zup generally refers to the height of the CG 50 above the ground plane 17. Another alternative coordinate system uses the club head center-of-gravity (CG) 50 as the origin when the oversized club head 2 is at normal address position. Each center-of-gravity axis passes through the CG 50. For example, the CG x-axis 90, seen in FIG. 6, passes through the center-of-gravity 50 substantially parallel to the ground plane 17 and generally parallel to the origin x-axis 70 when the oversized club head 2 is at normal address position. Similarly, the CG y-axis 95 passes through the center-of-gravity 50 substantially parallel to the ground plane 17 and generally parallel to the origin y-axis 75, and the CG z-axis 85, seen in FIG. 7, passes through the center-of-gravity 50 substantially perpendicular to the ground plane 17 and generally parallel to the origin z-axis 65 when the oversized club head 2 is at normal address position.

Mass Moments of Inertia

Referring to FIGS. 6-7, oversized club head moments of inertia are typically defined about the three CG axes that extend through the golf club head center-of-gravity 50.

For example, a moment of inertia about the golf club head CG z-axis 85 can be calculated by the following equation:

$$Izz=\int(x^2+y^2)dm$$

where x is the distance from a golf club head CG yz-plane to an infinitesimal mass, dm, and y is the distance from the golf club head CG xz-plane to the infinitesimal mass, dm. The golf club head CG yz-plane is a plane defined by the golf club head CG y-axis 95 and the golf club head CG z-axis 85.

The moment of inertia about the CG z-axis (Izz) is an indication of the ability of an oversized golf club head to resist twisting about the CG z-axis. Greater moments of inertia about the CG z-axis (Izz) provide the oversized golf club head 2 with greater forgiveness on toe-ward or heel-ward off-center impacts with a golf ball. In other words, a golf ball hit by an oversized golf club head 2 on a location of the striking face 18 between the toe 28 and the ideal impact location 23 tends to cause the oversized golf club head 2 to twist rearwardly and the golf ball to draw (e.g., to have a curving trajectory from right-to-left for a right-handed swing). Similarly, a golf ball hit by an oversized golf club head 2 on a location of the striking face 18 between the heel 26 and the ideal impact location 23 causes the oversized golf club head 2 to twist forwardly and the golf ball to slice (e.g., to have a curving trajectory from left-to-right for a right-handed swing). Increasing the moment of inertia about the CG z-axis (Izz) reduces forward or rearward twisting of the oversized club head 2, reducing the negative effects of heel or toe mis-hits.

A moment of inertia about the golf club head CG x-axis 90 can be calculated by the following equation $$Ixx=\int(y^2+z^2)dm$$

where y is the distance from a golf club head CG xz-plane to an infinitesimal mass, dm, and z is the distance from a golf club head CG xy-plane to the infinitesimal mass, dm. The oversized club head CG xz-plane is a plane defined by the golf club head CG x-axis 90 and the oversized club head CG z-axis 85. The CG xy-plane is a plane defined by the golf club head CG x-axis 90 and the golf club head CG y-axis 95.

As the moment of inertia about the CG z-axis (Izz) is an indication of the ability of an oversized club head 2 to resist twisting about the CG z-axis, the moment of inertia about the CG x-axis (Ixx) is an indication of the ability of the oversized club head 2 to resist twisting about the CG x-axis. In general, greater moments of inertia about the CG x-axis (Ixx) improve the forgiveness of the oversized club head 2 on high and low off-center impacts with a golf ball. In other words, a golf ball hit by an oversized club head 2 on a location of the striking surface 18 above the ideal impact location 23 causes the oversized club head 2 to twist upwardly and the golf ball to have a higher trajectory than desired. Similarly, a golf ball hit by an oversized club head 2 on a location of the striking face 18 below the ideal impact location 23 causes the oversized club head 2 to twist downwardly and the golf ball to have a lower trajectory than desired. Increasing the moment of inertia about the CG x-axis (Ixx) reduces upward and downward twisting of the oversized club head 2, reducing the negative effects of high and low mis-hits.

A moment of inertia about the golf club head shaft axis 21 is referred to as the hosel axis moment of inertia (Ih) and is calculated in a similar manner and is an indication of the ability of the oversized club head 2 to resist twisting about the shaft axis 21, and also serves as a measure of the resistance a golfer senses during a golf swing as they attempt to bring the oversized club head 2 back to a square position to impact a golf ball.

Club Head Height, Width, and Depth

In addition to redistributing mass within a particular club head envelope as discussed immediately above, the club head center-of-gravity location 50 can also be tuned by modifying the oversized club head external envelope. Referring now to FIGS. 7 and 8, the oversized club head 2 has a maximum club head height Hch defined as the maximum above ground z-axis coordinate of the outer surface of the crown 12. Similarly, a maximum club head width Wch can be defined as the distance between the maximum extents of the heel and toe portions 26, 28 of the body measured along an axis parallel to the x-axis when the oversized club head 2 is at normal address position and a maximum club head depth Dch, or length, defined as the distance between the forwardmost and rearwardmost points on the surface of the body 10 measured along an axis parallel to the y-axis when the club head 2 is at normal address position. Generally, the height and width of oversized club head 2 should be measured according to the USGA "Procedure for Measuring the Clubhead Size of Wood Clubs" Revision 1.0. The heel portion 28 of the oversized club head 2 is broadly defined as the portion of the club head 2 from a vertical plane passing through the origin y-axis 75 toward the hosel 20, while the toe portion 26 is that portion of the oversized club head 2 on the opposite side of the vertical plane passing through the origin y-axis 75.

Oversized Golf Club Heads and Golf Clubs

Producing a playable oversized golf club head 2 is a difficult challenge that requires a lot of creativity and inventive steps in establishing performance enhancing design features and relationships, and oversized club head constructions that facilitate such features and relationships. In other words, simply scaling up a 400-460 cc club head, or using the conventional design practices associated with a 400-460 cc USGA conforming golf club head, is unlikely to produce an oversized club that appeals to the novice golfer, or provides the performance benefits a golfer would expect from an oversized golf club head 2. In fact, simply scaling up a 460 cc club head to 800 cc would produce a club head weighing over 265 grams, which is undesirably and would be plagued by detrimental mass properties.

In one embodiment the body 10 has a volume greater than 550 $cm^3$, or cc. In an even further embodiment the volume is at least 600 cc, while in a further embodiment the volume is at least 650 cc, and in even further embodiments the volume is at least 700 cc, at least 750 cc, and at least 800 cc. While such large volumes, combined with the other relationships disclosed herein, provide the golfer with increased confidence and offer performance benefits, as the size continues to increase the negatives start to outweigh the positives. At volumes above 950 cc the aerodynamic drag is significant and the ability of an average golfer to reliably control the opening and closing of the oversized club head 2 throughout the golf swing is diminished. Thus, in one embodiment the volume is no more than 950 cc, while in an even further embodiment it is less than 900 cc. A particularly effective series of embodiments has identified a synergistic balance of the pros and cons of oversized club heads 2 when the volume in the range of 650-900 cc, and in another embodiment the volume is 700-850 cc, while in an even further embodiment the volume is 750-825 cc.

It is important to note that while it may be easiest to characterize an oversized club head 2 as being oversized based upon the volume, in another embodiment the present oversized golf club head invention may be characterized as oversized due to large dimensions, yet still have a volume of 460 cc or less. Just as with volume, once the decision has been made to design an oversized club head 2, simply "scaling-up" a 430-460 cc conforming club head design is likely to result in an oversized club head 2 characterized by poor performance due to aerodynamics, mass properties, and/or club head construction. While the disclosed dimensions and volumes, combined with the other relationships disclosed herein, provide the golfer with increased confidence and offer performance benefits, as the dimensions continues to increase the negatives start to outweigh the positives. Again, uniquely discovered relationships concerning combinations of dimensions, mass properties, volume, and club head construction and materials provide the synergistic balance that is necessary to design a lightweight oversized club head 2 that is easy to use and offers improved performance. A club head depth Dch of greater than 175 mm was found to negatively impact a golfer's confidence and negatively influence performance, while having a club head depth Dch of less than 125 mm does not fully take advantage of the potential confidence and performance advantages afforded by an oversized club head 2. Thus, in one embodiment the club head depth Dch is at least 125 mm, while in another embodiment the club head depth Dch is at least 135 mm, and in yet a further embodiment the club head depth Dch is at least 145 mm. Further, in one embodiment the club head depth Dch is no more than 175 mm, while in another embodiment the club head depth Dch is no more than 165 mm, and in yet a further embodiment the club head depth Dch is less than 155 mm. Similarly, a club head height Hch of greater than 100 mm was found to negatively impact a golfer's confidence and negatively influence performance, while having a club head height Hch of less than 70 mm does not fully take advantage of the potential confidence and performance advantages afforded by an oversized club head 2. Thus, in one embodiment the club head height Hch is at least 70 mm, while in another embodiment the club head height Hch is at least 72.5 mm, in yet a further embodiment the club head height Hch is at least 75 mm, and in still another embodiment the club head height Hch is at least 80 mm. Further, in one embodiment the club head height Hch is no more than 100 mm, while in another embodiment the club head height Hch is no more than 90 mm, and in yet a further embodiment the club head height Hch is less than 80 mm. Additionally, a club head width Wch of greater than 170 mm was found to negatively impact a golfer's confidence and is difficult for a novice golfer to return to a square position at impact, while having a club head width Wch of less than 120 mm does not fully take advantage of the potential confidence and performance advantages afforded by an oversized club head 2. Thus, in one embodiment the club head width Wch is at least 120 mm, while in another embodiment the club head width Wch is at least 135 mm, and in yet a further embodiment the club head width Wch is at least 140 mm. Further, in one embodiment the club head width Wch is no more than 170 mm, while in another embodiment the club head width Wch is no more than 160 mm, and in yet a further embodiment the club head width Wch is less than 150 mm. In one particular embodiment the head depth (Dch) is greater than about 85% of the club head width (Wch).

Further, in another embodiment the present invention is characterized as oversized because it has a face area of at least 5000 $mm^2$, regardless of volume, club head depth Dch, or club head height Hch. In one particular embodiment the face area is at least 5250 $mm^2$, while in an even further embodiment the face area is at least 5500 $mm^2$, and in yet another embodiment the face area is at least 5750 $mm^2$. Again, uniquely discovered relationships concerning combinations of dimensions, mass properties, volume, and club head construction and materials provide the synergistic balance that is necessary to design a lightweight oversized club head 2 that is easy to use and offers improved performance. A face area of greater than 7000 $mm^2$ was found to negatively impact a golfer's confidence and negatively influence performance, while having a face area of less than 5000 $mm^2$ does not fully take advantage of the potential confidence and performance advantages afforded by a lightweight oversized club head. Thus, in one embodiment the face area is no more than 7000 $mm^2$, while in a further embodiment the face area is no more than 6500 $mm^2$, and in an even further embodiment the face area is no more than 6250 $mm^2$. The procedure for measuring the face area is disclosed in U.S. Pat. No. 8,096,897, which is incorporated by reference herein.

Further, a unique relationship of volume to face area has been discovered that produces a playable oversized club head 2 that is confidence inspiring, and not aesthetically jarring, while being easily controllable by a novice golfer, and providing them with the ability to return the club face 18 to a square position at impact with the golf ball without having to think about the fact that they are swinging an oversized club head 2, while yielding the performance benefits discussed herein. In one such embodiment a volume-to-face-area ratio of the volume to face area is at least 0.120 cc/$mm^2$, while in a further embodiment the volume-to-face-area ratio is at least 0.125 cc/$mm^2$, and in yet another embodiment the volume-to-face-area ratio is at least 0.140 cc/$mm^2$. In another embodiment the volume-to-face-area ratio is no more than 0.200 cc/$mm^2$, and in yet a further embodiment the volume-to-face-area ratio is no more than 0.170 cc/$mm^2$.

Similarly, a unique relationships of volume to face height Hss, and face width Wss, have been discovered that produces a playable oversized club head 2 that is confidence inspiring and aesthetically pleasing, while being easily controllable by a novice golfer, and providing them with the ability to return the club face 18 to a square position and more consistently impact with the golf ball near the ideal impact location 23, or geometric center, of the face 18 without having to think about the fact that they are swinging an oversized club head 2, while yielding the performance benefits discussed herein. In one such embodiment a volume-to-FH ratio of the volume to face height is at least 10 cc/mm, while in another embodiment the volume-to-FH ratio is at least 13 cc/mm. Additionally, a series of embodiments incorporate a preferred range of volume-to-FH ratios producing enhanced performance and reducing regions of diminishing, and negative, returns. For instance, in one such embodiment the volume-to-FH ratio is no more than 20 cc/mm, while in another embodiment the volume-to-FH ratio is no more than 15 cc/mm, and in yet a further embodiment the volume-to-FH ratio is 10.5-14 cc/mm. Now turning to face width embodiments, in one such embodiment the volume-to-FW ratio of the volume to the face width is at least 7 cc/mm, while in another embodiment the volume-to-FW ratio is at least 8 cc/mm. Additionally, a series of embodiments incorporate a preferred range of volume-to-FW ratios producing enhanced performance and reducing regions of diminishing, and negative, returns. For instance, in one such embodiment the volume-to-FW ratio is no more than 12 cc/mm, while in another embodiment the volume-to-FW ratio is no more than 9, and in yet a further embodiment the volume-to-FW ratio is 7.5-9 cc/mm.

In the past, oversized club heads 2 are often either (a) club heads that maintain a head weight close to a conforming club head, and therefore are generally less than 650 cc, as seen in Tables 1 and 2 below, or (b) club heads that give little regard to head weight, often in excess of 275 grams, in exchange for increasing the volume even further. A benefit of an oversized golf club 2 is the ability to increase the face area, thereby allowing novice golfers to produce a good shot even when the golf ball is struck a significant distance from the geometric center of the face, or ideal impact location 23. Another benefit of an oversized golf club 2 is the ability to increase the dimensions of the club head 2 to inspire confidence and improve forgiveness. However, taking advantage of these potential benefits while not adversely affecting the performance of the oversized club head 2, including but not limited to the aerodynamic performance as well as the associated golf ball launch conditions, which are heavily influenced by the mass properties and face attributes of the oversized club head 2, required the discovery of new relationships and ranges not commonly thought of during the design of conforming club heads.

The properties of two past oversized club heads are shown in Table 1 and Table 2 below, and nicely illustrate what happens when traditional design principles and constructions are applied to oversize club heads. In their chase to increase the size of the face of the club heads, while using conventional construction techniques, these club heads are exceedingly face heavy. In other words, as the face size has been increased, often in conjunction with increasing the face thickness to ensure the durability of such a large face, the center of gravity (CG) of the club head has moved exceedingly close to the face, as evidenced by CG angles of 11.9 degrees and 8.8 degrees, as well as Delta1 values of 8.9 mm and 5.7 mm. While in some designs a forward CG location may offer performance benefits, when taken to the extreme, as has been done with these two illustrative club heads due to conventional "scaling-up" thinking, the result is undesirable.

TABLE 1

| | Vol. (cc) | Weight (grams) | Face Height (mm) | Face Width (mm) | Bulge (mm) | Roll (mm) | Head Height (mm) | Head Depth (mm) |
|---|---|---|---|---|---|---|---|---|
| Head A | 634 | 201 | 66.7 | 100.6 | 247 | 247 | 74.7 | 114.6 |
| Head B | 609 | 202 | 66.4 | 92.6 | 243 | 243 | 74.8 | 113.5 |

TABLE 2

| | CGx mm | CGz mm | Zup mm | Delta 1 mm | Delta 2 mm | CG angle degrees | Ixx kg · mm$^2$ | Iyy kg · mm$^2$ | Izz kg · mm$^2$ | Ih kg · mm$^2$ |
|---|---|---|---|---|---|---|---|---|---|---|
| Head A | −0.9 | −0.4 | 37.3 | 8.9 | 41.9 | 11.9 | 295 | 380 | 506 | 879 |
| Head B | 0.9 | 2.3 | 39.9 | 5.7 | 37 | 8.8 | 286 | 270 | 505 | 744 |

Figure 10:
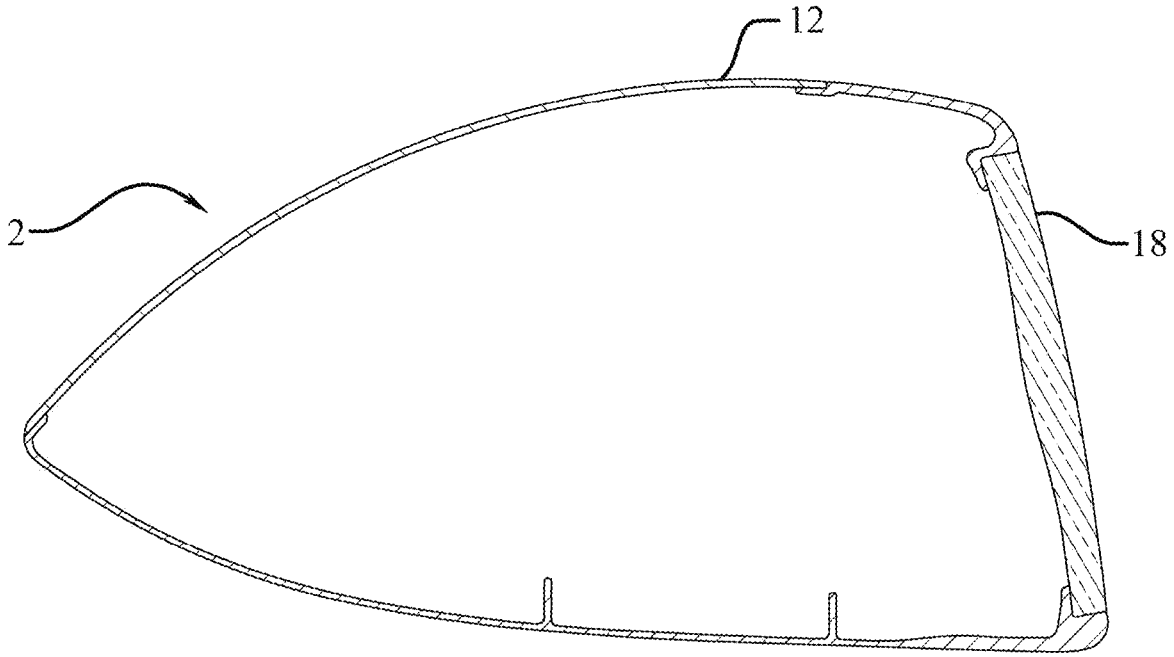
FIG. 10 is a cross-sectional view of an embodiment of an oversized golf club head taken along section line 10-10 in FIG. 1.

In one embodiment the present oversized club head 2 avoids such face heavy characteristics by incorporating a low-density material in at least a portion of the face 18, which may be metallic or non-metallic. As such, one particular embodiment has an average face density of less than 4 g/cc, while in another embodiment the average face density is less than 3 g/cc, and in yet another embodiment the average face density is less than 2 g/cc. In one particular embodiment, such as that seen in FIG. 10, at least 50% of the face area is composed of non-metallic material, such as that disclosed in U.S. patent application Ser. Nos. 14/210,000, 14/184,585, and 14/154,513, the entire contents of which are herein incorporated by reference. Such non-metallic materials may be on the outer, or striking side, of the face, or may be on the interior side of the face to provide support or reinforcing without actually coming in contact with the golf ball. In another embodiment at least 75% of the face area is composed of non-metallic material, while in an even further embodiment the entire face area is composed of non-metallic material, which provides roughly 5 grams of mass savings for every 500 mm$^2$ of face area, when compared to traditional titanium alloy face constructions. Therefore, an oversized club head 2 having a face area of 5500 mm$^2$ may save 20 grams by using an entirely non-metallic face 18, which then provides great flexibility in reallocating the location of this discretionary mass to beneficially control the mass properties of the oversized club head 2 and achieve one or more of the performance enhancing relationships disclosed herein, as well as increase the volume to levels not seen in oversized club heads 2 that maintain traditional head weights. This is particularly beneficial in lightweight oversized club heads 2 that traditionally lack the discretionary weight needed to effectively place the CG in a beneficial location. In another embodiment the oversized club head 2 has a face insert and face insert support, as seen in FIG. 10, such as that disclosed in U.S. patent application Ser. No. 14/699,905, the entire contents of which are herein incorporated by reference. In another embodiment the entire face insert is non-metallic and has a mass less than 60 grams, which in a further embodiment is less than 55 grams, and in yet another embodiment is less than 50 grams. Still further, in another embodiment the face 2 has a variable face thickness, such as that disclosed in U.S. patent application Ser. Nos. 14/565,311 and 14/456,927, the entire contents of which are herein incorporated by reference. In one particular embodiment the average face thickness is in the range of from about 1.0 mm to about 5.5 mm, while in another embodiment it is from about 1.5 mm to 5.0 mm, and in yet a further embodiment it is from about 2.0 mm to 4.5 mm.

In yet another embodiment the oversized club head 2 has a construction and characteristic time, or CT, profile as disclosed in U.S. patent application Ser. No. 14/862,438, the entire contents of which are herein incorporated by reference. In one particular embodiment the CT value at the ideal impact location is at least 280 microseconds, while in an even further embodiment it is at least 290 microseconds, and in yet another embodiment it is at least 300 microseconds. Additionally, in another embodiment the characteristic time at points along a horizontal axis through the ideal impact location 23, between a distance of 40 mm and −40 mm from the ideal impact location 23, deviate less than 20% from the characteristic time at the ideal impact location 23, while in a further embodiment the deviation is less than 15% from the characteristic time at the ideal impact location 23, and in yet another embodiment the deviation is less than 10% from the characteristic time at the ideal impact location 23.

The CG location is important in every club head, but even more so in oversized club heads 2. Traditionally the oversized nature of such a club head inspires confidence in a golfer, only to be disappointed by the associated performance because the oversized characteristics produce a CG location that is less than desirable, such as the exceedingly forward CG location, illustrated by the small CG angles and Delta1 values, and the high CG location (large Zup value) seen in Table 2. In some embodiments the CG location preferentially affects the Z-axis gear effect, which is particularly important in oversized club heads 2. For instance, in certain embodiments disclosed herein, the projected CG point on the ball striking club face 18 is located below the geometric center of the club face 18, or ideal impact point 23. A given golf club head having a given CG will have a projected center of gravity or "balance point" or "CG projection" that is determined by an imaginary line passing through the CG and oriented normal to the striking face 18. The location where the imaginary line intersects the striking face 18 is the CG projection, which is typically expressed as a distance above or below the center of the striking face 18. When the CG projection is well above the center of the face, impact efficiency, which is measured by COR, is not maximized. It has been discovered that a low CG projection or a CG projection located at or near the ideal impact location on the striking face 18 improves the impact efficiency of the oversized golf club head 2 as well as initial ball speed. One important ball launch parameter, namely ball spin, is also improved. In some embodiments the projected CG point on the ball striking club face 18 is closer to the sole 14 than the geometric center. As a result, when the golf club is swung such that the club head 2 impacts a golf ball at the ideal impact point 23, the impact is "off center" from the projected CG point, creating torque that causes the body 10 of the golf club head 2 to rotate (or twist) about the CG x-axis. The rotation of the club face 18 creates a "z-axis gear effect." More specifically, the rotation of the club head 2 about the CG x-axis tends to induce a component of spin on the ball. In particular, the backward rotation of the face 18 that occurs as the golf ball is compressed against the face 18 during impact causes the ball to rotate in a direction opposite to the rotation of the face 18, much like two gears interfacing with one another. Thus, the backward rotation of the club face 18 during impact creates a component of forward rotation in the golf ball. This effect is termed the "z-axis gear effect." Because the loft 15 of a golf club head 2 also creates a significant amount of backspin in a ball impacted by the golf club head 2, the forward rotation resulting from the z-axis gear effect is typically not enough to completely eliminate the backspin of the golf ball, but instead reduces the backspin from that which would normally be experienced by the golf ball. In general, the forward rotation (or topspin) component resulting from the z-axis gear effect is increased as the impact point of a golf ball moves upward from (or higher above) the projected CG point on the ball striking club face 18, and having an oversized club head 2 and face 18 may promote strikes high on the face 18. Additionally, the effective loft of the golf club head 2 that is experienced by the golf ball and that determines the launch conditions of the golf ball can be different than the static loft 15 of the golf club head 2. The difference between the golf club head's effective loft at impact and its static loft angle 15 at address is referred to as "dynamic loft" and can result from a number of factors. In general, however, the effective loft of a golf club head is increased from the static loft 15 as the impact point of a golf ball moves upward from (or higher than) the projected CG point on the ball striking club face 18. Thus, an oversized club head 2 with a low CG, or relatively small Zup value, and associated low projected CG point has preferred z-axis gear effect particularly when combined with an increased face height Hss that tends to promote impacts higher on the face 18. In a further embodiment the static loft angle 15 is at 8-20 degrees, while in another embodiment it is 11-18 degrees, and in yet a further embodiment it is 13-16 degrees.

The trajectory of a golf ball hit by an oversized club head 2 having a projected CG that coincides with the geometric center of the striking surface, or ideal impact point 23, typically includes a low launch angle and a significant amount of backspin. The backspin on the ball causes it to quickly rise in altitude and obtain a more vertical trajectory, "ballooning" into the sky. Consequently, the ball tends to quickly lose its forward momentum as it is transferred to vertical momentum, eventually resulting in a steep downward trajectory that does not create a significant amount of roll. Even though some backspin can be beneficial to a golf ball's trajectory by allowing it to "rise" vertically and resist a parabolic trajectory, too much backspin can cause the golf ball to lose distance by transferring too much of its forward momentum into vertical momentum.

In contrast, the trajectory of a golf ball hit by an oversized club head 2 having a lower center of gravity has a higher launch angle and less backspin relative to the oversized club head 2 having a projected CG that coincides with the geometric center of the striking surface, and the trajectory includes less "ballooning" but still has enough backspin for the ball to have some rise and to generally maintain its launch trajectory longer than a ball with no backspin. As a result, the golf ball carries further because the horizontal momentum of the golf ball is greater, which also increases the roll-out upon landing.

As seen in FIG. 7, Delta1 is a measure of how far rearward in the club head body 10 the CG is located behind a vertical plane containing the shaft axis 21; and Zup is a measure of the vertical distance that the CG is located above the ground plane 17. Smaller values of Delta1 result in lower projected CGs on the club head face 18. Thus, for embodiments of the disclosed oversized golf club heads in which the projected CG on the ball striking club face 18 is lower than the geometric center, reducing Delta1 can lower the projected CG and increase the distance between the geometric center and the projected CG. Recall also that a lower projected CG creates a higher dynamic loft and more reduction in backspin due to the z-axis gear effect. Thus, for particular embodiments of the disclosed oversized golf club heads, the Delta1 values are relatively low, thereby reducing the amount of backspin on the golf ball and helping the golf ball obtain the desired high launch, low spin trajectory.

Figure 9:
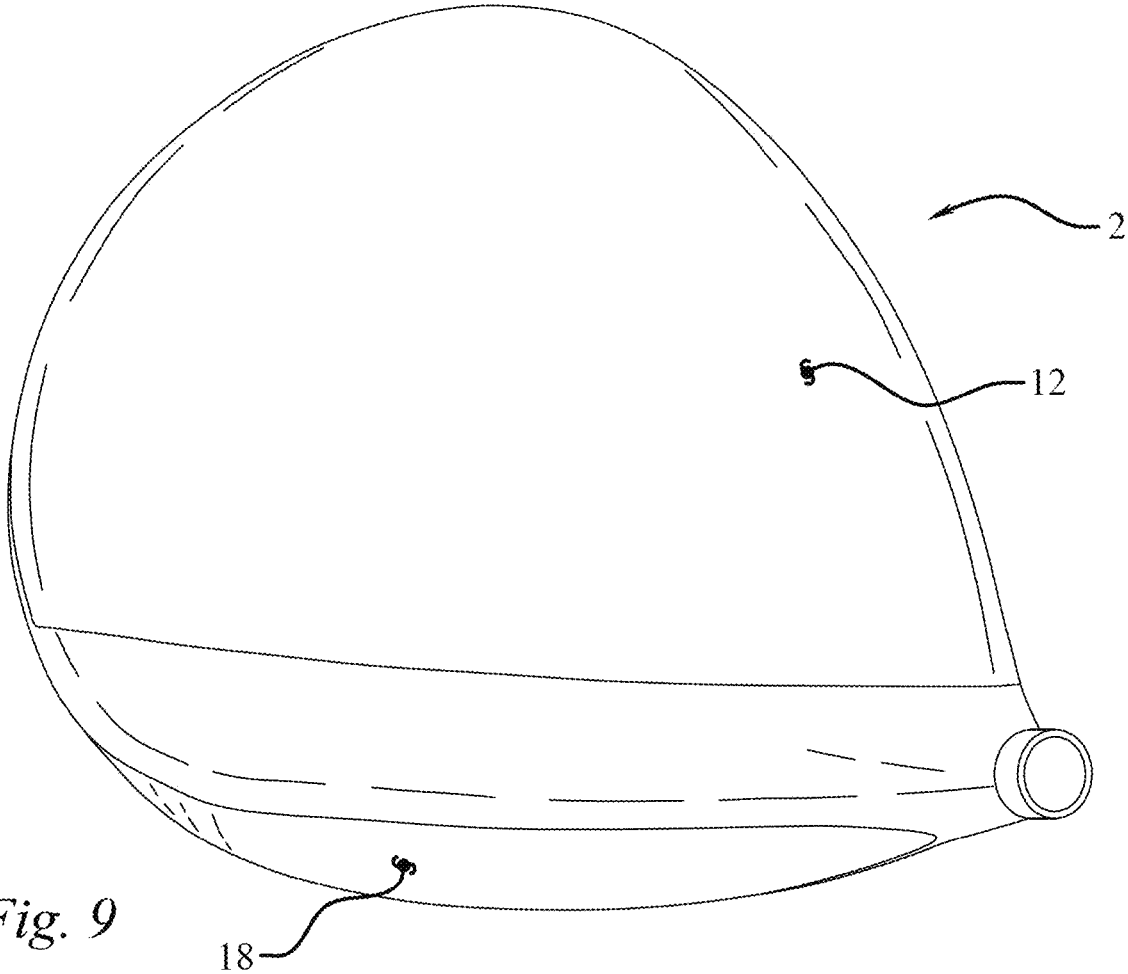
FIG. 9 is a top plan view of an embodiment of an oversized golf club head.

Adjusting the location of the discretionary mass in a golf club head 2, or the shape of the body 10 of the club head 2, can provide the desired Delta1 value. For instance, Delta1 can be manipulated by varying the mass in front of the CG (closer to the face) with respect to the mass behind the CG. That is, by increasing the mass behind the CG with respect to the mass in front of the CG, Delta1 can be increased. In a similar manner, by increasing the mass in front of the CG with the respect to the mass behind the CG, Delta1 can be decreased. The oversized club heads shown in Tables 1 and 2 suffer from a Delta1 value that is exceedingly small due to their use of metallic faces with large face areas, essentially making them face heavy. The shape of the body 10 may include any of the embodiments disclosed in U.S. patent application Ser. Nos. 14/325,168, 14/144,105, and 14/629,160, which are incorporated herein by reference. Additionally, one embodiment the present oversized club head 2 avoids the high CG location of the club heads shown in Tables 1 and 2 by incorporating a low-density material in at least a portion of the crown 12, which may be metallic or non-metallic. As such, one particular embodiment has an average crown density of less than 4 g/cc, while in another embodiment the average crown density is less than 3 g/cc, and in yet another embodiment the average crown density is less than 2 g/cc. In one particular embodiment, such as that seen in FIGS. 9 and 10, at least 50% of the crown area is composed of non-metallic material. In another embodiment at least 75% of the crown area is composed of non-metallic material. In another embodiment at least 50% of the surface area of the body 10 located above the height of the ideal impact location 23 is formed of non-metallic materials, while in an even further embodiment the non-metallic surface area located above the height of the ideal impact location 23 is at least 7500 $mm^2$, and in another embodiment the mass of the non-metallic portions located above the height of the ideal impact location 23 is 25-50 grams, while the mass is 30-45 grams in another embodiment, and is 15-25% of the total club head weight in still a further embodiment. In another embodiment at least 50% of the surface area of the body 10 located below the height of the ideal impact location 23 is formed of non-metallic materials, while in an even further embodiment the non-metallic surface area located below the height of the ideal impact location 23 is at least 7500 $mm^2$, and in another embodiment the mass of the non-metallic portions located below the height of the ideal impact location 23 is 15-50 grams, while the mass is 20-45 grams in another embodiment, and is 10-25% of the total club head weight in still a further embodiment. The non-metallic materials, body components, and construction techniques include, but are not limited to, all embodiments disclosed in U.S. patent application Ser. Nos. 14/516,503, 14/210,000, 14/184,585, 14/154,513, 14/717,864, 15/233,805, 15/087,002, and 62/205,601, the entire contents of which are herein incorporated by reference.

As previously mentioned, the Delta1 values of the oversized club heads in Tables 1 and 2 are not ideal. In one present embodiment, preferred z-axis gear effect and golf ball trajectory/launch characteristics are achieved in an oversize club head 2 when a volume-to-Delta1 ratio of the volume to the Delta1 value is no greater than 70 cc/mm, while in another embodiment the volume-to-Delta1 ratio is no greater than 65 cc/mm, while in an even further embodiment the volume-to-Delta1 ratio is no greater than 60 cc/mm, and in yet another embodiment the volume-to- Delta1 ratio is no greater than 55 cc/mm. A further series of embodiments identified preferred performance and feel when the volume-to-Delta1 ratio is maintained above 25 cc/mm, while in another embodiment it is at least 30 cc/mm, and in yet a further embodiment is at least 35 cc/mm, while in one embodiment a preferred range was identified as 40-65 cc/mm, and 45-60 cc/mm in still a further embodiment. Similarly, the Zup values of the oversized club heads of Tables 1 and 2 are not ideal. In one preferred z-axis gear effect and golf ball trajectory/launch characteristics are achieved in an oversize club head 2 when a volume-to-Zup ratio of the volume to the Zup value is at least 18 cc/mm, while in another embodiment the ratio is at least 20 cc/mm, in yet a further embodiment it is at least 22 cc/mm, and in still another embodiment it is at least 24 cc/mm. Another series of embodiments limits the top end of the volume-to-Zup ratio to provide the desired performance with the volume-to-Zup ratio not exceeding 30 cc/mm, while in another embodiment the ratio does not exceed 28 cc/mm, and in still a further embodiment the ratio does not exceed 26 cc/mm. Similarly, another series of embodiments have a Zup-to-Delta1 ratio that is 1.8-4, while in another embodiment the ratio is 2.0-3.5, and it is 2.2-3.0 in an even further embodiment. An even further series of embodiments a volume-to-Zup/Delta1 ratio of the volume to the Zup-to-Delta1 ratio that is at least 300 cc, while at least 320 cc in another embodiment, and at least 340 cc in yet a further embodiment; and further embodiments cap this ratio at no more than 400 cc in a first embodiment, no more than 380 cc in a second embodiment, and no more than 360 cc in a third embodiment. Ratios outside of these ranges unexpectedly produced a feeling in instability at impact, particularly on mis-hits, and may be more difficult to return to a square position at impact with the golf ball. In another embodiment preferred z-axis gear effect and trajectory are achieved in an oversize club head 2, when the Delta1 value is at least 9% of the head depth Dch, while in another embodiment the Delta1 value is no more than 14% of the head depth Dch, while in an even further embodiment the Delta1 value is 10-13% of the head depth Dch. In an even further embodiment preferred z-axis gear effect and trajectory are achieved in an oversize club head 2 when the Delta1 value is at least 10 mm, while in a further embodiment the Delta1 value is no more than 20 mm, while in yet a further embodiment the Delta1 value is no more than 18 mm, and in still a further embodiment the Delta1 value is no more than 16 mm.

As seen in FIG. 8, a Delta2 value is another important dimension used in quantifying the location of the center of gravity 50, which also influences the performance of the oversized club head 2. First, create an imaginary vertical shaft axis plane containing the shaft axis 21. Next, project the center of gravity 50 forward, along the CG y axis 95, seen in FIG. 6, until it strikes the imaginary vertical shaft axis plane thereby defining a point referred to as the D2 point. The shortest distance from the D2 point to the shaft axis 21 is the Delta2 value, thus the Delta2 value is the distance from the D2 point to a shaft-axis-intersection point within the imaginary vertical shaft axis plane. Therefore, an imaginary triangle may be created starting at the center of gravity 50 with a first leg along the CG y axis 95 with a magnitude of the Delta1 value; a second leg within the imaginary vertical shaft axis plane extends from the D2 point to the shaft-axis-intersection point, and has a magnitude of the Delta2 value; and the hypotenuse of the triangle extends from the shaft-axis-intersection point to the center of gravity 50. The CG angle is the angle between the second leg and the hypotenuse. Therefore, the tangent of the CG angle is equal to the D1 value divided by the D2 value, allowing for easy calculation of the CG angle.

As mentioned throughout, simply scaling up a conventional 430-460 cc conforming club head to create an oversized club head will not provide the performance or playability that a novice golfer needs or expects from an oversized club head 2. Tables 1 and 2 illustrate prior oversized club heads that fail to appreciate and achieve the unique relationships necessary to afford the desire performance, while not creating a club head that is difficult for a novice golfer to maneuver and return to a square position. Such surprising and unique relationships include variations of Delta1, Delta2, CG angle, moments of inertia, volume, face dimensions, bulge, roll, and club head dimensions, as well as unique and unexpected ratios of such variables that box in unexpected characteristics to achieve the goals disclosed herein.

As previously touched upon, as the face size has been increased, often in conjunction with increasing the face thickness to ensure the durability of such a large face, the center of gravity (CG) of the club head has moved exceedingly close to the face, as evidenced by CG angles of 11.9 degrees and 8.8 degrees, as well as Delta1 values of 8.9 mm and 5.7 mm, seen in the club heads of Tables 1 and 2. While in some designs a forward CG location may offer performance benefits, when taken to the extreme, as has been done with these two illustrative club heads due to conventional "scaling-up" thinking, the result is undesirable and are characterized by moments of inertia that are too small for the size of the club head resulting in a feeling of club head instability when a golf ball is stuck a significant distance from the geometric center of the face 18. Therefore, in one embodiment of the present invention the CG angle is at least 14 degrees, while in a further embodiment the CG angle is at least 16 degrees. Further, in another series of embodiments the CG angle is no more than 34 degrees, while in a further embodiment it is no more than 30 degrees, and in yet another embodiment the CG angle is no more than 26 degrees, and in an even further embodiment the CG angle is no more than 22 degrees. In one particular embodiment the CG angle is 14-18 degrees.

Obviously the Delta2 value is going to increase in an oversized club head 2 compared to a conforming 430-460 cc club head, however preferential performance of the present oversized club head 2 was unexpectedly found when the CG angle was relatively consistent with that of a conventional conforming club head despite the increases in volume, club head dimensions, and/or face area. In one particular embodiment the Delta2 value is at least 38 mm, while in another embodiment the Delta2 value is at least 40 mm, and in yet an even further embodiment the Delta2 value is at least 42 mm. Another series of embodiments recognizes the limits of Delta2 values that promote the goals, thus in one embodiment the Delta2 value is no more than 54 mm, while in another embodiment it is no more than 50 mm, and in yet another embodiment the Delta2 value is no more than 46 mm. In another embodiment preferred playability and ease of returning the club head to square are achieved in an oversize club head 2 when the Delta2 value is no more than 310% of the head depth Dch, and no more than 30% in another embodiment, and no more than 29% in an even further embodiment. However, the objectives are further enhanced in a series of embodiments in which the Delta2 value is at least 24% of the head depth Dch, and at least 26% in a further embodiment, and at least 28% in an even further embodiment. These objectives are also achieved in an embodiment in which a volume-to-Delta2 ratio of the volume to the Delta2 value is at least 17 cc/mm, which in another embodiment is at least 18 cc/mm, and in yet another embodiment is at least 19 cc/mm. Further, another embodiment recognizes the diminishing returns of the volume-to-Delta2 ratio and has a volume-to-Delta2 ratio of 17-23 cc/mm, while in a further embodiment the ratio is 18-22 cc/mm, and in an even further embodiment the ratio is 19-21 cc/mm. Further, another embodiment that unexpectedly achieves the desired objectives is characterized by a Delta ratio of Delta2 to Delta1 that is no more than 4.5, while in another embodiment the Delta ratio is no more than 4.0, and in yet a further embodiment the Delta ratio is no more than 3.5, while in yet another embodiment the Delta ratio is no more than 3.0. Another series of embodiments recognize a preferential floor of the Delta ratio whereby the Delta ratio is at least 1.5, while in a further embodiment the Delta ratio is at least 2.0, and in yet another embodiment the Delta ratio is at least 2.5. In yet another embodiment, preferred performance is achieve when the elevation of the shaft-axis-intersection point, above the ground plane 17, is greater than zero and no more than 12.5 mm, while in a further embodiment it is 2.5-10 mm, and in yet another embodiment it is 5-10 mm.

Similarly, another embodiment exhibiting preferential performance was unexpectedly found when a depth-to-Zup ratio of the head depth Dch to the Zup value was relatively consistent with that of a conventional conforming club head despite the increases in volume, club head dimensions, and/or face area. In one such embodiment the depth-to-Zup ratio is at least 3.50, while in another embodiment it is at least 3.75, at least 4.00 in a further embodiment, and at least 4.25 in an even further embodiment. In one particularly effective embodiment has a depth-to-Zup ratio of 3.50-5.25, while the range is 3.75-5.00 in another embodiment, 4.00-4.75 in still another embodiment, and 4.25-4.50 in yet a further embodiment.

Even further, it was determined that an unexpected ratio of the hosel axis moment of inertia (Ih) to the Delta1 value, referred to as the hosel axis ratio, is a good indicator of the feel and difficulty a novice golfer is going to have controlling the oversized club head 2 throughout the swing, while avoiding the previously explained unstable feeling associated with mis-hits struck far from the geometric center of the face 18. In one such embodiment the hosel axis ratio is no more than 90 kg·mm, while in a further embodiment the hosel axis ratio is no more than 80 kg·mm, and in yet another embodiment the hosel axis ratio is no more than 70 kg·mm, and in an even further embodiment the hosel axis ratio is no more than 65 kg·mm. Another series of embodiments recognize a preferential floor of the hosel axis ratio whereby it is at least 40 kg·mm, while in another embodiment it is at least 50 kg·mm, and in yet another embodiment it is at least 55 kg·mm, while in still a further embodiment it is at least 57.5 kg·mm. In one particular embodiment the hosel axis moment of inertia (Ih) is at least 900 kg·mm$^2$, while in another embodiment it is at least 920 kg·mm$^2$, while in yet another embodiment it is no more than 1050 kg·mm$^2$, and in an even further embodiment it is no more than 1000 kg·mm$^2$. Likewise, in another preferred series of embodiments an Ih-to-Zup ratio of the hosel axis moment of inertia (Ih) to the Zup value is at least 25 kg·mm, while in a further embodiment it is at least 26 kg·mm, and in yet another embodiment it is at least 27 kg·mm. In an even further series of embodiments the Ih-to-Zup ratio is no more than 35 kg·mm, while in another embodiment it is no more than 32 kg·mm, and in yet a further embodiment it is no more than 29 kg·mm. The disclosed ratios and ranges unexpectedly produce preferred launch conditions while not sacrificing playability and feel of the oversized golf club in the hands of a novice golfer.

An extreme forward CG location in an oversized club head 2 often results in a feeling of club head instability upon mis-hits struck far from the ideal impact point 23, due in part to moments of inertia that are too small for the size of the club head. While a degree of club head twisting is sensed by a novice golfer using a conforming golf club head when a golf ball is struck at the extreme toe or heel portion of the face, it is significantly more noticeable when using an oversized club head 2, particularly one shots struck high on the face or low on the face, which is virtually unperceivable to a novice golfer using a non-oversized club head. As such, another family of embodiments reduce this feeling with additional volumetric ratios created with reference to one or more of the other moment of inertial values, specifically Izz, Iyy, Ixx, and Ih. In one such embodiment a volume-to-Ixx ratio of the volume to the Ixx value is at least 2.1 cc/(kg·mm$^2$), whereas in a further embodiment the ratio is at least 2.25 cc/(kg·mm$^2$). Additional embodiments introduce limits to the upper extreme of this ratio to limit diminishing returns such as one particular embodiment in which the volume-to-Ixx ratio is no more than 3.0 cc/(kg·mm$^2$), and in an even further embodiment the ratio is no more than 2.75 cc/(kg·mm$^2$). In another such embodiment a volume-to-Izz ratio of the volume to the Izz value is at least 1.3 cc/(kg·mm$^2$), whereas in a further embodiment the ratio is at least 1.5 cc/(kg·mm$^2$). Additional embodiments introduce limits to the upper extreme of this ratio to limit diminishing returns such as one particular embodiment in which the volume-to-Izz ratio is no more than 2.1 cc/(kg·mm$^2$), and in an even further embodiment the ratio is no more than 1.9 cc/(kg·mm$^2$). Still further, in another such embodiment a volume-to-Ih ratio of the volume to the Ih value is at least 0.8 cc/(kg·mm$^2$), whereas in a further embodiment the ratio is at least 0.9 cc/(kg·mm$^2$). Additional embodiments introduce limits to the upper extreme of this ratio to limit diminishing returns such as one particular embodiment in which the volume-to-Ih ratio is no more than 1.2 cc/(kg·mm$^2$), and in an even further embodiment the ratio is no more than 1.0 cc/(kg·mm$^2$). Still even further, in another such embodiment a volume-to-Iyy ratio of the volume to the Iyy value is at least 1.7 cc/(kg·mm$^2$), whereas in a further embodiment the ratio is at least 1.9 cc/(kg·mm$^2$). Additional embodiments introduce limits to the upper extreme of this ratio to limit diminishing returns such as one particular embodiment in which the volume-to-Iyy ratio is no more than 2.5 cc/(kg·mm$^2$), and in an even further embodiment the ratio is no more than 2.25 cc/(kg·mm$^2$).

In one particular embodiment the Ixx value is at least 300 kg·mm$^2$, while in a further embodiment the Ixx value is at least 320 kg·mm$^2$, and in yet another embodiment the Ixx value is at least 340 kg·mm$^2$. Another series of embodiments introduces new limits on the Ixx value range to ensure the desired z-axis gear effect is not reduces or negated. For instance, in one embodiment the Ixx value is no more than 425 kg·mm$^2$, while in another embodiment the Ixx value is no more than 400 kg·mm$^2$, and in yet an even further embodiment the Ixx value is no more than 375 kg·mm$^2$. In another particular embodiment Iyy value is at least 400 kg·mm$^2$, while in a further embodiment the Iyy value is at least 425 kg·mm$^2$, and in yet another embodiment the Iyy value is at least 425 kg·mm$^2$. Another series of embodiments introduces new limits on the Iyy value range to promote a natural feeling when the oversized club head 2 is moved throughout the range of motion of a golf swing by a novice golfer. For instance, in one embodiment the Iyy value is no more than 525 kg·mm$^2$, while in another embodiment the Iyy value is no more than 500 kg·mm$^2$, and in yet another embodiment the Iyy value is no more than 475 kg·mm$^2$. In another particular embodiment the Izz value is at least 525 kg·mm$^2$ thereby reducing the feeling of the oversized club head 2 spinning open or closed when mis-hits are struck on the extreme toe or heel size of the oversized face 18, while in a further embodiment the Izz value is at least 550 kg·mm$^2$, and in yet another embodiment the Izz value is at least 575 kg·mm$^2$. Another series of embodiments introduces new limits on the Izz value range so that a novice golfer does not feel as though they need to introduce additional rotation of their hands and the grip to square the face 18 at impact with the golf ball. For instance, in one embodiment the Izz value is no more than 700 kg·mm$^2$, while in another embodiment the Izz value is no more than 650 kg·mm$^2$, and in yet another embodiment the Izz value is no more than 625 kg·mm$^2$. In still a further embodiment preferential feel and performance is found when the Izz value is between about 450 kg·mm$^2$ and about 650 kg·mm$^2$. Still further embodiments of the oversized club head 2 may incorporate any of the ratios and relationships disclosed in U.S. patent application Ser. No. 14/177,094, which is incorporated by reference herein.

Additionally, the location of the CG 50 may be used to further the goal of assisting the novice golfer maneuver the oversized club head 2 throughout the swing and promote the return to the square position at impact with the golf ball. In one such example the CGx value greater than −2.0 mm, while in a further embodiment it is at least 1 mm, while in yet a further embodiment it is at least 3 mm, and in an even further embodiment it is at least 5 mm. However, too much heel biasing of the CG location may negatively influence performance, and may be more perceivable as the Delta2 value increases, therefore in another embodiment the CGx value is no more than 10 mm, while in a further embodiment it is no more than 8 mm, and in yet a further embodiment it is no more than 6 mm. As previously explained, Delta1 is a measure of how far rearward in the club head body 10 the CG is located behind a vertical plane containing the shaft axis 21, further a center face progression CFP is a measure of how far the geometric face center, or ideal impact location 23, is in front of the vertical plane containing the shaft axis 21, and the CGy value is the sum of Delta1 and CFP. As noted with several other variables, the "scaling-up" approach in creating an oversized club head produces an oversized club head that suffers from many deficiencies. Another such deficiency is a large CFP-Delta1 ratio, which is a ratio of the CFP to the Delta1 value, and again, like many of the ratios disclosed herein, is not something ordinarily considered when designing a conforming club head but has been found to contribute to the feel and performance of oversized club heads 2. Therefore, in one such embodiment the CFP-Delta1 ratio is no more than 2.25, while in another embodiment it is no more than 2.00, and no more than 1.75 in yet another embodiment, and no more than 1.50 in an even further embodiment. In another series of embodiments a preferred lower limit of the CFP-Delta1 ratio has been discovered for oversized club heads 2, which in one embodiment is at least 1.00, and is at least 1.25 in a further embodiment. The CFP influences the mass properties of the oversized golf club head 2, but also must achieve a delicate balance with the mass properties to achieve an oversized club head 2 that is easy to control. In one particular embodiment the CGy value is at least 25 mm, while in a further embodiment it is at least 30 mm, while in yet an even further embodiment it is at least 32 mm, and in still another embodiment it is at least 34 mm. In another series of embodiments the CGy value is no more than 50 mm in one embodiment, while being no more than 40 mm in another embodiment, no more than 38 mm in another embodiment, and no more than 36 mm in yet another embodiment. In another embodiment the CGz value is no more than 0 mm, while in a further embodiment the CGz value is no more than −2.0 mm, in yet another embodiment it is no more than −4.0 mm, and in an even further embodiment it is no more than −6.0. Another series of embodiments balances how low a projected CG point should be in an oversized club head 2 having a tall face height Hss by ensuring the CGz value is no less than −24 mm, while in a further embodiment it is no less than −20.0 mm, in yet a further embodiment it is no less than −16.0 mm, and in still another embodiment it is no less than −12.0 mm. Conventional oversized club heads have struggled to obtain GCz values of 0 or less. In yet another embodiment the oversized golf club head 2 may include any of the ratios, products, relationships, and/or embodiments found in U.S. patent application Ser. Nos. 13/789,441, 13/839,727, and 15/146,581, which are incorporated by reference herein. In another embodiment the Zup value is no more than 35 mm, while in a further embodiment it is no more than 33 mm, and in yet a further embodiment it is no more than 30 mm. A further series of embodiments tailor the Zup value to achieve a desired z-axis gear effect by establishing a floor to the Zup range, with one embodiment having a Zup of at least 10 mm, while another embodiment has a Zup of at least 15 mm, and yet another embodiment has a Zup of at least 20 mm. In one particular embodiment having preferred launch characteristics has an elevation of the shaft-axis-intersection point above the ground plane 17 that is greater than zero and no more than 12.5 mm.

An example of an embodiment of the oversized club head 2 is seen in Tables 3 and 4 below.

TABLE 3

| | Vol. (cc) | Weight (grams) | Face Height (mm) | Face Width (mm) | Bulge (mm) | Roll (mm) | Head Height (mm) | Head Depth (mm) |
|---|---|---|---|---|---|---|---|---|
| Example 1 | 802 | 202.5 | 65.7 | 98.6 | 368 | 368 | 75.8 | 142.1 |

TABLE 4

| | CGx mm | CGz mm | Zup mm | Delta 1 mm | Delta 2 mm | CG angle deg's | Ixx kg · mm$^2$ | Iyy kg · mm$^2$ | Izz kg · mm$^2$ | Ih kg . mm$^2$ |
|---|---|---|---|---|---|---|---|---|---|---|
| Example 1 | 3.5 | −2.7 | 33.3 | 14.9 | 42.1 | 19.4 | 346 | 459 | 591 | 921 |

Another important influencer of z-axis gear effect is the curvature of the face 18. Bulge and roll are golf club face 18 properties that are generally used to compensate for gear effect. The term "bulge" on a golf club head 2 refers to the rounded properties of the golf club face 18 from the heel 26 to the toe 28 of the club face 18. The term "roll" on a golf club head 2 refers to the rounded properties of the golf club face 18 from the crown 12 to the sole 14 of the club face 18. The roll radius R refers to the radius of a circle having an arc that corresponds to the arc along the z-axis of the ball striking club face 18. Curvature is the inverse of radius and is defined as 1/R, where R is the radius of the circle having an arc corresponding to the arc along the z-axis of the ball striking club face 18. As an example, a roll with a curvature of 0.0050 $mm^{-1}$ corresponds to a roll with a radius of 200 mm. The process for measure bulge and roll is disclosed later herein.

The roll of the oversized golf club head 2 can contribute to the amount of backspin that the golf ball acquires when it is struck by the oversized club head 2 at a point on the club face 18 either above or below the projected CG of the oversized club head 2. For example, shots struck at a point on the club face 18 above the projected CG have less backspin than shots struck at or below the projected CG. If the roll radius of the oversized club head 2 is decreased, there will be a decreased variance between backspin for shots struck above the projected CG of the golf club face 18 and shots struck below the projected CG of the ball striking club face 18. In certain embodiments of the disclosed oversized golf club heads 2, the roll radius is relatively large (e.g., greater than or equal to 300 mm). Thus, for embodiments of the disclosed oversized golf club heads 2 in which the projected CG on the ball striking club face is lower than the geometric center 23, the higher roll radius operates to enhance the z-axis gear effect when a ball is struck at the geometric center, thereby reducing the amount of backspin on the golf ball and helping the golf ball obtain the desired high launch, low spin trajectory.

Taking advantage of the roll to influence z-axis gear effect is particularly important in oversize club heads 2 having large head heights, Hch, and face heights, Hss. One such embodiment has a roll-to-FH ratio of the roll (mm) to the face height Hss (mm) of at least 5.0, thereby promoting preferred z-axis gear effect, launch conditions, and trajectory. In a further embodiment the roll-to-FH ratio is at least 5.25, while in an even further embodiment it is at least 5.5. Another series of embodiments discovers that an upper limit of this roll-to-FH ratio promotes preferred z-axis gear effect, launch conditions, and trajectory associated with oversized club heads 2 having large face heights Hss. For instance, in one embodiment the roll-to-FH ratio is no more than 6.5, while in another embodiment the roll-to-FH ratio is no more than 6.25, and in yet a further embodiment the roll-to-FH ratio is no more than 6.0. Prior oversized club heads, as seen in Table 1, often have a roll similar to that of conforming club heads having a volume of 460 cc or less, which can be visually distracting to a golfer when applied to an oversized club head 2 and result in poor performance due to excessive spin and poor trajectory. In fact, this ratio for the club heads of Table 1 is less than 3.75.

Those in the golf industry are more accustomed to thinking of gear effect as being associated with the bulge and imparting corrective spin to a golf ball. Again, just as will roll, applying conventional bulge curvature to an oversized club head 2 having a large face width, Wss, will likely be perceived as unappealing to the eye, and negatively impact performance. Thus, in some embodiments the bulge is tailored to control such corrective spin and ensure that too much corrective spin is not imparted to the ball in association with off-center impacts. One such embodiment has a bulge-to-FW ratio of the bulge (mm) to the face width Wss (mm) of at least 3.4, thereby promoting preferred gear effect, launch conditions, and corrective spin. In a further embodiment the bulge-to-FW ratio is at least 3.5, while in an even further embodiment it is at least 3.6. Another series of embodiments discovers that an upper limit of this bulge-to-FW ratio promotes preferred gear effect, launch conditions, and corrective spin associated with oversized club heads 2 having large face widths, Wss. For instance, in one embodiment the bulge-to-FW ratio is no more than 6.0, while in another embodiment the bulge-to-FW ratio is no more than 5.0, and in yet a further embodiment the bulge-to-FW ratio is no more than 4.25. Prior oversized club heads, as seen in Table 1, often have a bulge similar to that of conforming club heads having a volume of 460 cc or less, which can be distracting to a golfer when applied to an oversized club head 2 and result in poor performance due to excessive spin. In fact, this ratio for the club heads of Table 1 is less than 2.65.

As previously mentioned, the Delta1 values of the oversized club heads in Tables 1 and 2 are not ideal. In one present embodiment, preferred z-axis gear effect and trajectory are achieved in an oversize club head 2 when the Delta1 value is at least 15% of the face height Hss, while in a further embodiment the Delta1 value is at least 18% of the face height Hss, and in yet a further embodiment the Delta1 value is at least 20% of the face height Hss. In a further series of embodiments preferred performance is achieved when the Delta1 value lies within a tight range of relationships to face height Hss. For instance in one embodiment the Delta1 value is no more than 25% of the face height Hss, while in a further embodiment the Delta1 value is no more than 23% of the face height Hss. Similarly, in another embodiment the Delta2 value is at least 64% of the face height Hss, while in a further embodiment it is 64-70% of the face height Hss, and in yet an even further embodiment it is 64-68% of the face height Hss.

As with virtually every aspect of the disclosed oversized club head 2 embodiments, simply scaling up a conforming 460 cc club head to create an oversized club head 2 will not result in the best performing oversized club head 2 or one that is user friendly. In fact doing so is likely to produce a face height that so large that it is aesthetically undesirable, may suffer from durability issues, and may not increase the club head performance. An exceedingly tall face increases the likelihood of a novice golfer striking the ball below the geometric center of the face, negatively influencing the launch conditions. Thus, in one embodiment the face height Hss does not increase in proportion to the increased face area and/or volume, and has a face height Hss of no more than 70 mm. While in another embodiment the face height Hss is at least 62.5 mm, and in yet a further embodiment the face height Hss is at least 65 mm. Further embodiments have a face height Hss that is 63-70 mm, 64-68 mm, and 65-67 mm. Similarly, in one embodiment the face width Wss is at least 93 mm, with the face width Wss being at least 95 mm in another embodiment, at least 97.5 mm in a third embodiment, and at least 100 mm in yet another embodiment. Further embodiments recognize diminishing returns on face width Wss and have a face width Wss that is no more than 110 mm, no more than 105 mm, and no more than 100 mm, thereby producing a series of embodiments having preferential ranges that capitalize on increased volume and face area without introducing excessive drag, to produce an oversized club head 2 that is playable by a novice golfer, possesses good feel and stability, and is aesthetically pleasing. In a further embodiment the oversized club head 2 is defined as one having a center face height, or the vertical height of the ideal impact point 23 above the ground plane 17, as seen in FIG. 7, that is at least 32 mm, while in a further embodiment the center face height is at least 34 mm, and in an even further embodiment it is at least 36 mm. However, in another series of embodiment it was discovered that the center face height must be controlled to minimize the risk of a novice golfer striking the golf ball below the ideal impact point 23. Thus, in one such embodiment the center face height is no more than 46 mm, while in a further embodiment the center face height is no more than 42 mm.

In one embodiment the head weight of the oversized club head 2, including any weights, moveable or otherwise, and loft/lie adjustment sleeves/systems, is less than 210 grams. Often oversize club heads are in excess of 275 grams and therefore the associated golf club would need to be unusually short to provide a swing weight that feels comfortable to most golfers, as disclosed later in detail. Achieving the desired lightweight oversized golf club head 2 is no easy task, particularly when trying to achieve any of the other performance enhancing relationships and/or constructions disclosed herein. In another embodiment the head weight is less than 200 grams, while in a further embodiment the head weight is less than 190 grams. A particularly effective series of embodiments has identified a synergistic balance of the pros and cons of oversized lightweight club heads 2 in the range of 185-205 grams, while in an even further embodiment the head weight is 195-205 grams, and in an even further embodiment the head weight is 190-200 grams. One particular embodiment includes an adjustment system such as that disclosed in U.S. patent application Ser. Nos. 14/871,789, 14/939,648, 14/876,694, 14/587,573, 14/565,311, the entire contents of which are herein incorporated by reference.

In fact, another embodiment recognizes a unique relationship of the volume to the head weight that aids in defining a lightweight oversized golf club head 2 that feels natural to a golfer, inspires confidence, and yet is easy to control and stable throughout a golf swing, particularly when combined with one or more of the other performance enhancing relationships and/or constructions disclosed herein. In a first such embodiment a volume-to-head-weight ratio of the volume to the head weight is at least 3.5 cc/gram, which is over 50% greater than such a ratio for a traditional 460 cc and 200 gram conforming club head, and over 10% greater than competitive club heads A and B seen in Tables 1 and 2. In another embodiment the volume-to-head-weight ratio is at least 3.75 cc/gram. However, as with the previously discussed oversized club head 2 volume and weight, this volume-to-head-weight ratio cannot simply be maximized or minimized to continue to increase performance. Rather, a particularly effective series of embodiments has identified a synergistic balance of the pros and cons of oversized lightweight club heads 2 in the range of volume-to-head-weight ratios from 3.5-4.5 cc/gram, while in an even further embodiment the range is 3.75-4.25 cc/gram.

The method used to obtain the bulge and roll values in the present disclosure is the optical comparator method. The club face includes a series of score lines which traverse the width of the club face generally along the X-axis of the club head. In the optical comparator method, the club head is mounted face down and generally horizontal on a V-block mounted on an optical comparator. The club head is oriented such that the score lines are generally parallel with the X-axis of the optical comparator. Measurements are then taken at the geometric center point on the club face. Further measurements are then taken 20 millimeters away from the geometric center point of the club face on either side of the geometric center point 5*a* and along the X-axis of the club head, and 30 millimeters away from the geometric center point of the club face on either side of the center point and along the X-axis of the club head. An arc is fit through these five measure points, for example by using the radius function on the machine. This arc corresponds to the circumference of a circle with a given radius. This measurement of radius is what is meant by the bulge radius. In one embodiment of the present invention the bulge is at least 325 mm, while in a further embodiment it is at least 350 mm. Further, additional embodiments ensure the bulge does not become too large and negatively influence performance by having a bulge that is no more than 400 mm, and one particularly effective embodiment has a bulge that is 325-375 mm.

To measure the roll, the club head is rotated by 90 degrees such that the Z-axis of the club head is generally parallel to the X-axis of the machine. Measurements are taken at the geometric center point of the club face. Further measurements are then taken 15 millimeters away from the geometric center point and along the Z-axis of the club face on either side of the center point, and 20 millimeters away from the geometric center point and along the Z-axis of the club face on either side of the geometric center point. An arc is fit through these five measurement points. This arc corresponds to the circumference of a circle with a given radius. This measurement of radius is what is meant by the roll radius. In one embodiment of the present invention the roll is at least 325 mm, while in a further embodiment it is at least 350 mm. Further, additional embodiments ensure the roll does not become too large and negatively influence performance by having a roll that is no more than 400 mm, and one particularly effective embodiment has a roll that is 325-375 mm.

As previously expressed, aerodynamic drag associated with an oversized golf club head 2 is significant compared to a smaller conforming golf club head, to the point that it not only may reduce the swing speed but also impacts a golfers ability to consistently return the club face 18 to the square position at the time of impact with the golf ball. Therefore, the oversized club head 2 may incorporate any of the aerodynamic features, contours, and elements described in U.S. patent application Ser. Nos. 15/012,880, 14/789,263, 15/002,471, 14/330,205, 14/629,160, and others disclosed herein, which are incorporated herein by reference. Additionally, as explained in detail in U.S. patent application Ser. No. 15/255,638, which is incorporated herein by reference, preferential aerodynamic shaping of the body 10, and particularly the crown 12, tend to result in a high center of gravity 50 especially in an oversized club head, and thus a large Zup dimension. Further, as explained above, traditional oversized club heads have produced a moment of inertia about the golf club head CG z-axis 85, Izz, that is less than ideal. An embodiment of the present invention unexpectedly discovered that a unique relationship of the Zup value relative to ½ of the maximum club head height Hch provides a preferred balance of aerodynamic performance, launch characteristic performance, forgiveness, and feel, provided a sufficient Izz is maintained. One embodiment achieves a differential between the Zup value and ½ the value of the maximum club head height Hch that is less than −1.5 mm, while in another embodiment the differential is less than −3.0 mm, and in still a further embodiment the differential is less than −4.5 mm. The preferred balance of aerodynamic performance, launch characteristic performance, forgiveness, and feel, are further provided in embodiments with sufficient Izz; for example, one embodiment has an Izz value of at least 550 kg·mm$^2$ and achieves a differential between the Zup value and ½ the value of the maximum club head height Hch that is less than −4.0 mm. With reference to the oversized club head 2 embodiment of Tables 3 and 4, the Zup value is 33.3 mm, while half the club head height Hch is 0.5×75.8, which is 37.9 mm, and thus the differential is −4.6 mm, while obtaining an Izz value of 591 kg·mm$^2$. In a further embodiment the Izz value is at least 575 kg·mm$^2$ and achieves a differential between the Zup value and ½ the value of the maximum club head height Hch that is less than −5.0 mm; while in yet another embodiment the Izz value is at least 600 kg·mm$^2$ and achieves a differential between the Zup value and ½ the value of the maximum club head height Hch that is less than −6.0 mm. Another series of embodiments identifies a floor for the differential and a ceiling for the Izz value that lead to desirable improvements and avoid diminishing returns, here the differential between the Zup value and ½ the value of the maximum club head height Hch that is greater than −12.0 mm and the Izz value is no more than 700 kg·mm$^2$, while in a further embodiment the differential is greater than −10 mm and the Izz value is no more than 650 kg·mm$^2$.

Preferably, the overall frequency of the oversized golf club head 2, i.e., the average of the first mode frequencies of the crown 12, sole 14, and skirt 16 portions of the oversized club head 2, generated upon impact with a golf ball is greater than 3,000 Hz. Frequencies above 3,000 Hz provide a user of the oversized golf club with an enhanced feel and satisfactory auditory feedback, while in some embodiments frequencies above 3,200 Hz are obtained and preferred. However, an oversized golf club head 2 having relatively thin walls and/or a thin bulbous crown 12, can reduce the first mode vibration frequencies to undesirable levels. The oversized club head 2 may incorporate a plurality of ribs positioned on an internal surface to achieve the desired frequency, such as, but not limited to, those disclosed in U.S. patent application Ser. Nos. 14/525,540 and 14/284,813, which are incorporated herein by reference. In another embodiment the oversized club head 2 includes contrast enhancing features including any of those disclosed in U.S. patent application Ser. Nos. 14/302,817 and 14/638,829, which are incorporated herein by reference. In still a further embodiment the oversized club head 2 has a surface covering including any of those disclosed in U.S. patent application Ser. No. 14/803,735, which is incorporated herein by reference.

Logically the oversized club head 2 is attached to a shaft, often via an adjustability sleeve, with the shaft having a grip, to create an oversized golf club having a club length. The club length is measured according to the current edition of the United States Golf Association's "Procedure for Measuring the Length of Golf Clubs (Excluding Putters)." One skilled in the art is familiar with U.S. Pat. No. 1,953,916 titled "Apparatus for Measuring Moments of Golf Clubs and the Like," which discloses an instrument for measuring the amount of torque the weight of an object exerts about a pivoting fulcrum located 14" from the end of the object. This device is particularly well known in the field of golf equipment. In one embodiment, the oversized golf club has a club length of at least 43.5" and produces a torque of 5500-7000 gram*inches about a fulcrum located 14" from the butt end of the grip, which is easily measured using such a swing weight apparatus and roughly equates to a swing weight of C3 through E7 on what is commonly referred to as the "Lorythmic" scale. In another embodiment, the oversized golf club has a club length of at least 43.5" and produces a torque of 6050-6500 gram*inches about a fulcrum located 14" from the butt end of the grip, which is easily measured using such a swing weight apparatus and roughly equates to a swing weight of D0 through D9 on the "Lorythmic" scale, while in a further embodiment the club length is at least 44.0". In still a further embodiment the oversized golf club has a club length of at least 44.0" and produces a torque of 6050-6300 gram*inches about a fulcrum located 14" from the butt end of the grip, which is easily measured using such a swing weight apparatus and roughly equates to a swing weight of D0 through D5 on the "Lorythmic" scale.

Achieving a resistance to squaring an oversized club head 2 during the golf swing that is comfortable to the novice golfer, and feels like a conventional non-oversized golf club, and avoids a sense of instability during off-center impacts, is important and not easily achieved. This is achieved in part via establishing a proper center of gravity location to result in the desired magnitude of the Delta1 and Delta2 values, CG angle, moments of inertia, and the associated ratios, relationships, and club head mass property characteristics influenced by these variables, but they must take into account the significance that the overall bulk of the oversized club head 2 also plays in the increase in aerodynamic drag associated with large face area club heads, large face height Hss and/or widths Wss, large club head depths Dch, and/or large club head heights Hch. The disclosed relationships and ratios accomplish this delicate balance were not found through mere experimentation, as most of the disclosed relationships and ratios are not even considerations in convention non-oversized club head design, rather they were discovered to be surprisingly important and critical in the design of an oversized golf club head 2 and yielded unexpected results.

Discretionary Mass

Desired club head mass moments of inertia, club head center-of-gravity locations, and other mass properties of a golf club head can be attained by distributing club head mass to particular locations. Discretionary mass generally refers to the mass of material that can be removed from various structures providing mass that can be distributed elsewhere for tuning one or more mass moments of inertia and/or locating the club head center-of-gravity.

Club head walls provide one source of discretionary mass, as does lightweight non-metallic components, such as crown inserts, face inserts, sole inserts, and composite head components, as disclosed in U.S. patent application Ser. Nos. 14/734,181, 14/516,503, 14/717,864, 15/233,805, 15/087,002, and 62/205,601, the entire contents of which are incorporated herein by reference. A reduction in wall thickness reduces the wall mass and provides mass that can be distributed elsewhere. For example, in some implementations, one or more walls of the oversized club head 2 can have a thickness (constant or average) less than approximately 0.7 mm, such as between about 0.55 mm and about 0.65 mm. In some embodiments, the crown 12 can have a thickness (constant or average) of approximately 0.60 mm or approximately 0.65 mm throughout more than about 70% of the crown, with the remaining portion of the crown 12 having a thickness (constant or average) of approximately 0.76 mm or approximately 0.80 mm. In addition, the skirt 16 can have a similar thickness and the wall of the sole 14 can have a thickness of between approximately 0.6 mm and approximately 2.0 mm. In contrast, many conventional club heads have crown wall thicknesses in excess of about 0.75 mm, and some in excess of about 0.85 mm.

Thin walls, particularly a thin crown 12, provide significant discretionary mass compared to conventional club heads. For example, a club head 2 made from an alloy of steel can achieve about 4 grams of discretionary mass for each 0.1 mm reduction in average crown thickness. Similarly, a club head 2 made from an alloy of titanium can achieve about 2.5 grams of discretionary mass for each 0.1 mm reduction in average crown thickness. Discretionary mass achieved using a thin crown 12, e.g., less than about 0.65 mm, can be used to tune one or more mass moments of inertia and/or center-of-gravity location.

To achieve a thin wall on the club head body 10, such as a thin crown 12, a club head body 10 can be formed from an alloy of steel or an alloy of titanium. Thin wall investment casting, such as gravity casting in air for alloys of steel and centrifugal casting in a vacuum chamber for alloys of titanium, provides one method of manufacturing a club head body with one or more thin walls.

Weights and Weight Ports and Weight Channels

Various approaches can be used for positioning discretionary mass within a golf club head 2. For example, many club heads 2 have integral sole weight pads cast into the head at predetermined locations that can be used to lower, to move forward, to move rearward, or otherwise to adjust the location of the club head's center-of-gravity. Also, epoxy can be added to the interior of the club head through the club head's hosel opening to obtain a desired weight distribution. Alternatively, weights formed of high-density materials can be attached to the sole, skirt, and other parts of a club head, including channels formed within the body, on the body, and/or projecting from the body. With such methods of distributing the discretionary mass, installation is critical because the club head endures significant loads during impact with a golf ball that can dislodge the weight. Accordingly, such weights are usually permanently attached to the club head and are limited to a fixed total mass, which of course, permanently fixes the club head's center-of-gravity and moments of inertia.

Alternatively, the golf club head 2 can define one or more weight ports or channels formed in the body 10 that are configured to receive one or more weights. For example, one or more weight ports can be disposed in the crown 12, skirt 16 and/or sole 14. The weight port and/or channel can have any of a number of various configurations to receive and retain any of a number of weights or weight assemblies, such as described in U.S. patent application Ser. Nos. 14/871,789, 14/939,648, 14/575,745, 14/266,608, 14/509,966, 14/843,605, 14/508,981, 14/861,881, 14/875,554, 14/789,838, 13/956,046, 15/004,509, 15/233,805, 15/087,002, and 62/205,601, and U.S. Pat. Nos. 7,407,447 and 7,419,441, which are incorporated herein by reference.

Coefficient of Restitution and Characteristic Time

Another parameter that contributes to the forgiveness and successful playability and desirable performance of a golf club 2 is the coefficient of restitution (COR) and Characteristic Time (CT) of the golf club head 2. Upon impact with a golf ball, the club head's face 18 deflects and rebounds, thereby imparting energy to the struck golf ball. The club head's coefficient of restitution (COR) is the ratio of the velocity of separation to the velocity of approach. A thin face plate generally will deflect more than a thick face plate. Thus, a properly constructed club with a thin, flexible face plate can impart a higher initial velocity to a golf ball, which is generally desirable, than a club with a thick, rigid face plate. It typically is desirable to incorporate thin walls and a thin face plate into the design of the club head. Thin walls and the incorporation of lightweight materials afford the designers additional leeway in distributing club head mass to achieve desired mass distribution, and a thinner face plate may provide for a relatively higher COR as well as provide more discretionary mass to achieve the desired mass distribution.

Thus, selective use of thin walls is important to a club's performance. However, overly thin walls can adversely affect the club head's durability. Problems also arise from stresses distributed across the club head upon impact with the golf ball, particularly at junctions of club head components, such as the junction of the face plate with other club head components (e.g., the sole, skirt, and crown). One prior solution has been to provide a reinforced periphery about the face plate, such as by welding, in order to withstand the repeated impacts. Another approach to combat stresses at impact is to use one or more ribs extending substantially from the crown to the sole vertically, and in some instances extending from the toe to the heel horizontally, across an inner surface of the face plate. These approaches tend to adversely affect club performance characteristics, e.g., diminishing the size of the sweet spot, and/or inhibiting design flexibility in both mass distribution and the face structure of the club head. Thus, these club heads fail to provide optimal MOI, CG, and/or COR parameters, and as a result, fail to provide much forgiveness for off-center hits for all but the most expert golfers.

In addition to the thickness of the face plate and the walls of the golf club head, the location of the center of gravity also has a significant effect on the COR of a golf club head. For example, a given golf club head having a given CG will have a projected center of gravity or "balance point" or "CG projection" that is determined by an imaginary line passing through the CG and oriented normal to the striking face 18. The location where the imaginary line intersects the striking face 18 is the CG projection, which is typically expressed as a distance above or below the center of the striking face 18. When the CG projection is well above the center of the face, impact efficiency, which is measured by COR, is not maximized. It has been discovered that a club head with a relatively lower CG projection or a CG projection located at or near the ideal impact location on the striking surface of the club face, as described more fully below, improves the impact efficiency of the golf club head as well as initial ball speed. One important ball launch parameter, namely ball spin, is also improved. The CG projection above center face of a golf club head can be measured directly, or it can be calculated from several measurable properties of the club head.

A golf club head Characteristic Time (CT) can be described as a numerical characterization of the flexibility of a golf club head striking face. The CT may also vary at points distant from the center of the striking face, but may not vary greater than approximately 20% of the CT as measured at the center of the striking face. The CT values for the golf club heads described in the present application were calculated based on the method outlined in the USGA "Procedure for Measuring the Flexibility of a Golf Clubhead," Revision 2.0, Mar. 25, 2005, which is incorporated by reference herein in its entirety. Specifically, the method described in the sections entitled "3. Summary of Method," "5. Testing Apparatus Set-up and Preparation," "6. Club Preparation and Mounting," and "7. Club Testing" are exemplary sections that are relevant. Specifically, the characteristic time is the time for the velocity to rise from 5% of a maximum velocity to 95% of the maximum velocity under the test set forth by the USGA as described above.

The coefficient of restitution (COR) of a golf club may be increased by increasing the height Hs, of the striking face 18 and/or by decreasing the thickness of the striking face 18 of a golf club head 2. However, increasing the face height may be considered undesirable because doing so will potentially cause an undesirable change to the mass properties of the golf club and to the golf club's appearance. In another embodiment the performance of the oversized club head 2 is increased with the introduction of a channel, stress reducing feature, or boundary condition feature such as the ones disclosed in U.S. patent application Ser. Nos. 14/868,446, 14/658,267, 14/873,477, 14/939,648, 14/871,789, 14/573,701, and 14/457,883, which are incorporated herein by reference.

Composite Striking Face

In the following description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

As used herein, the singular forms "a," "an," and "the" refer to one or more than one, unless the context clearly dictates otherwise.

As used herein, the term "includes" means "comprises." For example, a device that includes or comprises A and B contains A and B but may optionally contain C or other components other than A and B. A device that includes or comprises A or B may contain A or B or A and B, and optionally one or more other components such as C.

As used herein, the term "composite" or "composite materials" means a fiber-reinforced polymeric material.

Figure 11:
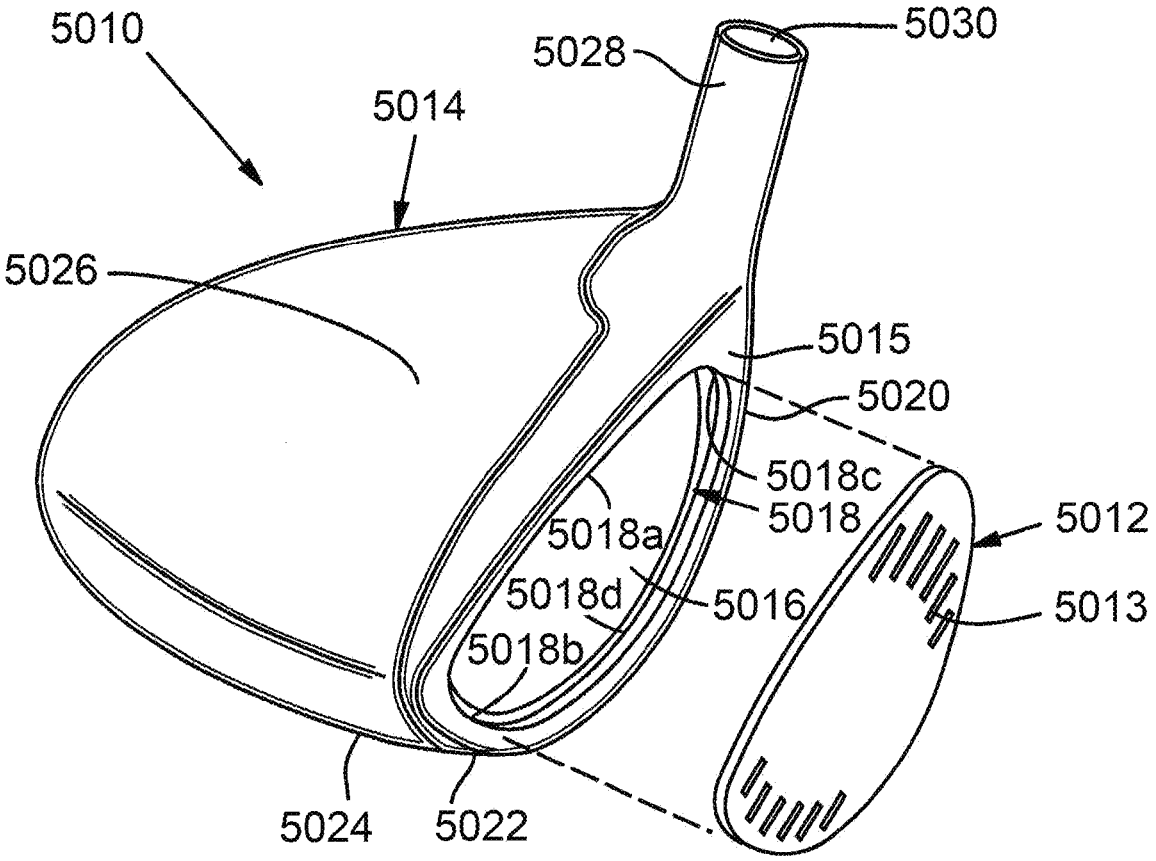
FIG. 11 is a perspective view of a "metal-wood" club-head, showing certain general features pertinent to the instant disclosure.

The main features of an exemplary hollow "metal-wood" club-head 5010 are depicted in FIG. 11. The club-head 5010 comprises a face plate, strike plate, or striking plate 5012 and a body 5014. The face plate 5012 typically is convex, and has an external ("striking") surface (face) 5013. The body 5014 defines a front opening 5016. A face support 5018 is disposed about the front opening 5016 for positioning and holding the face plate 5012 to the body 5014. The body 5014 also has a heel 5020, a toe 5022, a sole 5024, a top or crown 5026, and a hosel 5028. Around the front opening 5016 is a "transition zone" 5015 that extends along the respective forward edges of the heel 5020, the toe 5022, the sole 5024, and the crown 5026. The transition zone 5015 effectively is a transition from the body 5014 to the face plate 5012. The face support 5018 can comprise a lip or rim that extends around the front opening 5016 and is released relative to the transition zone 5015 as shown. The hosel 5028 defines an opening 5030 that receives a distal end of a shaft (not shown). The opening 5016 receives the face plate 5012, which rests upon and is bonded to the face support 5018 and transition zone 5015, thereby enclosing the front opening 5016. The transition zone 5015 can include a sole-lip region 5018*d*, a crown-lip region 5018*a*, a heel-lip region 5018*c*, and a toe-lip region 5018*b*. These portions can be contiguous, as shown, or can be discontinuous, with spaces between them.

In a club-head according to one embodiment, at least a portion of the face plate 5012 is made of a composite including multiple plies or layers of a fibrous material (e.g., graphite, or carbon, fiber) embedded in a cured resin (e.g., epoxy). For example, the face plate 5012 can comprise a composite component (e.g., component 5040 shown in FIGS. 12-14) that has an outer polymeric layer forming the striking surface 5013. Examples of suitable polymers that can be used to form the outer coating, or cap, are described in detail below. Alternatively, the face plate 5012 can have an outer metallic cap forming the external striking surface 5013 of the face plate, as described in U.S. Pat. No. 7,267,620, which is incorporated herein by reference.

An exemplary thickness range of the composite portion of the face plate is 7.0 mm or less. The composite desirably is configured to have a relatively consistent distribution of reinforcement fibers across a cross-section of its thickness to facilitate efficient distribution of impact forces and overall durability. In addition, the thickness of the face plate 5012 can be varied in certain areas to achieve different performance characteristics and/or improve the durability of the club-head. The face plate 5012 can be formed with any of various cross-sectional profiles, depending on the club-head's desired durability and overall performance, by selectively placing multiple strips of composite material in a predetermined manner in a composite lay-up to form a desired profile.

Attaching the face plate 5012 to the support 5018 of the club-head body 5014 may be achieved using an appropriate adhesive (typically an epoxy adhesive or a film adhesive). To prevent peel and delamination failure at the junction of an all-composite face plate with the body of the club-head, the composite face plate can be recessed from or can be substantially flush with the plane of the forward surface of the metal body at the junction. Desirably, the face plate is sufficiently recessed so that the ends of the reinforcing fibers in the composite component are not exposed.

The composite portion of the face plate is made as a lay-up of multiple prepreg plies. For the plies the fiber reinforcement and resin are selected in view of the club-head's desired durability and overall performance. In order to vary the thickness of the lay-up, some of the prepreg plies comprise elongated strips of prepreg material arranged in one or more sets of strips. The strips in each set are arranged in a criss-cross, overlapping pattern so as to add thickness to the composite lay-up in the region where the strips overlap each other, as further described in greater detail below. The strips desirably extend continuously across the finished composite part; that is, the ends of the strips are at the peripheral edge of the finished composite part. In this manner, the longitudinally extending reinforcing fibers of the strips also can extend continuously across the finished composite part such that the ends of the fibers are at the periphery of the part. Consequently, during the curing process, defects can be shifted toward a peripheral sacrificial portion of the composite lay-up, which sacrificial portion subsequently can be removed to provide a finished part with little or no defects. Moreover, the durability of the finished part is increased because the free ends of the fibers are at the periphery of the finished part, away from the impact zone.

In tests involving certain club-head configurations, composite portions formed of prepreg plies having a relatively low fiber areal weight (FAW) have been found to provide superior attributes in several areas, such as impact resistance, durability, and overall club performance. (FAW is the weight of the fiber portion of a given quantity of prepreg, in units of $g/m^2$.) FAW values below 100 $g/m^2$, and more desirably below 70 $g/m^2$, can be particularly effective. A particularly suitable fibrous material for use in making prepreg plies is carbon fiber, as noted. More than one fibrous material can be used. In other embodiments, however, prepreg plies having FAW values above 100 $g/m^2$ may be used.

In particular embodiments, multiple low-FAW prepreg plies can be stacked and still have a relatively uniform distribution of fiber across the thickness of the stacked plies. In contrast, at comparable resin-content (R/C, in units of percent) levels, stacked plies of prepreg materials having a higher FAW tend to have more significant resin-rich regions, particularly at the interfaces of adjacent plies, than stacked plies of low-FAW materials. Resin-rich regions tend to reduce the efficacy of the fiber reinforcement, particularly since the force resulting from golf-ball impact is generally transverse to the orientation of the fibers of the fiber reinforcement.

Figure 14:
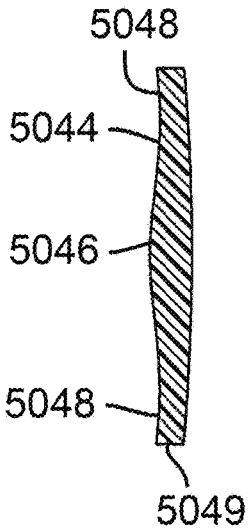
FIG. 14 is a cross-sectional view taken along line 14-14 of FIG. 12.
Figure 12:
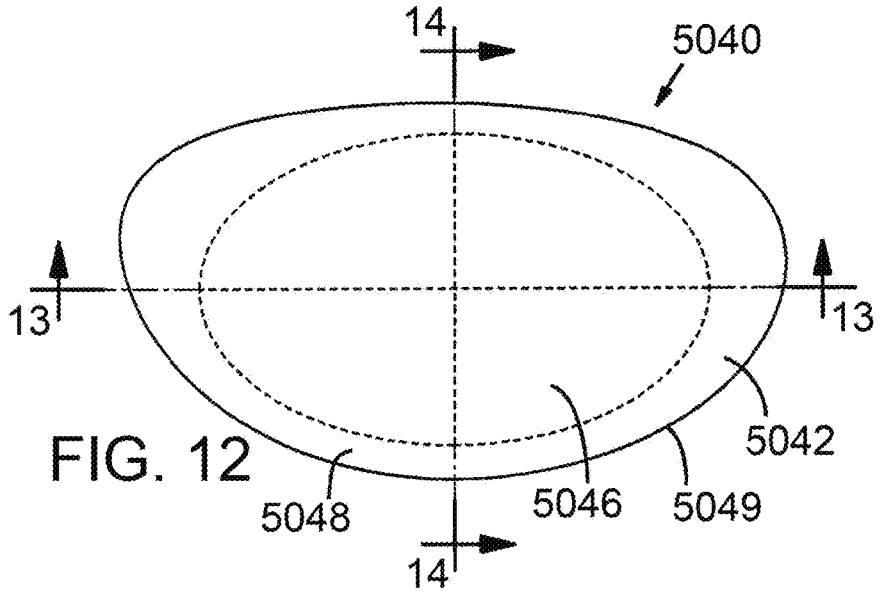
FIG. 12 is a front elevation view of one embodiment of a net-shape composite component used to form the strike plate of a club-head, such as the club-head shown in FIG. 11.
Figure 13:
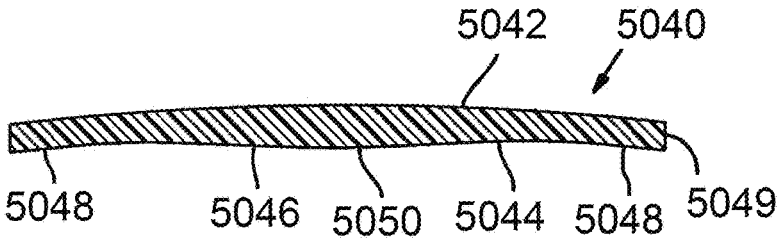
FIG. 13 is a cross-sectional view taken along line 13-13 of FIG. 12.

FIGS. 12-14 show an exemplary embodiment of a finished component 5040 that is fabricated from a plurality of prepreg plies or layers and has a desired shape and size for use as a face plate for a club-head or as part of a face plate for a club head. The composite part 5040 has a front surface 5042 and a rear surface 5044. In this example the composite part has an overall convex shape, a central region 5046 of increased thickness, and a peripheral region 5048 having a relatively reduced thickness extending around the central region. The central region 5046 in the illustrated example is in the form of a projection or cone on the rear surface having its thickest portion at a central point 5050 (FIG. 13) and gradually tapering away from the point in all directions toward the peripheral region 5048. The central point 5050 represents the approximate center of the "sweet spot" (optimal strike zone) of the face plate 5012, but not necessarily the geometric center of the face plate. The thicker central region 5046 adds rigidity to the central area of the face plate 5012, which effectively provides a more consistent deflection across the face plate. In certain embodiments, the central region 5046 has a thickness of about 5 mm to about 7 mm and the peripheral region 5048 has a thickness of about 4 mm to about 5 mm.

Figure 15:
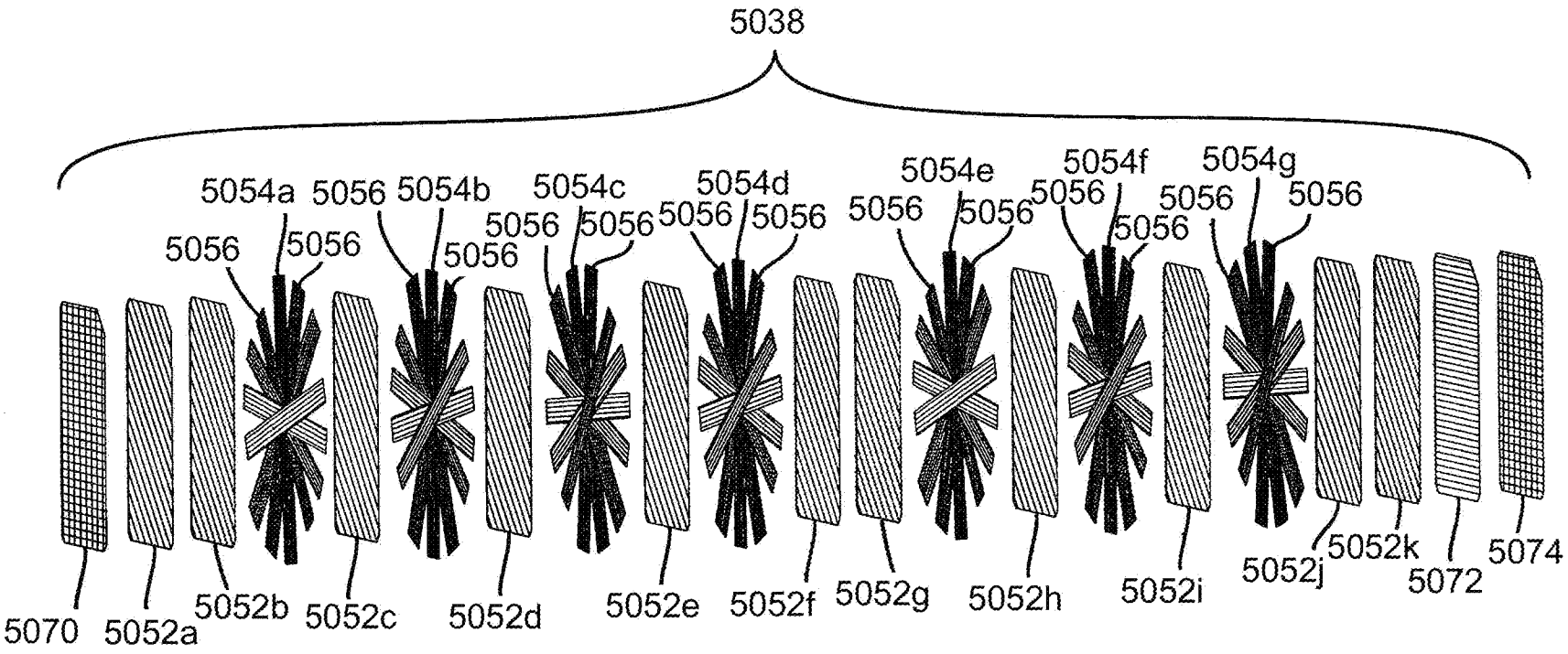
FIG. 15 is an exploded view of one embodiment of a composite lay-up from which the component shown in FIG. 12 can be formed.
Figure 19:
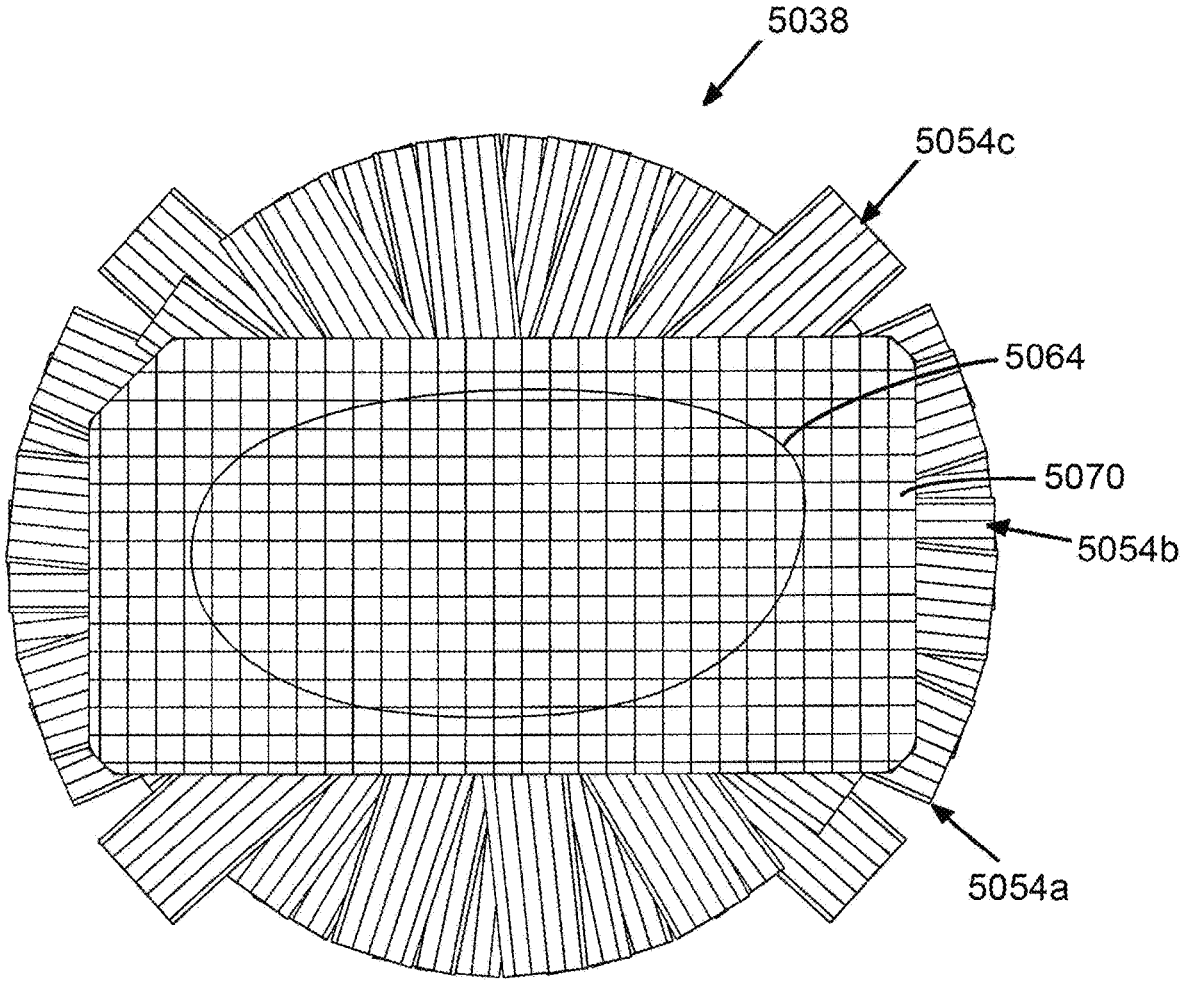
FIG. 19 is a top plan view of the composite lay-up shown in FIG. 15.

In certain embodiments, the composite component 5040 is fabricated by first forming an oversized lay-up of multiple prepreg plies, and then machining a sacrificial portion from the cured lay-up to form the finished part 5040. FIG. 19 is a top plan view of one example of a lay-up 5038 from which the composite component 5040 can be formed. The line 5064 in FIG. 19 represents the outline of the component 5040. Once cured, the portion surrounding the line 5064 can be removed to form the component 5040. FIG. 15 is an exploded view of the lay-up 5038. In the lay-up, each prepreg ply desirably has a prescribed fiber orientation, and the plies are stacked in a prescribed order with respect to fiber orientation.

As shown in FIG. 15, the illustrated lay-up 5038 is comprised of a plurality of sets, or unit-groups, 5052*a*-5052*k* of one or more prepreg plies of substantially uniform thickness and one or more sets, or unit-groups, 5054*a*-5054*g* of individual plies in the form of elongated strips 5056. For purposes of description, each set 5052*a*-5052*k* of one or more plies can be referred to as a composite "panel" and each set 5054*a*-5054*g* can be referred to as a "cluster" of elongated strips. The clusters 5054*a*-5054*g* of elongated strips 5056 are interposed between the panels 5052*a*-5052*k* and serve to increase the thickness of the finished part 5040 at its central region 5046 (FIG. 12). Each panel 5052*a*-5052*k* comprises one or more individual prepreg plies having a desired fiber orientation. The individual plies forming each panel 5052*a*-5052*k* desirably are of sufficient size and shape to form a cured lay-up from which the smaller finished component 5040 can be formed substantially free of defects. The clusters 5054*a*-5054*g* of strips 5056 desirably are individually positioned between and sandwiched by two adjacent panels (i.e., the panels 5052*a*-5052*k* separate the clusters 5054*a*-5054*g* of strips from each other) to facilitate adhesion between the many layers of prepreg material and provide an efficient distribution of fibers across a cross-section of the part.

In particular embodiments, the number of panels 5052*a*-5052*k* can range from 9 to 14 (with eleven panels 5052*a*-5052*k* being used in the illustrated embodiment) and the number of clusters 5054*a*-5054*g* can range from 1 to 12 (with seven clusters 5054*a*-5054*g* being used in the illustrated embodiment). However, in alternative embodiments, the number of panels and clusters can be varied depending on the desired profile and thickness of the part.

The prepreg plies used to form the panels 5052*a*-5052*k* and the clusters 5054*a*-5054*g* desirably comprise carbon fibers impregnated with a suitable resin, such as epoxy. An example carbon fiber is "34-700" carbon fiber (available from Grafil, Sacramento, CA), having a tensile modulus of 234 GPa (34 Msi) and a tensile strength of 4500 MPa (650 Ksi). Another Grafil fiber that can be used is "TR50S" carbon fiber, which has a tensile modulus of 240 GPa (35 Msi) and a tensile strength of 4900 MPa (710 ksi). Suitable epoxy resins are types "301" and "350" (available from Newport Adhesives and Composites, Irvine, CA). An exemplary resin content (R/C) is 40%.

Figure 16:
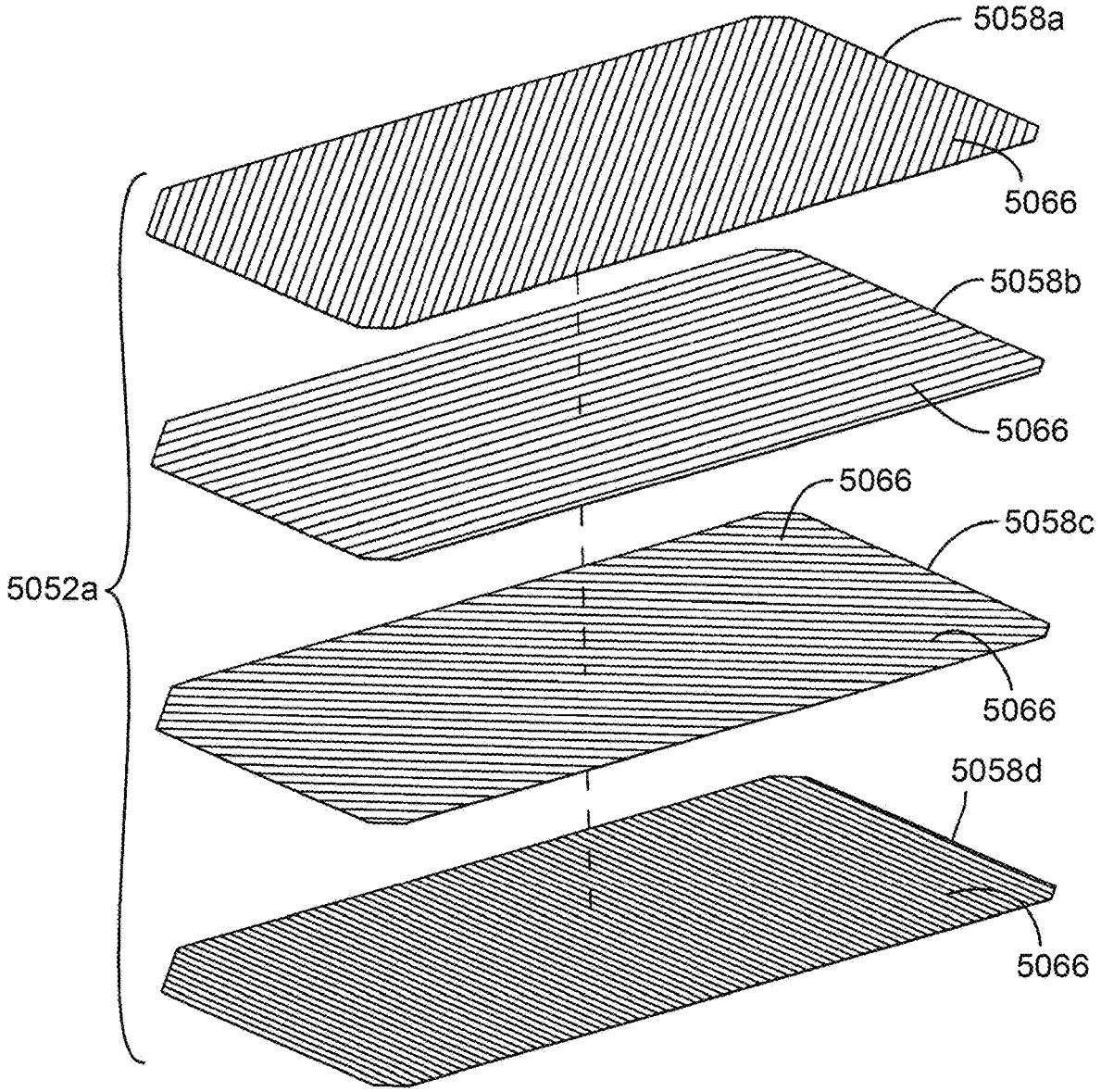
FIG. 16 is an exploded view of a group of prepreg plies of differing fiber orientations that are stacked to form a "quasi-isotropic" composite panel that can be used in the lay-up illustrated in FIG. 15.

FIG. 16 is an exploded view of the first panel 5052*a*. For convenience of reference, the fiber orientation (indicated by lines 5066) of each ply is measured from a horizontal axis of the club-head's face plane to a line that is substantially parallel with the fibers in the ply. As shown in FIG. 16, the panel 5052*a* in the illustrated example comprises a first ply 5058*a* having fibers oriented at +45 degrees, a second ply 5058*b* having fibers oriented at 0 degrees, a third ply 5058*c* having fibers oriented at −45 degrees, and a fourth ply 5058*d* having fibers oriented at 90 degrees. The panel 5052*a* of plies 5058*a*-5058*d* thus forms a "quasi-isotropic" panel of prepreg material. The remaining panels 5052*b*-5052*k* can have the same number of prepreg plies and fiber orientation as set 5052*a*.

The lay-up illustrated in FIG. 15 can further include an "outermost" fiberglass ply 5070 adjacent the first panel 5052*a*, a single carbon-fiber ply 5072 adjacent the eleventh and last panel 5052*k*, and an "innermost" fiberglass ply 5074 adjacent the single ply 5072. The single ply can have a fiber orientation of 90 degrees as shown. The fiberglass plies 5070, 5074 can have fibers oriented at 0 degrees and 90 degrees. The fiberglass plies 5070, 5074 are essentially provided as sacrificial layers that protect the carbon-fiber plies when the cured lay-up is subjected to surface finishing such as sand blasting to smooth the outer surfaces of the part.

Figure 17:
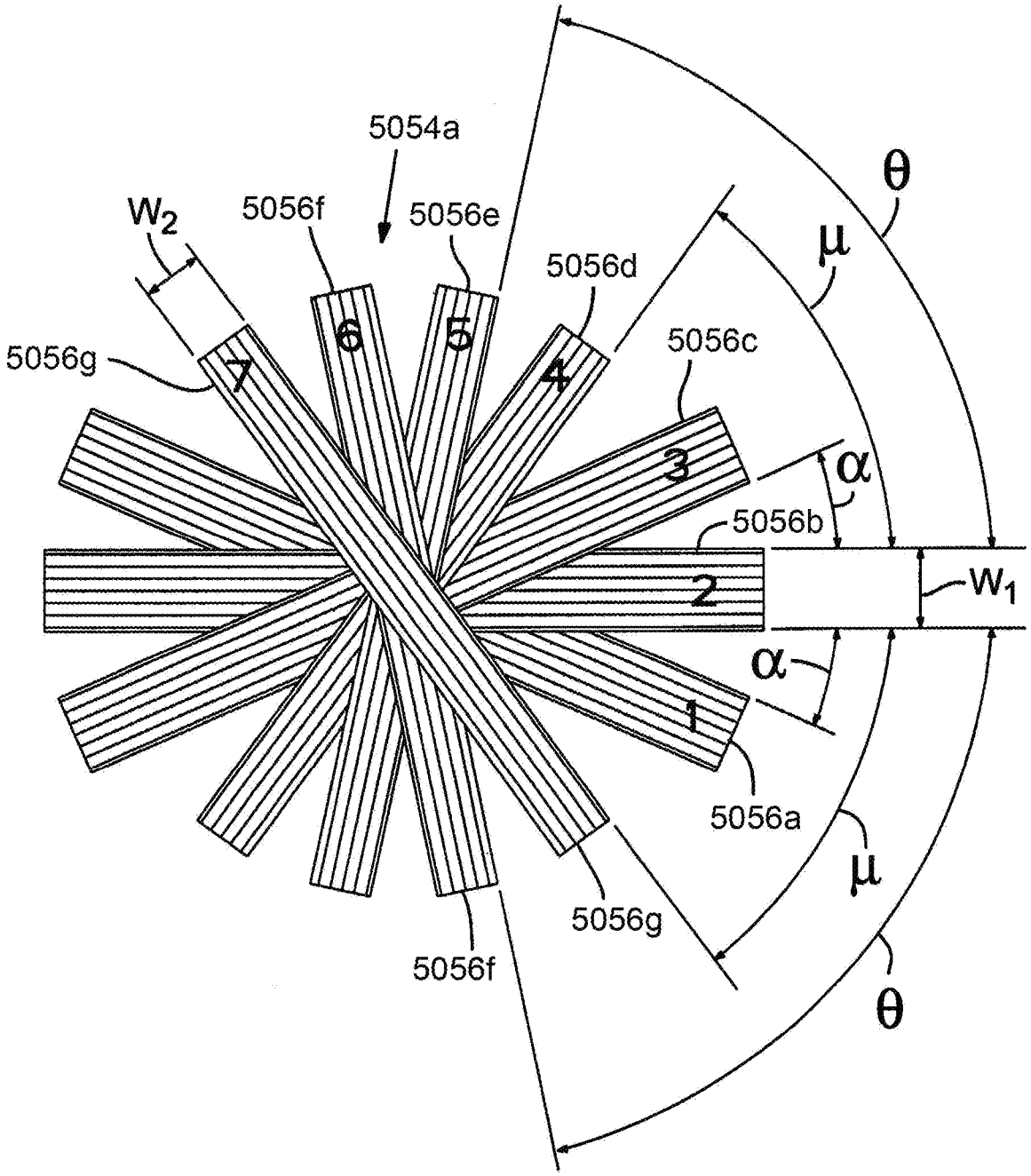
FIG. 17 is a plan view of a group or cluster of elongated prepreg strips that can be used in the lay-up illustrated in FIG. 15.

FIG. 17 is an enlarged plan view of the first cluster 5054*a* of elongated prepreg strips which are arranged with respect to each other so that the cluster has a variable thickness. The cluster 5054*a* in the illustrated example includes a first strip 5056*a*, a second strip 5056*b*, a third strip 5056*c*, a fourth strip 5056*d*, a fifth strip 5056*e*, a sixth strip 5056*f*, and a seventh strip 5056*g*. The strips are stacked in a criss-cross pattern such that the strips overlap each other to define an overlapping region 5060 and the ends of each strip are angularly spaced from adjacent ends of another strip. The cluster 5054*a* is therefore thicker at the overlapping region 5060 than it is at the ends of the strips. The strips can have the same or different lengths and widths, which can be varied depending on the desired overall shape of the composite part 5040, although each strip desirably is long enough to extend continuously across the finished part 5040 that is cut or otherwise machined from the oversized lay-up.

The strips 5056*a*-5056*g* in the illustrated embodiment are of equal length and are arranged such that the geometric center point 5062 of the cluster corresponds to the center of each strip. The first three strips 5056*a*-5056*c* in this example have a width $w_1$ that is greater than the width $w_2$ of the last four strips 5056*d*-5056*g*. The strips define an angle $\alpha$ between the "horizontal" edges of the second strip 5056*b* and the adjacent edges of strips 5056*a* and 5056*c*, an angle μ between the edges of strip 5056*b* and the closest edges of strips 5056*d* and 5056*g*, and an angle θ between the edges of strip 5056*b* and the closest edges of strips 5056*e* and 5056*f*. In a working embodiment, the width $w_1$ is about 20 mm, the width $w_2$ is about 15 mm, the angle α is about 24 degrees, the angle μ is about 54 degrees, and the angle θ is about 78 degrees.

Figure 18A:
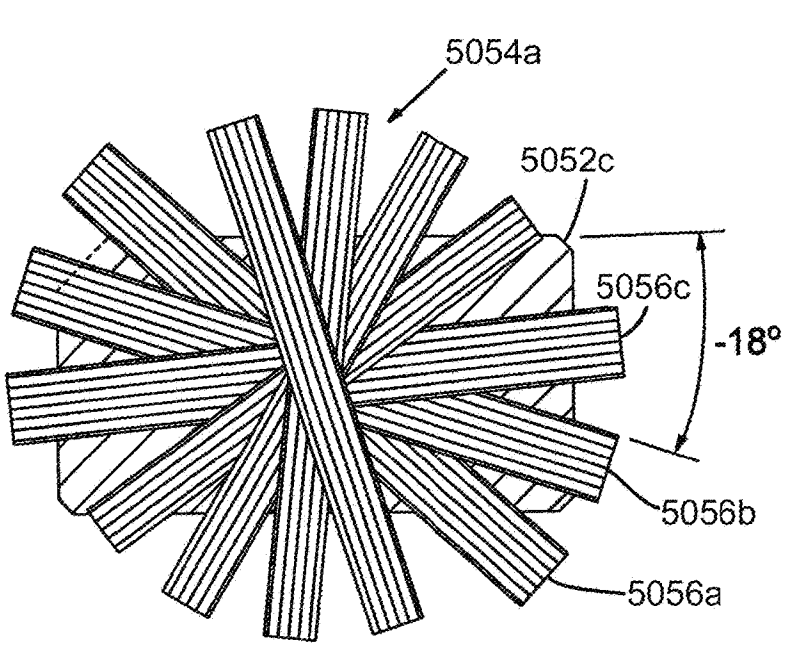
FIG. 18A-18B are plan views illustrating the manner in which clusters of prepreg strips can be oriented at different rotational positions relative to each other in a composite lay-up to create an angular offset between the strips of adjacent clusters.
Figure 18B:
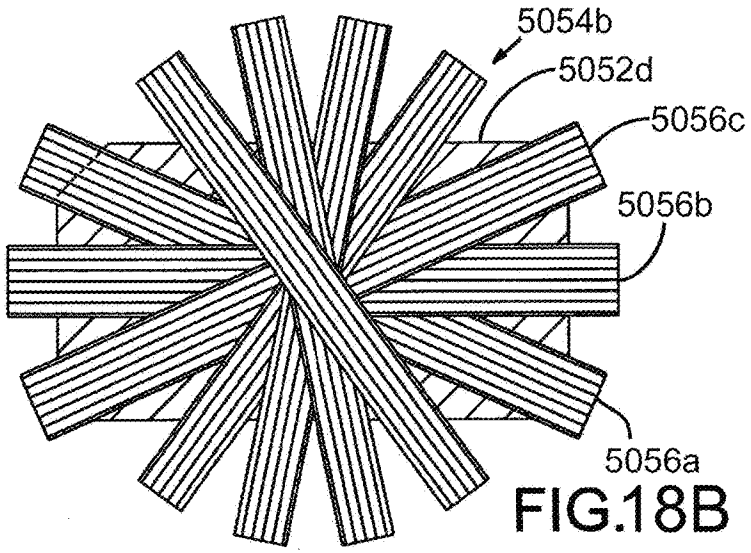
Figure 18C:
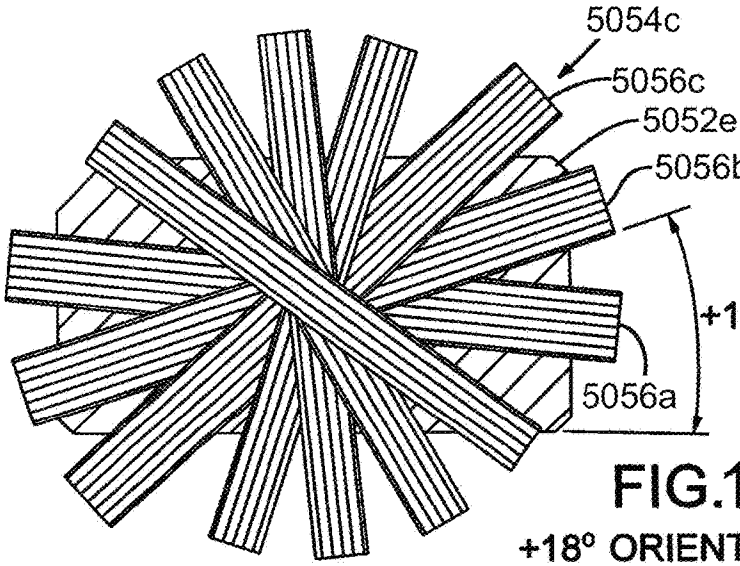
FIG. 18C is a plan view illustrating the manner in which clusters of prepreg strips can be oriented at different rotational positions relative to each other in a composite lay-up to create an angular offset between the strips of adjacent clusters.

Referring again to FIG. 15, each cluster 5054*a*-5054*g* desirably is rotated slightly or angularly offset with respect to an adjacent cluster so that the end portions of each strip in a cluster are not aligned with the end portions of the strips of an adjacent cluster. In this manner, the clusters can be arranged relative to each other in the lay-up to provide a substantially uniform thickness in the peripheral region 5048 of the composite part (FIG. 13). In the illustrated embodiment, for example, the first cluster 5054*a* has an orientation of −18 degrees, meaning that the "upper" edge of the second strip 5056*b* extends at a −18 degree angle with respect to the "upper" horizontal edge of the adjacent unit-group 5052*c* (as best shown in FIG. 18A). The next successive cluster 5054*b* has an orientation of 0 degrees, meaning that the second strip 5056*b* is parallel to the "upper" horizontal edge of the adjacent unit-group 5052*d* (as best shown in FIG. 18B). The next successive cluster 5054*c* has an orientation of +18 degrees, meaning that the "lower" edge of the respective second strip 5056*b* of cluster 5054*c* extends at a +18 degree angle with respect to the "lower" edge of the adjacent unit-group 5052*e*. Clusters 5054*d*, 5054*e*, 5054*f*, and 5054*g* (FIG. 15) can have an orientation of 0 degrees, −18 degrees, 0 degrees, and +18 degrees, respectively.

When stacked in the lay-up, the overlapping regions 5060 of the clusters are aligned in the direction of the thickness of the lay-up to increase the thickness of the central region 5046 of the part 5040 (FIG. 13), while the "spokes" (the strips 5056*a*-5056*g*) are "fanned" or angularly spaced from each other within each cluster and with respect to spokes in adjacent clusters. Prior to curing/molding, the lay-up has a cross-sectional profile that is similar to the finished part 5040 (FIGS. 12-14) except that the lay-up is flat, that is, the lay-up does not have an overall convex shape. Thus, in profile, the rear surface of the lay-up has a central region of increased thickness and gradually tapers to a relatively thinner peripheral region of substantially uniform thickness surrounding the central region. In a working embodiment, the lay-up has a thickness of about 5 mm at the center of the central region and a thickness of about 3 mm at the peripheral region. A greater or fewer number of panels and/or clusters of strips can be used to vary the thickness at the central region and/or peripheral region of the lay-up.

To form the lay-up, according to one specific approach, formation of the panels 5052*a*-5052*k* may be done first by stacking individual precut, prepreg plies 5058*a*-5058*d* of each panel. After the panels are formed, the lay-up is built up by laying the second panel 5052*b* on top of the first panel 5052*a*, and then forming the first cluster 5054*a* on top of the second panel 5052*b* by laying individual strips 5056*a*-5056*g* in the prescribed manner. The remaining panels 5052*c*-5052*k* and clusters 5054*b*-5054*g* are then added to the lay-up in the sequence shown in FIG. 15, followed by the single ply 5072. The fiberglass plies 5070, 5074 can then be added to the front and back of the lay-up.

The fully-formed lay-up can then be subjected to a "debulking" or compaction step (e.g., using a vacuum table) to remove and/or reduce air trapped between plies. The lay-up can then be cured in a mold that is shaped to provide the desired bulge and roll of the face plate. An exemplary curing process is described in detail below. Alternatively, any desired bulge and roll of the face plate may be formed during one or more debulking or compaction steps performed prior to curing. To form the bulge or roll, the debulking step can be performed against a die panel having the final desired bulge and roll. In either case, following curing, the cured lay-up is removed from the mold and machined to form the part 5040.

The following aspects desirably are controlled to provide composite components that are capable of withstanding impacts and fatigue loadings normally encountered by a club-head, especially by the face plate of the club-head. These three aspects are: (a) adequate resin content; (b) fiber straightness; and (c) very low porosity in the finished composite. These aspects can be controlled by controlling the flow of resin during curing, particularly in a manner that minimizes entrapment of air in and between the prepreg layers. Air entrapment is difficult to avoid during laying up of prepreg layers. However, air entrapment can be substantially minimized by, according to various embodiments disclosed herein, imparting a slow, steady flow of resin for a defined length of time during the laying-up to purge away at least most of the air that otherwise would become occluded in the lay-up. The resin flow should be sufficiently slow and steady to retain an adequate amount of resin in each layer for adequate inter-layer bonding while preserving the respective orientations of the fibers (at different respective angles) in the layers. Slow and steady resin flow also allows the fibers in each ply to remain straight at their respective orientations, thereby preventing the "wavy fiber" phenomenon. Generally, a wavy fiber has an orientation that varies significantly from its naturally projected direction.

As noted above, the prepreg strips 5056 desirably are of sufficient length such that the fibers in the strips extend continuously across the part 5040; that is, the ends of each fiber are located at respective locations on the outer peripheral edge 5049 of the part 5040 (FIGS. 12-14). Similarly, the fibers in the prepreg panels 5052*a*-5052*k* desirably extend continuously across the part between respective locations on the outer peripheral edge 5049 of the part. During curing, air bubbles tend to flow along the length of the fibers toward the outer peripheral (sacrificial) portion of the lay-up. By making the strips sufficiently long and the panels larger than the final dimensions of the part 5040, the curing process can be controlled to remove substantially all of the entrapped air bubbles from the portion of the lay-up that forms the part 5040. The peripheral portion of the lay-up is also where wavy fibers are likely to be formed. Following curing, the peripheral portion of the lay-up is removed to provide a net-shape part (or near net-shape part if further finishing steps are performed) that has a very low porosity as well as straight fibers in each layer of prepreg material.

In working examples, parts have been made without any voids, or entrapped air, and with a single void in one of the prepreg plies of the lay-up (either a strip or a panel-size ply). Parts in which there is a single void having its largest dimension equal to the thickness of a ply (about 0.1 mm) have a void content, or porosity, of about $1.7\times10^{-6}$ percent or less by volume.

Figure 20A:
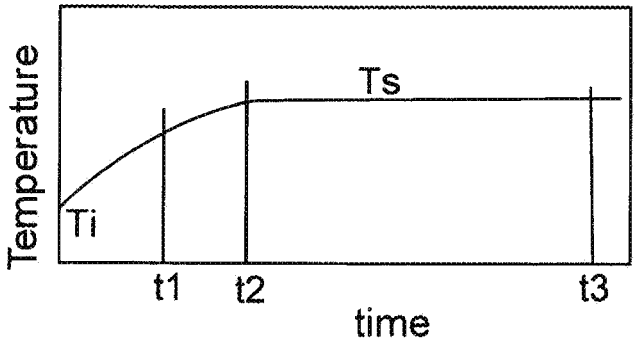
FIGS. 20A-20C are plots of temperature, viscosity, and pressure, respectively, versus time in a representative embodiment of a process for forming composite components.
Figure 20B:
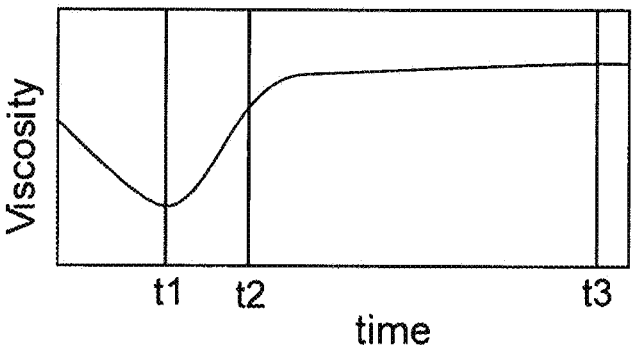
Figure 20C:
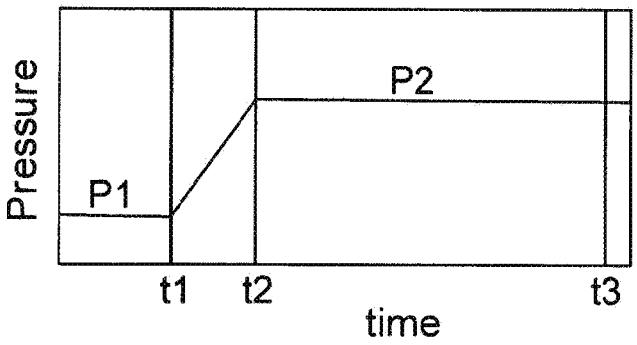

FIGS. 20A-20C depict an embodiment of a process (pressure and temperature as functions of time) in which slow and steady resin flow is performed with minimal resin loss. FIG. 20A shows temperature of the lay-up as a function of time. The lay-up temperature is substantially the same as the tool temperature. The tool is maintained at an initial tool temperature Ti, and the uncured prepreg lay-up is placed or formed in the tool at an initial pressure $P_1$ (typically atmospheric pressure). The tool and uncured prepreg is then placed in a hot-press at a tool-set temperature $T_s$, resulting in an increase in the tool temperature (and thus the lay-up temperature) until the tool temperature eventually reaches equilibrium with the set temperature $T_s$ of the hot-press. As the temperature of the tool increases from $T_i$ to $T_s$, the hot-press pressure is kept at $P_1$ for $t=0$ to $t=t_1$. At $t=t_1$, the hot-press pressure is ramped from $P_1$ to $P_2$ such that, at $t=t_2$, $P=P_2$. Between $T_i$ and $T_s$, the temperature increase of the tool and lay-up is continuous.

Exemplary rates of change of temperature and pressure are: $\Delta T$~30-60° C./minute up to $t_1$, and $\Delta P$~50 psi/minute from $t_1$ to $t_2$.

As the tool temperature increases from $T_i$ to $T_s$, the viscosity of the resin first decreases to a minimum, at time $t_1$, before the viscosity rises again due to cross-linking of the resin (FIG. 20B). At time $t_1$, resin flows relatively easily. This increased flow poses an increased risk of resin loss, especially if the pressure in the tool is elevated. Elevated tool pressure at this stage also causes other undesirable effects such as a more agitated flow of resin. Hence, tool pressure should be maintained relatively low at and around $t_1$ (see FIG. 20C). After $t_1$, cross-linking of the resin begins and progresses, causing a progressive rise in resin viscosity (FIG. 20B), so tool pressure desirably is gradually increased in the time span from $t_1$ to $t_2$ to allow (and to encourage) adequate and continued (but nevertheless controlled) resin flow. The rate at which pressure is increased should be sufficient to reach maximum pressure $P_2$ slightly before the end of rapid increase in resin viscosity. Again, a desired rate of change is $\Delta P$~50 psi/minute from $t_1$ to $t_2$. At time $t_2$ the resin viscosity desirably is approximately 80% of maximum.

Curing continues after time $t_2$ and follows a schedule of relatively constant temperature $T_s$ and constant pressure $P_2$. Note that resin viscosity exhibits some continued increase (typically to approximately 90% of maximum) during this phase of curing. This curing (also called "pre-cure") ends at time $t_3$ at which the component is deemed to have sufficient rigidity (approximately 90% of maximum) and strength for handling and removal from the tool, although the resin may not yet have reached a "full-cure" state (at which the resin exhibits maximum viscosity). A post-processing step typically follows, in which the components reach a "full cure" in a batch heating mode or other suitable manner.

Thus, important parameters of this specific process are: (a) $T_s$, the tool-set temperature (or typical resin-cure temperature), established according to manufacturer's instructions; (b) $T_i$, the initial tool temperature, usually set at approximately 50% of $T_s$ (in ° F. or ° C.) to allow an adequate time span ($t_2$) between $T_i$ and $T_s$ and to provide manufacturing efficiency; (c) $P_1$, the initial pressure that is generally slightly higher than atmospheric pressure and sufficient to hold the component geometry but not sufficient to "squeeze" resin out, in the range of 20-50 psig for example; (d) $P_2$, the ultimate pressure that is sufficiently high to ensure dimensional accuracy of components, in the range of 200-300 psig for example; (e) $t_1$, which is the time at which the resin exhibits a minimal viscosity, a function of resin properties and usually determined by experiment, for most resins generally in the range of 5-10 minutes after first forming the lay-up; (f) $t_2$, the time of maximum pressure, also a time delay from $t_1$, where resin viscosity increases from minimum to approximately 80% of a maximum viscosity (i.e., viscosity of fully cured resin), appears to be related to the moment when the tool reaches $T_s$; and (g) $t_3$, the time at the end of the pre-cure cycle, at which the components have reached handling strength and resin viscosity is approximately 90% of its maximum.

Figure 21A:
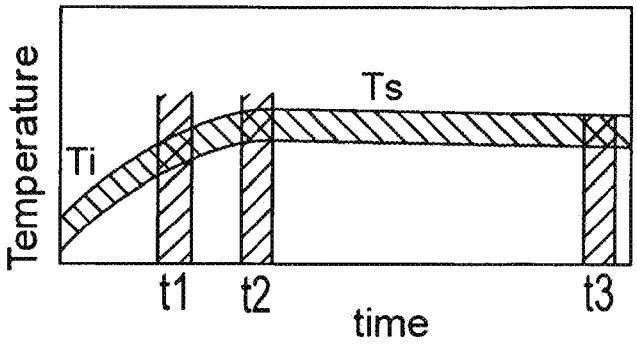
FIGS. 21A-21C are plots of temperature, viscosity, and pressure, respectively, versus time in a representative embodiment of a process in which each of these variables can be within a specified respective range (hatched areas)
Figure 21B:
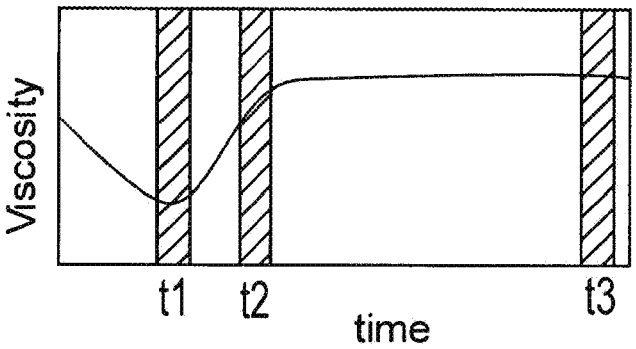
Figure 21C:
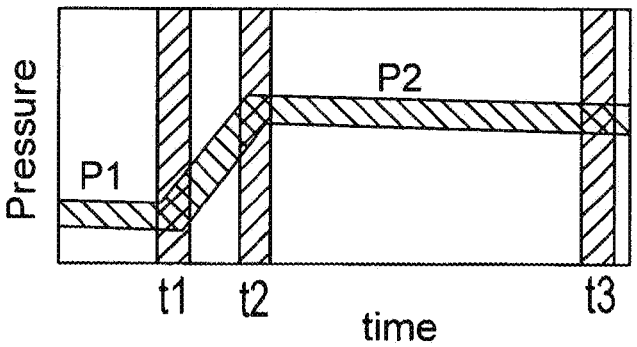
Figure 22:
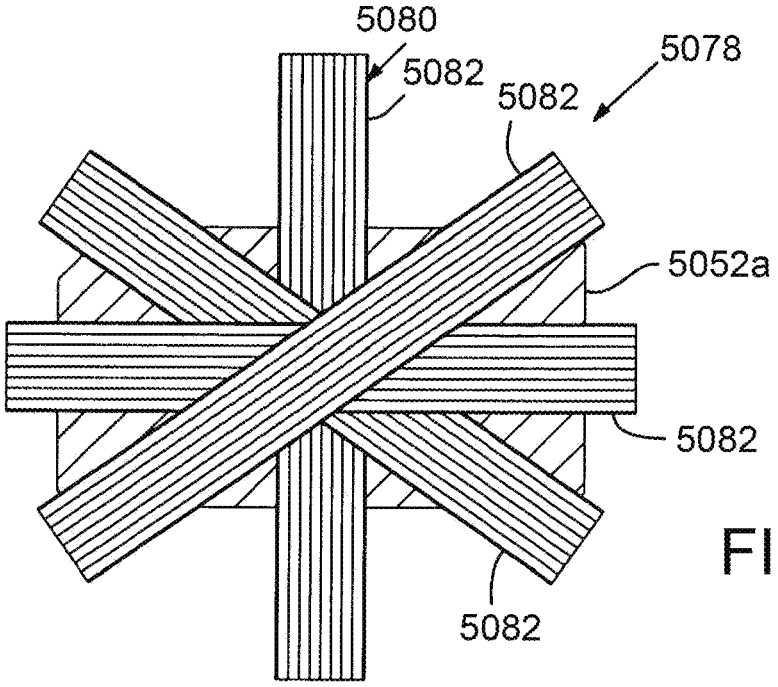
FIG. 22 is a plan view of a simplified lay-up of composite plies from which the component shown in FIG. 12 can be formed.

Many variations of this process also can be designed and may work equally as well. Specifically, all seven parameters mentioned above can be expressed in terms of ranges instead of specific quantities. In this sense, the processing parameters can be expressed as follows (see FIGS. 21A-21C):

$T_s$: recommended resin cure temperature$\pm\Delta T$, where $\Delta T$=20, 50, 75° F.

$T_i$: initial tool temperature (or $T_s/2$)+$\Delta T$.

$P_1$: 0-100 psig$\pm\Delta P$, where $\Delta P$=5, 10, 15, 25, 35, 50 psi.

$P_2$: 200-500 psig$\pm\Delta P$.

$t_1$: t (minimum$\pm\Delta x$ viscosity)$\pm\Delta t$, where $\Delta x$=1, 2, 5, 10, 25% and $\Delta t$=1, 2, 5, 10 min.

$t_2$: t (80%$\pm\Delta x$ maximum viscosity)$\pm\Delta t$.

$t_3$: t (90%$\pm\Delta x$ maximum viscosity)$\pm\Delta t$.

After reaching full-cure, the components are subjected to manufacturing techniques (machining, forming, etc.) that achieve the specified final dimensions, size, contours, etc., of the components for use as face plates on club-heads. Conventional CNC trimming can be used to remove the sacrificial portion of the fully-cured lay-up (e.g., the portion surrounding line 5064 in FIG. 19). However, because the tool applies a lateral cutting force to the part (against the peripheral edge of the part), it has been found that such trimming can pull fibers or portions thereof out of their plies and/or induce horizontal cracks on the peripheral edge of the part. These defects can cause premature delamination or other failure.

In certain embodiments, the sacrificial portion of the fully-cured lay-up is removed by water-jet cutting. In water-jet cutting, the cutting force is applied in a direction perpendicular to the prepreg plies (in a direction normal to the front and rear surfaces of the lay-up), which minimizes the occurrence of cracking and fiber pull out. Consequently, water-jet cutting can be used to increase the overall durability of the part.

The potential mass "savings" obtained from fabricating at least a portion of the face plate of composite, as described above, is about 10-30 g, or more, relative to a 2.7-mm thick face plate formed from a titanium alloy such as Ti-6Al-4V, for example. In a specific example, a mass savings of about 15 g relative to a 2.7-mm thick face plate formed from a titanium alloy such as Ti-6Al-4V can be realized. As mentioned above, this mass can be allocated to other areas of the club, as desired.

FIG. 12 shows a portion of a simplified lay-up 5078 that can be used to form the composite part 5040 (FIGS. 12-14). The lay-up 5078 in this example can include multiple prepreg panels (e.g., panels 5052*a*-5052*k*) and one or more clusters 5080 of prepreg strips 5082. The illustrated cluster 5080 comprises only four strips 5082 of equal width arranged in a criss-cross pattern and which are equally angularly spaced or fanned with respect to each other about the center of the cluster. Although the figure shows only one cluster 5080, the lay-up desirably includes multiple clusters 5080 (e.g., 1 to 12 clusters, with 7 clusters in a specific embodiment). Each cluster is rotated or angularly offset with respect to an adjacent cluster to provide an angular offset between strips of one cluster with the strips of an adjacent cluster, such as described above, in order to form the reduced-thickness peripheral portion of the lay-up.

Figure 25:
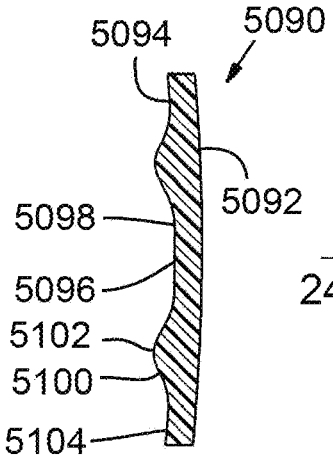
FIG. 25 is a cross-sectional view taken along line 25-25 of FIG. 23.
Figure 23:
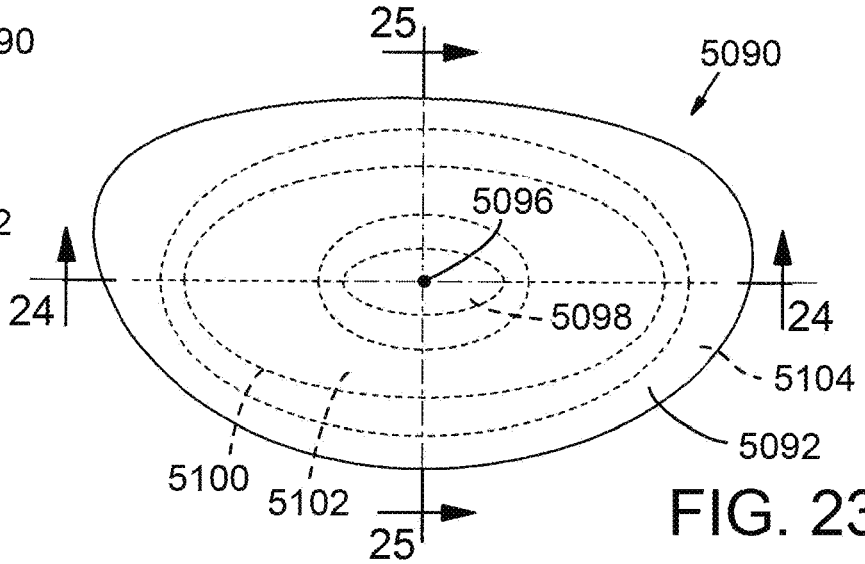
FIG. 23 is a front elevation view of another net-shape composite component that can be used to form the strike plate of a club-head.
Figure 24:
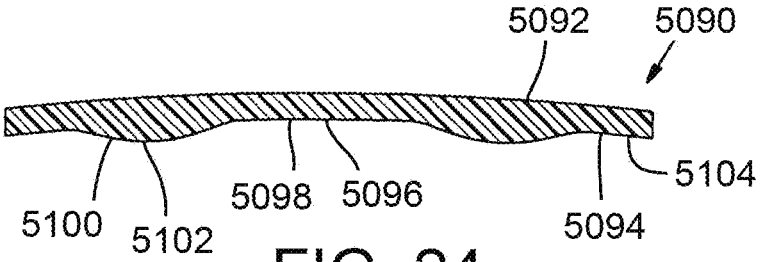
FIG. 24 is a cross-sectional view taken along line 24-24 of FIG. 23.

The embodiments described thus far provide a face plate having a projection or cone at the sweet spot. However, various other cross-sectional profiles can be achieved by selective placement of prepreg strips in the lay-up. FIGS. 23-25, for example, show a composite component 5090 for use as a face plate for a club-head (either by itself or in combination with a polymeric or metal outer layer). The composite component 5090 has a front surface 5092, a rear surface 5094, and an overall slightly convex shape. The reverse surface 5094 defines a point 5096 situated in a central recess 5098. The point 5096 represents the approximate center of the sweet spot of the face plate, not necessarily the center of the face plate, and is located in the approximate center of the recess 5098. The central recess 5098 is a "dimple" having a spherical or otherwise radiused sectional profile in this embodiment (see FIGS. 24 and 25), and is surrounded by an annular ridge 5100. At the point 5096 the thickness of the component 5090 is less than at the "top" 5102 of the annular ridge 5100. The top 5102 is normally the thickest portion of the component. Outward from the top 5102, the thickness of the component gradually decreases to form a peripheral region 5104 of substantially uniform thickness surrounding the ridge 5100. Hence, the central recess 5098 and surrounding ridge 5100 have a cross-sectional profile that is reminiscent of a "volcano." Generally speaking, an advantage of this profile is that thinner central region is effective to provide a larger sweet spot, and therefore a more forgiving club-head.

Figure 26:
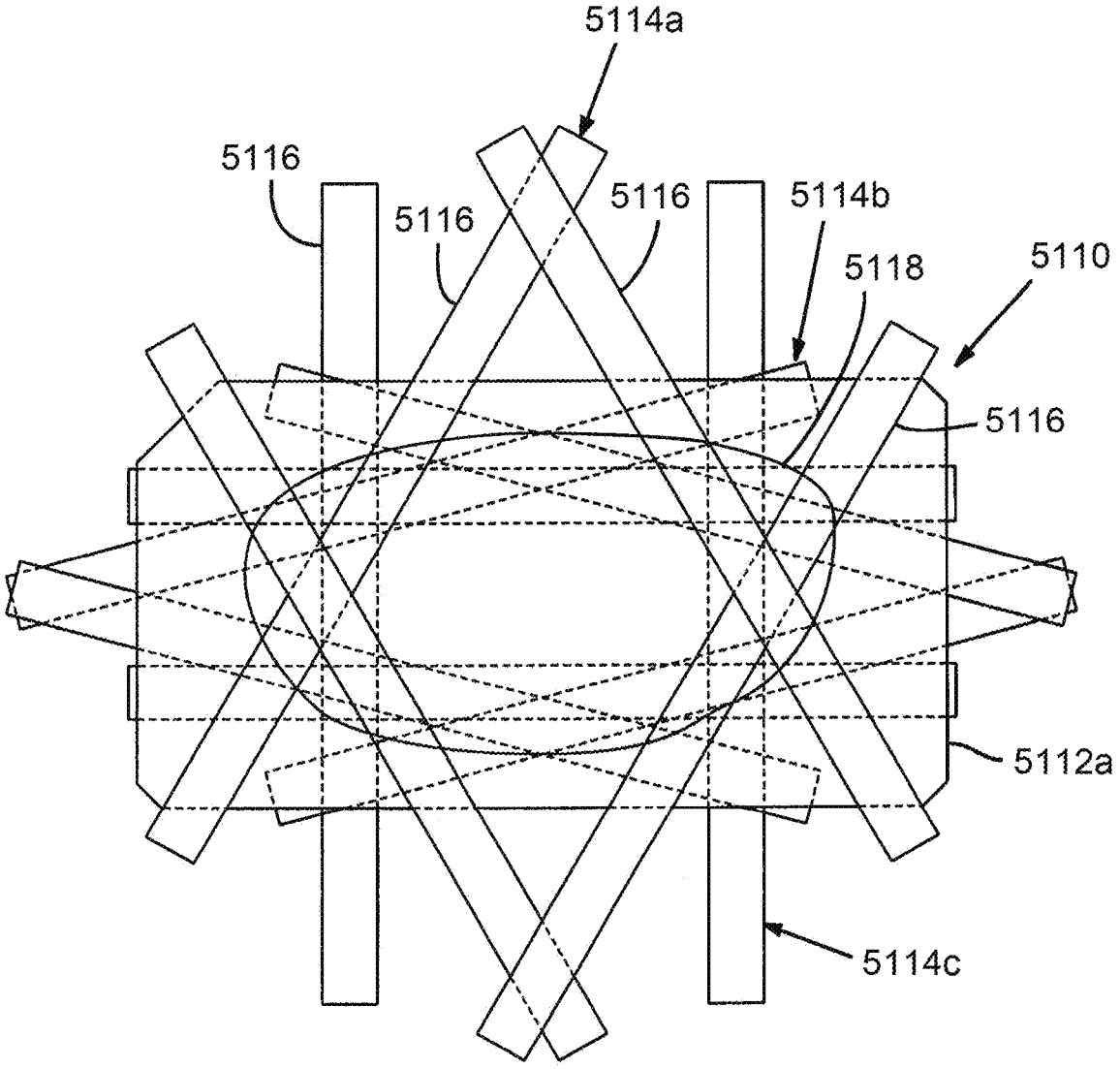
FIG. 26 is a top plan view of one embodiment of a lay-up of composite plies from which the component shown in FIG. 23 can be formed.
Figure 27:
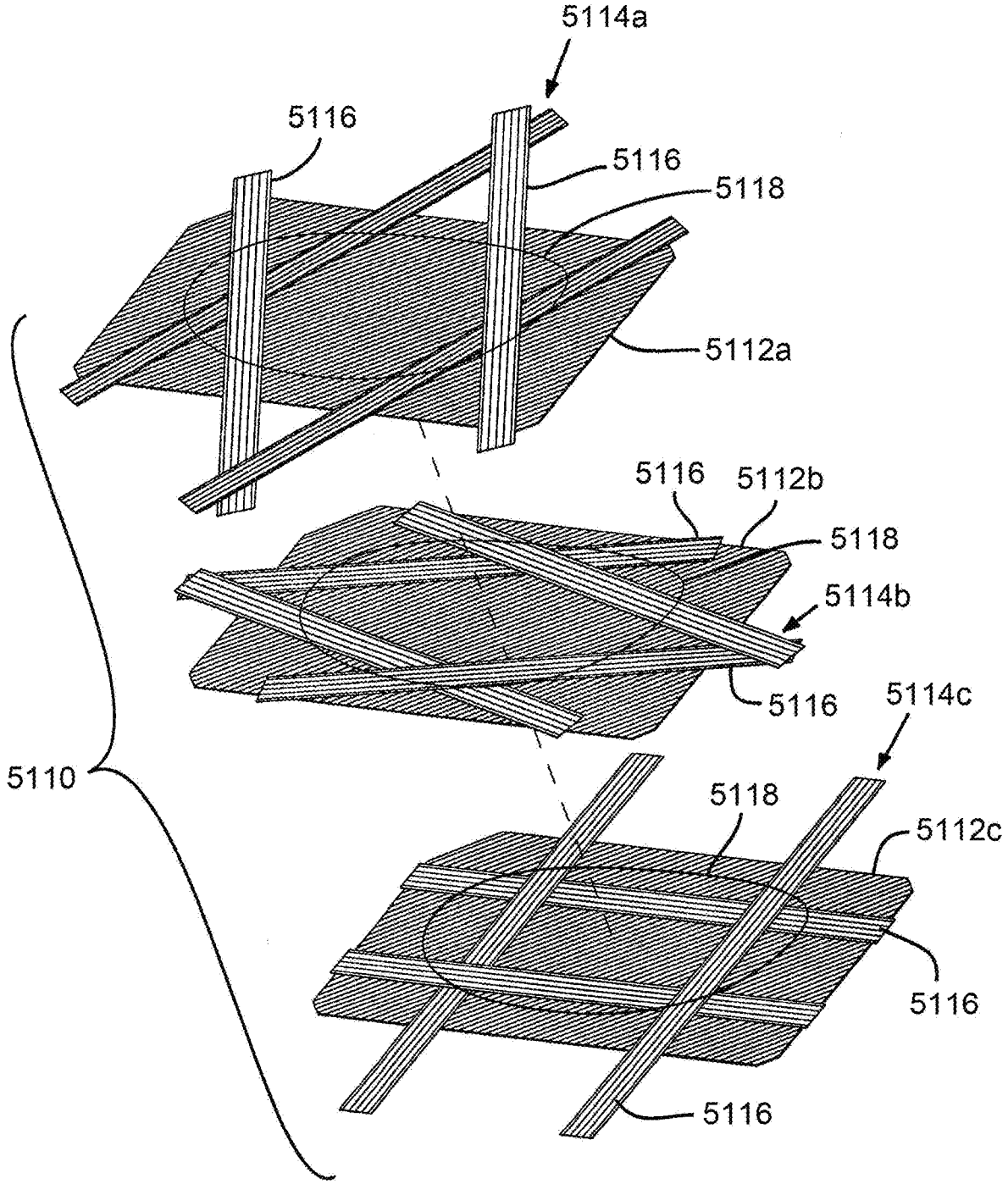
FIG. 27 is an exploded view of the first few groups of composite plies that are used to form the lay-up shown in FIG. 26.

FIG. 26 is a plan view of a lay-up 5110 of multiple prepreg plies that can be used to fabricate the composite component 5090. FIG. 27 shows an exploded view of a few of the prepreg layers that form the lay-up 5110. As shown, the lay-up 5110 includes multiple panels 5112*a*, 5112*b*, 5112*c* of prepreg material and sets, or clusters, 5114*a*, 5114*b*, 5114*c* of prepreg strips interspersed between the panels. The panels 5112*a*-5112*c* can be formed from one or more prepreg plies and desirably comprise four plies having respective fibers orientations of +45 degrees, 0 degrees, −45 degrees, and 90 degrees, in the manner described above. The line 5118 in FIGS. 26 and 27 represent the outline of the composite component 5090 and the portion surrounding the line 5118 is a sacrificial portion. Once the lay-up 5110 is cured, the sacrificial portion surrounding the line 5118 can be removed to form the component 5090.

Each cluster 5114*a*-5114*c* in this embodiment comprises four criss-cross strips 5116 arranged in a specific shape. In the illustrated embodiment, the strips of the first cluster 5114*a* are arranged to form a parallelogram centered on the center of the panel 5112*a*. The strips of the second cluster 5114*b* also are arranged to form a parallelogram centered on the center of the panel 5112*b* and rotated 90 degrees with respect to the first cluster 5114*a*. The strips of the third cluster 5114*c* are arranged to form a rectangle centered on the center of panel 5112*c*. When stacked in the lay-up, as best shown in FIG. 26, the strips 5116 of clusters 5114*a*-5114*c* overlay one another so as to collectively form an oblong, annular area of increased thickness corresponding to the annular ridge 5100 (FIG. 24). Hence, the fully-formed lay-up has a rear surface having a central recess and a surrounding annular ridge of increased thickness formed collectively by the buildup of strip clusters 5114*a*-5114*c*. Additional panels 5112*a*-5112*c* and strip clusters 5114*a*-5114*c* may be added to lay-up to achieve a desired thickness profile.

It can be appreciated that the number of strips in each cluster can vary and still form the same profile. For example, in another embodiment, clusters 114*a*-114*c* can be stacked immediately adjacent each other between adjacent panels 112 (i.e., effectively forming one cluster of twelve strips 116).

The lay-up 5110 may be cured and shaped to remove the sacrificial portion of the lay-up (the portion surrounding the line 5118 in FIG. 26 representing the finished part), as described above, to form a net shape part. As in the previous embodiments, each strip 5116 is of sufficient length to extend continuously across the part 5090 so that the free ends of the fibers are located on the peripheral edge of the part. In this manner, the net shape part can be formed free of any voids, or with an extremely low void content (e.g., about $1.7\times10^{-6}$ percent or less by volume) and can have straight fibers in each layer of prepreg material.

As mentioned above, any of various cross-sectional profiles can be achieved by arranging strips of prepreg material in a predetermined manner. Examples of other face plate profiles that can be formed by the techniques described herein are disclosed in U.S. Pat. Nos. 6,800,038, 6,824,475, 6,904,663, and 7,066,832, all of which are incorporated herein by reference.

As mentioned above, the face plate 5012 (FIG. 11) can include a composite plate and a metal cap covering the front surface of the composite plate. One such embodiment is shown, for example, in the partial section depicted in FIG. 28, in which the face plate 5012 comprises a metal "cap" 5130 formed or placed over a composite plate 5040 to form the strike surface 5013. The cap 5130 includes a peripheral rim 5132 that covers the peripheral edge 5134 of the composite plate 5040. The rim 5132 can be continuous or discontinuous, the latter comprising multiple segments (not shown).

The metal cap 5130 desirably is bonded to the composite plate 5040 using a suitable adhesive 5136, such as an epoxy, polyurethane, or film adhesive. The adhesive 5136 is applied so as to fill the gap completely between the cap 5130 and the composite plate 5040 (this gap usually in the range of about 0.05-0.2 mm, and desirably is approximately 0.1 mm). The face plate 5012 desirably is bonded to the body 5014 using a suitable adhesive 5138, such as an epoxy adhesive, which completely fills the gap between the rim 5132 and the adjacent peripheral surface 5140 of the face support 5018 and the gap between the rear surface of the composite plate 5040 and the adjacent peripheral surface 5142 of the face support 5018.

A particularly desirable metal for the cap 5130 is titanium alloy, such as the particular alloy used for fabricating the body (e.g., Ti-6Al-4V). For a cap 5130 made of titanium alloy, the thickness of the titanium desirably is less than about 1 mm, and more desirably less than about 0.3 mm. The candidate titanium alloys are not limited to Ti-6Al-4V, and the base metal of the alloy is not limited to Ti. Other materials or Ti alloys can be employed as desired. Examples include commercially pure (CP) grade Ti, aluminum and aluminum alloys, magnesium and magnesium alloys, and steel alloys.

Surface roughness can be imparted to the composite plate 5040 (notably to any surface thereof that will be adhesively bonded to the body of the club-head and/or to the metal cap 5130). In a first approach, a layer of textured film is placed on the composite plate 5040 before curing the film (e.g., "top" and/or "bottom" layers discussed above). An example of such a textured film is ordinary nylon fabric. Conditions under which the adhesives 5136, 5138 are cured normally do not degrade nylon fabric, so the nylon fabric is easily used for imprinting the surface topography of the nylon fabric to the surface of the composite plate. By imparting such surface roughness, adhesion of urethane or epoxy adhesive, such as 3M® DP 460, to the surface of the composite plate so treated is improved compared to adhesion to a metallic surface, such as cast titanium alloy.

In a second approach, texture can be incorporated into the surface of the tool used for forming the composite plate 5040, thereby allowing the textured area to be controlled precisely and automatically. For example, in an embodiment having a composite plate joined to a cast body, texture can be located on surfaces where shear and peel are dominant modes of failure.

Figure 28:
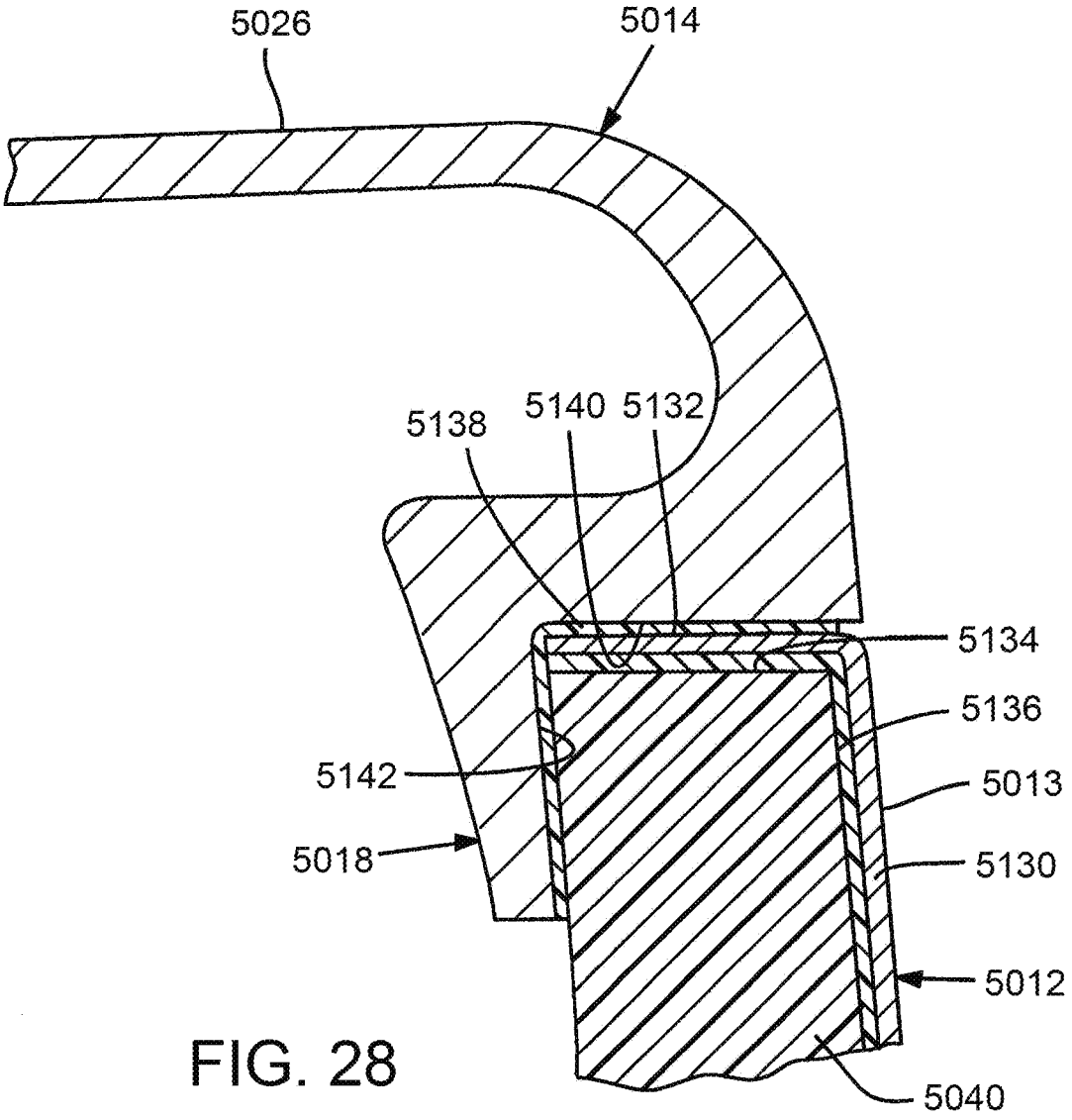
FIG. 28 is a partial sectional view of the upper lip region of an embodiment of a club-head of which the face plate comprises a composite plate and a metal cap.
Figure 29:
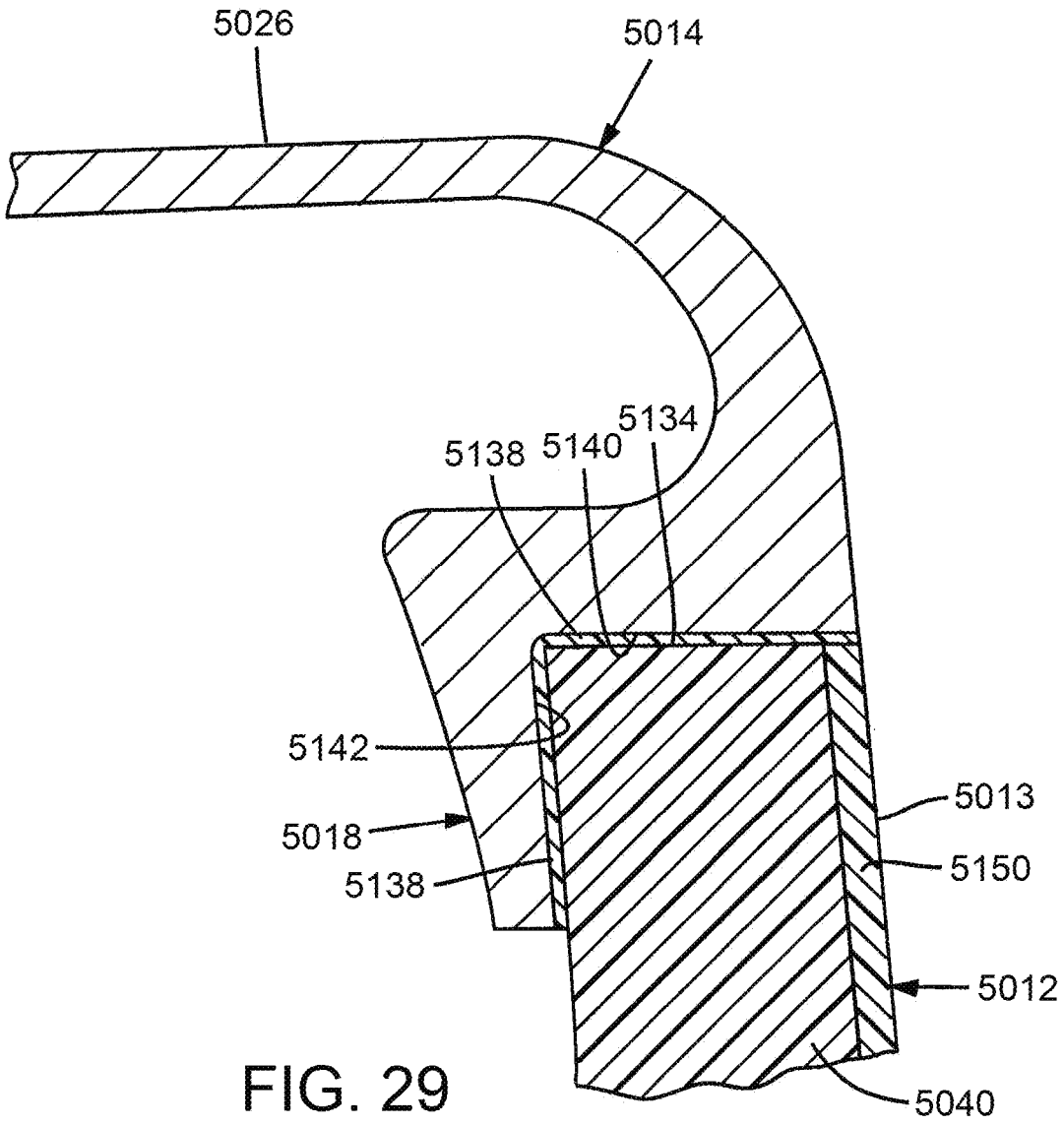
FIG. 29 is a partial sectional view of the upper lip region of an embodiment of a club-head of which the face plate comprises a composite plate and a polymeric outer layer.
Figure 31:
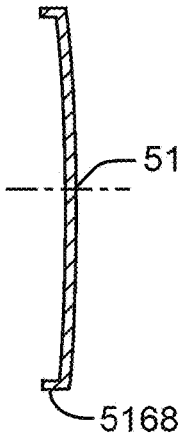
FIGS. 30-33 illustrate a metallic cover for a composite face plate.

FIG. 29 shows an embodiment similar to that shown in FIG. 28, with one difference being that in the embodiment of FIG. 29, the face plate 5012 includes a polymeric outer layer, or cap, 5150 on the front surface of the composite plate 5040 forming the striking surface 5013. The outer layer 5150 desirably completely covers at least the entire front surface of the composite plate 5040. A list of suitable polymers that can be used as an outer layer on a face plate is provided below. A particularly desirable polymer is urethane. For an outer layer 5150 made of urethane, the thickness of the layer desirably is in the range of about 0.2 mm to about 1.2 mm, with about 0.4 mm being a specific example. As shown, the face plate 5012 can be adhesively secured to the face support 5018 by an adhesive 5138 that completely fills the gap between the peripheral edge 5134 and the adjacent peripheral surface 5140 of the face support 5018 and the gap between the rear surface of the composite plate 5040 and the adjacent peripheral surface 5142 of the face support 5018.

The composite face plate as described above needs not be coextensive (dimensions, area, and shape) with atypical face plate on a conventional club-head. Alternatively, a subject composite face plate can be a portion of a full-sized face plate, such as the area of the "sweet spot." Both such composite face plates are generally termed "face plates" herein. Further, the composite plate 5040 itself (without additional layers of material bonded or formed on the composite plate) can be used as the face plate 5012.

Example 1

In this example, a number of composite strike plates were formed using the strip approach described above in connection with FIGS. 12-19. A number of strike plates having a similar profile were formed using the partial ply approach described above. Five plates of each batch were sectioned and optically examined for voids. Table 5 below reports the yield of the examined parts. The yield is the percentage of parts made that did not contain any voids. As can be seen, the strip approach provided a much greater yield of parts without voids than the partial ply approach. The remaining parts of each batch were then subjected to endurance testing during which the parts were subjected to 3600 impacts at a ball speed of 50 m/s. As shown in Table 5, the parts made by the strip approach yielded a much higher percentage of parts that survived 3600 impacts than the parts made by the partial ply approach (72.73% vs. 52%). Table 5 also shows the average characteristic time (CT) (ball contact time with the strike plate) measured during the endurance test.

TABLE 5

| | Average weight (g) | Yield (%) | CT (μs) | Pieces tested | Number of passing parts | % of passing parts | Maximum shots |
|---|---|---|---|---|---|---|---|
| Strip | 21.9 | 81 | 255 | 11 | 8 | 72.73 | 3600 |
| Partial ply | 21.6 | 57.5 | 259 | 25 | 13 | 52 | 3600 |

Example 2

In this example, a number of composite strike plates were formed using the strip approach described above in connection with FIGS. 12-19. A number of strike plates having a similar profile were formed using the partial ply approach above. Five plates of each batch were sectioned and optically examined for voids. Table 6 below reports the yield of the parts formed by both methods. As in Example 1, the strip approach provided a much greater yield of parts without voids than the partial ply approach (90% vs. 70%). The remaining parts of each batch were then subjected to endurance testing during which the parts were subjected to 3600 impacts at a ball speed of 42 m/s. At this lower speed, all of the tested parts survived 3600 impacts.

TABLE 6

| | Average weight (g) | Yield (%) | CT (μs) | Pieces tested | Number of passing parts | % of passing parts | Maximum shots |
|---|---|---|---|---|---|---|---|
| Strip | 22 | 90 | 255 | 11 | 11 | 100 | 3600 |
| Partial ply | 21.5 | 70 | 258 | 16 | 16 | 100 | 3600 |

The methods described above provide improved structural integrity of the face plates and other club-head components manufactured according to the methods, compared to composite component manufactured by prior-art methods. These methods can be used to fabricate face plates for any of various types of clubs, such as (but not limited to) irons, wedges, putter, fairway woods, etc., with little to no process-parameter changes.

The subject methods are especially advantageous for manufacturing face plates because face plates are the most severely loaded components in golf club-heads. If desired, conventional (and generally less expensive) composite-processing techniques (e.g., bladder-molding, etc.) can be used to make other parts of a club-head not subject to such severe loads.

Moreover, the methods for fabricating composite parts described herein can be used to make various other types of composite parts, and in particular, parts that are subject to high impact loads and/or repetitive loads. Some examples of such parts include, without limitation, a hockey stick (e.g., the blade of a stick), a bicycle frame, a baseball bat, and a tennis racket, to name a few.

Example 3

Figure 30:
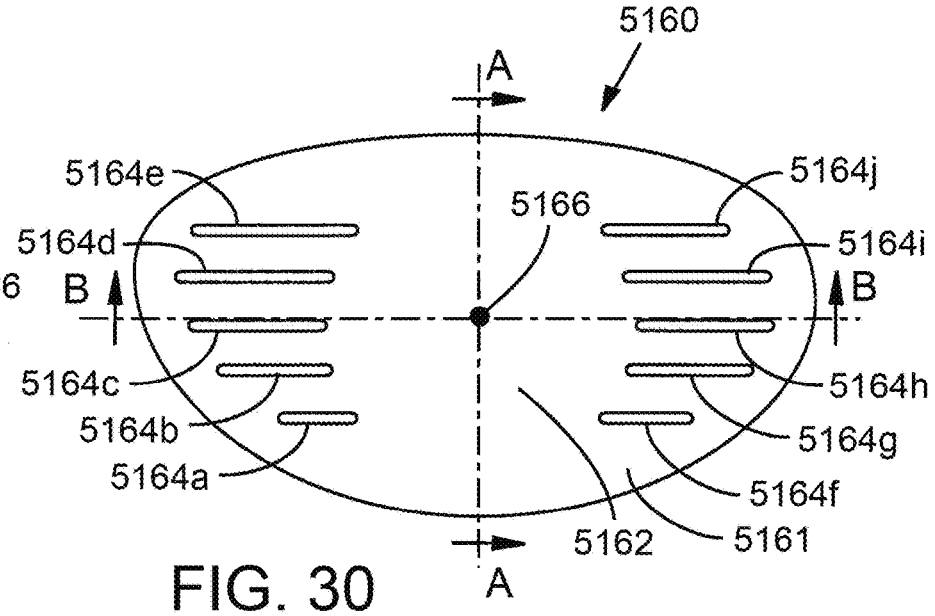
Figure 32:
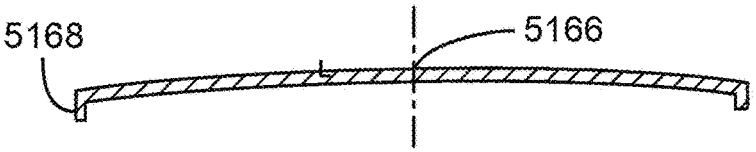

As shown in FIGS. 28-29, a metallic cover can be provided so that a golf club striking plate includes a composite face plate and a metallic striking surface that tends to be wear resistant. A representative metallic cover 5160 is illustrated in detail in FIGS. 30-33. Referring to FIG. 30, the metallic cover 5160 provides a striking surface 5161 that includes a central striking region 5162 and a plurality of contrasting scorelines **5164*a*-5164*j* that are associated with respective dents, depressions, or indentations in the metallic cover that are generally filled with a contrasting pigment or paint such as white paint. Scorelines generally extend along an axis parallel to a toe-to-heel direction. In a representative example, scorelines have lengths of between about 6 mm and 14 mm, with scoreline lengths larger toward a golf club crown. The scorelines are spaced about 6-7 mm apart in a top-to-bottom direction. The arrangement of FIG. 30** is one example, and other arrangements can be used.

The metallic cover 5160 is generally made of a titanium alloy or other metal such as those mentioned above, and has a bulge/roll center 5166 for bulge and roll curvatures that are provided to control club performance. Centers of curvature for bulge/roll curvatures are typically situated on an axis that is perpendicular to the striking surface 5161 at the bulge/roll center 5166. In this example, innermost edges of the scorelines 5164*a*-5164*j* are situated along a circumference of a circle having a diameter of about 40-50 mm that is centered at the bulge/roll center 5166. As shown in the sectional view of FIG. 31, a "roll" radius of curvature (a top-to-bottom radius of curvature) is about 300 mm and is symmetric about the bulge/roll center. As shown in the sectional view of FIG. 32, a "bulge" radius of curvature (a toe-to-heel radius of curvature) is about 410 mm and is symmetric about the bulge/roll center 5166. Bulge and roll curvatures can be spherical or circular curvatures, but other curvatures such as elliptical, oval, or other curvatures can be provided. In this example, a rim 5168 is provided and is intended to at least partially cover an edge of a composite faceplate to which the metallic cover 5160 is attached.

Figure 33:
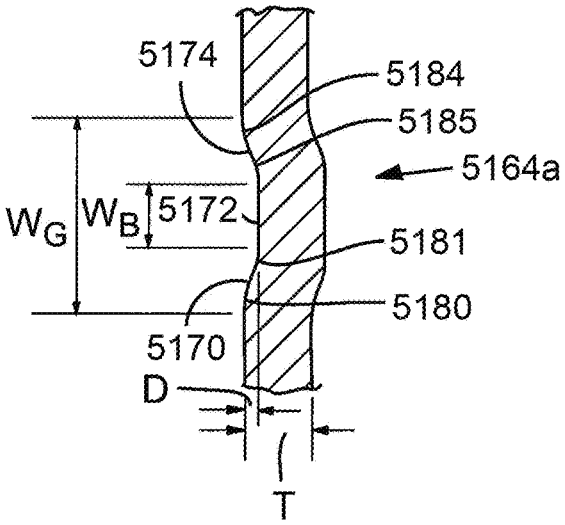
Figure 34:
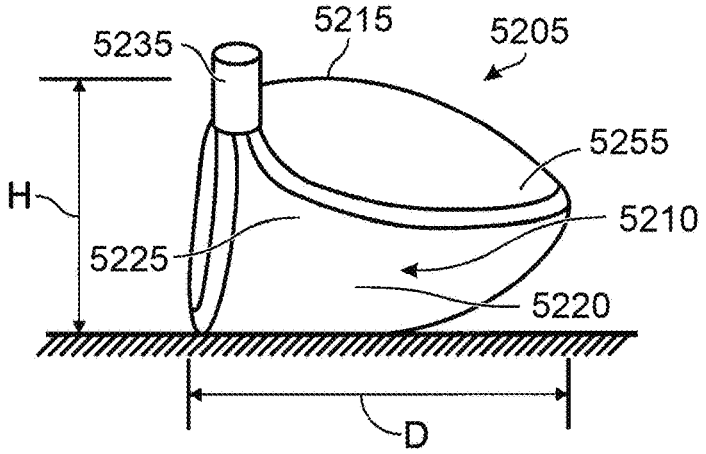
FIG. 34 is a side perspective view of a wood-type golf club head.
Figure 35:
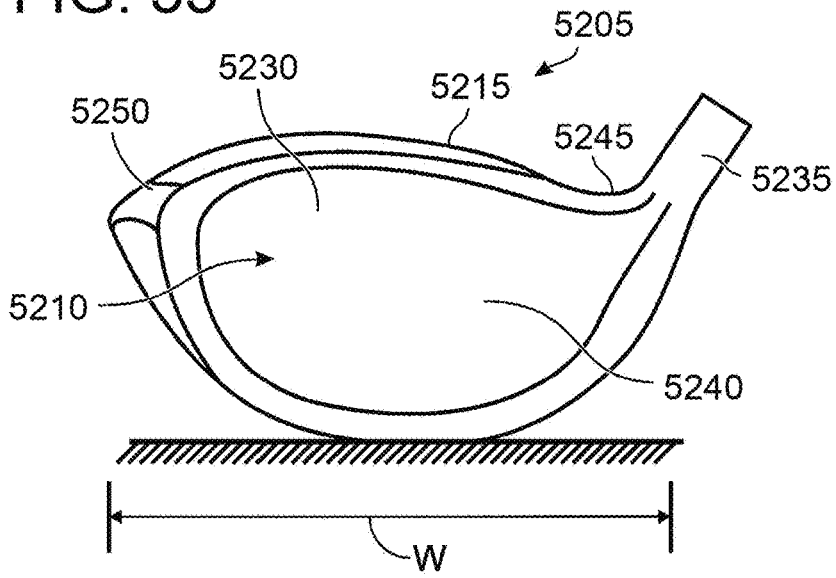
FIG. 35 is a front perspective view of a wood-type golf club head.
Figure 36:
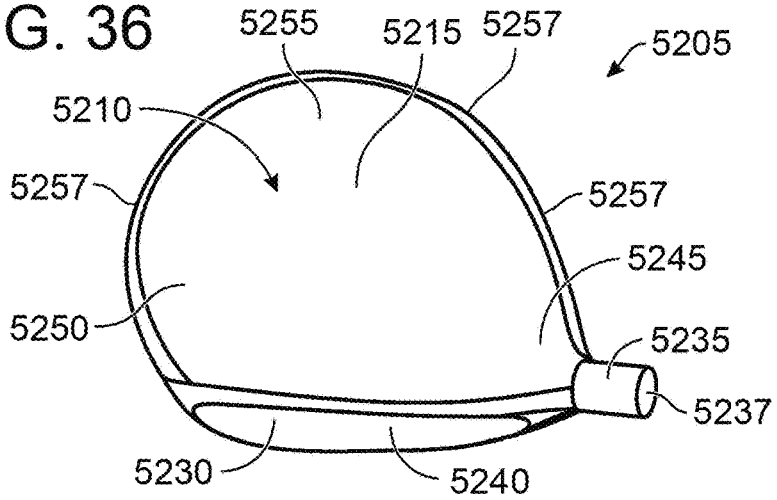
FIG. 36 is a top perspective view of a wood-type golf club head.
Figure 37:
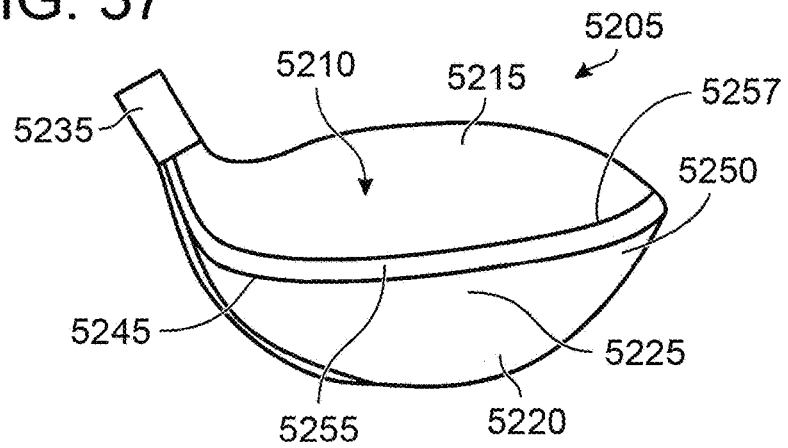
FIG. 37 is a back perspective view of a wood-type golf club head.

The striking region 5162 can be roughened by sandblasting, bead blasting, sanding, or other abrasive process or by a machining or other process. The scorelines 5164*a*-5164*j* are situated outside of the intended striking region 5162 and are generally provided for visual alignment and do not typically contribute to ball trajectory. A cross-section of a representative scoreline 5164*a* is shown in FIG. 33 (paint or other pigment is not shown). The scoreline 5164*a* is provided as an indentation in the cover 5160 and includes transition portions 5170, 5174 and a bottom portion 5172. For a thin cover plate (thickness less than about 1.0 mm, 0.5 mm, 0.3 mm, or 0.2 mm), the scoreline 5164*a* can be formed by pressing a correspondingly shaped tool against a sheet of a selected cover plate material. An overall curvature for the cover 5160 can also be provided in the same manner based on a bulge and roll of a face plate such as a composite face plate to which the cover 5160 is to be applied. For atypical cover thickness, indented scorelines are associated with corresponding protruding features on a rear surface 5176 of the cover 5160. In this example, the scoreline 5164*a* has a depth D of about 0.07 mm in a cover having a thickness T of about 0.30 mm. A width $W_B$ of the bottom portion 5172 is about 0.29 mm, and a width $W_G$ of the entire indent is about 0.90 mm. The transition portions 5170, 5174 have inner and outer radiused regions 5181, 5185 and 5180, 5184, respectively, having respective radii of curvature of about 0.40 mm and 0.30 mm.

In other examples, a cover can be between about 0.10 mm and 1.0 mm thick, between about 0.2 mm and 0.8 mm thick, or between about 0.3 mm and 0.5 mm thick. Indentation depths between about 0.02 mm and 0.12 mm or about 0.06 mm and 0.10 mm are generally preferred for scoreline definition. Impact resistant cover plates with scorelines generally have scoreline depths D and cover plate thicknesses T such that a ratio D T is less than about 0.4, 0.3, 0.25, or 0.20. A ratio $W_B/T$ is typically between about 0.5 and 1.5, 0.75 and 1.25, or 0.9 and 1.1. A ratio $W_G/T$ is typically between about 1 and 5, 2 and 4, or 2.5 and 3.5. A ratio of transition region radii of curvature R to cover thickness T is typically between about 0.5 and 1.5, 0.67 and 1.33, or 0.75 and 1.33. While it is convenient to provide scorelines based on common indentation depths, scorelines on a single cover can be based on indentations of one or more depths.

For wood-type golf clubs, an impact area is based on areas associated with inserts used in traditional wood golf clubs. For irons, an impact area is a portion of the striking surface within 20 mm on either side of a vertical centerline, but does not include 6.35 mm wide strips at the top and bottom of the striking surface. For wood-type golf clubs, scorelines are generally provided in a cover so as to be situated exterior to an impact region. The disclosed covers with scorelines are sufficiently robust for placement within or without an impact region for either wood or iron type golf clubs.

A cover is generally formed from a sheet of cover stock that is processed so as to have a bulge/roll region that includes the necessary arrangement of scoreline dents. The formed cover stock is then trimmed to fit an intended face plate, and attached to the face plate with an adhesive. Typically a glue layer is situated between the cover and the face plate, and the cover and face plate are urged together so as to form an adhesive layer of a suitable thickness. For typical adhesives, layer thicknesses between about 0.05 mm and 0.10 mm are preferred. Once a suitable layer thickness is achieved, the adhesive can be cured or allowed to set. In some cases, the cover includes a cover lip or rim as well so as to cover a face plate perimeter. The scoreline indentations are generally filled with paint of a color that contrasts with the remainder of the striking surface.

Although the scorelines are provided to realize a particular appearance in a finished product, the indentations used to define the scorelines also serve to control adhesive thickness. As a cover plate and a face plate are urged together in a gluing operation, the rear surface protrusions associated with the indentations tend to approach the face plate and thus regulate an adhesive layer thickness. Accordingly, indentation depth can be selected not only to retain paint or other pigment on a striking face, but can also be based on a preferred adhesive layer thickness. In some examples, protruding features of indentations in a cover plate are situated at distances of less than about 0.10 mm, 0.05 mm, 0.03 mm, and 0.01 mm from a face plate surface as an adhesive layer thickness is established.

In other examples, the indent-based scorelines shown in FIGS. 30-33 can be replaced with grooves that are punched, machined, etched or otherwise formed in a cover plate sheet. Indentations are generally preferable as gluing operations based on indented plates are not generally associated with adhesive transfer to the striking surface. In addition, striking plates made with dented metallic covers tend to be more stable in long term use than cover plates that have been machined or punched. Scoreline or indent dimensions (length, depth, and transition region dimensions and curvatures) as well as scoreline or indentation location on a striking surface are preferably selected based on a selected cover material or cover material thickness. Fabrication methods (such as punching, machining) tend to produce cover plates that are more likely to show wear under impact endurance testing in which a finished striking plate is subject to the forces associated with 3000 shots by, for example, forming a club head with a striking plate under test, and making 3000 shots with the club head. A cover that performs successfully under such testing without degradation is referred as an impact-resistant cover plate.

In alterative embodiments, a cover includes a plurality of slots situated around a striking region. A suitably colored adhesive can be used to secure the cover layer to a face plate so that the adhesive fills the slots or is visible through the slots so to provide visible orientation guides on the striking plate surface.

Example 4

Polymer or other surface coatings or surface layers can be provided to composite or other face plates to provide performance similar to that of conventional irons and metal type woods. Such surface layers, methods of forming such layers, and characterization parameters for such layers are described below.

Surface Texture and Roughness

Surface textures or roughness can be conveniently characterized based on a surface profile, i.e., a surface height as a function of position on the surface. A surface profile is typically obtained by interrogating a sample surface with a stylus that is translated across the surface. Deviations of the stylus as a function of position are recorded to produce the surface profile. In other examples, a surface profile can be obtained based on other contact or non-contact measurements such as with optical measurements. Surface profiles obtained in this way are often referred to as "raw" profiles. Alternatively, surface profiles for a golf club striking surface can be functionally assessed based on shot characteristics produced when struck with surfaces under wet conditions.

For convenience, a control layer is defined as a striking face cover layer configured so that shots are consistent under wet and dry playing conditions. Generally, satisfactorily roughened or textured striking surfaces (or other control surfaces) provide ball spins that are similar to conventional metal faces under wet conditions when struck with club head speeds of between about 75 mph and 120 mph. Stylus or other measurement based surface roughness characterizations for such control surfaces are described in detail below.

A surface profile is generally processed to remove gradual deviations of the surface from flatness. For example, a wood-type golf club striking face generally has slight curvatures from toe-to-heel and crown-to-sole to improve ball trajectory, and a "raw" surface profile of a striking surface or a cover layer on the striking surface can be processed to remove contributions associated with these curvatures. Other slow (i.e., low spatial frequency) contributions can also be removed by such processing. Typically features of size of about 1 mm or greater (or spatial frequencies less than about 1/mm) can be removed by processing as the contributions of these features to wet ball spin about a horizontal or other axis tend to be relatively small. A raw (unprocessed) profile can be spatially filtered to enhance or suppress high or low spatial frequencies. Such filtering can be required in some measurements to conform to various standards such as DIN or other standards. This filtering can be performed using processors configured to execute a Fast Fourier Transform (FFT).

Generally, a patterned roughness or texture is applied to a substantial portion of a striking surface or at least to an impact area. For wood-type golf clubs, an impact area is based on areas associated with inserts used in traditional wood golf clubs. For irons, an impact area is a portion of the striking surface within 20 mm on either side of a vertical centerline, but does not include 6.35 mm wide strips at the top and bottom of the striking surface. Generally, such patterned roughness need not extend across the entire striking surface and can be provided only in a central region that does not extend to a striking surface perimeter. Typically for hollow metal woods, at least some portions of the striking surface at the striking surface perimeter lack pattern roughness in order to provide an area suitable for attachment of the striking plate to the head body.

Striking surface roughness can be characterized based on a variety of parameters. A surface profile is obtained over a sampling length of the striking surface and surface curvatures removed as noted above. An arithmetic mean $R_a$ is defined a mean value of absolute values of profile deviations from a mean line over a sampling length of the surface. For a surface profile over the sampling length that includes N surface samples each of which is associated with a mean value of deviations $Y_i$, from the mean line, the arithmetic mean $R_a$ is:

$$R_a = \frac{1}{N}\sum_{i=1}^{N}|Y_i|,$$

wherein i is an integer i=1, . . . , N. The sampling length generally extends along a line on the striking surface over a substantial portion or all of the striking area, but smaller samples can be used, especially for a patterned roughness that has substantially constant properties over various sample lengths. Two-dimensional surface profiles can be similarly used, but one-dimensional profiles are generally satisfactory and convenient. For convenience, this arithmetic mean is referred to herein as a mean surface roughness.

A surface profile can also be further characterized based on a reciprocal of a mean width $S_m$ of the profile elements. This parameter is used and described in one or more standards set forth by, for example, the German Institute for Standardization (DIN) or the International Standards Organization (ISO). In order to establish a value for $S_m$, an upper count level (an upward surface deviation associated with a peak) and a lower count level (a downward surface deviation associated with a valley) are defined. Typically, the upper count level and the lower count level are defined as values that are 5% greater than the mean line and 5% less than the mean line, but other count levels can be used. A portion of a surface profile projecting upward over the upper count level is called a profile peak, and a portion projecting downward below the given lower count level is called a profile valley. A width of a profile element is a length of the segment intersecting with a profile peak and the adjacent profile valley. $S_m$ is a mean of profile element widths $S_{mi}$ within a sampling length:

$$S_m = \frac{1}{K}\sum_{i=1}^{K}S_{mi}$$

For convenience, this mean is referred to herein as a mean surface feature width.

In determining $S_m$, the following conditions are generally satisfied: 1) Peaks and valleys appear alternately; 2) An intersection of the profile with the mean line immediately before a profile element is the start point of a current profile element and is the end point of a previous profile element; and 3) At the start point of the sampling length, if either of the profile peak or profile valley is missing, the profile element width is not taken into account. Rpc is defined as a reciprocal of the mean width $S_m$ and is referred to herein as mean surface feature frequency.

Another surface profile characteristic is a surface profile kurtosis Ku that is associated with an extent to which profile samples are concentrated near the mean line. As used herein, the profile kurtosis Ku is defined as:

$$Ku = \frac{1}{R_q^4}\square\frac{1}{N}\sum_{i=1}^{N}(Y_i)^4,$$

wherein $R_q$ a square root of the arithmetic mean of the squares of the profile deviations from the mean line, i.e., $$R_q = \left(\frac{1}{N}\sum_{i=1}^{N} Y_i^2\right)^{1/2}.$$

Profile kurtosis is associated with an extent to which surface features are pointed or sharp. For example, a triangular wave shaped surface profile has a kurtosis of about 0.79, a sinusoidal surface profile has a kurtosis of about 1.5, and a square wave surface profile has a kurtosis of about 1.

Other parameters that can be used to characterize surface roughness include $R_2$ which is based on a sum of a mean of a selected number of heights of the highest peaks and a mean of a corresponding number of depths of the lowest valleys.

One or more values or ranges of values can be specified for surface kurtosis Ku, mean surface feature width $S_m$, and arithmetic mean deviation $R_a$ (mean surface roughness) for a particular golf club striking surface. Superior results are generally obtained with $R_a \leq 5$ μm, $R_{pc} \geq 30$/cm, and $K_u \geq 2.0$. However in certain embodiments, superior results are achieved with $R_a$ being between about 4 μm and 5 μm or between about 4.5 μm and 5 μm. In addition, in similar embodiments, a superior $R_{pc}$ is between about 20/cm and 30/cm or between about 22/cm and 28/cm. Finally, the $K_u$ is between about 1.5 and 2.5 or between about 1.7 and 2.2.

Wood-Type Club Heads

For convenient illustration, representative examples of striking plates and cover layers for such striking plates are set forth below with reference to wood-type golf clubs. In other examples, such striking plates can be used in iron-type golf clubs. In some examples, face plate cover layers are formed on a surface of a face plate in a molding process, but in other examples surface layers are provided as caps that are formed and then secured to a face plate.

As illustrated in FIGS. 34-37, a typical wood type (i.e., driver or fairway wood) golf club head 5205 includes a hollow body 5210 delineated by a crown 5215, a sole 5220, a skirt 5225, a striking plate 5230, and a hosel 5235. The striking plate 5230 defines a front surface, or striking face 5240 adapted for impacting a golf ball (not shown). The hosel 5235 defines a hosel bore 5237 adapted to receive a golf club shaft (not shown). The body 5210 further includes a heel portion 5245, a toe portion 5250 and a rear portion 5255. The crown 5215 is defined as an upper portion of the club head 5005 extending above a peripheral outline 5257 of the club head as viewed from a top-down direction and rearwards of the topmost portion of the striking face 5240. The sole 5220 is defined as a lower portion of the club head 5205 extending in an upwardly direction from a lowest point of the club head approximately 50% to 60% of the distance from the lowest point of the club head to the crown 5215. The skirt 5225 is defined as a side portion of the club head 5205 between the crown 5215 and the sole 5220 extending immediately below the peripheral outline 5257 of the club head, excluding the striking face 5240, from the toe portion 5250, around the rear portion 5255, to the heel portion 5245. The club head 5205 has a volume, typically measured in cubic-centimeters ($cm^3$), equal to the volumetric displacement of the club head 5205.

Figure 38:
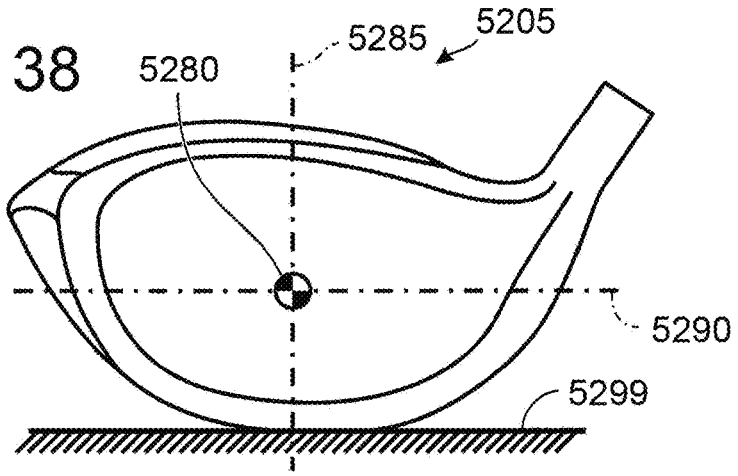
FIG. 38 is a front perspective view of a wood-type golf club head showing a golf club head center of gravity coordinate system.
Figure 39:
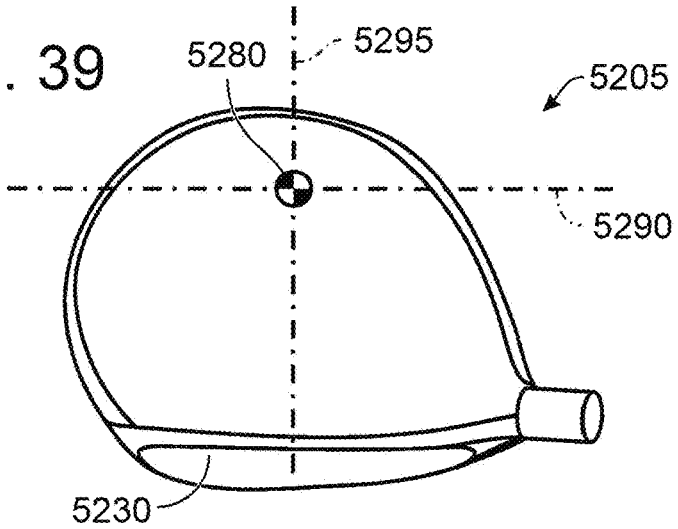
FIG. 39 is a top perspective view of a wood-type golf club head showing a golf club head center of gravity coordinate system.

Referencing FIGS. 38-39, club head coordinate axes can be defined with respect to a club head center-of-gravity (CG) 5280. A $CG_z$-axis 5285 extends through the CG 5280 in a generally vertical direction relative to the ground 5299 when the club head 5205 is at address position. A CGX-axis 5290 extends through the CG 5280 in a heel-to-toe direction generally parallel to the striking face 5240 and generally perpendicular to the $CG_z$-axis 5285. A CGy-axis 5095 extends through the CG 5280 in a front-to-back direction and generally perpendicular to the CGx-axis 5290 and the $CG_z$-axis 5285. The CGX-axis 5290 and the CGy-axis 5295 both extend in a generally horizontal direction relative to the ground when the club head 5005 is at address position. The polymer coated or capped striking plates described herein generally provide 2-15 g of additional distributable mass so that placement of the CG 5280 can be selected using this mass.

Figure 40:
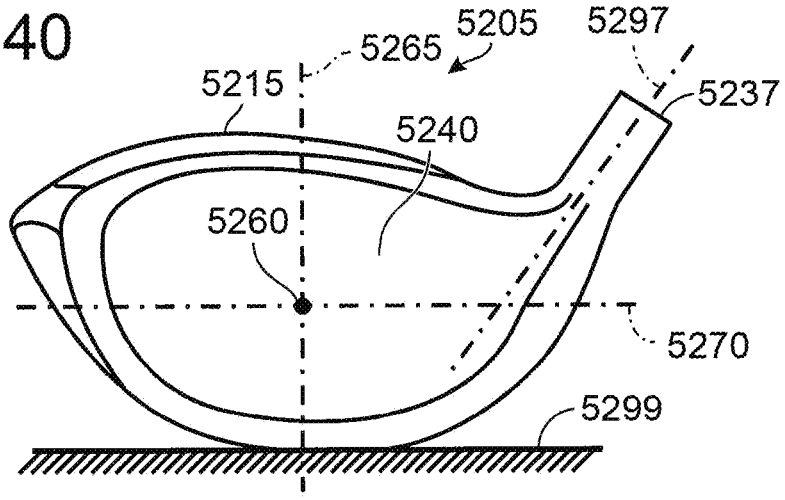
FIG. 40 is a front perspective view of a wood-type golf club head showing a golf club head origin coordinate system.
Figure 41:
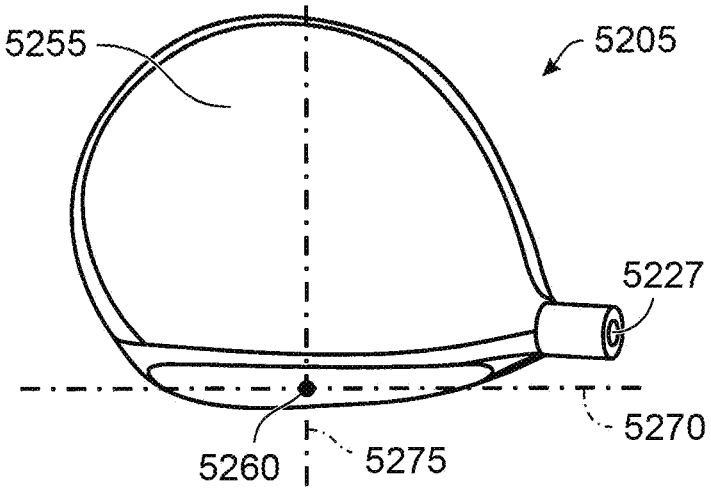
FIG. 41 is a top perspective view of a wood-type golf club head showing a golf club head origin coordinate system.

A club head origin coordinate system can also be used. Referencing FIGS. 40-41, a club head origin 5260 is represented on club head 5205. The club head origin 5260 is positioned at an approximate geometric center of the striking face 5240 (i.e., the intersection of the midpoints of the striking face's height and width, as defined by the USGA "Procedure for Measuring the Flexibility of a Golf Clubhead," Revision 2.0).

The head origin coordinate system, with head origin 5260, includes three axes: a z-axis 5265 extending through the head origin 5260 in a generally vertical direction relative to the ground 5299 when the club head 5205 is at address position; an x-axis 5270 extending through the head origin 5060 in a heel-to-toe direction generally parallel to the striking face 5240 and generally perpendicular to the z-axis 5265; and a y-axis 5275 extending through the head origin 5260 in a front-to-back direction and generally perpendicular to the x-axis 5270 and the z-axis 5265. The x-axis 5270 and the y-axis 5275 both extend in a generally horizontal direction relative to the ground 5299 when the club head 5205 is at address position. The x-axis 5270 extends in a positive direction from the origin 5260 to the toe 5250 of the club head 5205; the y-axis 5275 extends in a positive direction from the origin 5260 towards the rear portion 5255 of the club head 5205; and the z-axis 5265 extends in a positive direction from the origin 5260 towards the crown 5215.

In a club-head according to one embodiment, a striking plate includes a face plate and a cover layer. In addition, in some examples, at least a portion of the face plate is made of a composite including multiple plies or layers of a fibrous material (e.g., graphite, or carbon, fiber) embedded in a cured resin (e.g., epoxy). Examples of suitable polymers that can be used to form the cover layer include, without limitation, urethane, nylon, SURLYN ionomers, or other thermoset, thermoplastic, or other materials. The cover layer defines a striking surface that is generally a patterned, roughened, and/or textured surface as described in detail below. Striking plates based on composites typically permit a mass reduction of between about 5 g and 20 g in comparison with metal striking plates so that this mass can be redistributed.

Figure 44:
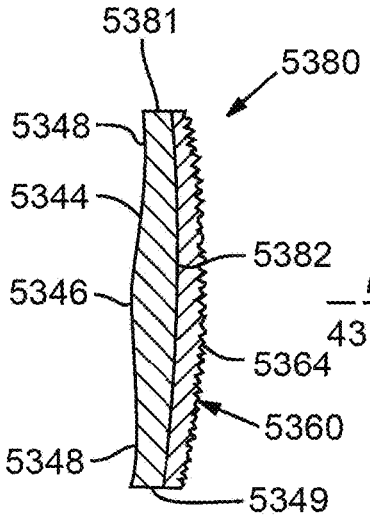
FIGS. 42-44 illustrate a striking plate that includes a face plate and a cover layer having a striking surface with a patterned roughness.
Figure 42:
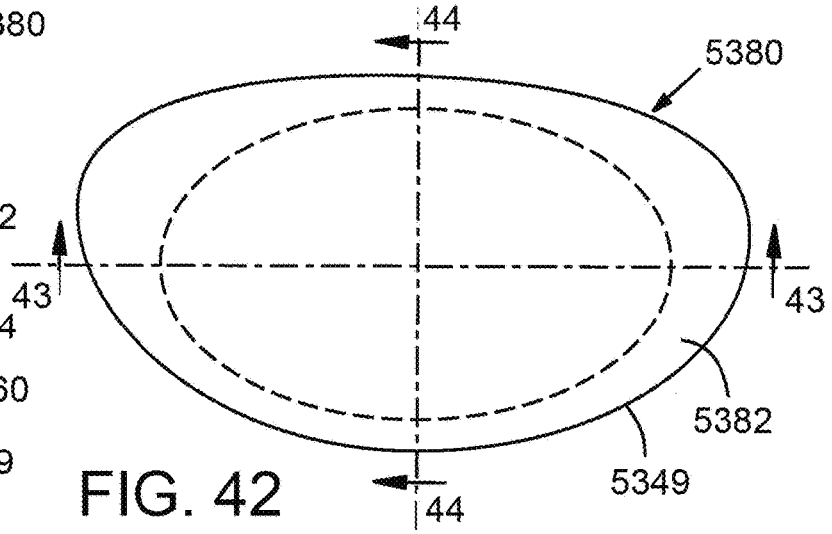
Figure 43:
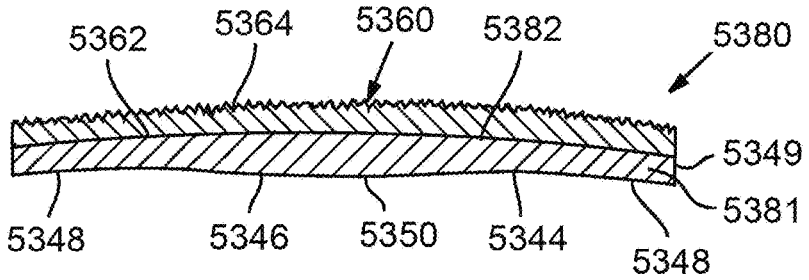

In the example shown in FIGS. 42-44, a striking plate 5380 includes a face plate 5381 fabricated from a plurality of prepreg plies or layers and has a desired shape and size for use in a club-head. The face plate 5381 has a front surface 5382 and a rear surface 5344. In this example, the face plate 5381 has a slightly convex shape, a central region 5346 of increased thickness, and a peripheral region 5348 having a relatively reduced thickness extending around the central region 5346. The central region 5346 in the illustrated example is in the form of a projection or cone on the rear surface having its thickest portion at a central point 5350 and gradually tapering away from the point in all directions toward the peripheral region 5348. The central point 5350 represents the approximate center of the "sweet spot" (optimal strike zone) of the striking plate 5380, but not necessarily the geometric center of the face plate 5381. The thicker central region 5348 adds rigidity to the central area of the face plate 5381, which effectively provides a more consistent deflection across the face plate. In certain embodiments, the face plate 5381 is fabricated by first forming an oversized lay-up of multiple prepreg plies that are subsequently trimmed or otherwise machined.

As shown in FIGS. 43-44, a cover layer 5360 is situated on the front surface 5382 of the face plate 5381. The cover layer 5360 includes a rear surface 5362 that is typically conformal with and bonded to the front surface 5382 of the face plate 5381, and a striking surface 5364 that is typically provided with patterned roughness so as to control or select a shot characteristic so as to provide performance similar to that obtained with conventional club construction. The cover layer 5360 can be formed of a variety of polymers such as, for example, SURLYN ionomers, urethanes, or others. Representative polymers are disclosed in U.S. patent application Ser. No. 11/685,335, filed Mar. 13, 2007 and Ser. No. 11/809,432, filed May 31, 2007 that are incorporated herein by reference. These polymers are discussed with reference to golf balls, but are also suitable for use in striking plates as described herein. In some examples, the cover layer 5360 can be co-cured with the prepreg layers that form the face plate 5381. In other examples, the cover layer 5360 is formed separately and then bonded or glued to the face plate 5381. The cover layer 5362 can be selected to provide wear resistance or ultraviolet protection for the face plate 5381, or to include a patterned striking surface that provides consistent shot characteristics during play in both wet and dry conditions. Typically, surface textures and/or patterning are configured so as to substantially duplicate the shot characteristics achieved with conventional wood clubs or metal wood type clubs with metallic striking plates. To enhance wear resistance, a Shore D hardness of the cover layer 5360 is preferably sufficient to provide a striking face effective hardness with the polymer layer applied of at least about 75, 80, or 85. In typical examples, a thickness of the cover layer 5360 is between about 0.1 mm and 3.0 mm, 0.15 mm and 2.0 mm, or 0.2 mm and 1.2 mm. In some examples, the cover layer 360 is about 0.4 mm thick.

Club face hardness or striking face hardness is generally measured based on a force required to produce a predetermined penetration of a probe of a standard size and/or shape in a selected time into a striking face of the club, or a penetration depth associated with a predetermined force applied to the probe. Based on such measurements, an effective Shore D hardness can be estimated. For the club faces described herein, the Shore D hardness scale is convenient, and effective Shore D hardnesses of between about 75 and 90 are generally obtained. In general, measured Shore D values decrease for longer probe exposures. Club face hardnesses as described herein are generally based on probe penetrations sufficient to produce an effective hardness estimate (an effective Shore D value) that can be associated with shot characteristics substantially similar to conventional wood or metal wood type golf clubs. The effective hardness generally depends on faceplate and polymer layer thicknesses and hardnesses.

Figure 45:
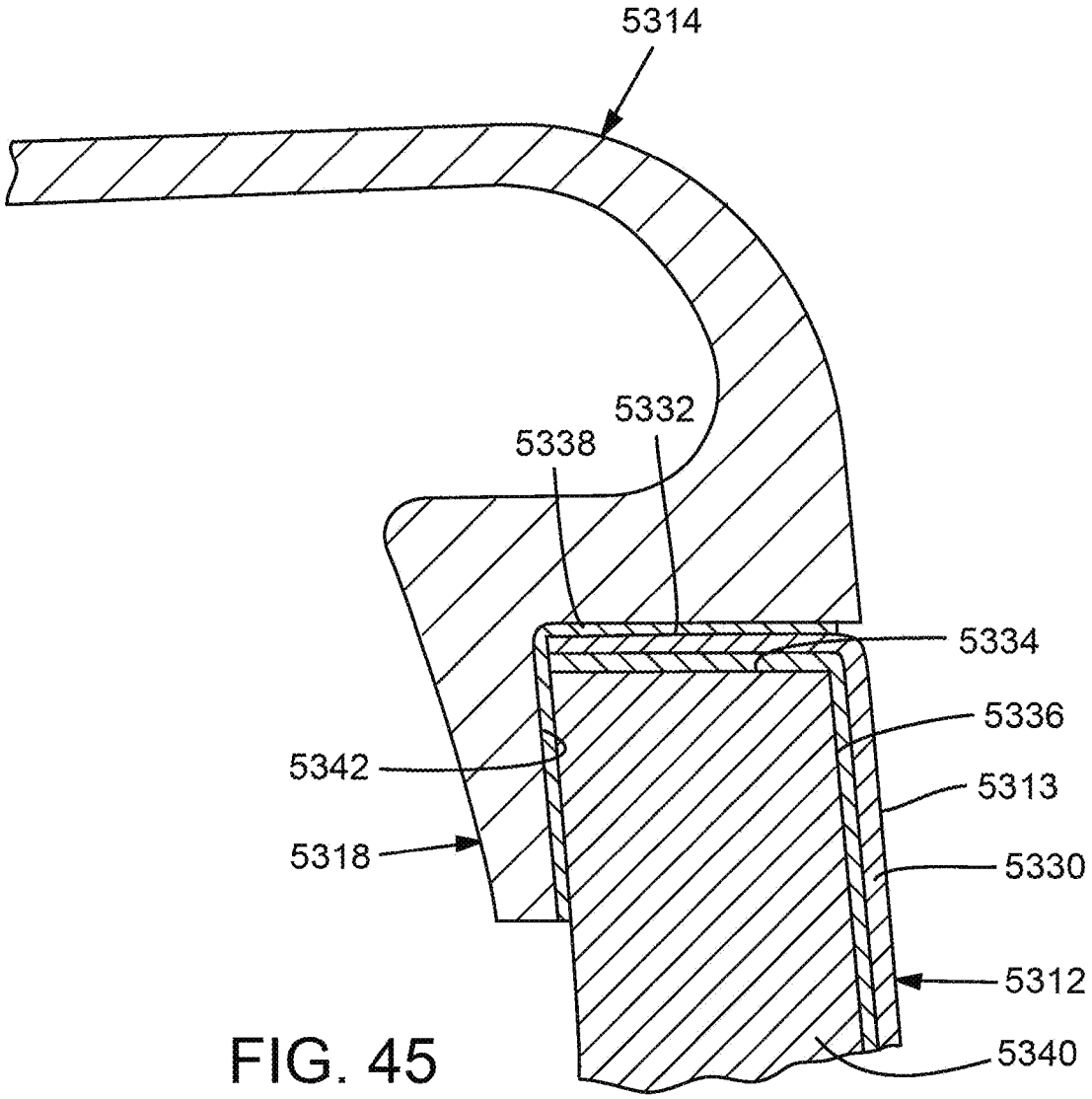
FIG. 45 illustrates attachment of a striking plate comprising a face plate and a cover layer to a club body.

As shown in FIG. 45, a striking plate 5312 comprises a cover layer 5330 formed or placed over a composite face plate 5340 to form a striking surface 5313. In other examples, the cover layer 5330 can include a peripheral rim that covers a peripheral edge 5334 of the composite face plate 5340. The rim 5332 can be continuous or discontinuous, the latter comprising multiple segments (not shown). The cover layer 5330 can be bonded to the composite plate 5340 using a suitable adhesive 5336, such as an epoxy, polyurethane, or film adhesive, or otherwise secured. The adhesive 5336 is applied so as to fill the gap completely between the cover layer 5330 and the composite plate 5340 (this gap is usually in the range of about 0.05-0.2 mm, and desirably is less than approximately 0.05 mm). Typically the cover layer 5330 is formed directly on the face plate, and the adhesive 5336 is omitted. The striking plate 5312 desirably is bonded to a club body 5314 using a suitable adhesive 5338, such as an epoxy adhesive, which completely fills the gap between the rim 5332 and the adjacent peripheral surface 5338 of the face support 5318 and the gap between the rear surface of the composite plate 5340 and the adjacent peripheral surface 5342 of the face support 5318. In the example of FIG. 45, the cover layer 5330 extends at least partially around a faceplate edge, but in other examples, a cover layer is situated only on an external surface of the face plate. As used herein, an external surface of a face plate is a face plate surface directed towards a ball in normal address position. In conventional metallic striking plates that consist only of a metallic face plate, the external surface is the striking surface.

Cover layers such as the cover layer 5330 can be formed and secured to a face plate using various methods. In one example, a striking surface of a cover layer is patterned with a mold. A selected roughness pattern is etched, machined, or otherwise transferred to a mold surface. The mold surface is then used to shape the striking surface of the cover layer for subsequent attachment to a composite face plate or other face plate. Such cover layers can be bonded with an adhesive to the face plate. Alternatively, the mold can be used to form the cover layer directly on the composite part. For example, a layer of a thermoplastic material (or pellets or other portions of such a material) can be situated on an external surface of a face plate, and the mold pressed against the thermoplastic material and the face plate at suitable temperatures and pressures so as to impress the roughness pattern on a thermoplastic layer, thereby forming a cover layer with a patterned surface. In another example, a thermoset material can be deposited on the external surface of the cover plate, and the mold pressed against the thermoset material and the face plate to provide a suitable cover layer thickness. The face plate, the thermoset material, and the mold are then raised to a suitable temperature so as to cure or otherwise fix the shape and thickness of the cover layer. These methods are examples only, and other methods can be used as may be convenient for various cover materials.

Representative Polymer Materials

Representative polymer materials suitable for face plate covers or caps are described herein.

Definitions

The term "bimodal polymer" as used herein refers to a polymer comprising two main fractions and more specifically to the form of the polymer's molecular weight distribution curve, i.e., the appearance of the graph of the polymer weight fraction as a function of its molecular weight. When the molecular weight distribution curves from these fractions are superimposed onto the molecular weight distribution curve for the total resulting polymer product, that curve will show two maxima or at least be distinctly broadened in comparison with the curves for the individual fractions.

Such a polymer product is called bimodal. The chemical compositions of the two fractions may be different.

The term "chain extender" as used herein is a compound added to either a polyurethane or polyurea prepolymer, (or the prepolymer starting materials), which undergoes additional reaction but at a level sufficiently low to maintain the thermoplastic properties of the final composition The term "conjugated" as used herein refers to an organic compound containing two or more sites of unsaturation (e.g., carbon-carbon double bonds, carbon-carbon triple bonds, and sites of unsaturation comprising atoms other than carbon, such as nitrogen) separated by a single bond.

The term "curing agent" or "curing system" as used interchangeably herein is a compound added to either polyurethane or polyurea prepolymer, (or the prepolymer starting materials), which imparts additional crosslinking to the final composition to render it a thermoset.

The term "(meth)acrylate" is intended to mean an ester of methacrylic acid and/or acrylic acid.

The term "(meth)acrylic acid copolymers" is intended to mean copolymers of methacrylic acid and/or acrylic acid.

The term "polyurea" as used herein refers to materials prepared by reaction of a diisocyanate with a polyamine.

The term "polyurethane" as used herein refers to materials prepared by reaction of a diisocyanate with a polyol.

The term "prepolymer" as used herein refers to any material that can be further processed to form a final polymer material of a manufactured golf ball, such as, by way of example and not limitation, a polymerized or partially polymerized material that can undergo additional processing, such as crosslinking.

The term "thermoplastic" as used herein is defined as a material that is capable of softening or melting when heated and of hardening again when cooled. Thermoplastic polymer chains often are not cross-linked or are lightly cross-linked using a chain extender, but the term "thermoplastic" as used herein may refer to materials that initially act as thermoplastics, such as during an initial extrusion process or injection molding process, but which also may be cross-linked, such as during a compression molding step to form a final structure.

The term "thermoplastic polyurea" as used herein refers to a material prepared by reaction of a prepared by reaction of a diisocyanate with a polyamine, with optionally addition of a chain extender.

The "thermoplastic polyurethane" as used herein refers to a material prepared by reaction of a diisocyanate with a polyol, with optionally addition of a chain extender.

The term "thermoset" as used herein is defined as a material that crosslinks or cures via interaction with as crosslinking or curing agent. The crosslinking may be brought about by energy in the form of heat (generally above 200° C.), through a chemical reaction (by reaction with a curing agent), or by irradiation. The resulting composition remains rigid when set, and does not soften with heating. Thermosets have this property because the long-chain polymer molecules cross-link with each other to give a rigid structure. A thermoset material cannot be melted and re-molded after it is cured thus thermosets do not lend themselves to recycling unlike thermoplastics, which can be melted and re-molded.

The term "thermoset polyurethane" as used herein refers to a material prepared by reaction of a diisocyanate with a polyol, and a curing agent.

The term "thermoset polyurea" as used herein refers to a material prepared by reaction of a diisocyanate with a polyamine, and a curing agent.

The term "urethane prepolymer" as used herein is the reaction product of diisocynate and a polyol.

The term "urea prepolymer" as used herein is the reaction product of a diisocyanate and a polyamine.

The term "unimodal polymer" refers to a polymer comprising one main fraction and more specifically to the form of the polymer's molecular weight distribution curve, i.e., the molecular weight distribution curve for the total polymer product shows only a single maximum.

Materials

Polymeric materials generally considered useful for making the golf club face cap according to the present invention include both synthetic or natural polymers or blend thereof including without limitation, synthetic and natural rubbers, thermoset polymers such as other thermoset polyurethanes or thermoset polyureas, as well as thermoplastic polymers including thermoplastic elastomers such as metallocene catalyzed polymer, unimodal ethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, unimodal ionomers, bimodal ionomers, modified unimodal ionomers, modified bimodal ionomers, thermoplastic polyurethanes, thermoplastic polyureas, polyamides, copolyamides, polyesters, copolyesters, polycarbonates, polyolefins, halogenated (e.g. chlorinated) polyolefins, halogenated polyalkylene compounds, such as halogenated polyethylene [e.g. chlorinated polyethylene (CPE)], polyalkenamers, polyphenylene oxides, polyphenylene sulfides, diallyl phthalate polymers, polyimides, polyvinyl chlorides, polyamide-ionomers, polyurethane-ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic copolymers, functionalized styrenic copolymers, functionalized styrenic terpolymers, styrenic terpolymers, cellulosic polymers, liquid crystal polymers (LCP), ethylene-propylene-diene terpolymers (EPDM), ethylene-vinyl acetate copolymers (EVA), ethylene-propylene copolymers, ethylene vinyl acetates, polyureas, and polysiloxanes and any and all combinations thereof.

One preferred family of polymers for making the golf club face cap of the present invention are the thermoplastic or thermoset polyurethanes and polyureas made by combination of a polyisocyanate and a polyol or polyamine respectively. Any isocyanate available to one of ordinary skill in the art is suitable for use in the present invention including, but not limited to, aliphatic, cycloaliphatic, aromatic aliphatic, aromatic, any derivatives thereof, and combinations of these compounds having two or more isocyanate (NCO) groups per molecule.

Any polyol available to one of ordinary skill in the polyurethane art is suitable for use according to the invention. Polyols suitable for use include, but are not limited to, polyester polyols, polyether polyols, polycarbonate polyols and polydiene polyols such as polybutadiene polyols.

Any polyamine available to one of ordinary skill in the polyurea art is suitable for use according to the invention. Polyamines suitable for use include, but are not limited to, amine-terminated hydrocarbons, amine-terminated polyethers, amine-terminated polyesters, amine-terminated polycaprolactones, amine-terminated polycarbonates, amine-terminated polyamides, and mixtures thereof.

The previously described diisocynate and polyol or polyamine components may be previously combined to form a prepolymer prior to reaction with the chain extender or curing agent. Any such prepolymer combination is suitable for use in the present invention. Commercially available prepolymers include LFH580, LFH120, LFH710, LFH1570, LF930A, LF950A, LF601D, LF751D, LFG963A, LFG640D.

One preferred prepolymer is a toluene diisocyanate prepolymer with polypropylene glycol. Such polypropylene glycol terminated toluene diisocyanate prepolymers are available from Uniroyal Chemical Company of Middlebury, Conn., under the trade name ADIPRENE® LFG963A and LFG640D. Most preferred prepolymers are the polytetramethylene ether glycol terminated toluene diisocyanate prepolymers including those available from Uniroyal Chemical Company of Middlebury, Conn., under the trade name ADIPRENE® LF930A, LF950A, LF601D, and LF751D.

Polyol chain extenders or curing agents may be primary, secondary, or tertiary polyols. Diamines and other suitable polyamines may be added to the compositions of the present invention to function as chain extenders or curing agents. These include primary, secondary and tertiary amines having two or more amines as functional groups.

Depending on their chemical structure, curing agents may be slow- or fast-reacting polyamines or polyols. As described in U.S. Pat. Nos. 6,793,864, 6,719,646 and copending U.S. Patent Publication No. 2004/0201133 A1, (the contents of all of which are hereby incorporated herein by reference).

Suitable curatives for use in the present invention are selected from the slow-reacting polyamine group include, but are not limited to, 3,5-dimethylthio-2,4-toluenediamine; 3,5-dimethylthio-2,6-toluenediamine; N,N'-dialkyldiamino diphenyl methane; trimethylene-glycol-di-p-aminobenzoate; polytetramethyleneoxide-di-p-aminobenzoate, and mixtures thereof. Of these, 3,5-dimethylthio-2,4-toluenediamine and 3,5-dimethylthio-2,6-toluenediamine are isomers and are sold under the trade name ETHACURE® 300 by Ethyl Corporation. Trimethylene glycol-di-p-aminobenzoate is sold under the trade name POLACURE 740M and polytetramethyleneoxide-di-p-aminobenzoates are sold under the trade name POLAMINES by Polaroid Corporation. N,N'-dialkyldiamino diphenyl methane is sold under the trade name UNILINK® by UOP. Suitable fast-reacting curing agent can be used include diethyl-2,4-toluenediamine, 4,4"-methylenebis-(3-chloro,2,6-diethyl)-aniline (available from Air Products and Chemicals Inc., of Allentown, Pa., under the trade name LONZACURE®), 3,3'-dichlorobenzidene; 3,3'-dichloro-4,4'-diaminodiphenyl methane (MOCA); N,N,N',N'-tetrakis(2-hydroxypropyl)ethylenediamine and Curalon L, a trade name for a mixture of aromatic diamines sold by Uniroyal, Inc. or any and all combinations thereof. A preferred fast-reacting curing agent is diethyl-2,4-toluene diamine, which has two commercial grades names, Ethacure® 100 and Ethacure® 100LC commercial grade has lower color and less by-product. Blends of fast and slow curing agents are especially preferred.

In another preferred embodiment the polyurethane or polyurea is prepared by combining a diisocyanate with either a polyamine or polyol or a mixture thereof and one or more dicyandiamides. In a preferred embodiment the dicyandiamide is combined with a urethane or urea prepolymer to form a reduced-yellowing polymer composition as described in U.S. Patent Application No. 60/852,582 filed on Oct. 17, 2006, the entire contents of which are herein incorporated by reference in their entirety.

Another preferred family of polymers for making the golf club face cap of the present invention are thermoplastic ionomer resins. One family of such resins was developed in the mid-1960's, by E.I. DuPont de Nemours and Co., and sold under the trademark SURLYN®. Preparation of such ionomers is well known, for example see U.S. Pat. No. 3,264,272. Generally speaking, most commercial ionomers are unimodal and consist of a polymer of a mono-olefin, e.g., an alkene, with an unsaturated mono- or dicarboxylic acids having 3 to 12 carbon atoms. An additional monomer in the form of a mono- or dicarboxylic acid ester may also be incorporated in the formulation as a so-called "softening comonomer". The incorporated carboxylic acid groups are then neutralized by a basic metal ion salt, to form the ionomer. The metal cations of the basic metal ion salt used for neutralization include $Li^+$, $Na^+$, $K^+$, $Zn^{2+}$, $Ca^{2+}$, Co2+, $Ni^{2+}$, $Cu^{2+}$, $Pb^{2+}$, and $Mg^{2+}$, with the $Li^+$, $Na^+$, $Ca^{2+}$, $Zn^{2+}$, and $Mg^{2+}$ being preferred. The basic metal ion salts include those derived by neutralization of for example formic acid, acetic acid, nitric acid, and carbonic acid. The salts may also include hydrogen carbonate salts, metal oxides, metal hydroxides, and metal alkoxides.

Today, there are a wide variety of commercially available ionomer resins based both on copolymers of ethylene and (meth)acrylic acid or terpolymers of ethylene and (meth) acrylic acid and (meth)acrylate, all of which many of which are be used as a golf club component such as a cover layer that provides a striking surface. The properties of these ionomer resins can vary widely due to variations in acid content, softening comonomer content, the degree of neutralization, and the type of metal ion used in the neutralization. The full range commercially available typically includes ionomers of polymers of general formula, E/X/Y polymer, wherein E is ethylene, X is a $C_3$ to $C_8$ $\alpha,\beta$ ethylenically unsaturated carboxylic acid, such as acrylic or methacrylic acid, and is present in an amount from about 2 to about 30 weight % of the E/X/Y copolymer, and Y is a softening comonomer selected from the group consisting of alkyl acrylate and alkyl methacrylate, such as methyl acrylate or methyl methacrylate, and wherein the alkyl groups have from 1-8 carbon atoms, Y is in the range of 0 to about 50 weight % of the E/X/Y copolymer, and wherein the acid groups present in said monomeric polymer are partially neutralized with a metal selected from the group consisting of lithium, sodium, potassium, magnesium, calcium, barium, lead, tin, zinc or aluminum, and combinations thereof.

The ionomer may also be a so-called bimodal ionomer as described in U.S. Pat. No. 6,562,906 (the entire contents of which are herein incorporated by reference). These ionomers are bimodal as they are prepared from blends comprising polymers of different molecular weights In addition to the unimodal and bimodal ionomers, also included are the so-called "modified ionomers" examples of which are described in U.S. Pat. Nos. 6,100,321, 6,329,458 and 6,616,552 and U.S. Patent Publication U.S. 2003/0158312 A1, the entire contents of all of which are herein incorporated by reference. An example of such a modified ionomer polymer is DuPont® HPF-1000 available from E. I. DuPont de Nemours and Co. Inc.

Also useful for making the golf club face cap of the present invention is a blend of an ionomer and a block copolymer. A preferred block copolymer is SEPTON HG-252. Such blends are described in more detail in commonly-assigned U.S. Pat. No. 6,861,474 and U.S. Patent Publication No. 2003/0224871 both of which are incorporated herein by reference in their entireties.

In a further embodiment, the golf club face cap of the present invention can comprise a composition prepared by blending together at least three materials, identified as Components A, B, and C, and melt-processing these components to form in-situ, a polymer blend composition incorporating a pseudo-crosslinked polymer network. Such blends are described in more detail in commonly-assigned U.S. Pat. No. 6,930,150, to Kim et al., the content of which is incorporated by reference herein in its entirety.

Component A is a monomer, oligomer, prepolymer or polymer that incorporates at least five percent by weight of at least one type of an acidic functional group. Examples of such polymers suitable for use as include, but are not limited to, ethylene/(meth)acrylic acid copolymers and ethylene/(meth)acrylic acid/alkyl (meth)acrylate terpolymers, or ethylene and/or propylene maleic anhydride copolymers and terpolymers.

As discussed above, Component B can be any monomer, oligomer, or polymer, preferably having a lower weight percentage of anionic functional groups than that present in Component A in the weight ranges discussed above, and most preferably free of such functional groups. Preferred materials for use as Component B include polyester elastomers marketed under the name PEBAX and LOTADER marketed by ATOFINA Chemicals of Philadelphia, Pennsylvania; HYTREL, FUSABOND, and NUCREL marketed by E.I. DuPont de Nemours & Co. of Wilmington, Delaware; SKYPEL and SKYTHANE by S.K. Chemicals of Seoul, South Korea; SEPTON and HYBRAR marketed by Kuraray Company of Kurashiki, Japan; ESTHANE by Noveon; and KRATON marketed by Kraton Polymers. A most preferred material for use as Component B is SEPTON HG-252. Component C is a base capable of neutralizing the acidic functional group of Component A and is a base having a metal cation. These metals are from groups IA, IB, IIA, IIB, IIIA, IIIB, IVA, IVB, VA, VB, VIA, VIB, VIIB and VIIIB of the periodic table. Examples of these metals include lithium, sodium, magnesium, aluminum, potassium, calcium, manganese, tungsten, titanium, iron, cobalt, nickel, hafnium, copper, zinc, barium, zirconium, and tin. Suitable metal compounds for use as a source of Component C are, for example, metal salts, preferably metal hydroxides, metal oxides, metal carbonates, or metal acetates. The composition preferably is prepared by mixing the above materials into each other thoroughly, either by using a dispersive mixing mechanism, a distributive mixing mechanism, or a combination of these.

In a further embodiment, the golf club face cap of the present invention can comprise a polyamide. Specific examples of suitable polyamides include polyamide 6; polyamide 11; polyamide 12; polyamide 4,6; polyamide 6,6; polyamide 6,9; polyamide 6,10; polyamide 6,12; polyamide MXD6; PA12, CX; PA12, IT; PPA; PA6, IT; and PA6/PPE.

The polyamide may be any homopolyamide or copolyamide. One example of a group of suitable polyamides is thermoplastic polyamide elastomers. Thermoplastic polyamide elastomers typically are copolymers of a polyamide and polyester or polyether. For example, the thermoplastic polyamide elastomer can contain a polyamide (Nylon 6, Nylon 66, Nylon 11, Nylon 12 and the like) as a hard segment and a polyether or polyester as a soft segment. In one specific example, the thermoplastic polyamides are amorphous copolyamides based on polyamide (PA 12). Suitable amide block polyethers include those as disclosed in U.S. Pat. Nos. 4,331,786; 4,115,475; 4,195,015; 4,839,441; 4,864,014; 4,230,848 and 4,332,920.

One type of polyetherester elastomer is the family of Pebax, which are available from Elf-Atochem Company. Preferably, the choice can be made from among Pebax 2533, 3533, 4033, 1205, 7033 and 7233. Blends or combinations of Pebax 2533, 3533, 4033, 1205, 7033 and 7233 can also be prepared, as well. Some examples of suitable polyamides for use include those commercially available under the trade names PEBAX, CRISTAMID and RILSAN marketed by Atofina Chemicals of Philadelphia, Pennsylvania, GRIVORY and GRILAMID marketed by EMS Chemie of Sumter, South Carolina, TROGAMID and VESTAMID available from Degussa, and ZYTEL marketed by E.I. DuPont de Nemours & Co., of Wilmington, Delaware.

The polymeric compositions used to prepare the golf club face cap of the present invention also can incorporate one or more fillers. Such fillers are typically in a finely divided form, for example, in a size generally less than about 20 mesh, preferably less than about 100 mesh U.S. standard size, except for fibers and flock, which are generally elongated. Filler particle size will depend upon desired effect, cost, ease of addition, and dusting considerations. The appropriate amounts of filler required will vary depending on the application but typically can be readily determined without undue experimentation.

The filler preferably is selected from the group consisting of precipitated hydrated silica, limestone, clay, talc, asbestos, barytes, glass fibers, aramid fibers, mica, calcium metasilicate, barium sulfate, zinc sulfide, lithopone, silicates, silicon carbide, diatomaceous earth, carbonates such as calcium or magnesium or barium carbonate, sulfates such as calcium or magnesium or barium sulfate, metals, including tungsten, steel, copper, cobalt or iron, metal alloys, tungsten carbide, metal oxides, metal stearates, and other particulate carbonaceous materials, and any and all combinations thereof. Preferred examples of fillers include metal oxides, such as zinc oxide and magnesium oxide. In another preferred embodiment the filler comprises a continuous or non-continuous fiber. In another preferred embodiment the filler comprises one or more so called nanofillers, as described in U.S. Pat. No. 6,794,447 and copending U.S. patent application Ser. No. 10/670,090 filed on Sep. 24, 2003 and copending U.S. patent application Ser. No. 10/926,509 filed on Aug. 25, 2004, the entire contents of each of which are incorporated herein by reference.

Another particularly well-suited additive for use in the compositions of the present invention includes compounds having the general formula:

$$(R_2N)_m—R'—(X(O)_nOR_y)_m,$$

wherein R is hydrogen, or a $C_1$-$C_{20}$ aliphatic, cycloaliphatic or aromatic systems; R' is a bridging group comprising one or more $C_1$-$C_{20}$ straight chain or branched aliphatic or alicyclic groups, or substituted straight chain or branched aliphatic or alicyclic groups, or aromatic group, or an oligomer of up to 12 repeating units including, but not limited to, polypeptides derived from an amino acid sequence of up to 12 amino acids; and X is C or S or P with the proviso that when X=C, n=1 and y=1 and when X=S, n=2 and y=1, and when X=P, n=2 and y=2. Also, m=1-3. These materials are more fully described in copending U.S. patent application Ser. No. 11/182,170, filed on Jul. 14, 2005, the entire contents of which are incorporated herein by reference. Most preferably the material is selected from the group consisting of 4,4'-methylene-bis-(cyclohexylamine)-carbamate (commercially available from R.T. Vanderbilt Co., Norwalk CT under the trade name Diak® 4), 11-aminoundecanoic acid, 12-aminododecanoic acid, epsilon-caprolactam; omega-caprolactam, and any and all combinations thereof.

If desired, the various polymer compositions used to prepare the golf club face cap of the present invention can additionally contain other conventional additives such as, antioxidants, or any other additives generally employed in plastics formulation. Agents provided to achieve specific functions, such as additives and stabilizers, can be present. Exemplary suitable ingredients include plasticizers, pigments colorants, antioxidants, colorants, dispersants, U.V. absorbers, optical brighteners, mold releasing agents, processing aids, fillers, and any and all combinations thereof. UV stabilizers, or photo stabilizers such as substituted hydroxphenyl benzotriazoles may be utilized in the present invention to enhance the UV stability of the final compositions. An example of a commercially available UV stabilizer is the stabilizer sold by Ciba Geigy Corporation under the trade name TINUVIN.

Representative "Peel Ply" Method

In another method, a layer of a so-called "peel ply" fabric is bonded to an exterior surface of a composite face plate (preferably as the face plate is fabricated) or to a striking surface on a polymer cover layer. In some examples, a thermoset material is used for the cover layer, while in other examples thermoplastic materials are used. With either type of material, the peel ply fabric is removably bonded to the cover layer (or to the face plate). The peel ply fabric is removed from the cover layer, leaving a textured or roughened striking surface. A striking surface texture can be selected based upon peel ply fabric texture, fabric orientation, and fiber size so as to achieve surface characteristics comparable to conventional metal woods and irons.

A representative peel ply based process is illustrated in FIGS. 50-52. A portion of a peel ply fabric 5602 is oriented so the woven fibers in the fabric are along an x-axis 5604 and a z-axis 5606 based on an eventual striking plate orientation in a finished club. In other examples, different orientations can be used. Peel ply fabric weave is not generally or necessarily the same along the warp and the weft directions, and in some examples, the warp and weft are aligned preferentially along selected directions. As shown in FIG. 51, a resulting striking plate 5610 includes a face plate 5612 and a cover layer 5614 that has a textured striking surface 5616. A portion of the textured striking surface 5616 is shown in FIG. 52 to illustrate the surface texture based on surface peaks 5618 that are separated by about 0.27 mm and having a height H of about 0.03 mm. In the example of FIGS. 50-52, the cover layer 5610 is about 0.5 mm thick.

Figure 53:
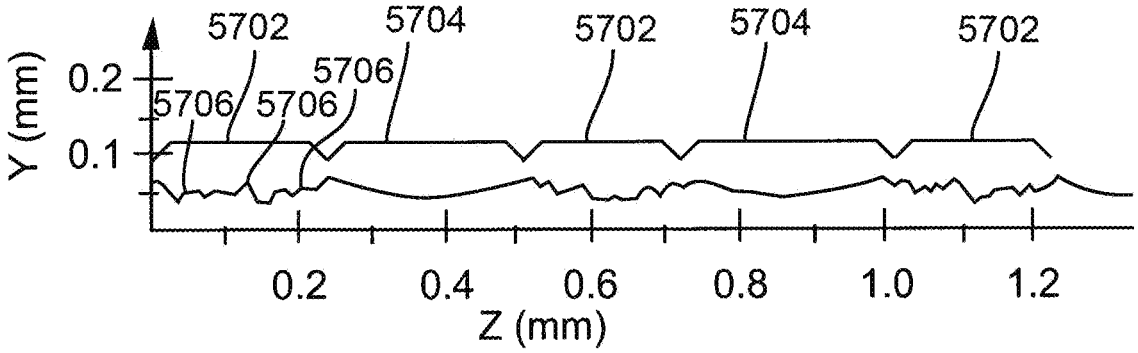
FIGS. 53-54 are surface profiles of a representative textured striking surface of polymer layer produced with a peel ply fabric.
Figure 54:
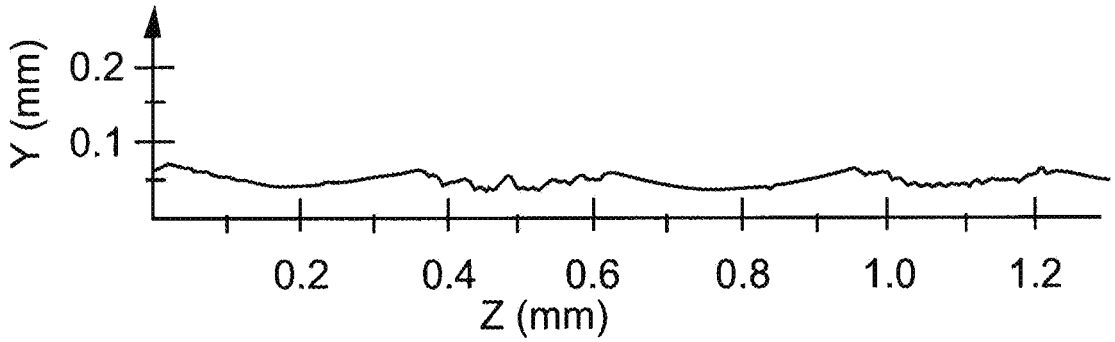
Figure 55:
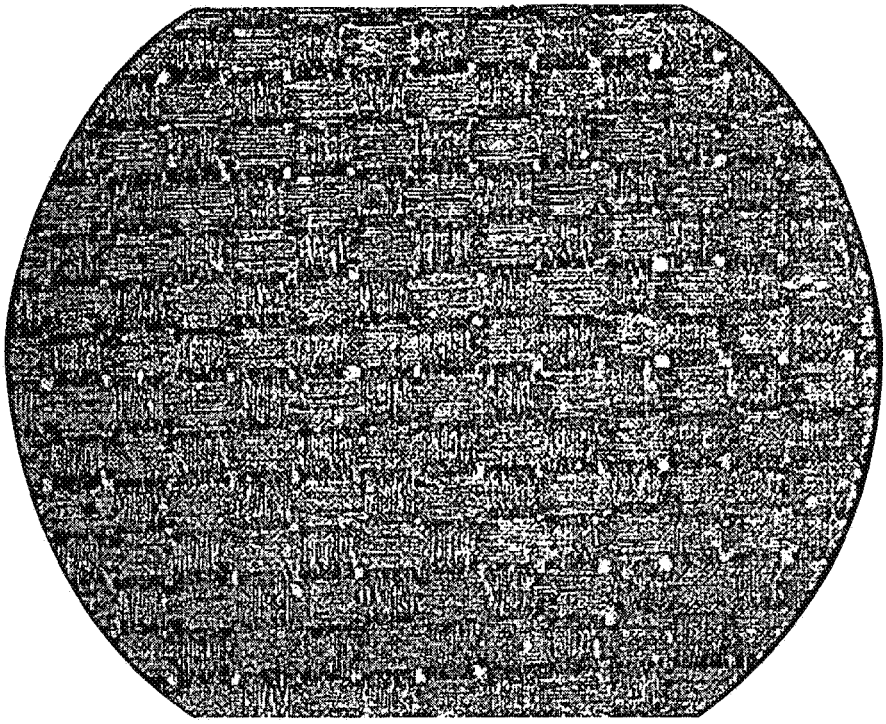
FIG. 55 is a photograph of a portion of a peel ply fabric textured surface.

Representative surface profiles of peel ply based striking surfaces are shown in FIGS. 53-54. FIG. 53 is portion of a toe-to-heel surface profile scan performed with a stylus-based surface profilometer as described further detail above. Relatively rough profile portions 5702 are separated by profile portions 5704 that correspond to more gradual surface curvatures. A plurality of peaks 5706 in the rough profile portions 5702 appear to correspond to a stylus crossing over features defined by individual peel ply fabric fibers. The smoother portions 5704 appear to correspond to stylus scanning along a feature that is defined along a fiber direction. Surface peaks have a periodic separation of about 0.5 mm and a height of about 20-30 μm. FIG. 54 is a portion of a similar scan to that of FIG. 53 but along a top-to-bottom direction. Relatively smooth and rough areas alternate, and peak spacing is about 0.6 mm, slightly larger than that in the toe-to-heel direction, likely due to differing fiber spacings in peel ply fabric warp and weft. FIG. 55 is a photograph of a portion of a striking surface formed with a peel ply fabric.

Representative Machined or Molded Surface Textures

Figure 56:
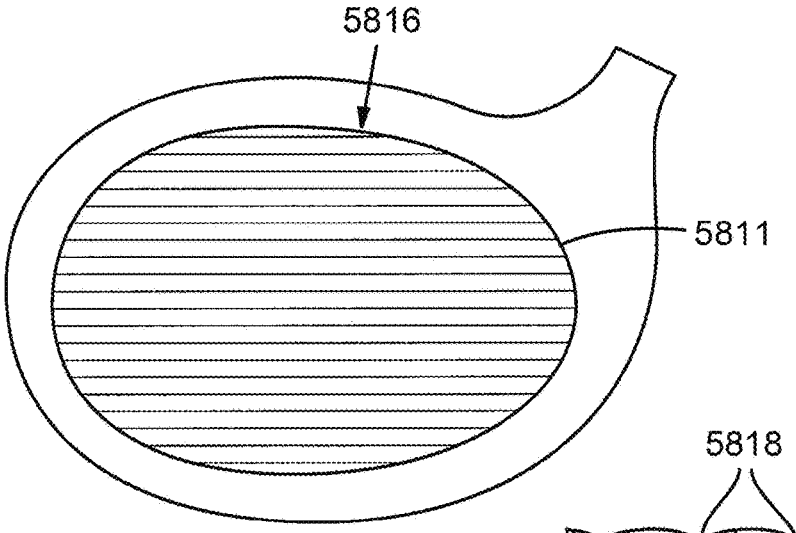
FIGS. 56-58 illustrate another representative striking plate that includes a cover layer having a roughened striking surface.
Figure 57:
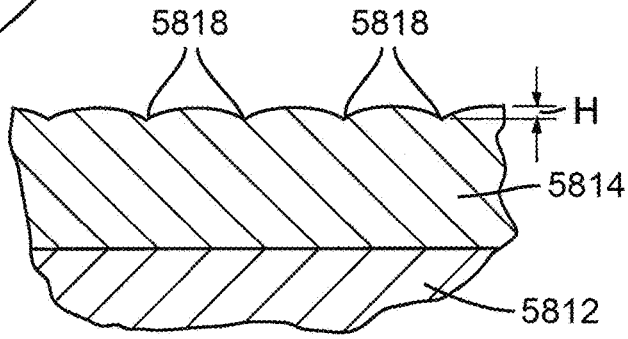
Figure 58:
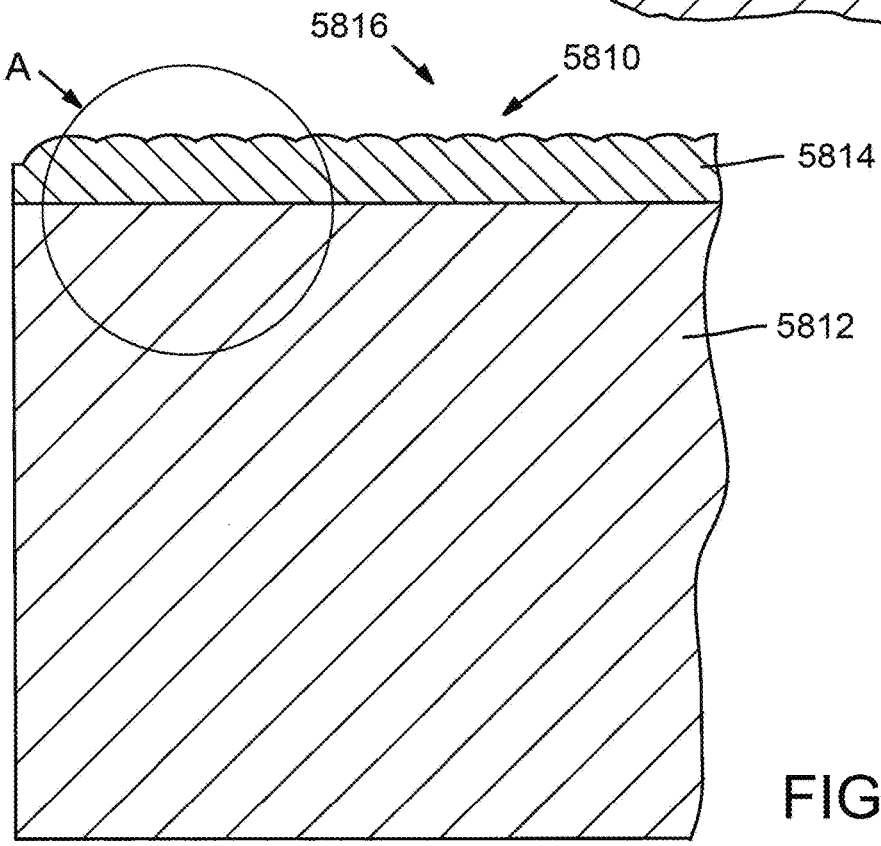
Figure 59:
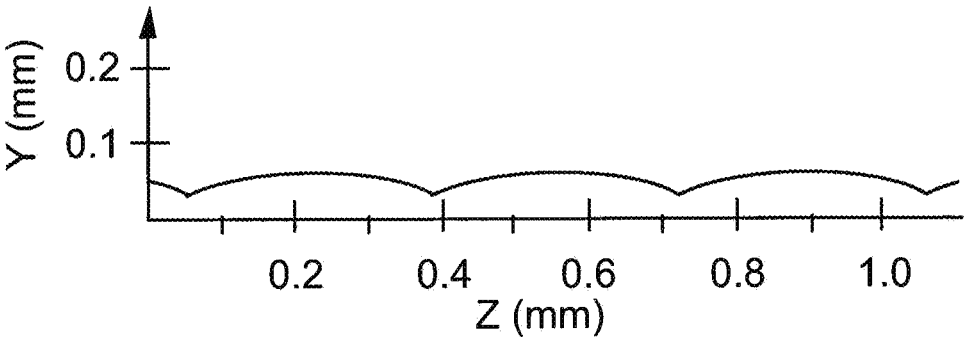
FIG. 59 is a surface profile of the roughened surface of FIGS. 56-58.
Figure 60:
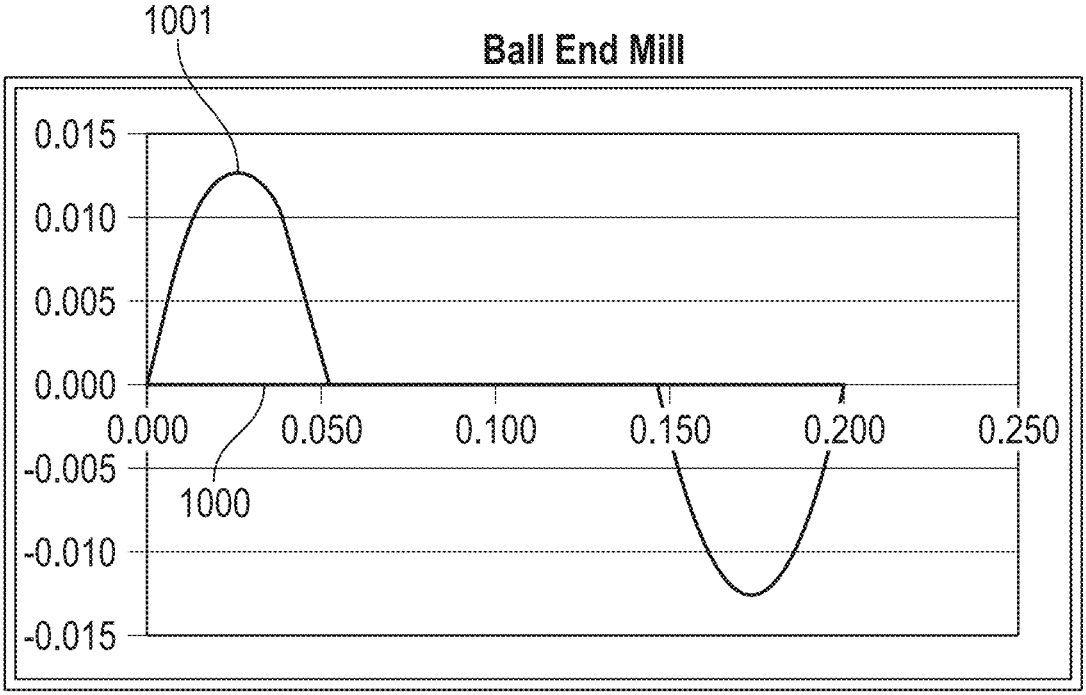
FIGS. 60-106 are graphs representing various examples of surface profiles, the y-axis of the graphs depicts the height of the peak and/or valley, the x-axis of the graphs depicts the length of the representative surface profile.
Figure 61:
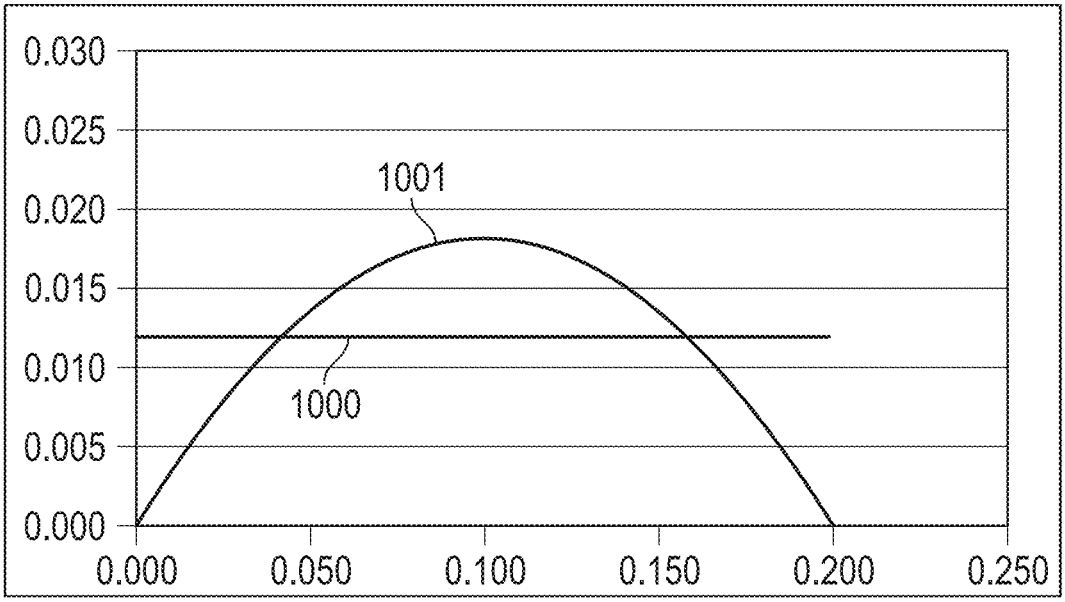
Figure 62:
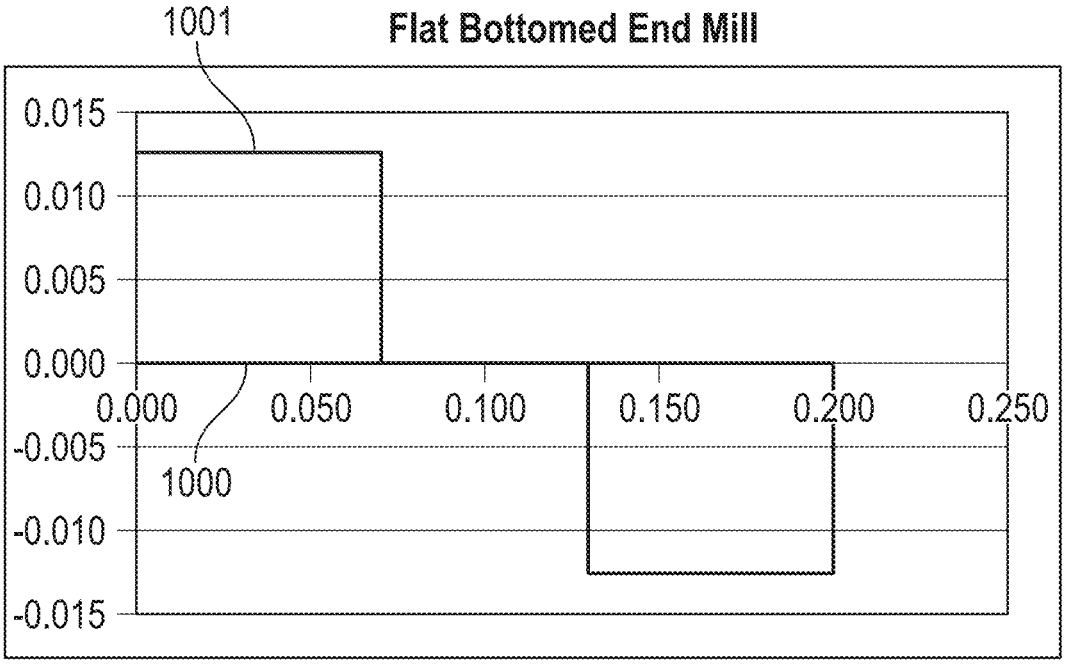
Figure 63:
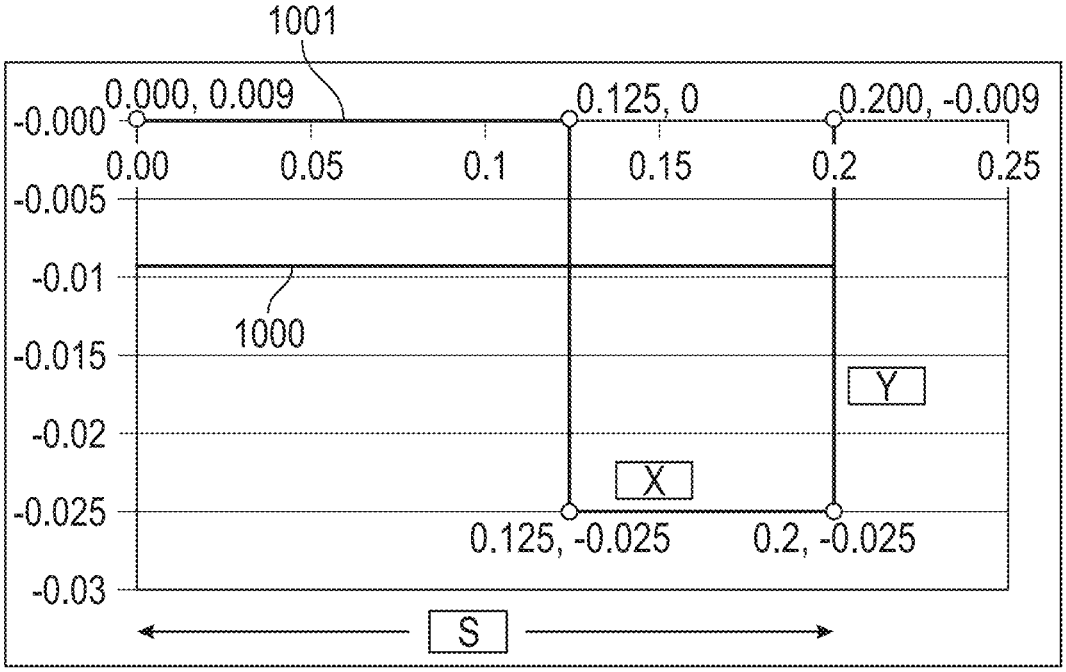
Figure 64:
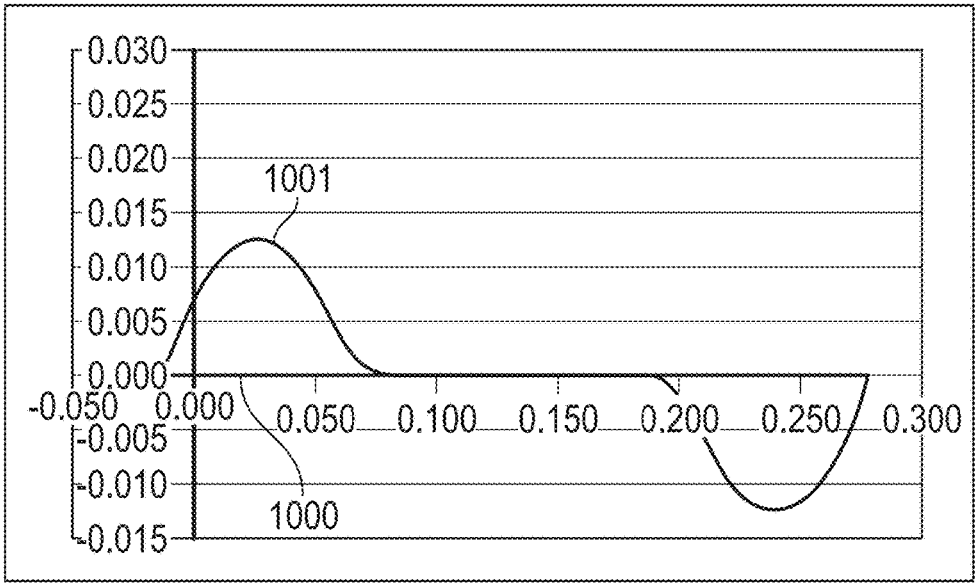
Figure 65:
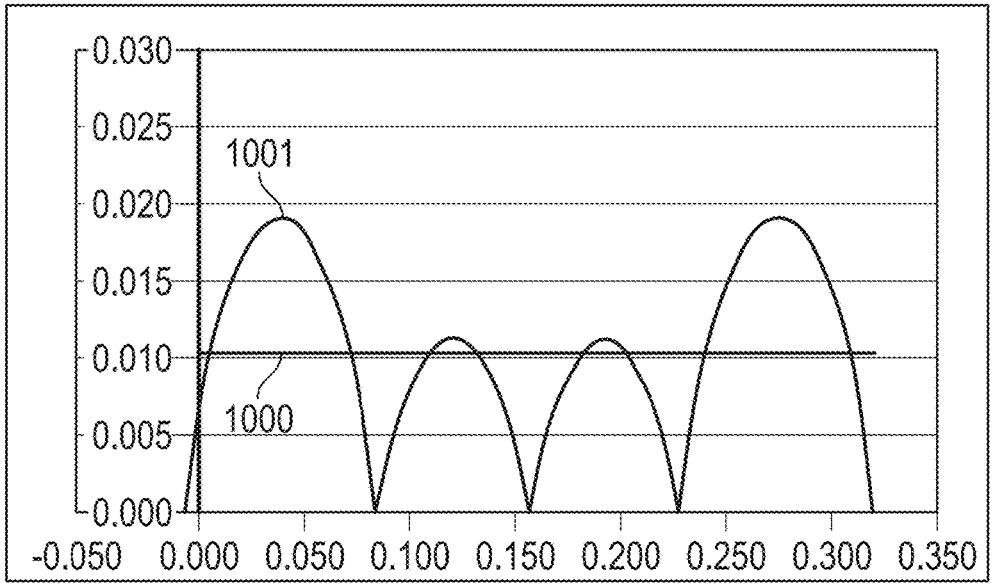
Figure 66:
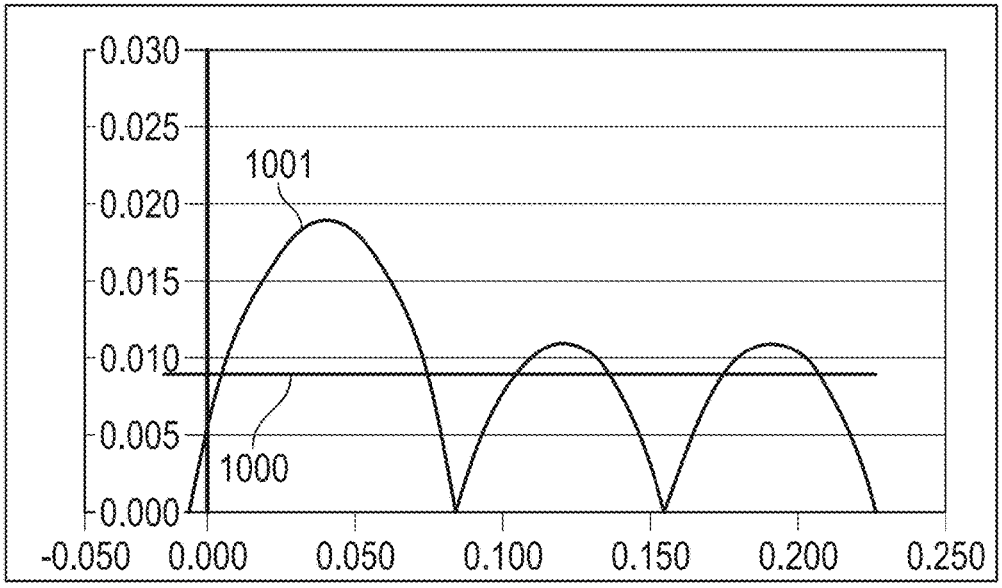
Figure 67:
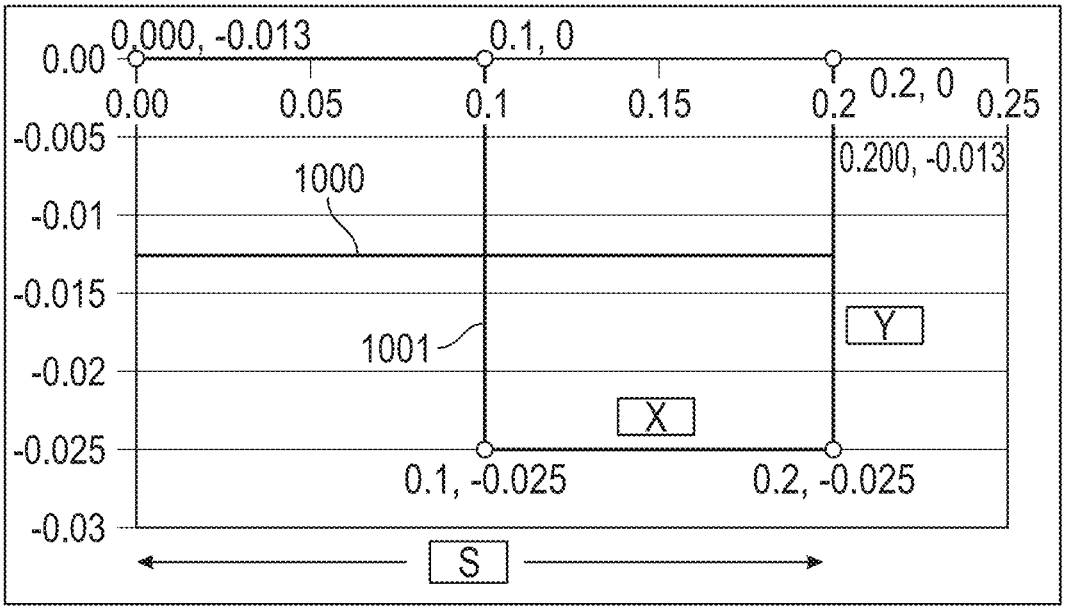
Figure 68:
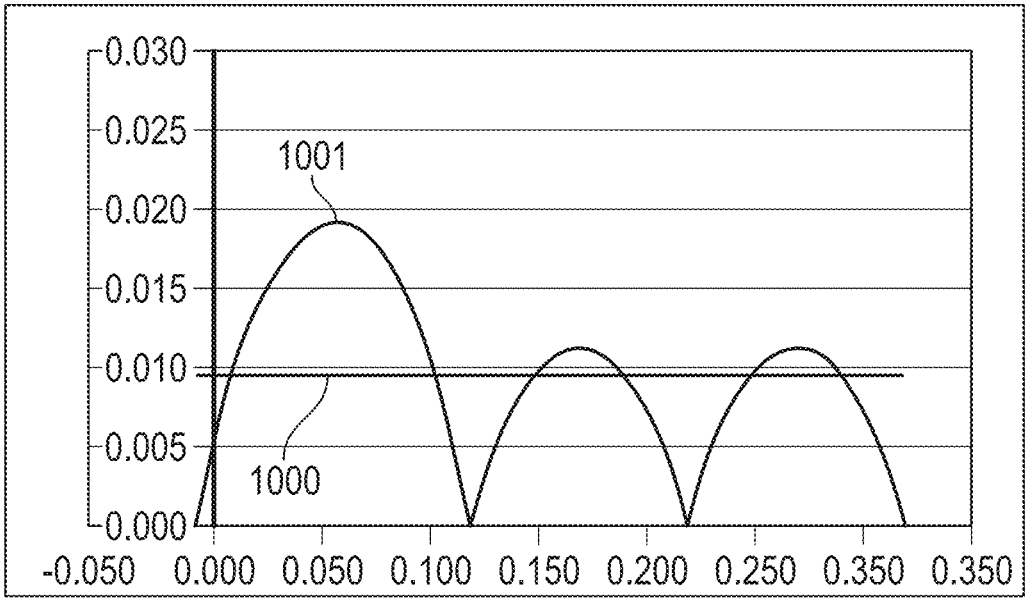
Figure 69:
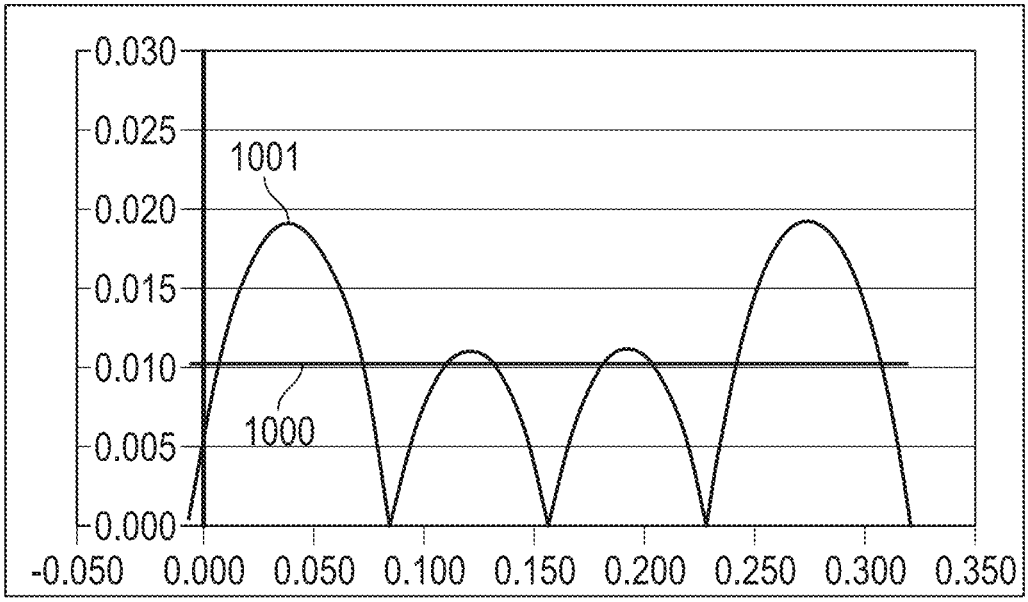
Figure 70:
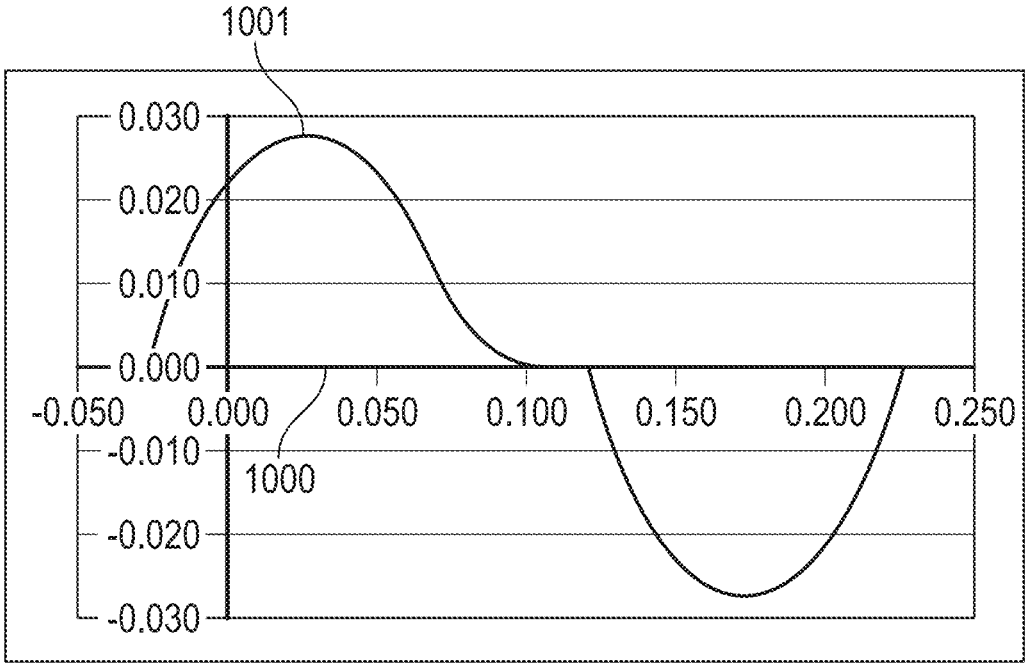
Figure 71:
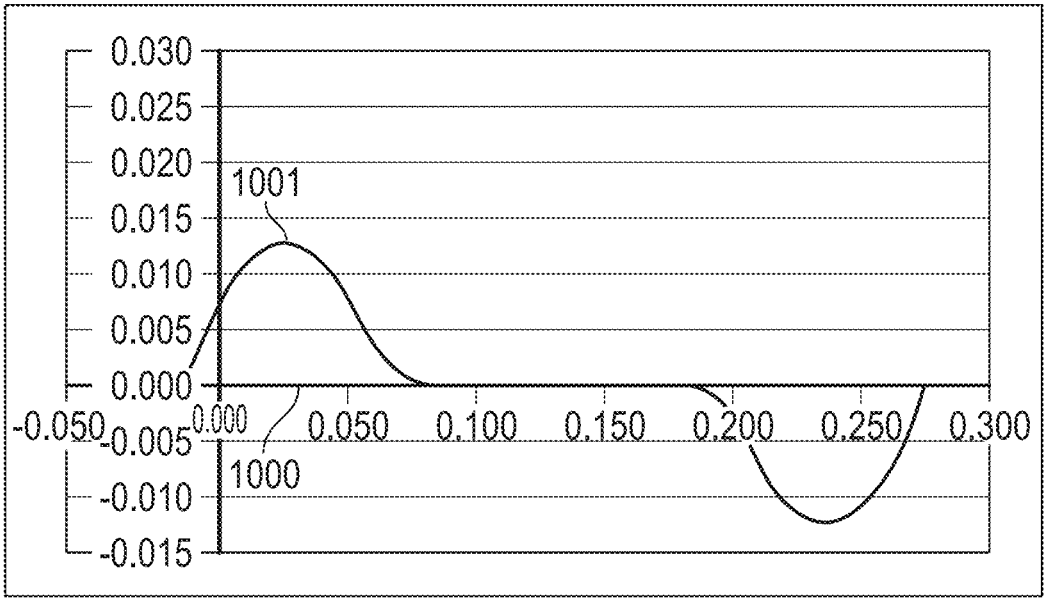
Figure 72:
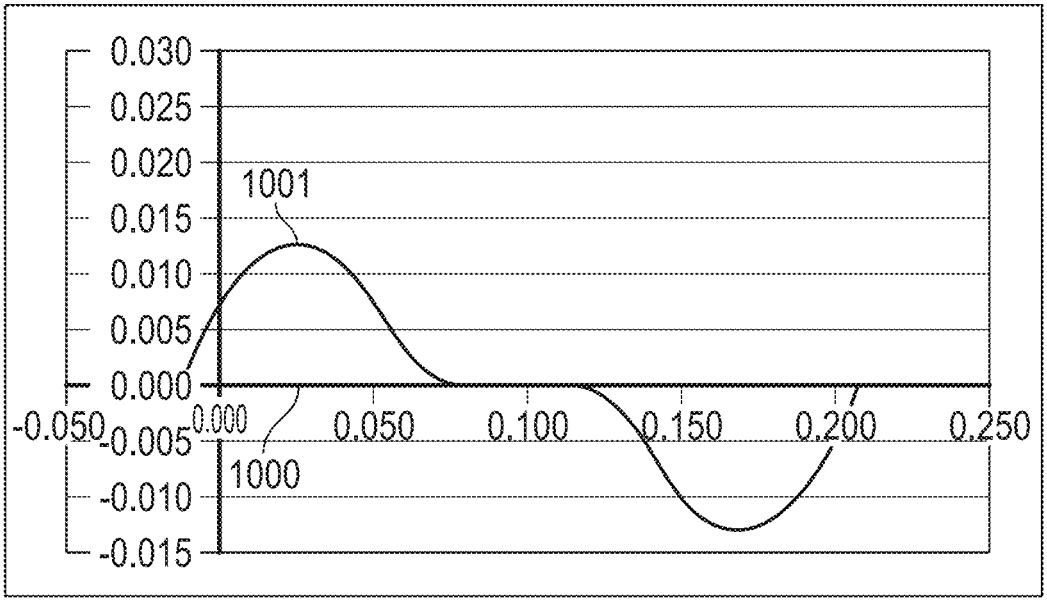
Figure 73:
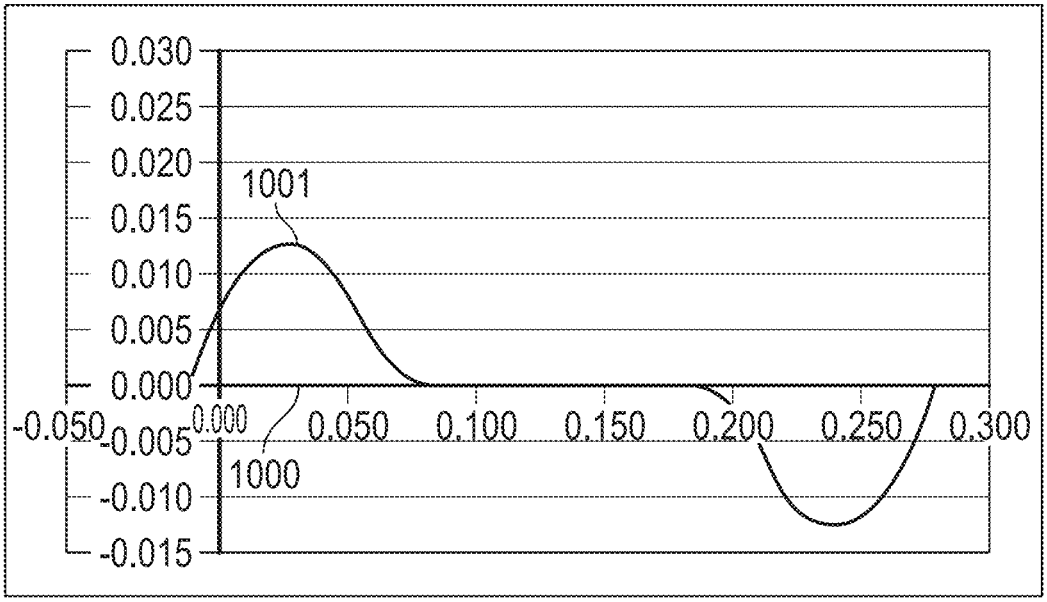
Figure 74:
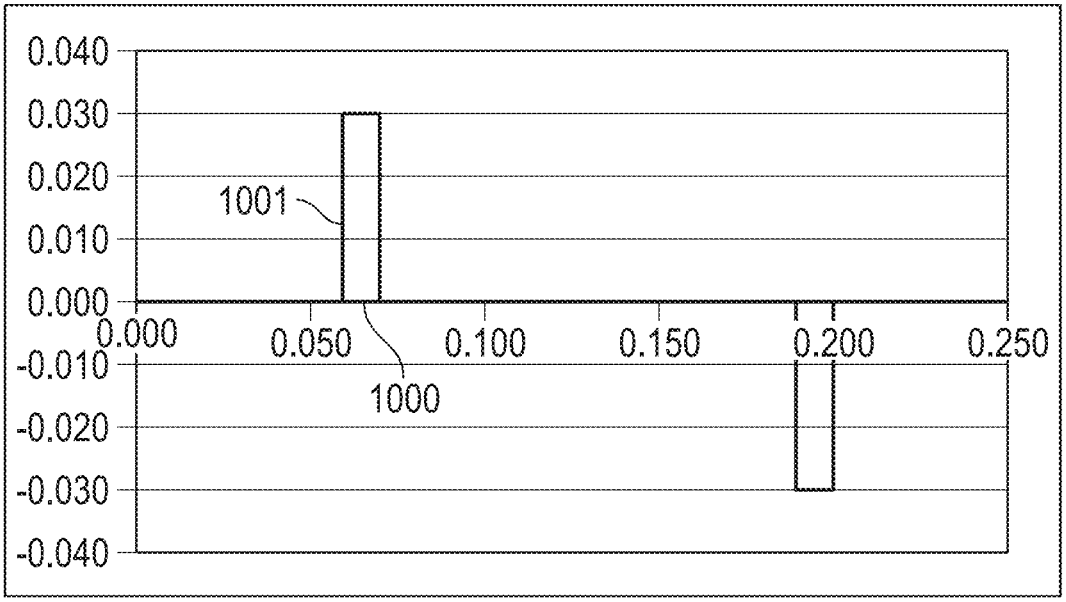
Figure 75:
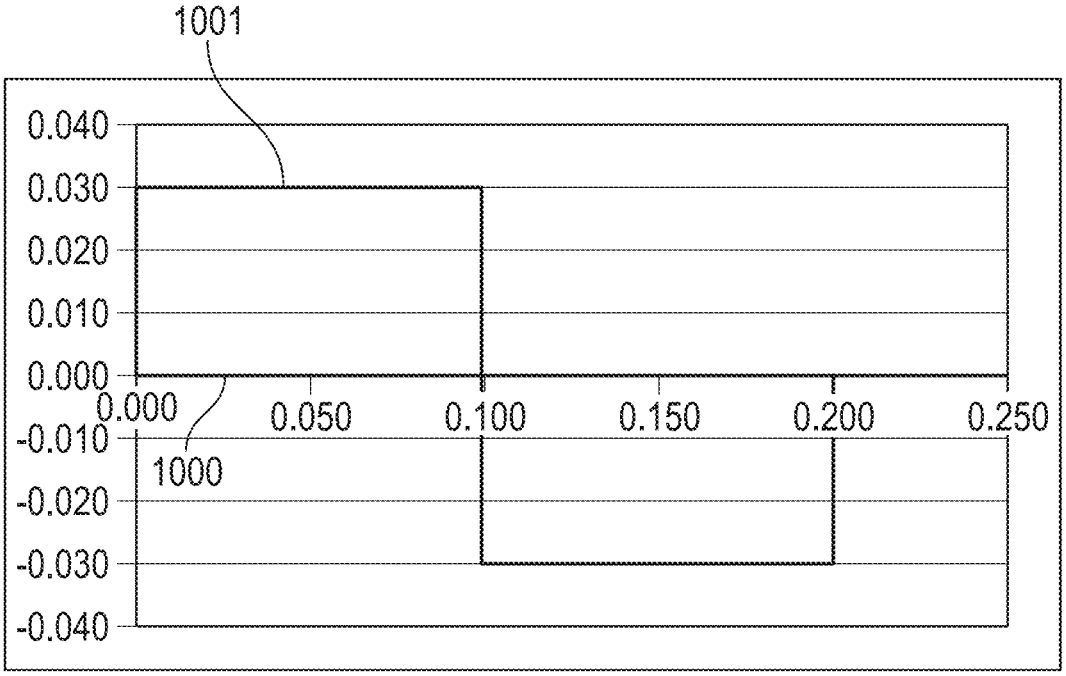
Figure 76:
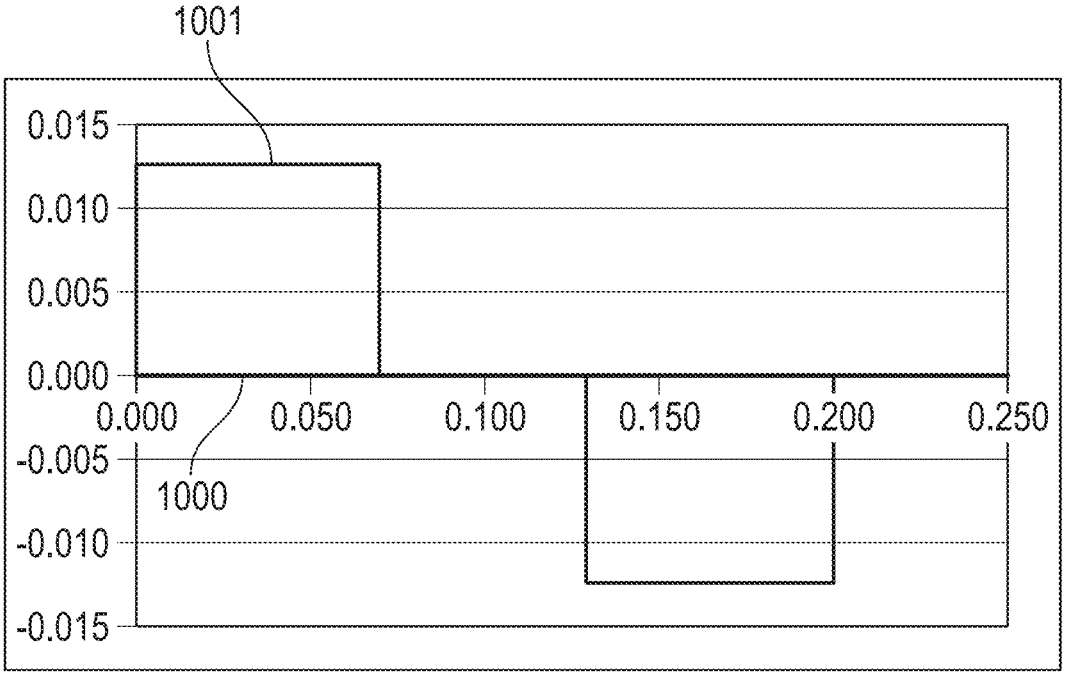
Figure 77:
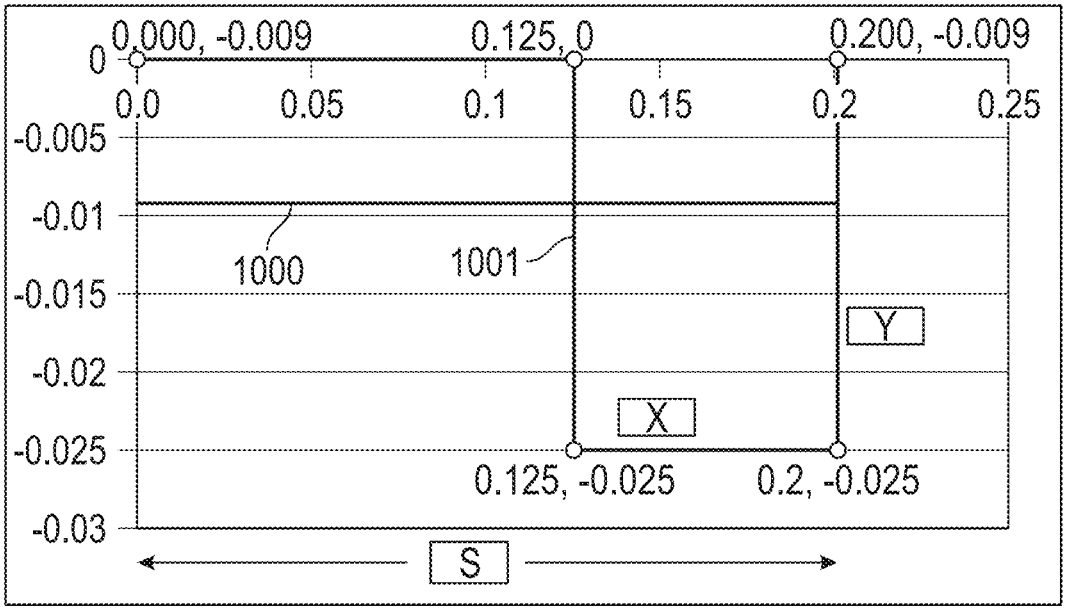

An example striking plate 5810 based on a machined or other mold is shown in FIGS. 56-58. In this example, a surface texture 5811 provided to a striking surface 5816 is aligned with respect to a club and a club head substantially along an x-axis as shown in FIG. 56. FIGS. 57-58 illustrate the texture 5811 of the striking surface 5816 that is formed as a surface of a cover layer 5814 that is situated on a face plate 5812. As shown in FIG. 58, the cover layer 5814 is about 0.5 mm thick, and the texture includes a plurality of valleys 5818 separated by about 0.34 mm and about 40 μm deep. FIG. 59 includes a portion of a stylus-based top-to-bottom surface scan of a representative polymer surface showing bumps having a center to center spacing of about 0.34 mm.

The following Table 7 summarizes surface roughness parameters associated with the scans of FIGS. 53-54 and 59. In typical examples, measured surface roughness is greater than about 0.1 μm, 1 μm, 2 μm, or 2.5 μm and less than about 20 μm, 10 μm, 5 μm, 4.5 μm, or 4 μm.

TABLE 7

| Parameter | Toe-to-Heel Scan (Tooled Mold) | Toe-to-Heel Scan (Peel Ply Shaped) | Top-to-Bottom Scan (Peel Ply Shaped) |
|---|---|---|---|
| $R_a$ | 6.90 μm | 8.31 μm | 7.07 μm |
| $R_z$ | 29.4 μm | 49.0 μm | 48.7 μm |
| $R_p$ | 9.9 μm | 26.9 μm | 27.4 μm |
| RPc | 29.7/cm | 44.4/cm | 37.6/cm |
| $K_u$ | 2.41 | | |

Figure 46:
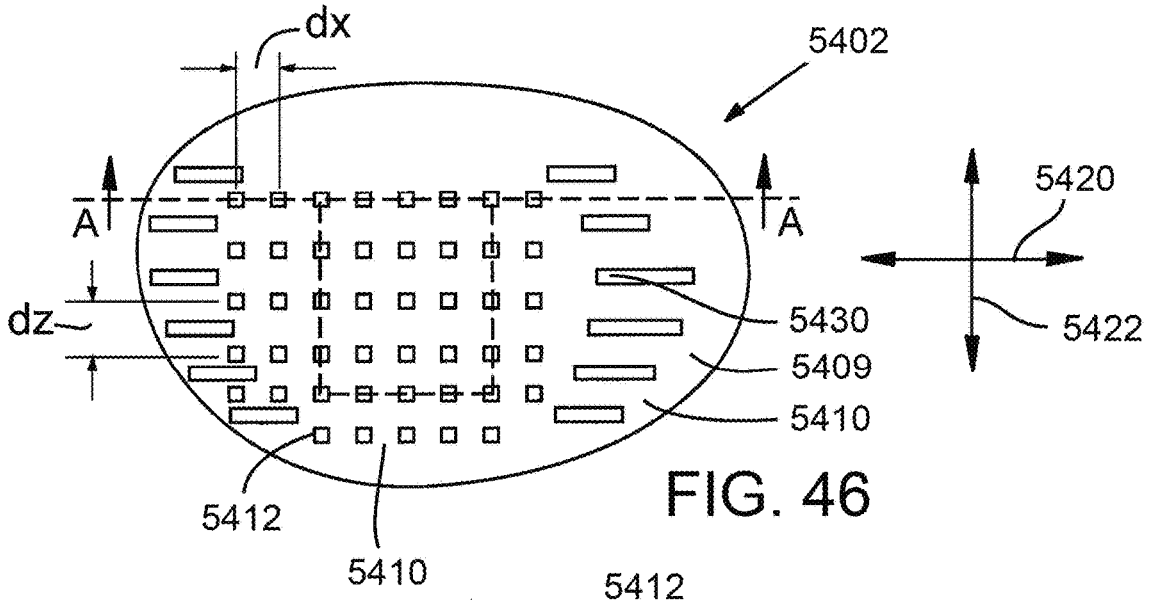
FIGS. 46-47 illustrate a representative striking plate that includes a cover layer having a roughened striking surface.
Figure 47:
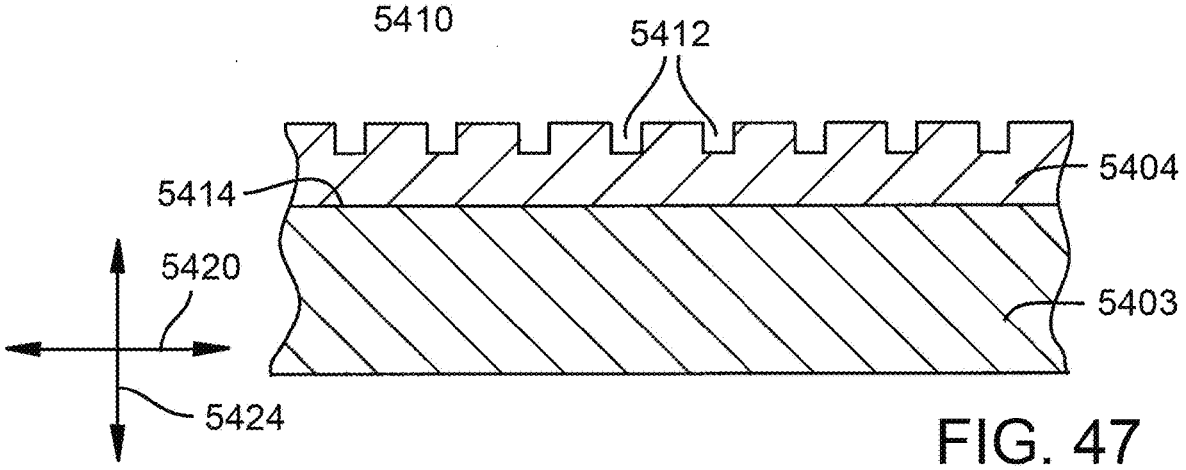

A striking surface of a cover layer can be provided with a variety of other roughness patterns some examples of which are illustrated in FIGS. 46-49. Typically these patterns extend over substantially the entire striking surface, but in some illustrated examples only a portion of the striking surface is shown for convenient illustration. Referring to FIGS. 46-47, a striking plate 5402 includes a composite face plate 5403 and a cover layer 5404. A striking surface 5409 of the cover layer includes a patterned area 5410 that includes a plurality of pattern features 5412 that are arranged in a two dimensional array. As shown in FIGS. 46-47, the pattern features 5412 are rectangular or square depressions formed in the cover layer 5404 and that extend along a +y-direction (i.e., inwardly towards an external surface 5414 of the face plate 5403). A horizontal spacing (along an x-axis 5420) of the pattern features is dx and a vertical spacing (along a z-axis 5422) is dz. These spacings can be the same or different, and the features 5412 can be inwardly or outwardly directed and can be columns or depressions having square, circular, elliptical, polygonal, oval, or other cross-sections in an xz-plane. In addition, for cross-sectional shapes that are asymmetric, the pattern features can be arbitrarily aligned with respect to the x-axis 5420 and the z-axis 5422. The pattern features 5412 can be located in a regular array, but the orientation of each of the pattern features can be arbitrary, or the pattern features can be periodically arranged along the x-axis 5420, the z-axis 5422, or another axis in the xz-plane. As shown in FIG. 46, a plurality of scorelines 5430 are provided and are typically colored so as to provide a high contrast. A maximum depth dy of the pattern features 512 along the y-axis is between about 10 μm and 100 μm, between about 5 μm and 50 μm, or about 2 μm and 25 μm. The horizontal and vertical spacings are typically between about 0.025 mm and 0.500 mm While the pattern features 5412 may have substantially constant cross-sectional dimensions in one or more planes perpendicular the xz-plane (i.e. vertical cross-sections), these vertical cross-sections can vary along a y-axis 5424 or as a function of an angle of a cross-sectional plane with respect to the x-axis, the y-axis, or the z-axis. For example, columnar protrusions can have bases that taper outwardly, inwardly, or a combination thereof along the y-axis 5424, and can be tilted with respect to the y-axis 5424.

Figure 48:
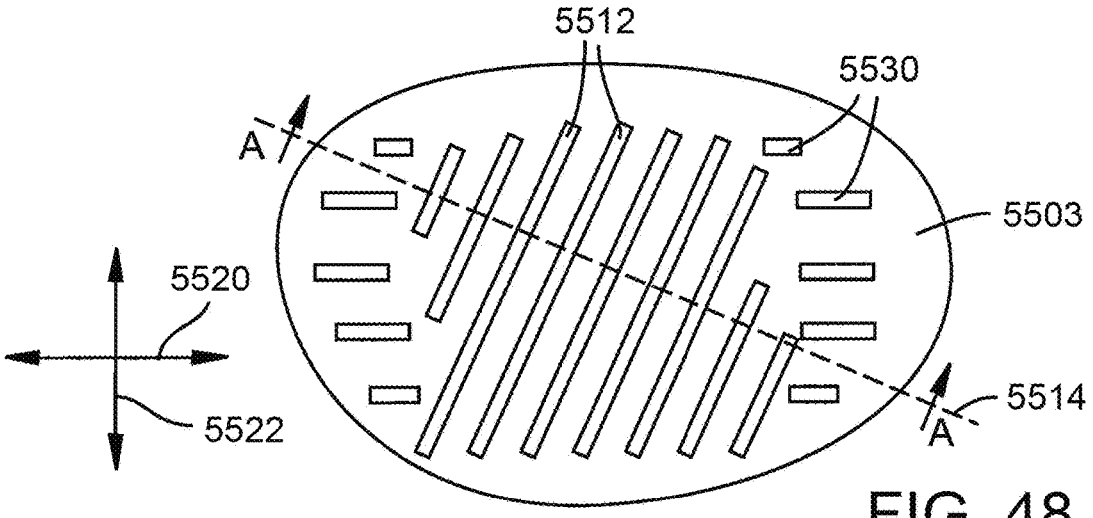
FIGS. 48-49 illustrate a representative striking plate that includes a cover layer having a roughened striking surface.
Figure 49:
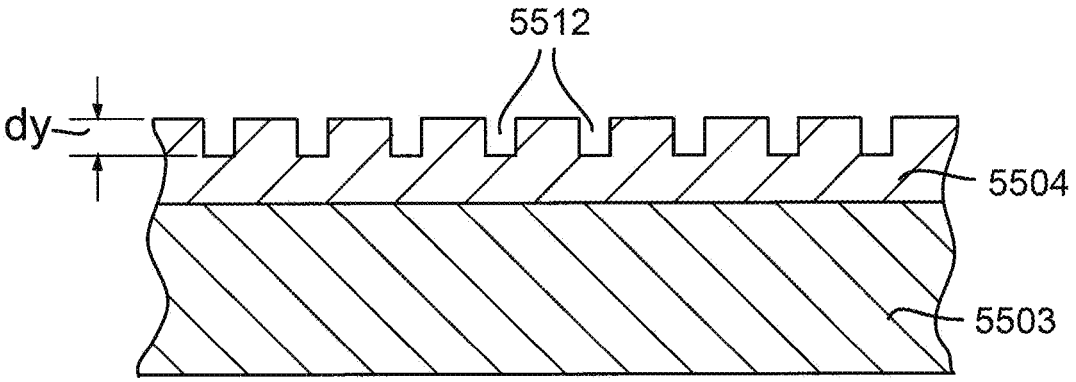

In an example shown in FIGS. 48-49, a cover layer 5504 includes a plurality of pattern features 5512 that are periodically situated along an axis 5514 that is tilted with respect to an x-axis 5520 and a z-axis 5522. The pattern features 5512 are periodic in one dimension, but in other examples, pattern features periodic along one more axes that are tilted (or aligned with) x- and z-axes can be provided. A plurality of scorelines 5530 are provided (generally in a face plate) and are colored so as to provide a high contrast. As shown in FIG. 49, the cover layer 5504 is secured to a face plate 5503 and the pattern features 5512 have a depth dy.

In other examples, pattern features can be periodic, aperiodic, or partially periodic, or randomly situated. Spatial frequencies associated with pattern features can vary, and pattern feature size and orientation can vary as well. In some examples, a roughened surface is defined as series of features that are randomly situated and sized.

Similar striking plates can be provided for iron-type golf clubs. While striking plates for wood-type golf clubs generally have top-to-bottom and toe-to-heel curvatures (commonly referred to as bulge and roll), striking plates for irons are typically flat. Composite-based striking plates for iron-type clubs typically include a polymer cover layer selected to protect the underlying composite face plate. In some examples, similar striking surface textures to those described above can be provided. In addition, one or more conventional grooves are generally provided on the striking surface. Such striking plates can be secured to iron-type golf club bodies with various adhesives or otherwise secured.

Roughness-Efficient Surfaces

Certain features of a golf club face surface are significant in terms of striking a golf ball. Surface features that are included in the $R_a$ calculation, but do not aid in striking the ball, can be removed or minimized without compromising the performance of the golf club face. Removing or minimizing such features can enable the addition of more performance-effective features for a given $R_a$.

One approach for achieving a "roughness-efficient" surface profile is to make non-critical transition segments that are between critical ball-striking segments (e.g., a peak or a valley) occur as closely to the mean line of the profile as possible. The most efficient approach is to have the transition segment fall directly on, or near to, the mean line. Thus, in one embodiment, a substantial portion of the transition segment is near to, or on, the mean line. For example, at least 50%, particularly at least 75%, more particularly at least 90%, and most particularly 100%, of the transition segment is near to, or on, the mean line. In certain embodiments, at least 50%, particularly at least 75%, more particularly at least 90%, and most particularly 100%, of the transition segment is on the mean line. In one embodiment, the phrase "on the mean line" can be defined as the portion of a segment that is within about 10% of the mathematically calculated mean line, defined herein.

A further efficient approach is to make the transitions between the mean line and the critical peaks and valleys occur as quickly as possible (i.e., transition segments with steep slopes). For instance, the transition segment may include a portion having a slope of at least 30°, more particularly at least 45°, and most particularly, at least 75°, relative to the mean line. The sloped portion may constitute at least 25%, particularly at least 50%, more particularly at least 75%, and most particularly 100%, of the transition segment. In particular embodiments, the transition segment may include a first portion that is a straight line that lies on the mean line, and a second portion that is a line having a slope relative to the mean line as described above.

Figure 78:
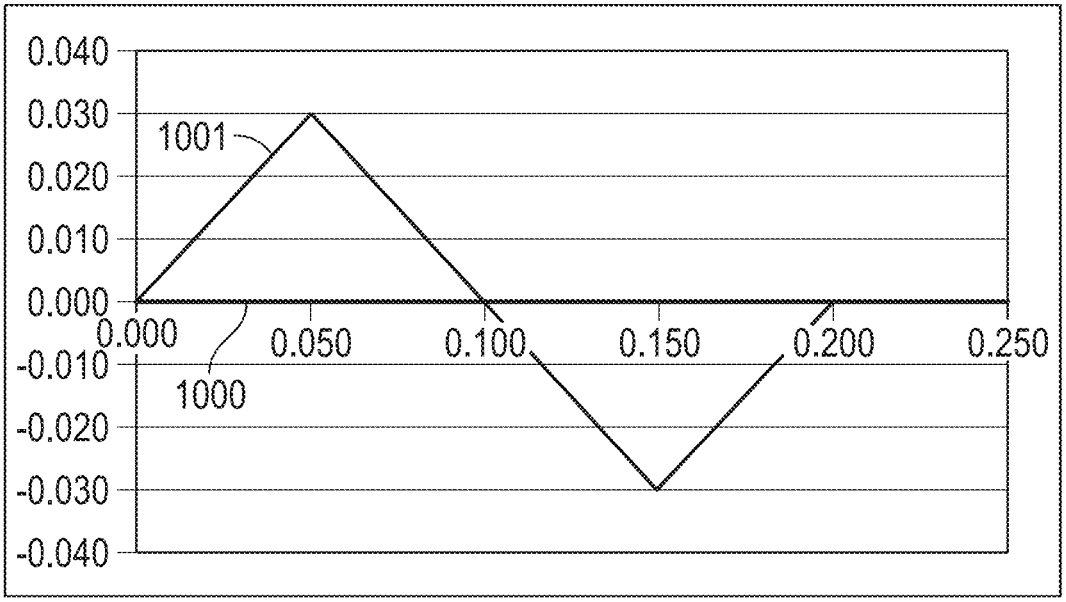
Figure 79:
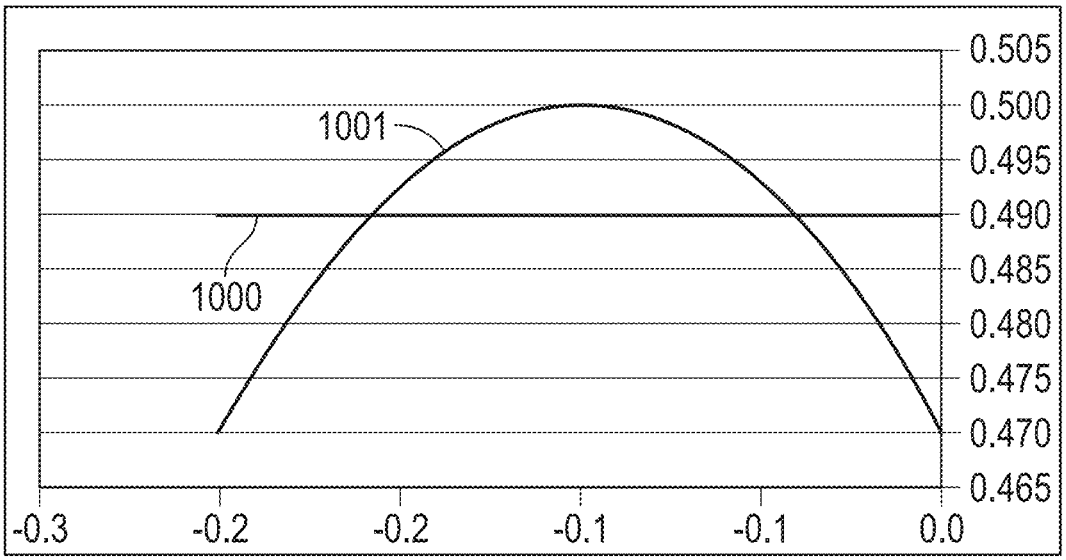
Figure 80:
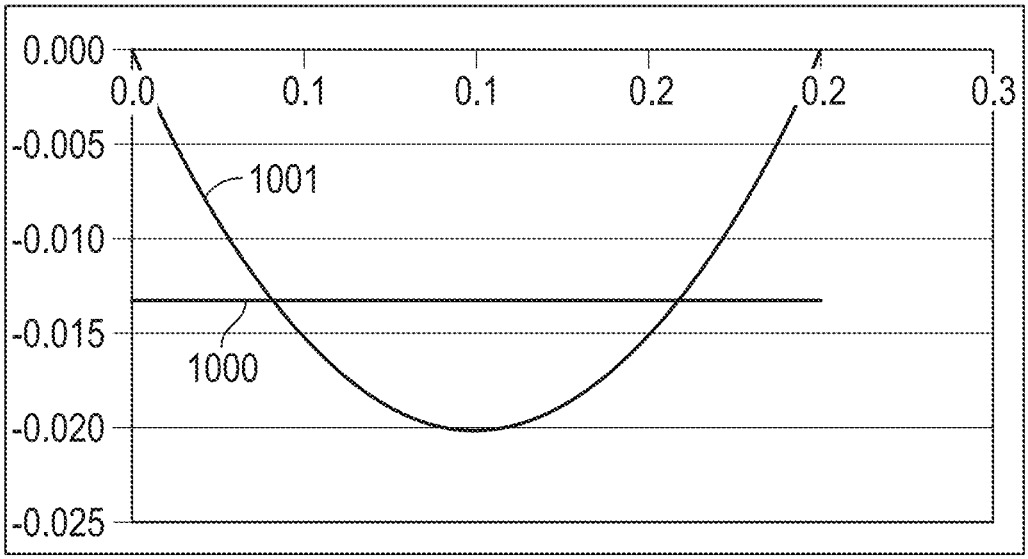
Figure 81:
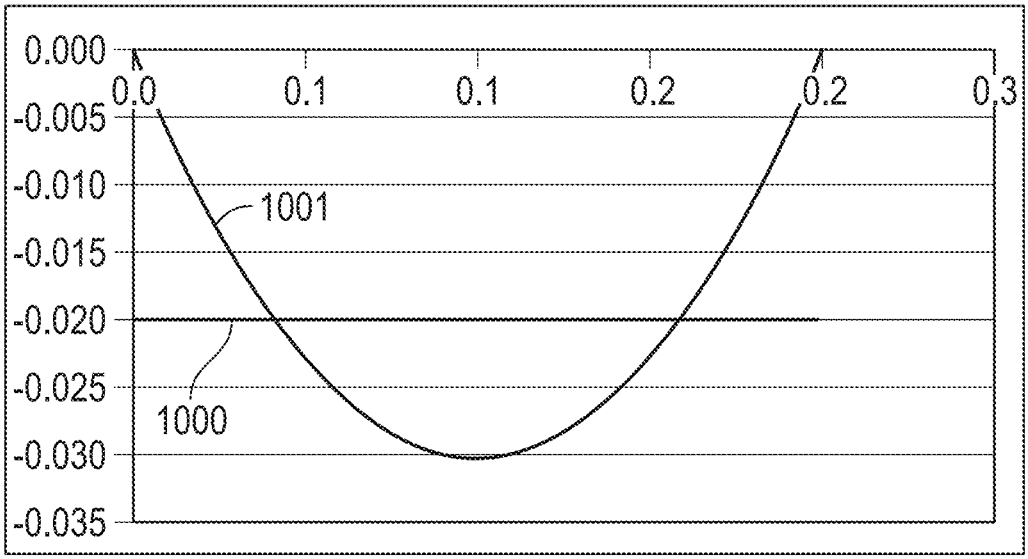
Figure 82:
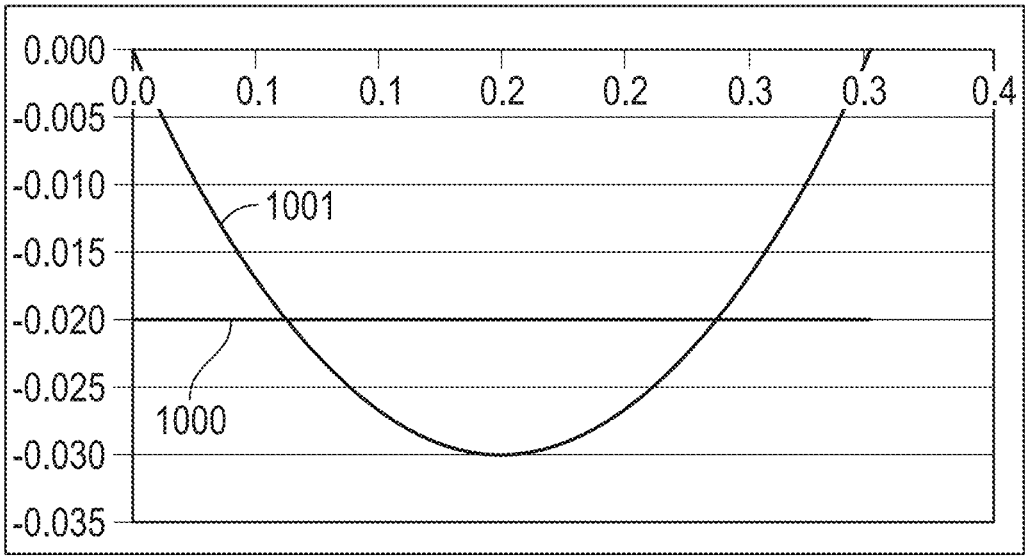
Figure 83:
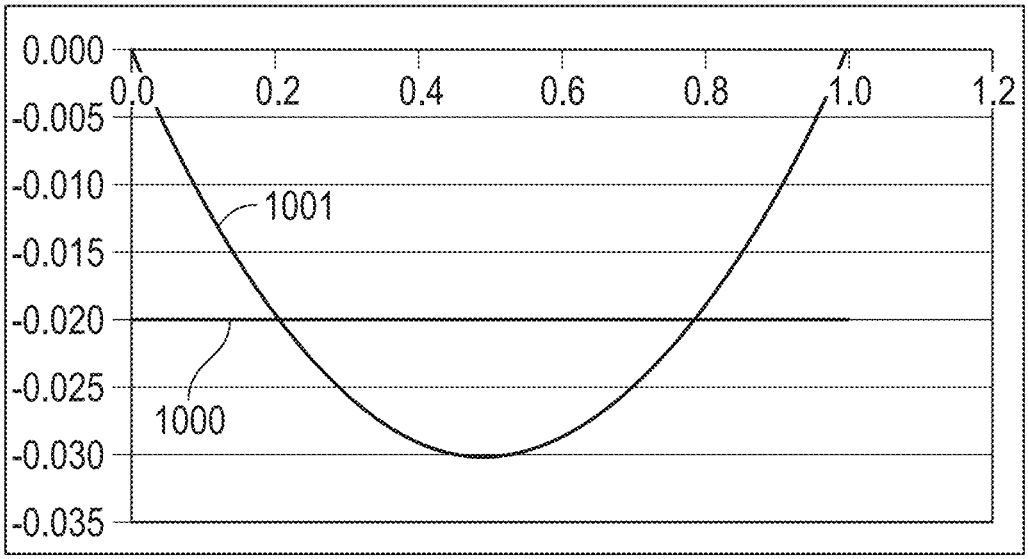
Figure 84:
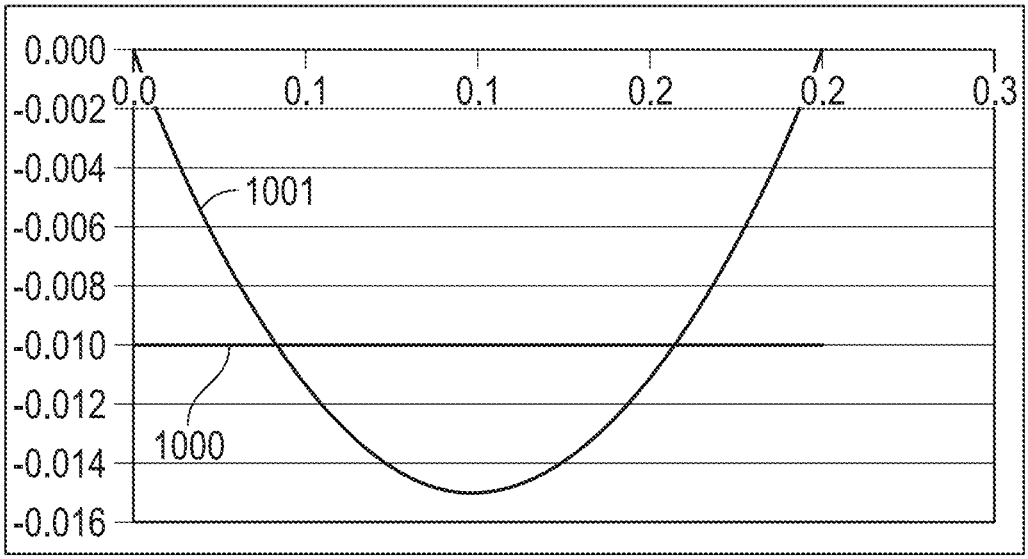
Figure 85:
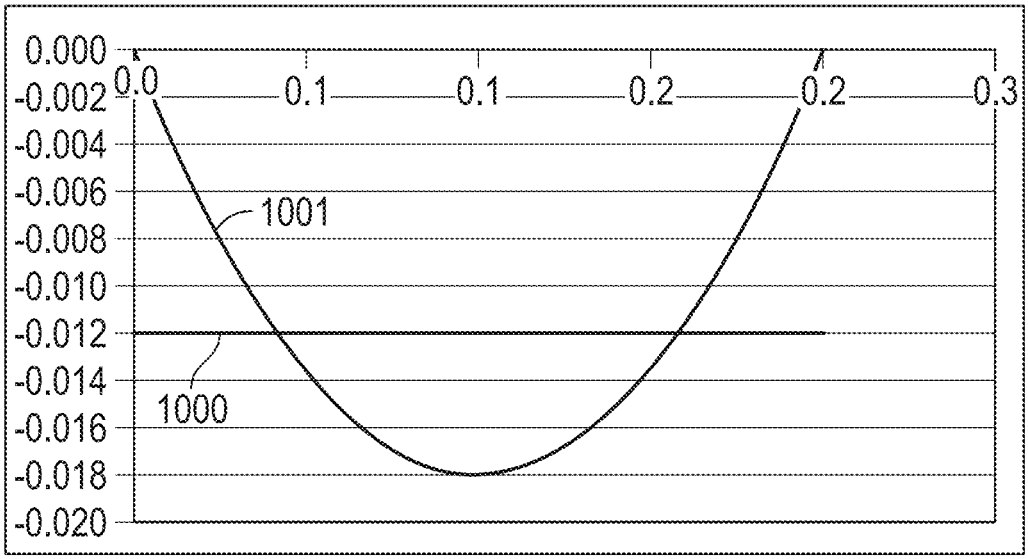
Figure 86:
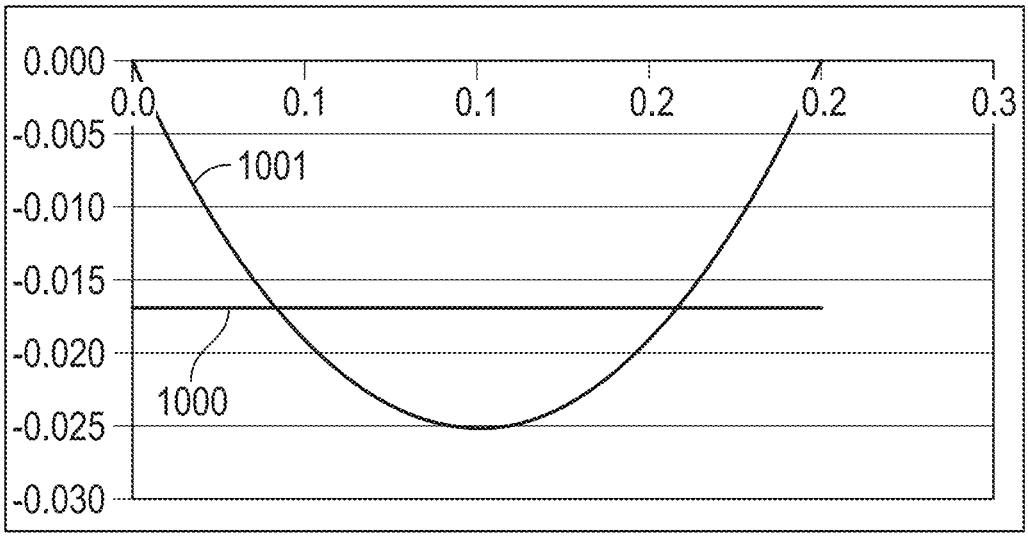
Figure 87:
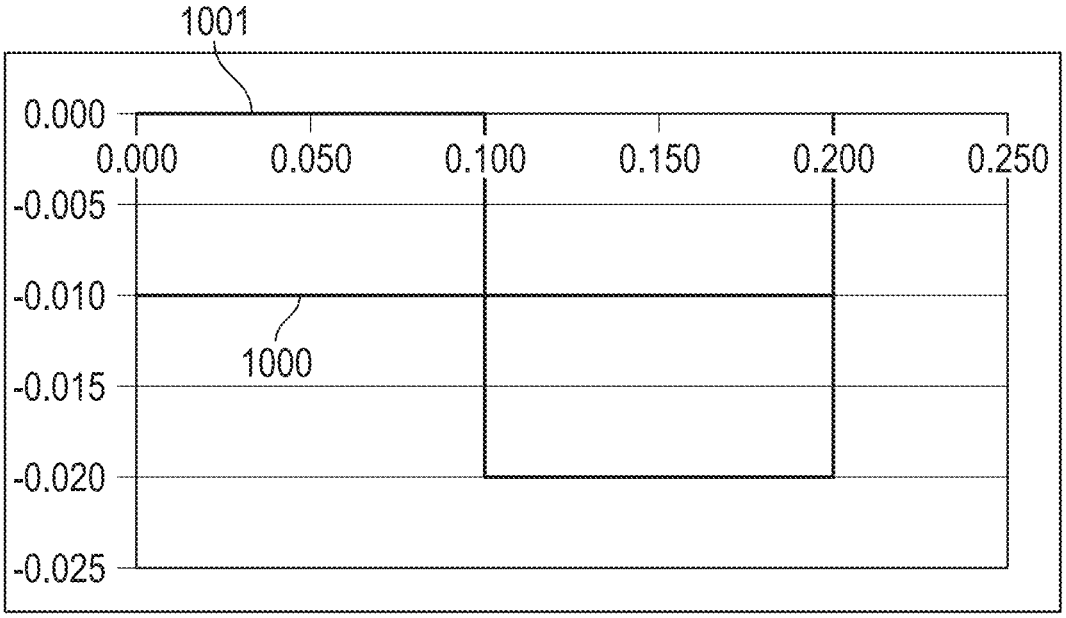
Figure 88:
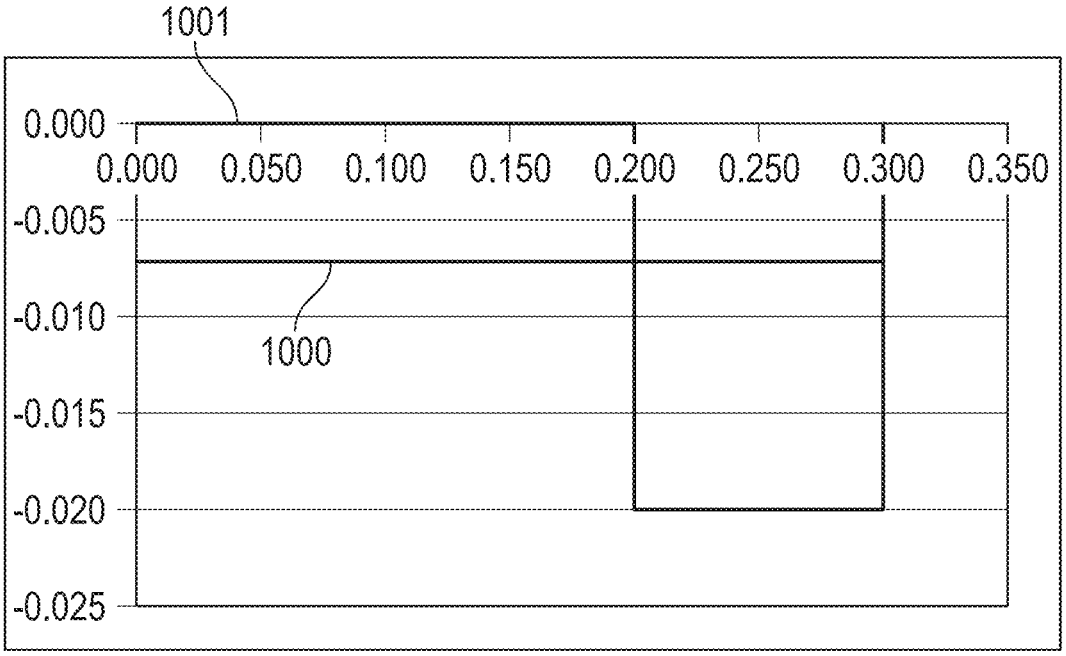
Figure 89:
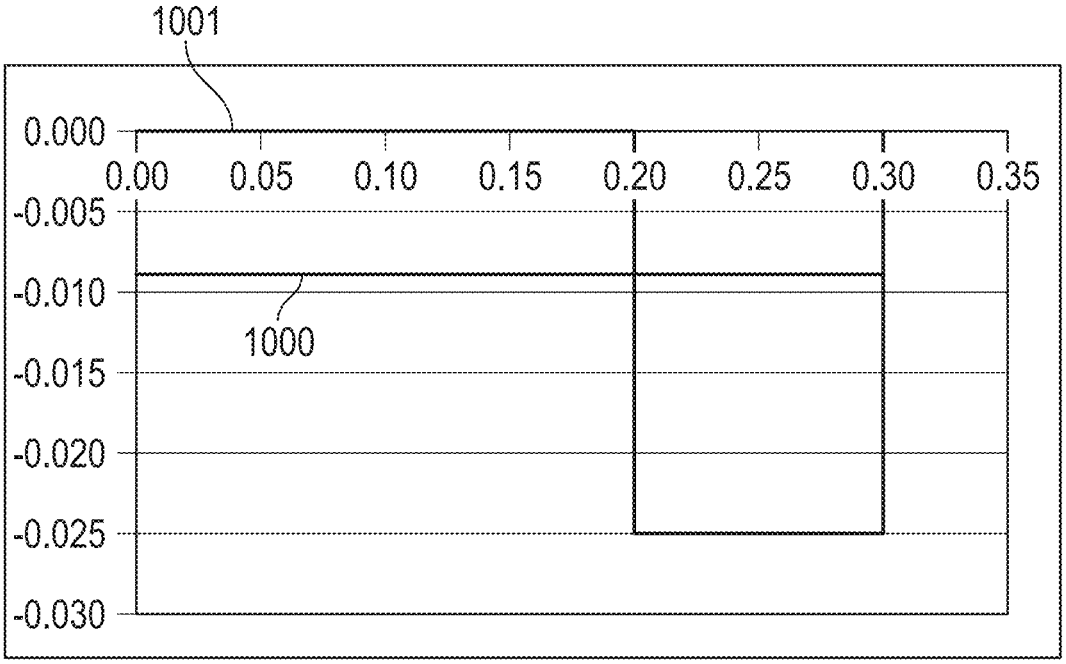
Figure 90:
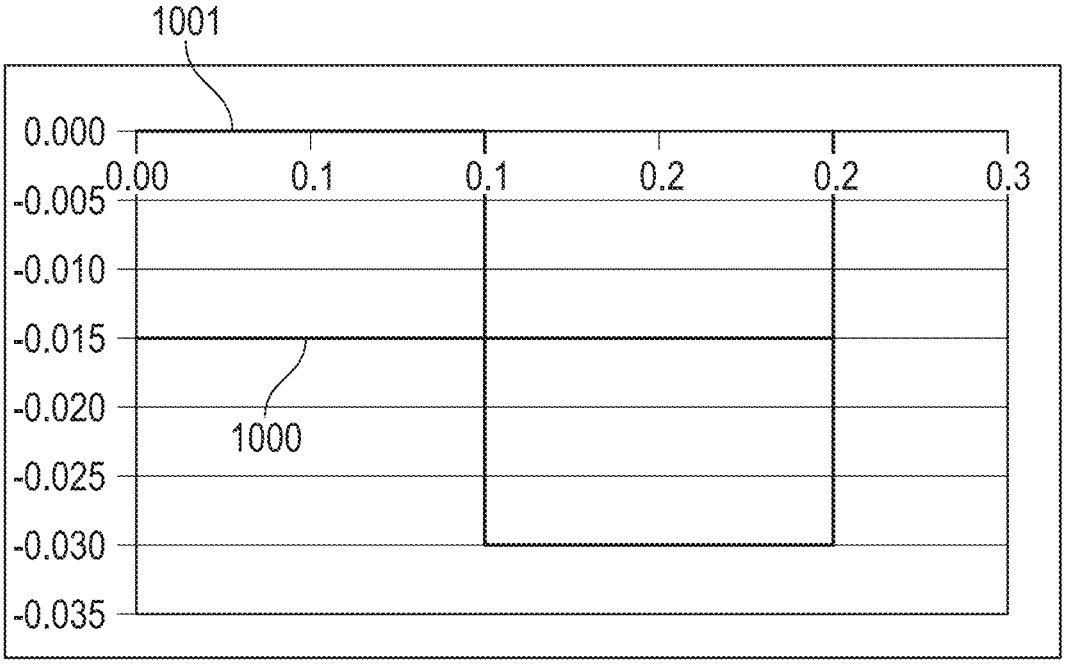
Figure 91:
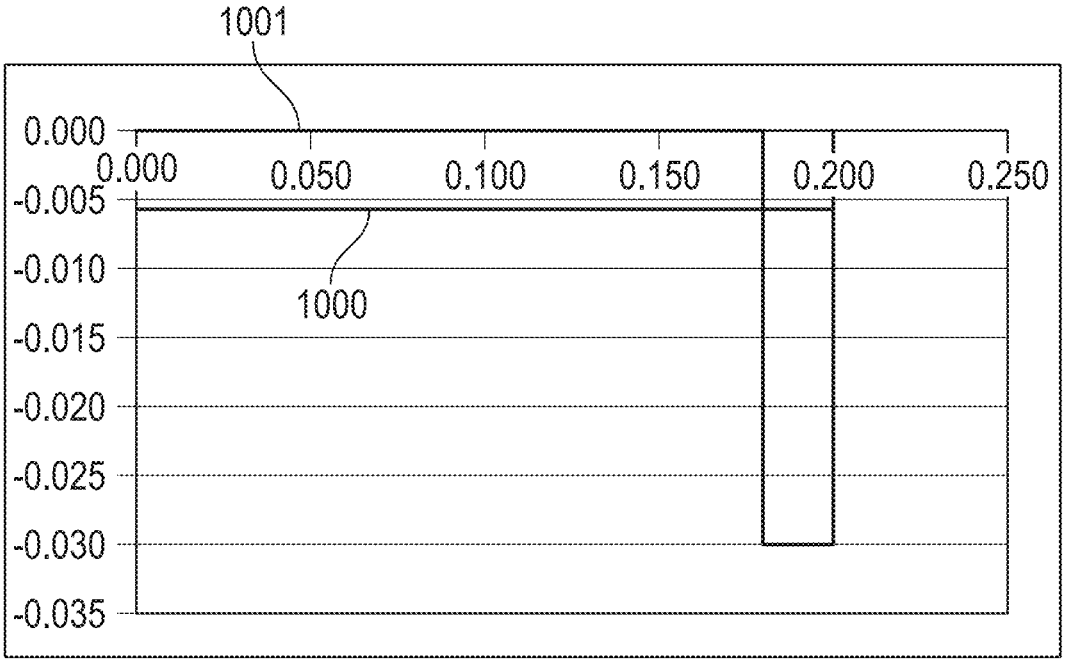
Figure 92:
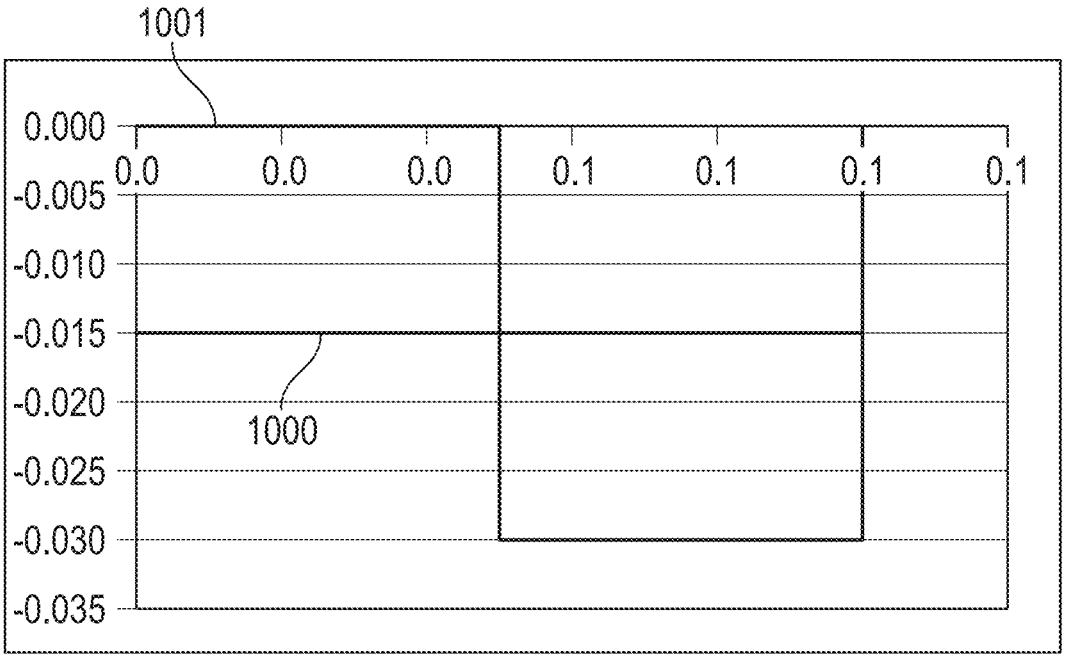
Figure 93:
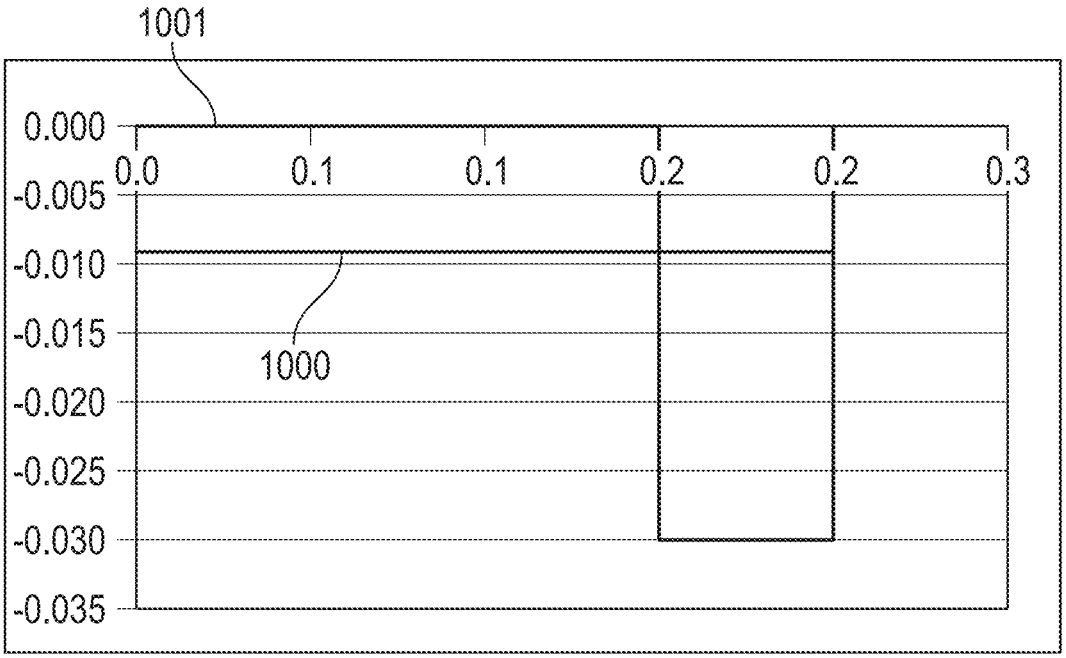
Figure 94:
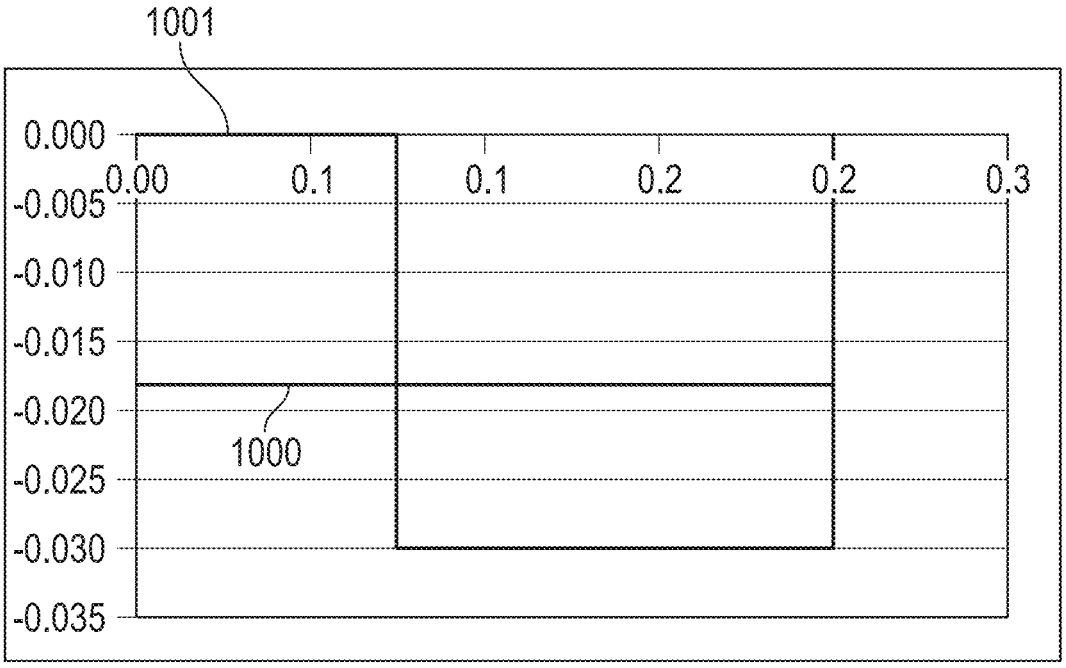
Figure 95:
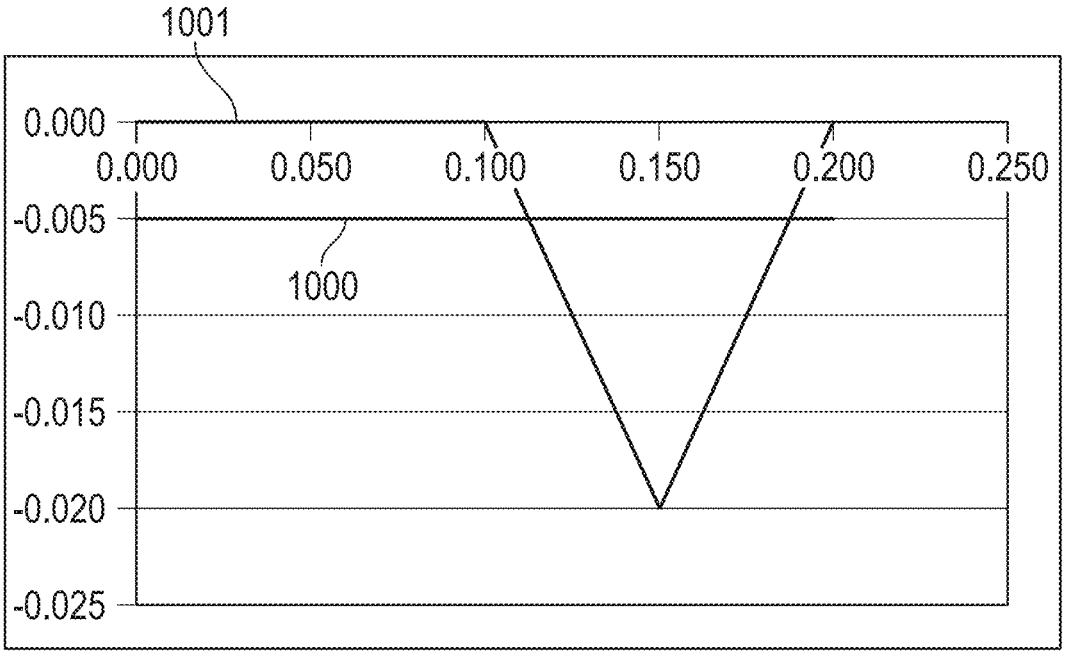
Figure 96:
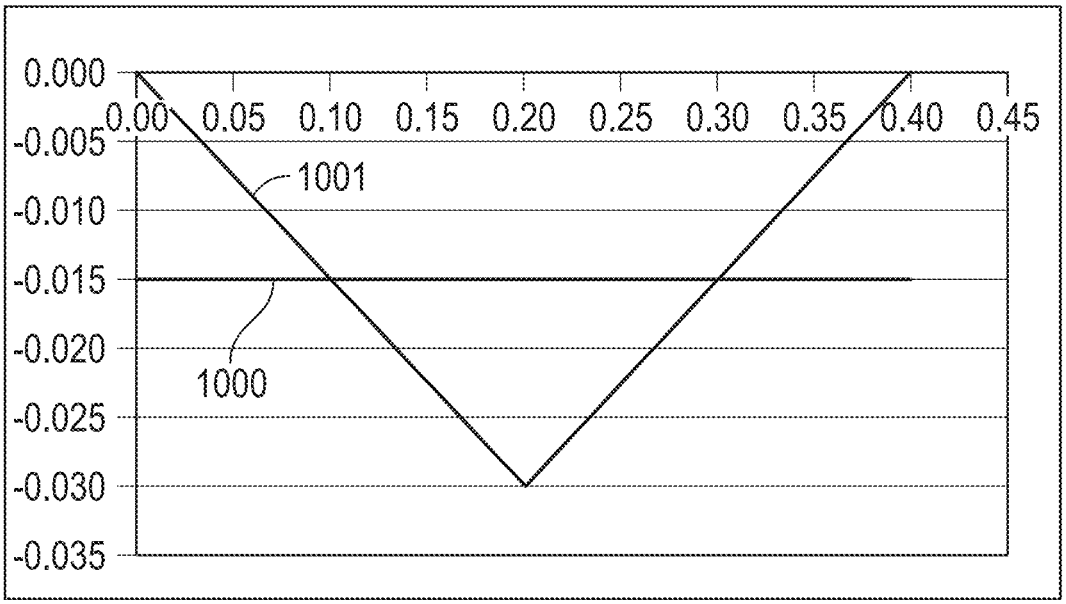
Figure 97:
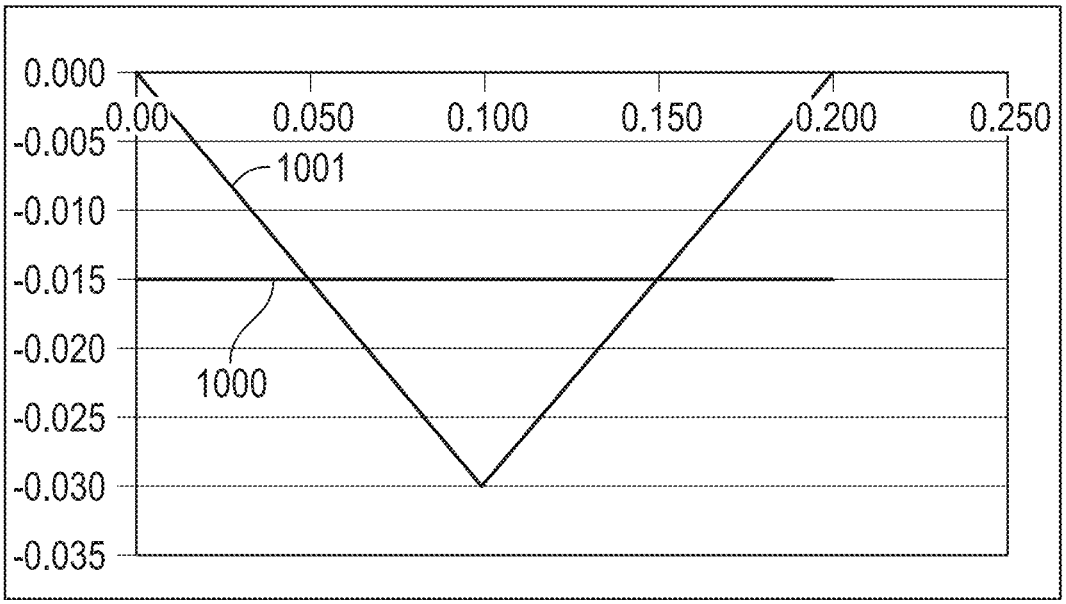
Figure 98:
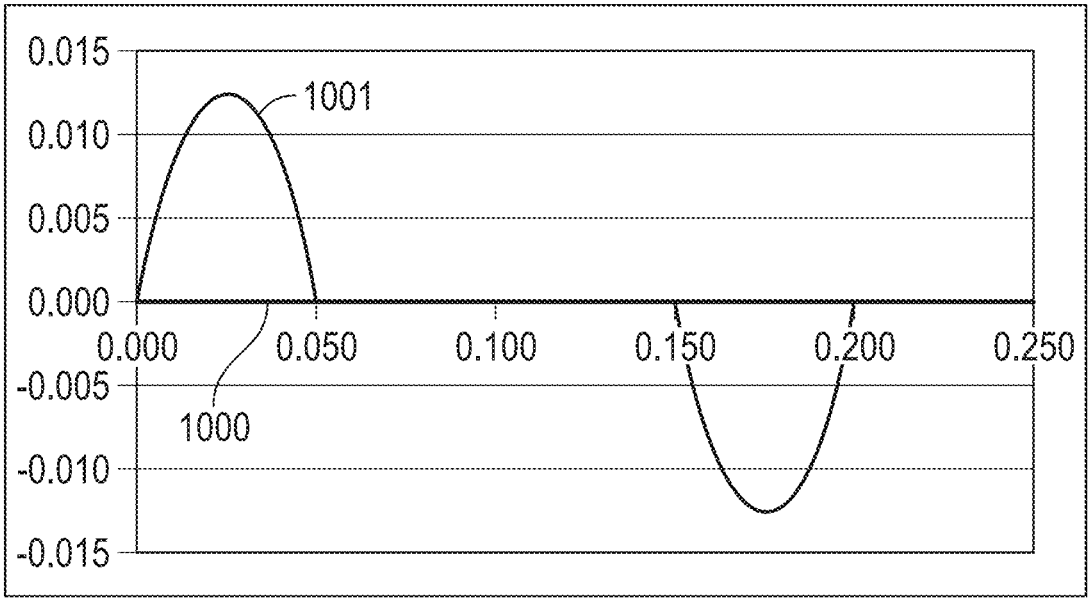
Figure 99:
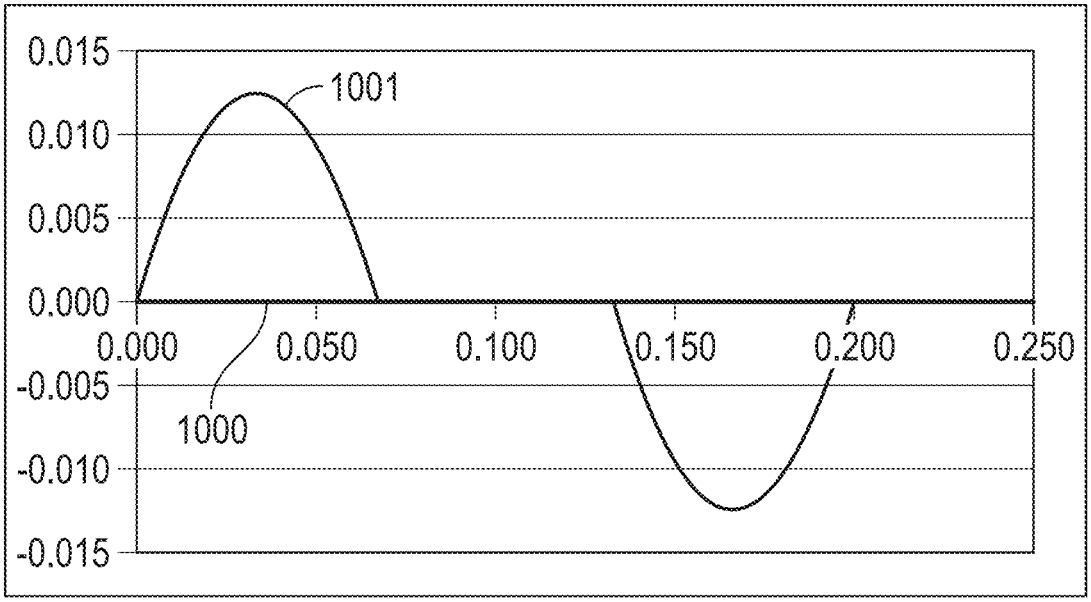
Figure 100:
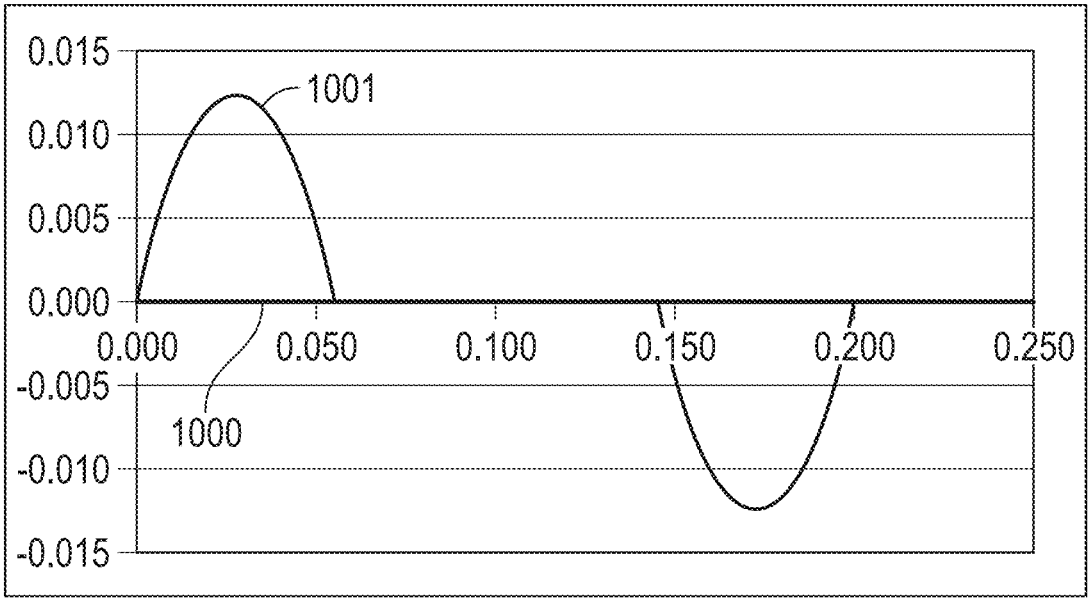
Figure 101:
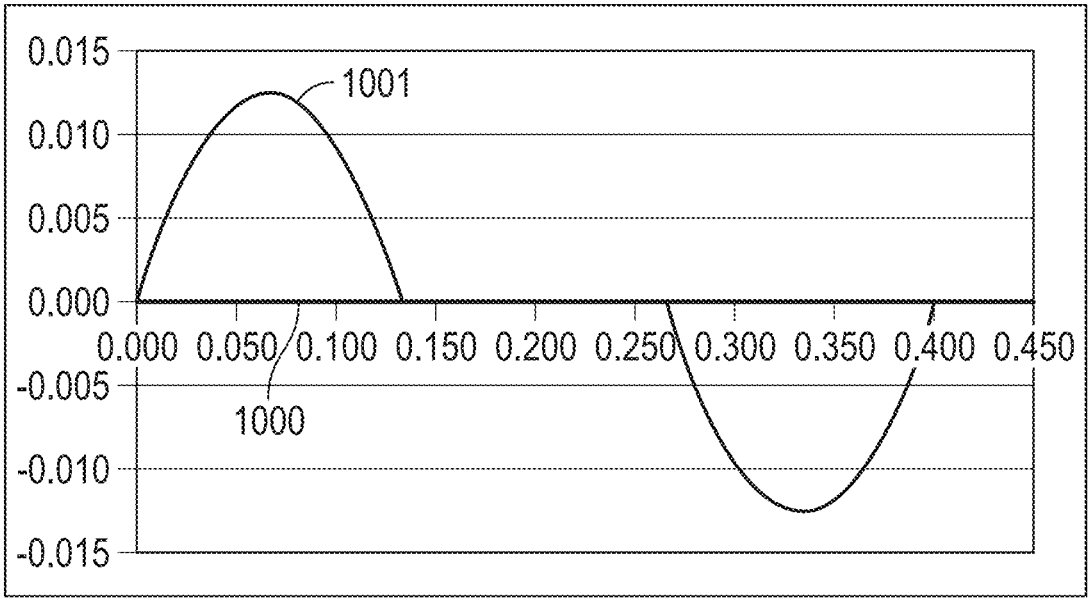
Figure 102:
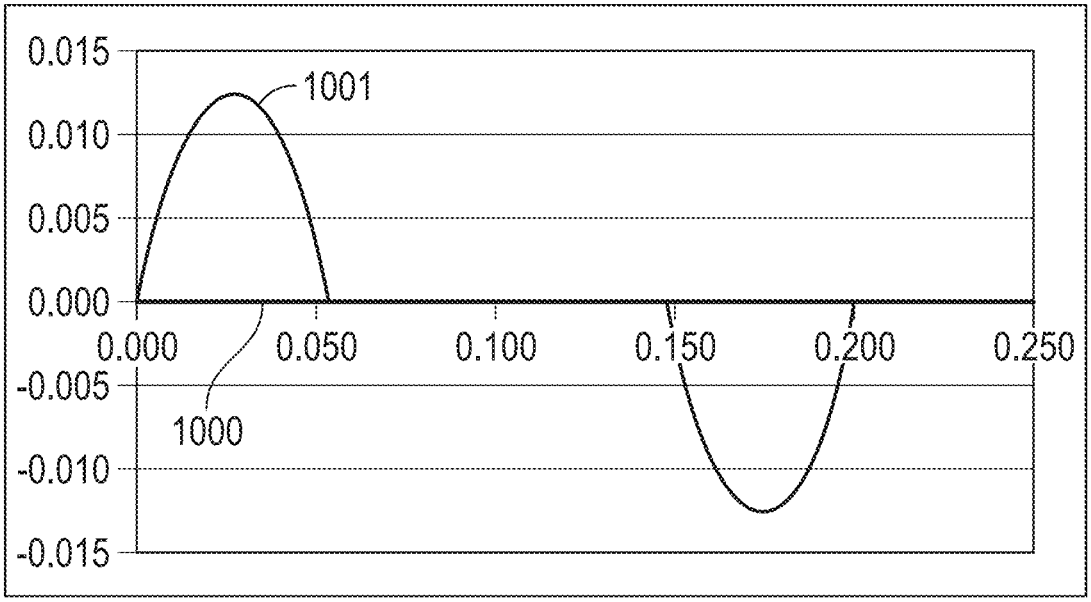
Figure 103:
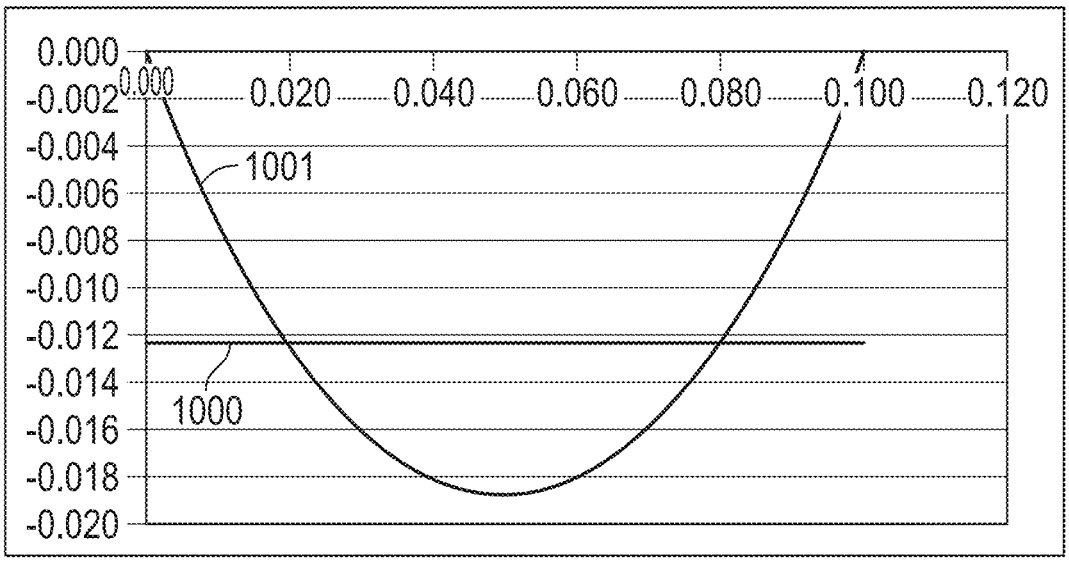
Figure 104:
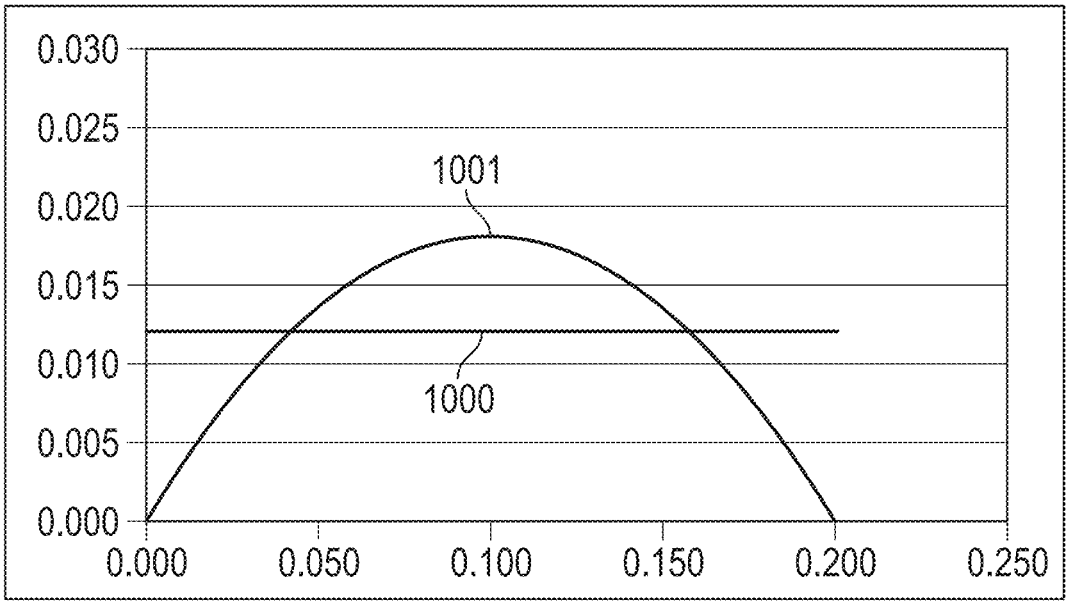
Figure 105:
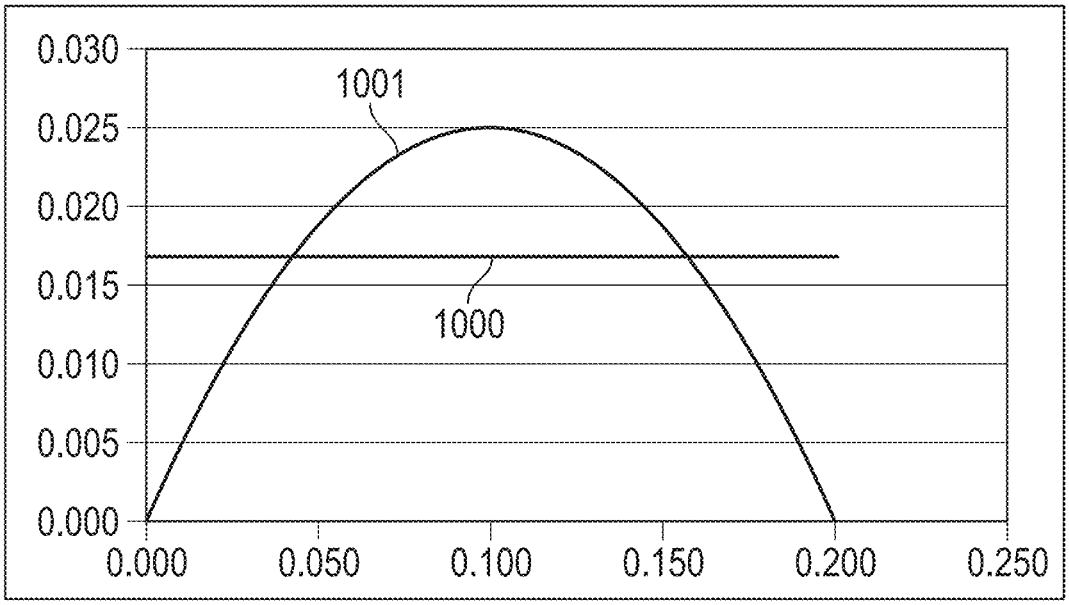
Figure 106:
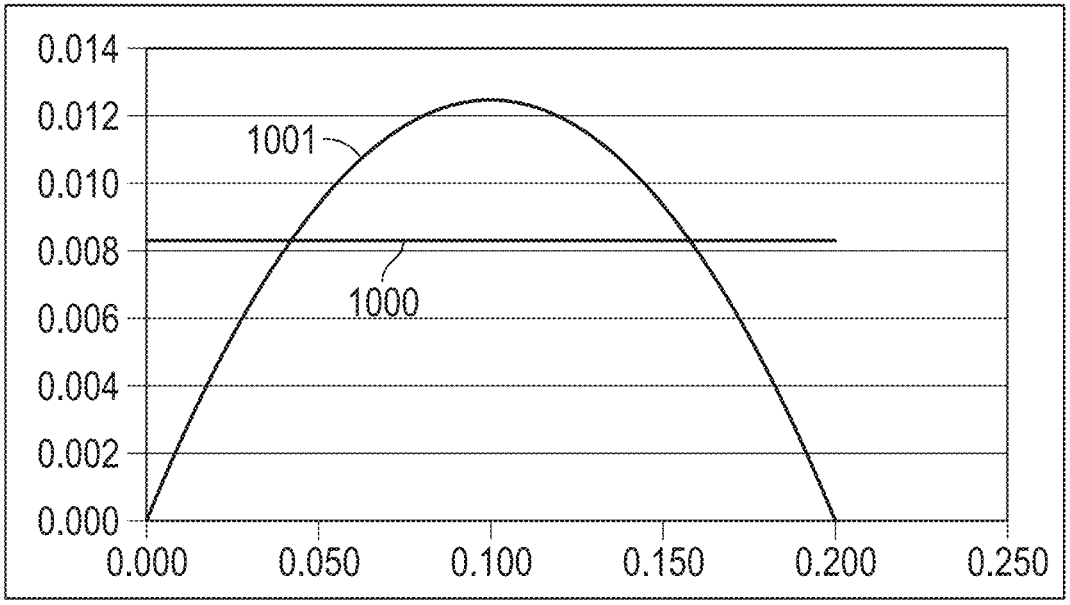

As used herein, a "peak" refers to a segment of a surface profile that includes a point or line located at a maxima (either locally or globally) above the mean line. For instance, the peak may be in the shape of a curve with an inflection point at a maxima above the mean line as shown in FIGS. 60, 64-66, 68-73, 79, 98-102, and 104-106. The curve can assume any shape such as a parabola. The peak may be in the shape of a triangle with an apex at a maxima above the mean line as shown in FIG. 78. The peak may be in the shape of a quadrilateral (e.g., rectangle or square) with a plateau line at a maxima above the mean line as shown in FIGS. 62, 63, 67, 74-77, 88-89, and 91-95. The peak segment includes the maxima (e.g., apex, inflection point, plateau) as well as certain points in the near vicinity of the maxima.

A "valley" refers to a segment of a surface profile that includes a point or line located at a maxima (either locally or globally) below the mean line. For instance, the valley may be in the shape of a curve with an inflection point at a maxima below the mean line as shown in FIGS. 60, 64, 70-73, 80-86, and 98-103. The curve can assume any shape such as a parabola. The valley may be in the shape of an inverted triangle with an apex at a maxima below the mean line as shown in FIGS. 65, 66, 68, 69, 78, and 95-97. The valley may be in the shape of a quadrilateral (e.g., square or rectangle) with a plateau line at a maxima below the mean line as shown in FIGS. 62, 63, 67, 74-77, and 87-94. The valley segment includes the maxima (e.g., apex, inflection point, plateau) as well as certain points in the near vicinity of the maxima.

The segment of the surface profile between a peak and an adjacent valley is referred to herein as a "transition segment". Illustrative transition segment shapes include lines parallel to, or directly on, the mean line, straight lines sloped at an angle relative to the mean line, or curved lines. Examples of a transition segment are identified in FIGS. 60, 62, 64, 70-74, 76, 98-102 (transition segment is a straight line directly on the mean line); FIGS. 63, 67, 75, 77, 87-94 (transition segment is a straight line with a slope of 90° relative to the mean line); and FIGS. 65, 67, 68, 69, 78, 95 (transition segment is a line with a slope of less than 90° relative to the mean line). In certain examples, a surface profile may include at least one transition segment that includes a first portion that is a straight line located directly on the mean line and a second portion that has a steep slope relative to the mean line. In certain examples, a surface profile may include at least one transition segment that includes a first portion that is a straight line that is located near to, or on, the mean line and a second portion that has a steep slope relative to the mean line.

Figure 107:
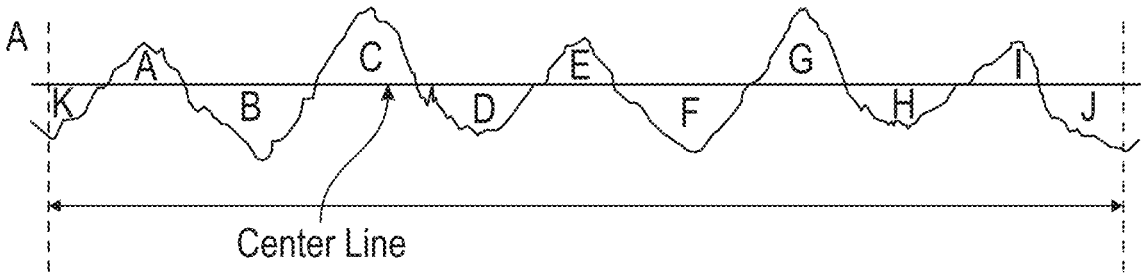
FIG. 107 is a representation of a calculation for determining a mean line.

The "mean line" or "center line" is the line that divides a sampling length of surface (L) so that the sum of areas above this line is equal to the sum of areas below the line. The mean line 1000 is shown in FIGS. 60-107 as a continuous straight line in the X-direction. In one example, a mean line 1000 is provided having a characteristic such as:

$$\text{Area}(A+C+E+G+I)=\text{Area}(B+D+F+H+J+K),$$ as shown in FIG. 107.

An overall goal of more roughness-efficient surface profiles is to maximize $R_y$ for a desired or predetermined $R_a$. $R_y$ is the area that falls under the highest peak of a surface profile and this is the area that the ball impacts. In some cases, it is also desirable to maximize $R_{pc}$.

Examples of roughness-efficient surface profiles 1001 for striking surface roughness patterns are shown in FIGS. 60-106. In certain embodiments, the surface profile includes alternating peaks and valleys with flat transition segments between the peaks and valleys as shown, for example, in FIGS. 60, 62, 64, 70-74, 76 and 98-102. Another example of a surface profile includes repeating alternating peak heights wherein one set of peaks has a first height above the mean line and a second set of peaks has a second height above the mean line, the first height being greater than the second height, as shown in FIGS. 65, 66, 68, and 69. A further example of surface profile includes at least one peak and at least one valley with a transfer segment between the peak and valley having a slope of 300 to 90°, 45° to 90°, 75° to 90°, and most particularly 90°, relative to the mean line. A single roughness-efficient surface profile for a golf club face may include any combination of profiles individually shown in FIGS. 60-106.

A striking surface of a golf club head can be provided with a variety of roughness-efficient patterns as described herein or with a single roughness-efficient pattern as described herein. Typically these patterns extend over substantially the entire striking surface, but in some examples only a portion of the striking surface is patterned. A striking plate includes a composite face plate and a cover layer. A striking surface of the cover layer includes a patterned area that includes a plurality of pattern features that are arranged in a two dimensional array. The pattern features are surface profiles as described herein wherein the valleys are formed in the cover layer and extend along a +y-direction (i.e., inwardly towards an external surface of the face plate). A horizontal spacing (along an x-axis) of the pattern features is dx and a vertical spacing (along a z-axis) is dz. These spacings can be the same or different, and the features can be inwardly or outwardly directed. In addition, for cross-sectional shapes that are asymmetric, the pattern features can be arbitrarily aligned with respect to the x-axis and the z-axis. The pattern features can be located in a regular array, but the orientation of each of the pattern features can be arbitrary, or the pattern features can be periodically arranged along the x-axis, the z-axis, or another axis in the xz-plane. A plurality of score-lines may be provided in addition to the roughness-efficient pattern and are typically colored so as to provide a high contrast. A maximum depth dy of the pattern features along the y-axis is between about 10 μm and 100 μm, between about 5 μm and 50 μm, or about 2 μm and 25 μm. The horizontal and vertical spacings are typically between about 0.025 mm and 0.500 mm While the pattern features may have substantially constant cross-sectional dimensions in one or more planes perpendicular the xz-plane (i.e. vertical cross-sections), these vertical cross-sections can vary along a y-axis or as a function of an angle of a cross-sectional plane with respect to the x-axis, the y-axis, or the z-axis. For example, columnar protrusions can have bases that taper outwardly, inwardly, or a combination thereof along the y-axis, and can be tilted with respect to the y-axis.

Similar striking plates can be provided for iron-type golf clubs. While striking plates for wood-type golf clubs generally have top-to-bottom and toe-to-heel curvatures (commonly referred to as roll and bulge), striking plates for irons are typically flat. Composite-based striking plates for iron-type clubs typically include a polymer cover layer selected to protect the underlying composite face plate. In some examples, similar striking surface textures to those described above can be provided. In addition, one or more conventional grooves are generally provided on the striking surface. Such striking plates can be secured to iron-type golf club bodies with various adhesives or otherwise secured.

Machining the roughened surface profiles into a mold that is then used to cast a cover for a golf club face can be an effective manufacturing method for a controllable and repeatable technique for prescribing wherein the mean line falls on the profile plot. In certain embodiments, the cover that includes the roughness-efficient surface profiles described herein is made from a non-metallic material such as a polymeric material as described above. In other embodiments, the striking surface with the roughness-efficient pattern is made from a metallic material such as titanium or a metal/polymer composite as described above.

The roughness-efficient surface profiles described herein can be utilized with any type of golf club.

Asymmetric Surface Textures

Similarly to the roughness efficient texture, an asymmetric surface texture may provide more efficient roughness performance compared to a symmetric texture. Several exemplary impact surface texture geometries are shown in FIGS. 111-117. Some of these geometries, when formed in polymer cover layer of a composite face plate, can enable the composite face plate to perform substantially the same as a standard all-metal face plate under wet conditions.

Figure 109:
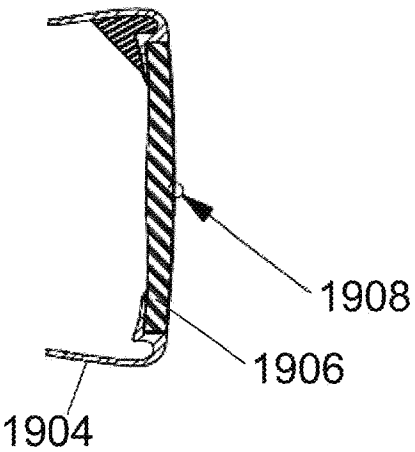
FIG. 109 is a cross-sectional view of a front portion of the golf club of FIG. 108, taken along line A-A.
Figure 108:
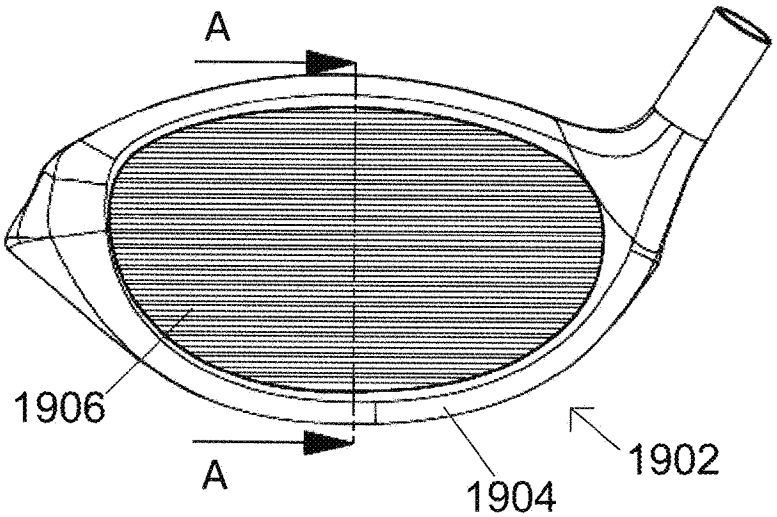
FIG. 108 is a front view of an exemplary metal-wood type golf club.

Exemplary impact surface textures can be relatively smooth in a horizontal, heel-toe direction and can be contoured in a vertical, sole-crown direction. Preferably, the surface texture can be asymmetric in the sole-crown direction. An exemplary metal-wood type golf club head 1902 is shown in FIG. 108. FIG. 109 is a cross-sectional view of the front portion of the golf club head 1902 shown in FIG. 108, taken along line A-A. The golf club head 1902 can comprise a body portion 1904 and a face portion 1906. The exterior surface of the face portion 1906 comprises the impact surface 1908.

Figure 113:
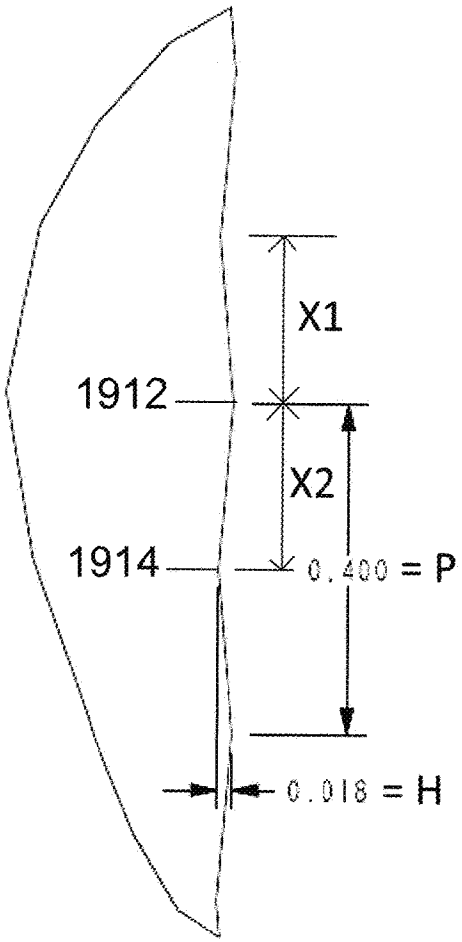
FIGS. 111-113 are enlarged views of a portion of an impact surface showing exemplary symmetric surface textures.
Figure 112:
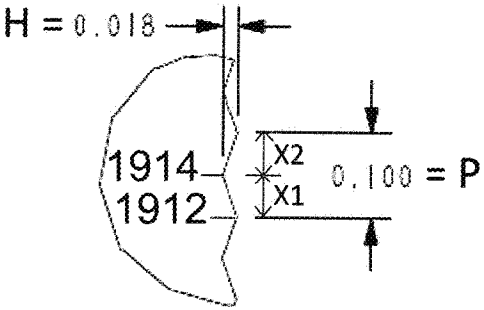
Figure 111:
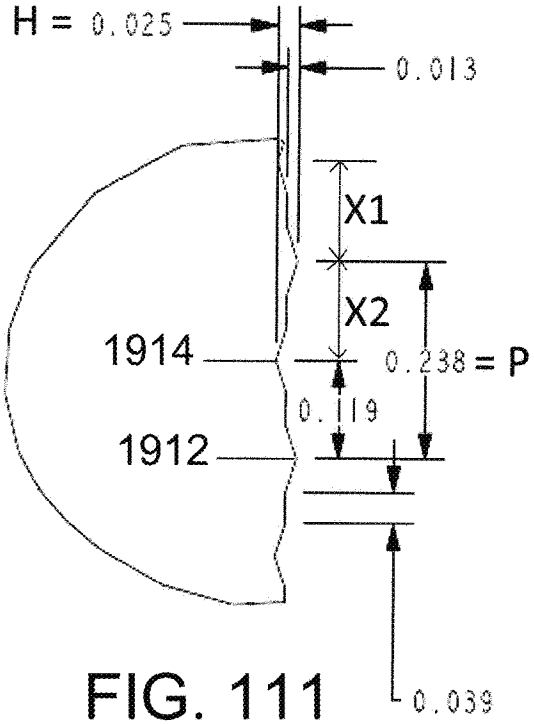
Figure 115:
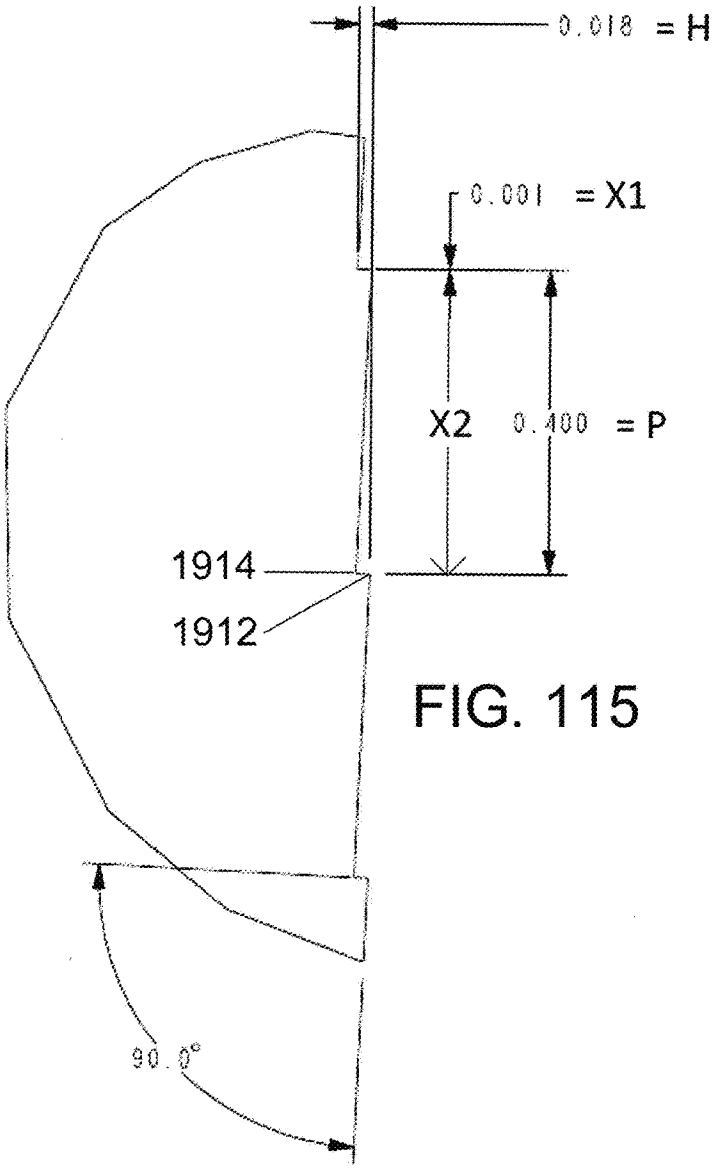
FIGS. 114-117 are enlarged views of a portion of an impact surface showing exemplary asymmetric surface textures.
Figure 114:
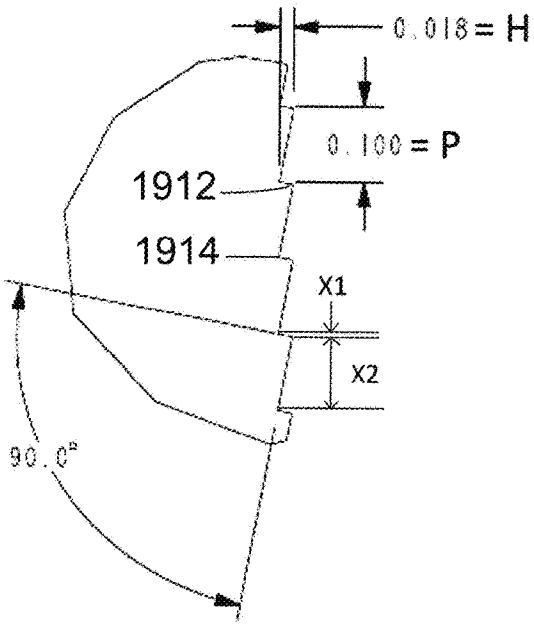

FIGS. 111-115 show enlarged views of a portion of the impact surface 1908 comprising exemplary surface textures. FIGS. 111-113 show exemplary symmetrical surface textures, while FIGS. 114 and 115 show exemplary asymmetrical surface textures. All dimensions shown in FIGS. 111-115 are in millimeters, however these dimensions are only exemplary dimensions provided for reference and should not be construed to limit the scope of the disclosure. Accordingly, the dimensions disclosed in the present application can be modified as needed depending on the particular application.

Figure 110:
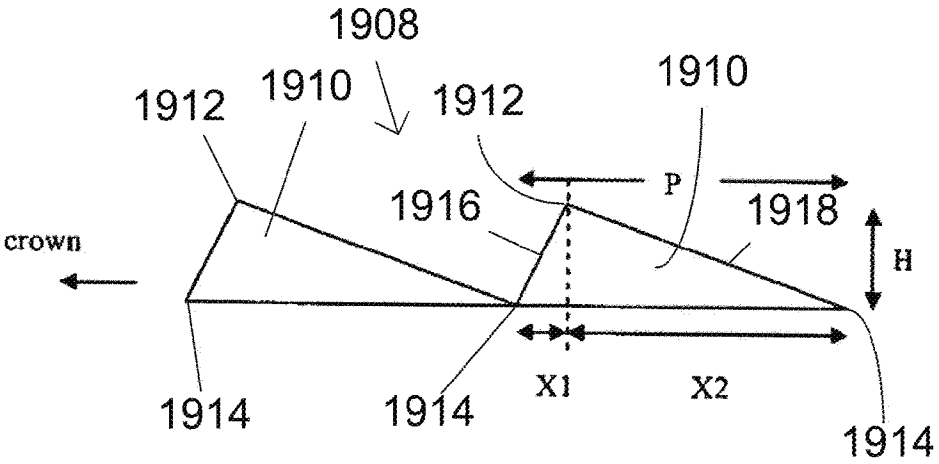
FIG. 110 is a diagram showing exemplary surface texture dimensions.

As shown in FIG. 108, the surface textures shown in FIGS. 111-115 create a plurality of ridges 1910 extending laterally across the impact surface in the heel-toe direction. As shown in FIG. 110, these ridges 1910 can comprise a height, or depth, "H" equal to the distance between the peaks 1912 and valleys 1914 in the direction perpendicular to the impact surface. Each ridge 1910 has an upwardly facing first surface 1916 and a downwardly facing second surface 1918 that converge at a respective peak 1912. The ridges 1910 can further comprise a periodic width "P" equal to the distance between neighboring valleys 1914, or between neighboring peaks 1912, in the sole-crown direction. "X1" is the distance in the sole-crown direction between a peak 1912 and the nearest valley 1914 above the peak, while "X2" is the distance in the sole-crown direction between a peak 1912 and the nearest valley 1914 below the peak. The sum of X1 and X2 is equal to P. The dimensions H, P, X1 and X2 can represent average values or other normalized values over a plurality of ridges 1910.

The geometry of a ridge 1910 can be characterized in terms of the slopes of the upwardly facing surface 1916 and the downwardly facing surface 1918 of the ridge. The slope S1 of an upwardly facing surface 1916 can be defined as the ratio H/X1 and the slope S2 of a downwardly facing surface 1918 can be defined as the ratio H/X2.

When X1 and X2 are equal (S1 and S2 are equal), the surface texture is symmetric in the sole-crown direction. FIGS. 111-113 show exemplary symmetric surface textures. In FIG. 111, the periodic width P is 0.238 mm and X1 and X2 are each equal to 0.119, or half of P. The height H of the texture is equal to 0.025 mm. FIGS. 112 and 113 show symmetrical surface textures wherein H equals 0.018 mm and P ranges from 0.100 mm to 0.400 mm.

When X1 and X2 are not equal, the surface texture is asymmetric in the sole-crown direction. When X2 is greater than X1 (S1 is greater than S2), the peaks 1912 slant upwardly and the texture can be referred to as "asymmetric-up." FIGS. 114 and 115 show exemplary asymmetric-up surface textures wherein X2 is greater than X1 and the two sides 1916, 1918 of a ridge 1910 form a right angle at the peak 1912. In FIG. 115, X1 is about 0.001 mm and X2 is about 0.399 mm.

Figure 117:
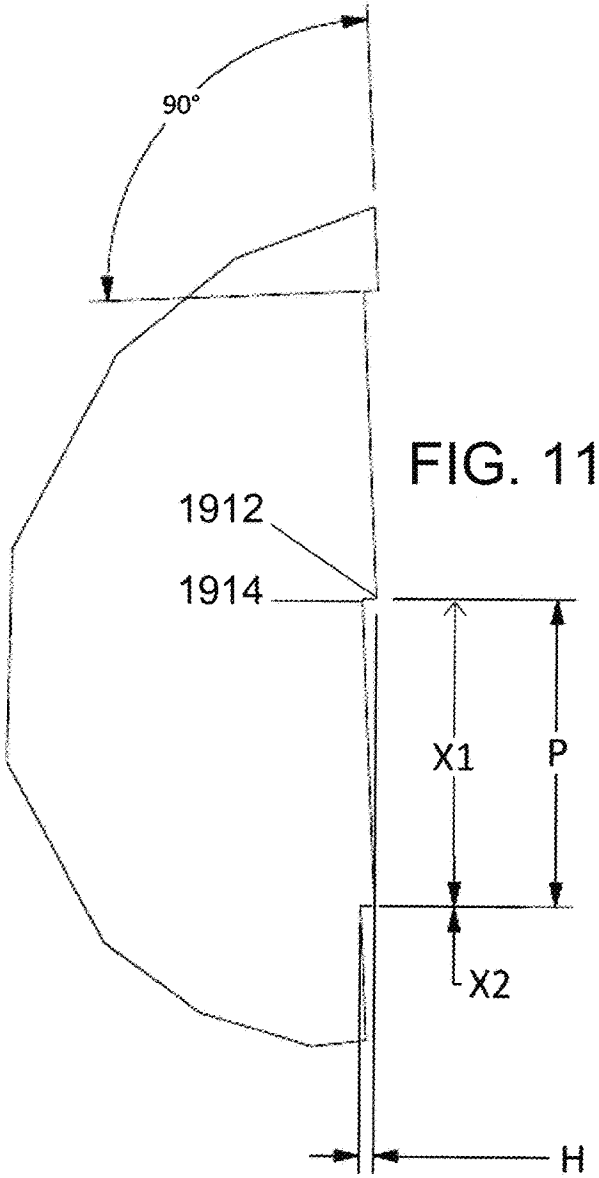
Figure 116:
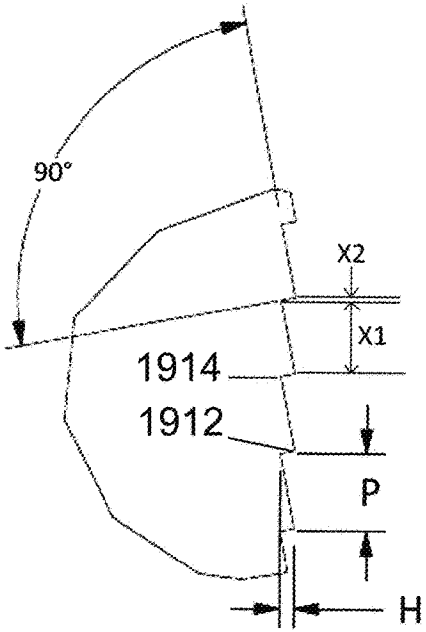

When X1 is greater than X2 (S1 is less than S2), the peaks 1912 slant downwardly and the surface texture can be referred to as "asymmetric-down." FIGS. 116 and 117 show exemplary asymmetric-down surface textures. Note that FIGS. 116 and 117 are mirror images of FIGS. 114 and 115, respectively, with X1 and X2 inverted.

A surface texture that is asymmetric in the sole-crown direction can be symmetric and/or constant in the perpendicular heel-toe direction. In other words, the values of H, P, X1 and X2 can be constant moving across the face 1906 in the heel-toe direction, with parallel peaks 1912 and valleys 1914 and ridges 1910 that have a cross-sectional profile that is constant in the heel-toe direction. Referring again to FIG. 110, the following ranges of P, H and the ratio X1/X2 can be preferable. P can be from about 0.1 mm to about 0.7 mm, and most preferably from about 0.1 mm to about 0.4 mm. H can be from about 0.015 mm to about 0.020 mm, and most preferably from about 0.015 mm to about 0.025 mm. X1/X2 can be from about 0.001 to about 0.003, and most preferably from about 0.004 to about 0.027.

In some embodiments, the surface texture of the impact surface of the golf club can be varied across the impact surface. For example, the surface texture can vary in the sole-crown direction such that the ratio X1/X2 is highest nearer to the crown and becomes gradually lower at locations moving downward toward the sole. The surface texture can vary in the heel-toe direction as well.

The surface texture of the impact surface can affect the launch angle of the ball. In particular, asymmetric-up surface textures can result in an increased launch angle compared to a smooth impact surface, which can result in increased shot distance.

A surface texture can be applied to all or only a portion of the impact surface of the face. For example, the surface texture need not extend across the entire impact surface and can be provided only in a central region of the impact surface that does not extend to a perimeter of the face. For hollow metal-woods, at least some portions of the impact surface at the perimeter of the face can lack surface texture in order to provide an area suitable for attachment of the face to the head body.

An exemplary golf club embodiment that includes a face comprising a composite plate with a polymer cover on the impact surface as described in U.S. Pat. No. 7,874,936, which is incorporated herein by reference. This golf club can further comprise an asymmetric-up surface texture on the impact surface, such as those shown in FIGS. 114 and 115. In other embodiments, a golf club can have an all-titanium face that includes an asymmetric surface texture on the impact surface.

Polymeric cover layers on the impact surface of the face can be formed and secured to a face plate using various methods. In some embodiments, a texture can be formed on the outer impact surface of a cover layer with a mold. For example, a selected surface texture can be etched, machined, or otherwise transferred to the mold surface. The mold can be used to form a cover layer having a textured impact surface, which can then be attached to a composite face plate or face plate comprised of other materials. Such cover layers can be bonded with an adhesive to the face plate.

Alternatively, a mold can be used to form the cover layer directly on the composite face plate. For example, a layer of a thermoplastic material (or pellets or other portions of such a material) can be placed on an external surface of a pre-formed face plate, and the assembly can be placed in a mold. The mold has a surface with the desired surface texture adjacent the polymeric material. The mold surfaces can be pressed against the thermoplastic material and the face plate at suitable temperatures and pressures so as to impress the desired surface texture on a thermoplastic layer, thereby forming a cover layer with a desired surface texture. In another example, a thermoset material can be deposited on the external surface of the face plate, and the mold pressed against the thermoset material and the face plate to form a cover layer having a desired thickness and texture. The face plate, the thermoset material, and the mold can then be raised to a suitable temperature so as to cure or otherwise fix the shape and thickness of the cover layer. Exemplary materials are described above.

In other embodiments, a composite face plate and textured layer can be formed at the same time in a mold. For example, a lay-up can be formed from a plurality of pre-preg composite sheets (as disclosed in U.S. Pat. No. 7,874,936) and a layer of polymeric material to form the cover layer of the face plate. The lay-up can be placed in a mold, which applies heat and/or pressure to the lay-up to form a molded part. The cured, molded part can then be removed from the mold and machined as needed to achieve the final shape and size of the face plate. These methods are examples only, and other methods can be used as may be convenient for forming cover layers for face plates.

In other embodiments, the desired surface texture can be machined or otherwise formed directly on the face plate. For example, a desired surface texture can be machined directly into a metal (e.g., titanium) face plate.

Scorelines

As described above and as shown in several of the figures, a plurality of scorelines may be provided on the striking surface of the striking plate. In some embodiments, the striking plate includes a composite face plate and a polymer cover. In those embodiments, the scorelines extend inwardly into the surface of the cover layer from the exterior most surface of the cover layer. The scorelines may be provided in addition to the surface texture features described herein, or without a surface texture. Several exemplary scoreline profiles and scoreline dimensions are shown in and described by reference to FIGS. 118-121. In some embodiments, the described scoreline profiles, when formed in a polymer cover layer of a composite face plate, can enable the composite face plate to perform substantially the same as a standard all-metal face plate under wet conditions.

Figure 118A:
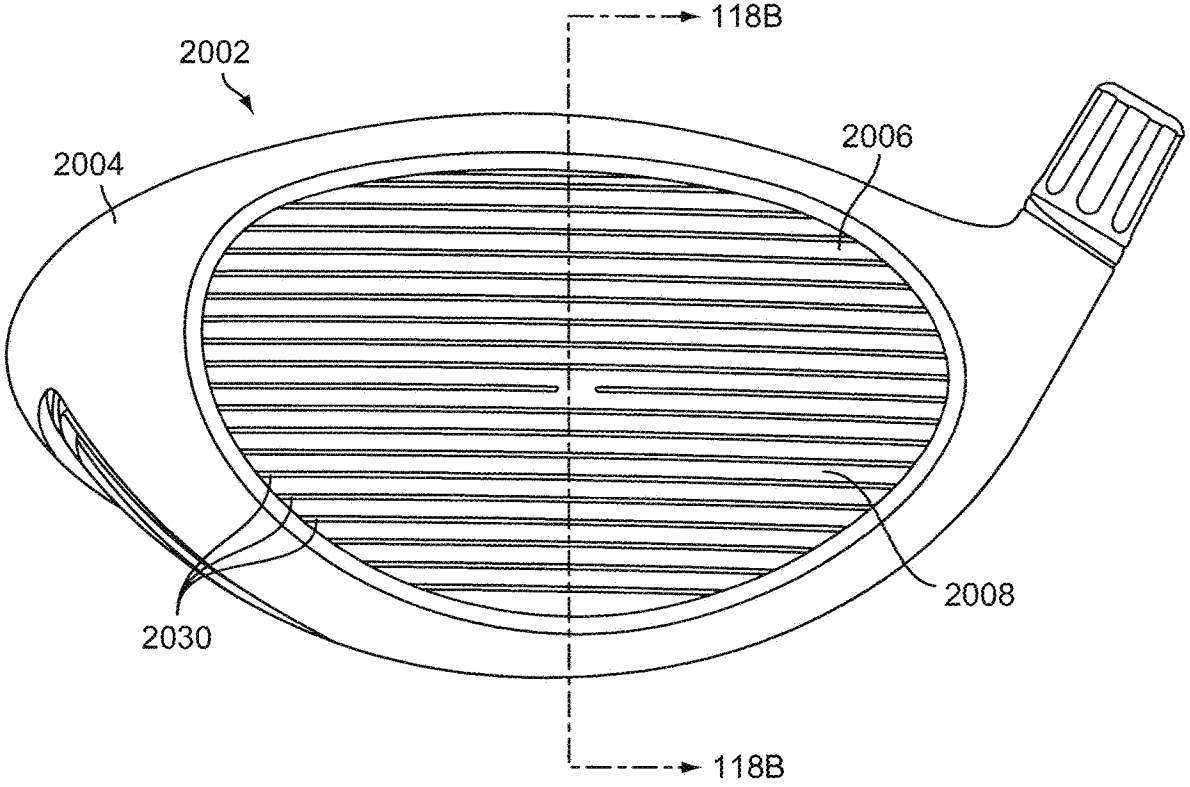
FIG. 118A is a front view of another exemplary metal-wood type golf club.
Figure 118B:
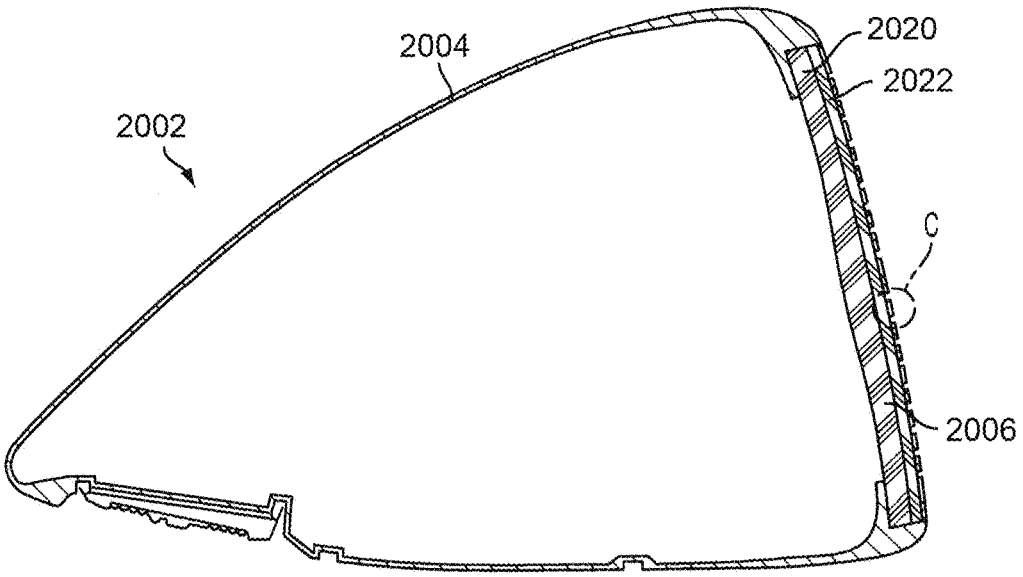
FIG. 118B is a cross-sectional view of a front portion of the golf club of FIG. 118A, taken along line B-B.
Figure 118C:
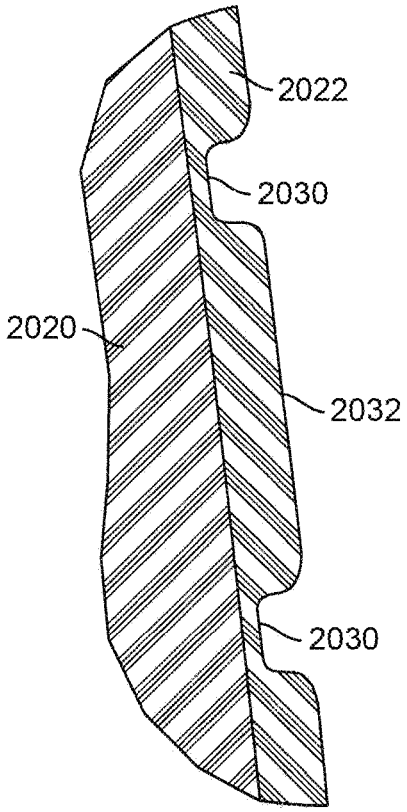
FIG. 118C is a close up of the cross-sectional view of FIG. 118B, taken along the dashed circle C of FIG. 118B.

An exemplary metal-wood type golf club head 2002 is shown in FIG. 118A. FIG. 118B is a cross-sectional view of the golf club head 2002 shown in FIG. 118A, taken along line B-B. FIG. 118C is a close-up view of the portion of the striking plate 2006 of the golf club head 2002 shown in FIG. 118B, taken along the region designated "C" in FIG. 118B. The club head 2002 includes a body portion 2004 and a striking plate 2006. The exterior surface of the striking plate 2006 comprises the impact surface 2008. The impact surface 2008 includes a center zone 2040, an impact zone 2050, and a peripheral zone 2060, which are described below in reference to FIGS. 119A-B. A plurality of scorelines 2020 is provided on the impact surface 2008 within the impact zone 2050 and peripheral zone 2060, but no scorelines are included in the center zone 2040. The impact surface 2008 may also be provided with a surface texture geometry such as those described elsewhere herein, including the surface texture geometries described above in relation to FIGS. 111-118.

Figure 120A:
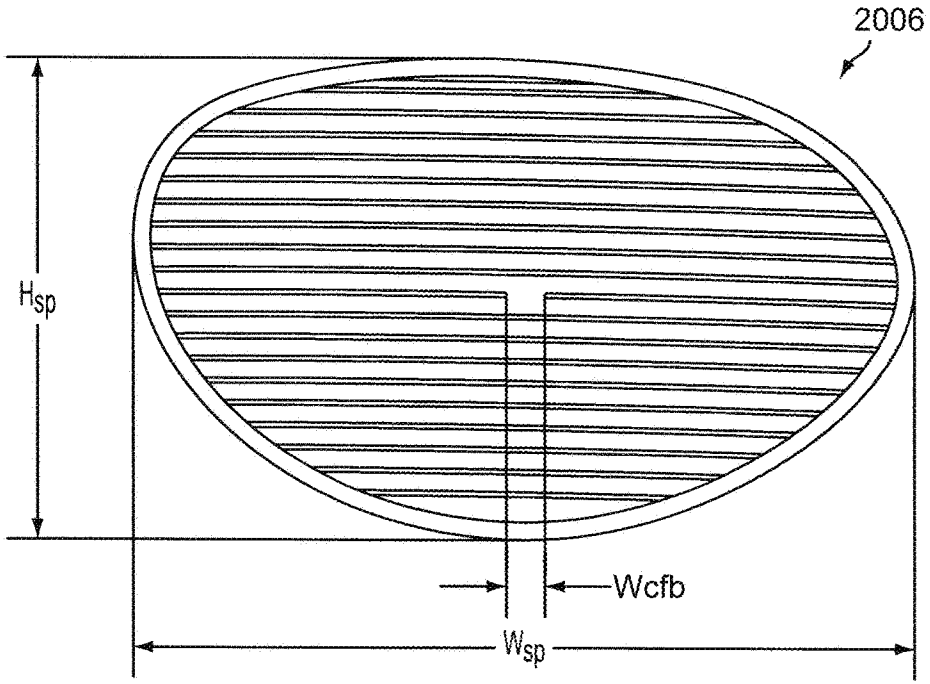
FIG. 120A is a front view of a striking plate of the metal-wood golf club of FIG. 118A.
Figure 120B:
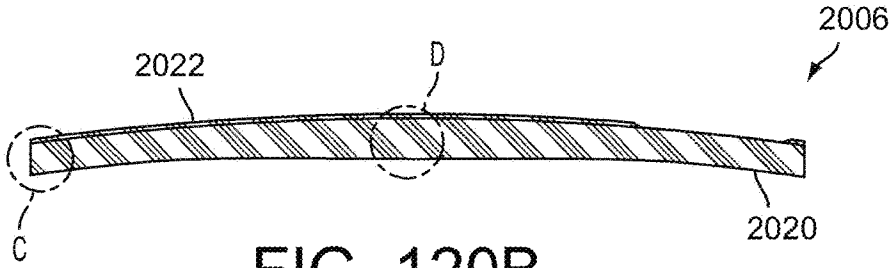
FIG. 120B is a cross-sectional view of the striking plate of FIG. 120A.
Figure 120D:
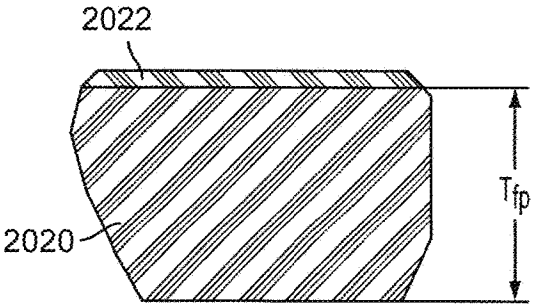
FIG. 120D is a close up of the cross-sectional view of FIG. 120B, taken along the dashed circle D of FIG. 120B.
Figure 120C:
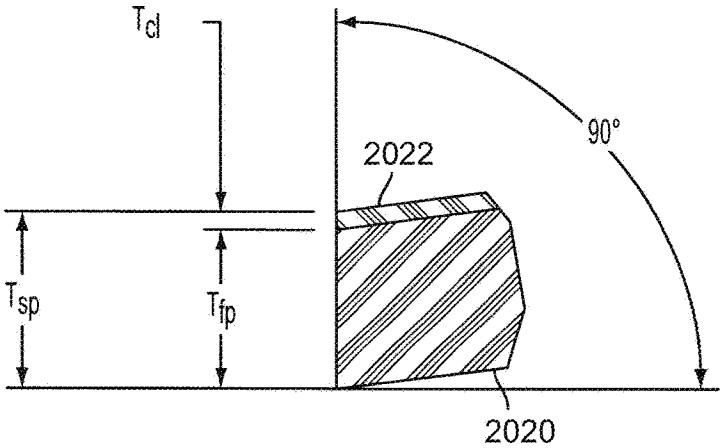
FIG. 120C is a close up of the cross-sectional view of FIG. 120B, taken along the dashed circle C of FIG. 120B.

An exemplary striking plate 2006 for the metal-wood type golf club head 2002 is shown in FIG. 120A. FIG. 120B is a cross-sectional view of the striking plate 2006 taken along a horizontal cross-section through the striking plate 2006. FIGS. 120C and 120D are close-up views of the portions of the striking plate 2006 shown in FIG. 120B, taken along the regions designated "C" and "D" in FIG. 120B. As shown in the figures, the striking plate 2006 has a striking plate height, Hsp, and a striking plate width, Wsp. In the embodiment shown, the striking plate height, Hsp, may be from about 40 mm to about 70 mm, such as from about 50 mm to about 65 mm, such as from about 55 mm to about 65 mm. The striking plate width, Wsp, may be from about 80 mm to about 120 mm, such as from about 85 mm to about 115 mm, such as from about 90 mm to about 110 mm.

The embodiment of the striking plate 2006 shown in FIGS. 120A-D includes a composite face plate 2020 and a polymer cover layer 2022, each of which is described in more detail above. As shown in the figures, the composite face plate 2020 has a face plate thickness, Tfp, and the cover layer 2022 has a cover layer thickness, Tel. The face plate thickness Tfp may be substantially constant throughout the face plate 2020, or the face plate 2020 may be formed having a variable thickness in the manner described herein. In several embodiments, the face plate thickness Tfp may be from about 2 mm to about 8 mm, such as from about 3 mm to about 7 mm, such as from about 4 mm to about 5 mm. In several embodiments, the cover layer thickness Tcl may be from about 0.10 mm to about 1.0 mm, from about 0.2 mm to about 0.9 mm, or from about 0.25 mm to about 0.6 mm.

As noted above, the center zone 2040 may be described by reference to FIG. 119A which, for clarity, shows the golf club head 2002 without any scorelines or other markings on the impact surface 2008. The center 2024 of the face is defined as the intersection of the midpoints of the height and width of the striking face, as described in the USGA pendulum test ("Procedure for Measuring the Flexibility of a Golf Clubhead," Rev. 2.0, Mar. 25, 2005). As used herein, the term "USGA center face" shall refer to the center 2024 of the face determined according to this method. The center zone 2040 is a circular area defined by an outer boundary 2042 that has its center located at the center 2024 of the striking plate. The outer boundary 2042 of the center zone 2040 has a diameter, Dcz. The area of the center zone 2024 is $\pi*(Dcz)^2/4$. In some embodiments, the diameter Dcz is between 2 mm and 10 mm, such as between 3 mm and 8 mm, such as between 3 mm and 6 mm. For these embodiments, the area of the projection of the center zone 2024 is between 3.14 $mm^2$ to 78.5 $mm^2$, such as between 7.07 $mm^2$ and 50.24 $mm^2$, such as between 7.07 $mm^2$ and 28.3 $mm^2$.

Figure 119A:
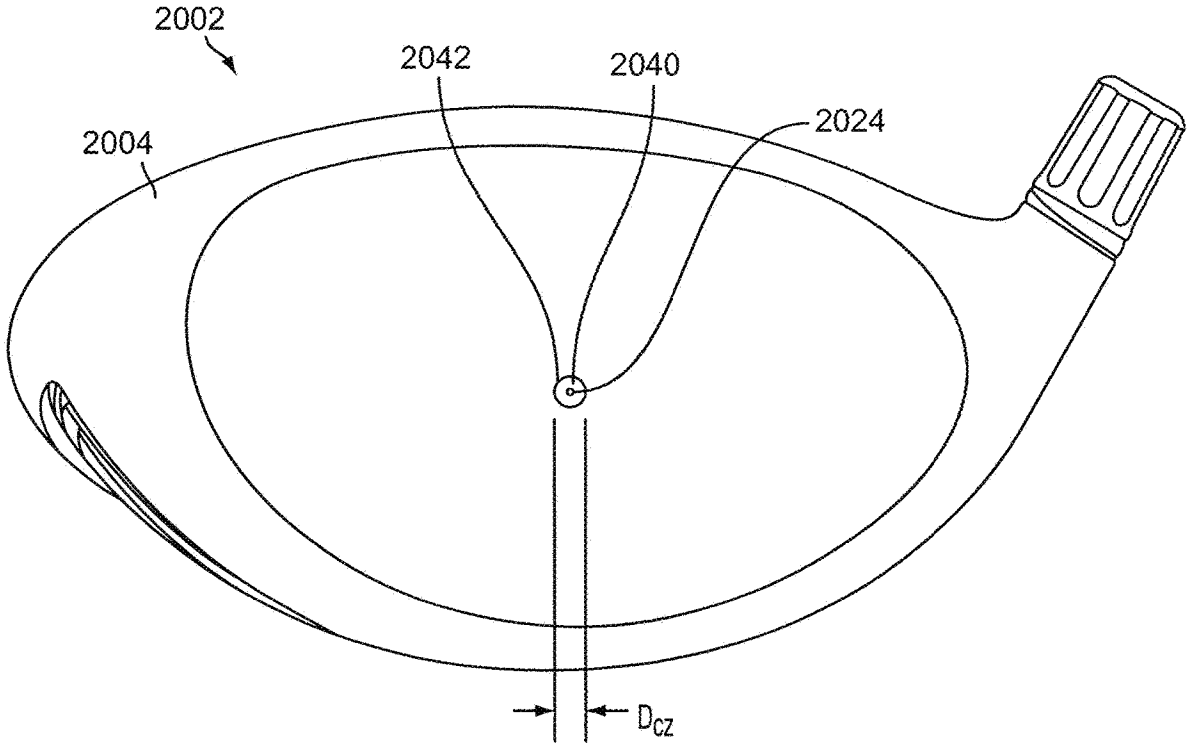
FIGS. 119A-B are front views of the metal-wood golf club of FIG. 118A with the scorelines and other impact surface markings removed for clarity.
Figure 119B:
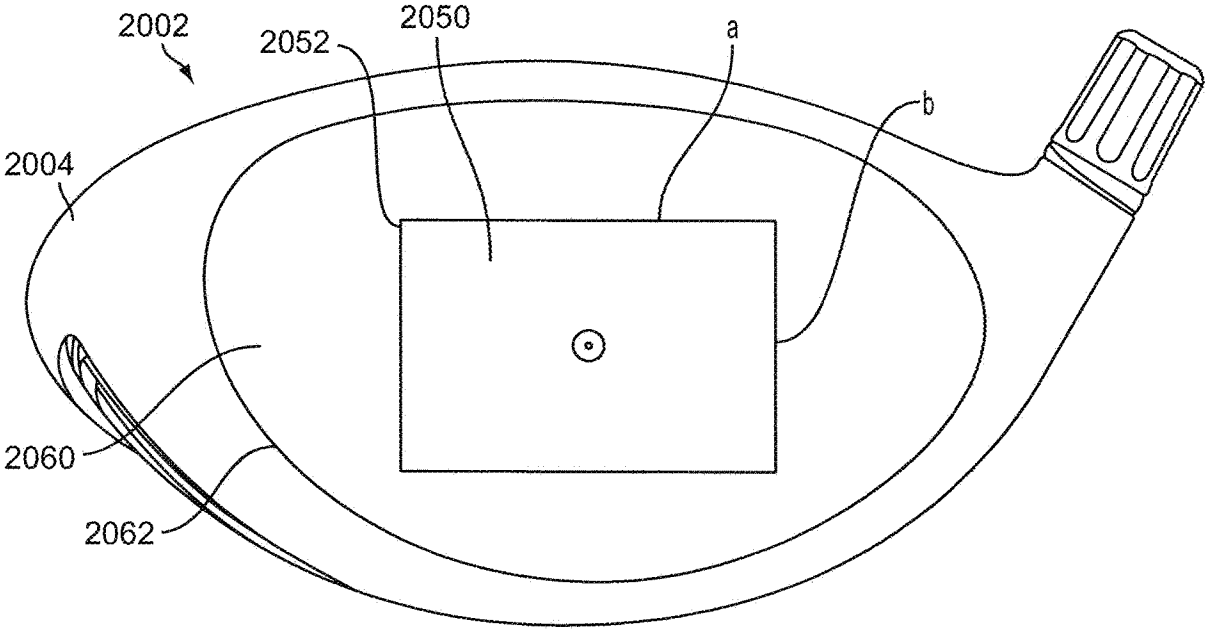
Figure 119C:
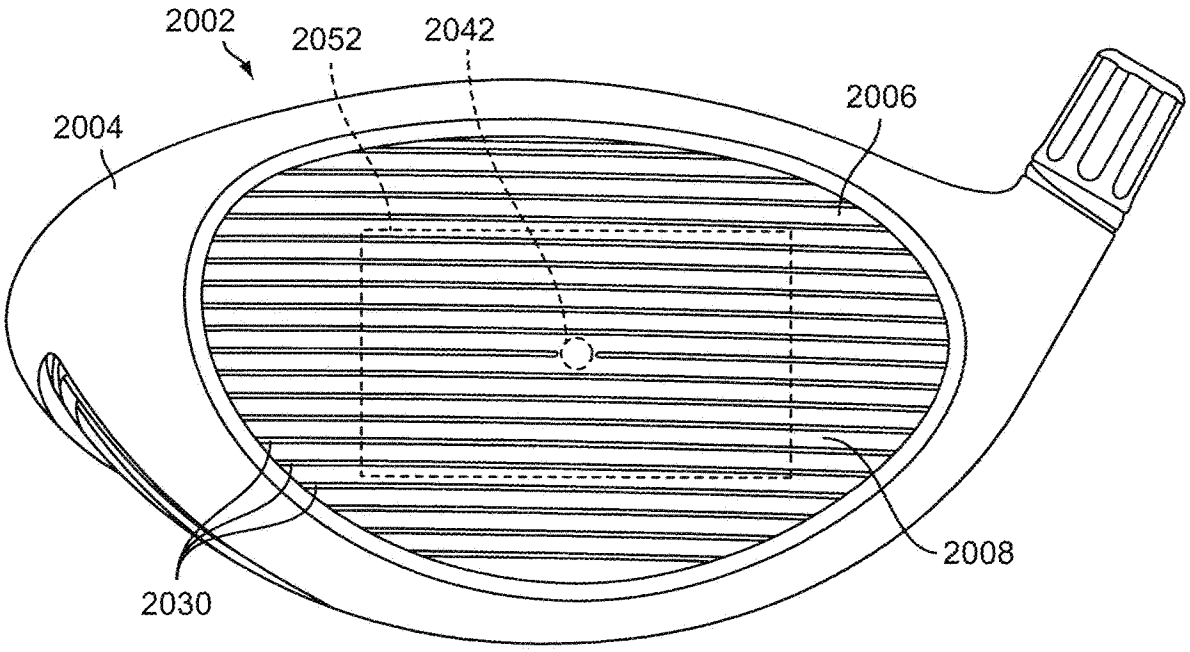
FIG. 119C is a front view of the metal-wood golf club of FIG. 118A with dashed markings showing a center zone and an impact zone.

FIG. 119C shows (in dashed lines) the outer boundary 2042 of the scoreline free center zone 2040 graphically represented on the impact surface of the club head 2002 shown in FIG. 119A or the striking plate 2006 shown in FIG. 120A. As shown, the center zone 2040 corresponds with the break in the scoreline 2030 occurring at the face center 2024 of the impact surface 2008 shown in these figures. Accordingly, although the center zone 2040 shown in FIG. 119A is defined by reference to a circle having a specified diameter, Dcz, the scoreline free area surrounding the center face 2024 may take on any shape that is inclusive of the center zone circle 2042. For example, FIG. 120A shows a scoreline break at the center face location having a width, Wcfb, that is greater than or equal to the diameter, Dcz, of the center zone circle 2042: Wcfb≥Dcz.

The impact zone 2050 may be described by reference to FIGS. 119B and 119C. The impact zone 2050 is an area on the impact surface 2008 that is defined by an inner boundary (i.e., nearer to the center face 2024) and an outer boundary (i.e., nearer to the peripheral edge 2062). The inner boundary of the impact zone 2050 is defined by the outer boundary 2042 of the center zone 2040. The outer boundary 2052 of the impact zone 2050 is defined by a rectangle having its center at the center face 2024, having upper and lower sides having a length a, and having heel and toe sides with a length b, as shown in FIGS. 119B and 119C. The length a of the upper and lower sides of the rectangular outer boundary 2052 is 45 mm. The length b of the heel and toe sides of the outer boundary 2052 is 30 mm. The upper and lower sides of the outer boundary 2052 extend in planes that are oriented parallel to each other and parallel to the ground plane when the club head 2002 is in the address position, and the heel and toe sides of the outer boundary 2052 extend in planes that are parallel to each other and perpendicular to the ground plane when the club head 2002 is in the address position.

Finally, the peripheral zone 2060 may also be described by reference to FIGS. 119B and 119C. The peripheral zone 2060 is an area on the impact surface 2008 that is defined by an inner boundary and an outer boundary. The inner boundary of the peripheral zone 2060 is defined by the outer boundary 2052 of the impact zone 2050. The outer boundary of the peripheral zone 2060 is defined by the peripheral edge 2062 of the striking plate.

A plurality of scorelines 2030 is formed on the impact surface 2008 of the striking plate 2006 as shown, for example, in FIGS. 118A and 120A. The scorelines 2030 may be colored in some embodiments so as to provide a high contrast. The scorelines 2030 generally extend along an axis parallel to the ground plane in a toe-to-heel direction of the golf club head. Alternatively, in some embodiments, the scorelines 2030 may extend across the impact surface at a scoreline angle, such as from about ±1° to about ±5° relative to the ground plane, when the club head is in the address position. In a representative example, some or all of the scorelines have lengths that extend across substantially the full width, Wsp, of the impact surface 2008 of the striking plate 2006, with the exception of the center zone 2040.

Figure 121A:
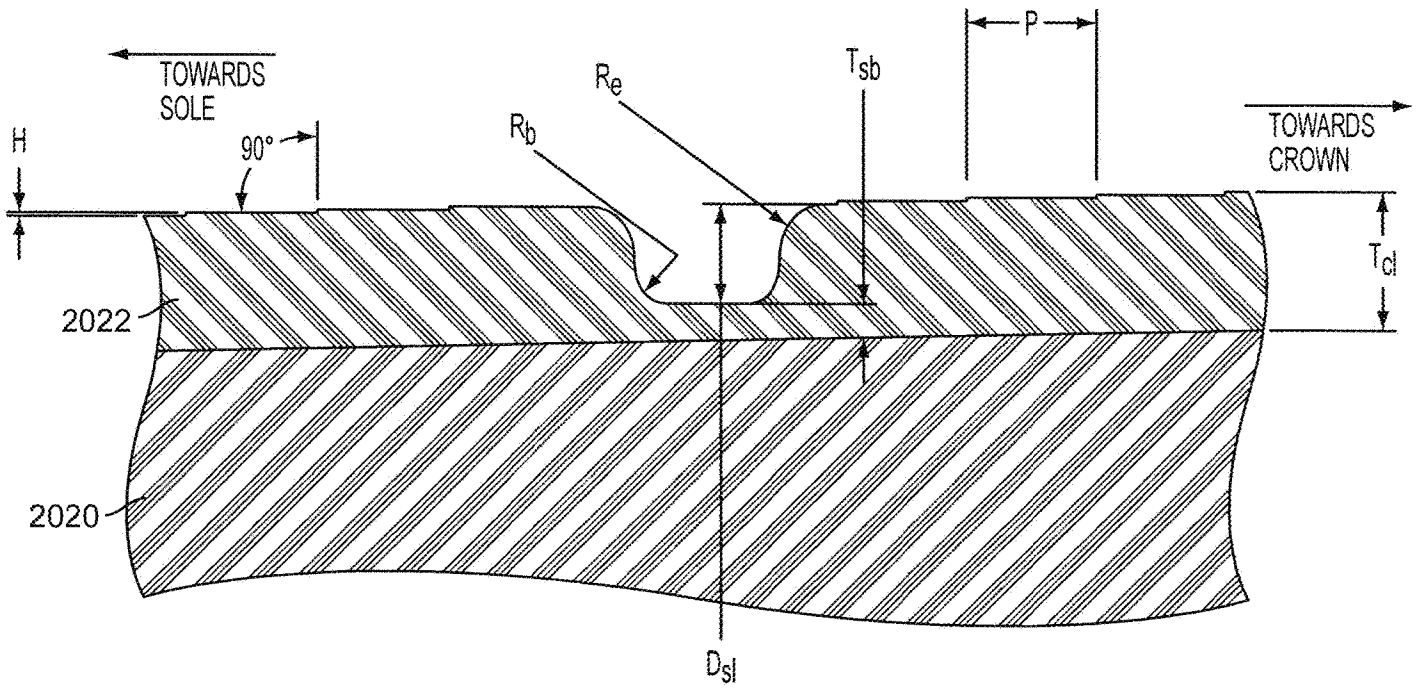
FIG. 121A is a cross-sectional view of a scoreline formed in a cover layer of a striking plate of the metal-wood golf club of FIG. 118A.
Figure 121B:
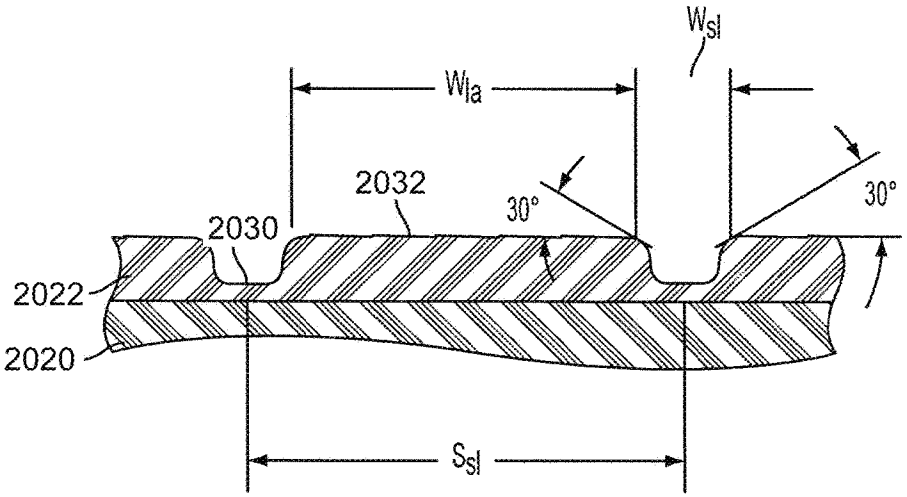
FIG. 121B is a cross-sectional view of a pair of adjacent scorelines formed in a cover layer of a striking plate of the metal-wood golf club of FIG. 118A.

An exemplary scoreline profile is shown in FIGS. 121A-B. FIG. 121A shows a single scoreline 2030 and an exemplary surface texture geometry formed in a cover layer 2022 attached to the forward surface of a composite face plate 2020. FIG. 121B shows a pair of adjacent scorelines 2030 formed in the cover layer 2022. Several representative dimensions of the scorelines 2030 and the scoreline profile are shown in the drawings, including the scoreline depth, Dsl, and scoreline width, Wsl. Although not shown in FIGS. 121A-B, each scoreline 2030 or portion of a scoreline 2030 also includes a length dimension, Lsl, which refers to length distance of the scoreline along the axis parallel to a toe-to-heel direction or along the scoreline angle axis, as discussed above. Moreover, in alternative embodiments not shown in the figures, one or more scorelines may have an orientation within a perpendicular plane relative to the ground plane, or another plane oriented at an angle between parallel and perpendicular.

The scoreline depth Dsl is typically measured in an orientation normal to the impact surface 2008 of the striking plate 2006 from the deepest portion of the scoreline 2030 to a plane representative of the impact surface 2008 at a land area 2032 adjacent to the scoreline. In some embodiments, the scoreline depth Dsl is between 0.1 mm and 0.508 mm, such as between 0.15 mm and 0.4 mm, such as between 0.15 mm and 0.35 mm.

The scoreline width Wsl is measured according to the USGA 30 degree measurement method, in which an edge of the scoreline is designated to be the point on the edge radius where a line inclined at 30 degrees to the land area 2032 of the club face is tangent, and the scoreline width Wsl is measured from edge to edge, as shown for example in FIG. 121B. If the tangent point using the 30 degree method occurs at a location that is more than 0.0762 mm below the land area, then the width measurement is made at the points on the edge radius of the scoreline that are 0.0762 mm below the land area. In some embodiments, the scoreline width Wsl is between 0.3 mm and 0.889 mm, such as between 0.4 mm and 0.75 mm, such as between 0.5 mm and 0.65 mm, or such as between 0.6 mm and 0.889 mm.

The scoreline 2030 may also be described by reference to its edge radii, Re, and bottom radii, Rb. In the embodiment shown in FIG. 121A, the bottom of the scoreline is a compound curve having a first bottom radius Rb located toward the sole side of the scoreline, a second bottom radius Rb located toward the crown side of the scoreline, and a flat section extending between the two bottom radii. In other embodiments, the bottom of the scoreline may be a simple curve having a single bottom radius Rb. In the embodiment shown, the two edge radii, Re, are about 0.15 mm, and the two bottom radii, Rb, are about 0.10 mm. In another embodiment having a scoreline bottom surface defined by a simple curve, the two edge radii, Re, are about 0.397 mm, and the bottom radius, Rb, is about 0.65 mm. Variations of the edge radius, Re, and bottom radius, Rb, are also within the scope of the described scoreline profiles.

The areas between adjacent scorelines 2030 are designated as land areas 2032. In the example shown in FIG. 121B, the land area has a width, Wla, that is measured from the adjacent edges of a pair of adjacent scorelines 2030, with the scoreline edges being defined according to the USGA 30 degree measurement method discussed above. The spacing between adjacent scorelines, Ssl, is also illustrated in FIG. 121B. The scoreline spacing, Ssl, is determined between the midpoints of the widths, Wsl, of each of a pair of adjacent scorelines 2030. In some embodiments, the land area width, Wla, for at least 50% of the land areas 2032 on the impact surface 2008 is at least three times the maximum adjacent measured scoreline width, such as at least four times the adjacent measured scoreline width, or at least five times the adjacent measured scoreline width. In the embodiment shown, the land area width, Wla, is about 2.20 mm, and the scoreline separation, Ssl, is about 2.80 mm. In another embodiment, the land area width, Wla, is about 2.59 mm, and the scoreline separation, Ssl, is about 3.42 mm. Variations of the land area width Wla and scoreline separation distance Ssl are also within the scope of the described scoreline profiles.

As noted above, the center zone 2040 is an area on the impact surface 2008 that is free of scorelines. (See, e.g., FIG. 119C). One advantage of having a scoreline-free center zone 2040 is to provide an improved capability of obtaining an accurate center face characteristic time (CT) measurement using the pendulum testing apparatus and procedure prescribed by the USGA. Details of the USGA procedure are provided in the USGA "Procedure for Measuring the Flexibility of a Golf Clubhead," Revision 1.0.0, May 1, 2008, which is incorporated herein by reference. Providing a center zone 2040 that is scoreline free and of sufficient size allows the pendulum apparatus to impact an area of the club face that has a consistent thickness, thereby providing a more consistent and accurate measurement.

In several embodiments, the impact zone 2050 is provided with scorelines 2030 having scoreline widths, Wsl, scoreline lengths, Lsl, land area widths, Wla, and scoreline separations, Ssl, that provide at least a minimum value for a ratio of scoreline area to impact zone area. In particular, the area of a scoreline, Asl, is generally defined herein as the product of the scoreline width, Wsl, and its length, Lsl. In other words, Asl=Wsl×Lsl. The scoreline area, Asl, may be calculated for the full length of a given scoreline, or for a designated portion of the length of a scoreline, such as the length of a scoreline within the impact zone 2050. It is also contemplated that if the scoreline width, Wsl, varies over the relevant portion of its length, then these variations may be accounted for in the calculation by determining an effective width, Wsl', over the relevant length, Lsl, in order to determine the appropriate measured area, Asl.

The scoreline area, Asl, is the sum of the areas of the scorelines 2030 for a given are of the impact surface 2008. Accordingly, the scoreline area of the impact zone 2050, Asliz, is the sum of the areas of those portions of the scorelines provided within the impact zone 2050. Table 8 below summarizes the scoreline dimensions of several scoreline profile embodiments described herein. For each embodiment, Table 8 also lists the calculated scoreline area within the impact zone 2050, Asliz, the impact zone area, Aiz, and the impact zone scoreline area ratio Asliz/Aiz.

TABLE 8

| | Wsl (mm) | Wla (mm) | Ssl (mm) | Asliz ($mm^2$) | Aiz ($mm^2$) | Asliz/Aiz |
|---|---|---|---|---|---|---|
| Ex. 1 | 0.60 | 2.20 | 2.80 | 294.6 | 1337.44 | 0.22 |
| Ex. 2 | 0.62 | 1.92 | 2.54 | 310.8 | 1337.44 | 0.23 |
| Ex. 3 | 0.83 | 2.59 | 3.42 | 332.8 | 1337.44 | 0.25 |
| Ex. 4 | 0.60 | 3.00 | 3.60 | 240.6 | 1337.44 | 0.18 |
| Ex. 5 | 0.62 | 3.10 | 3.72 | 231.3 | 1337.44 | 0.17 |
| Ex. 6 | 0.83 | 4.15 | 4.98 | 220.8 | 1337.44 | 0.17 |
| Ex. 7 | 0.60 | 4.80 | 5.40 | 132.6 | 1337.44 | 0.10 |
| Ex. 8 | 0.62 | 4.96 | 5.58 | 137.0 | 1337.44 | 0.10 |
| Ex. 9 | 0.83 | 6.64 | 7.47 | 151.3 | 1337.44 | 0.11 |

In the examples listed in Table 8, each of the scorelines 2030 in the impact zone 2050 extends across the full length of the impact zone 2050 with the exception of a single scoreline having a 4 mm discontinuity at the center zone 2040.

The results presented in Table 8 show that the scoreline profiles of several of the embodiments described herein included a value for the scoreline area within the impact zone 2050, Asliz, of at least 130 $mm^2$, such as at least 200 $mm^2$, such as at least 300 $mm^2$. These scoreline profile embodiments also provided a ratio of scoreline area within the impact zone 2050, Asliz, to the area of the impact zone, Aiz, of at least 0.10, such as at least 0.17, such as at least 0.20. Moreover, the described scoreline profile embodiments provide ranges of the ratio Asliz/Aiz that are between about 0.10 to about 0.30, such as between about 0.10 to about 0.25, such as between about 0.17 to about 0.30, or such as between about 0.17 to about 0.25. These values for scoreline area, Asliz, and the ratio of scoreline area to impact zone area, Asliz/Aiz, can enable the composite face plate of the club heads described herein to perform substantially the same as a standard all-metal face plates under wet conditions.

Several of the club head embodiments described herein also include scoreline profiles in the peripheral zone 2060 that provide a ratio of scoreline area, Aslpz, within the peripheral zone 2060 to the area of the peripheral zone, Apz, that are the same as the comparable ratio in the impact zone 2050. For example, in these embodiments, the ratio Aslpz/Apz for the peripheral zone 2060 is at least 0.10, such as at least 0.17, such as at least 0.20. Moreover, the described scoreline profile embodiments provide ranges of the ratio Aslpz/Apz that are between about 0.10 to about 0.30, such as between about 0.10 to about 0.25, such as between about 0.17 to about 0.30, or such as between about 0.17 to about 0.25. In several of these embodiments, such as those shown in FIGS. 118A and 120A, the scoreline widths, Wsl, land area widths, Wla, and scoreline spacing, Ssl, are substantially the same in the peripheral zone 2060 as they are in the impact zone 2050, thereby providing a consistent scoreline profile throughout the extent of the impact surface 2008. Variations of the scoreline dimensions between the scorelines in the impact zone 2050 and those in the peripheral zone 2060 are also within the scope of the described scoreline profiles, as are variations of these dimensions for the scorelines included within each of the respective impact zone 2050 and peripheral zone 2060.

The scoreline profiles described herein can be provided on all or only a portion of the impact surface of the face. For example, for hollow metal-woods, at least some portions of the impact surface at the perimeter of the face can lack scorelines in order to provide an area suitable for attachment of the face to the head body.

An exemplary golf club embodiment that includes a face comprising a composite plate with a polymer cover on the impact surface as described in U.S. Pat. No. 7,874,936, which is incorporated herein by reference. This golf club can further comprise a scoreline profile on the impact surface, such as those shown in FIGS. 118 to 121. In other embodiments, a golf club can have an all-titanium face that includes one of the described scoreline profiles on the impact surface.

Polymeric cover layers on the impact surface of the face can be formed and secured to a face plate using various methods. In some embodiments, a scoreline profile can be formed on the outer impact surface of a cover layer with a mold. For example, a selected scoreline profile can be etched, machined, or otherwise transferred to the mold surface. The mold can be used to form a cover layer having an impact surface that includes the scoreline profile, which can then be attached to a composite face plate or face plate comprised of other materials. Such cover layers can be bonded with an adhesive to the face plate.

Alternatively, a mold can be used to form the cover layer directly on the composite face plate. For example, a layer of a thermoplastic material (or pellets or other portions of such a material) can be placed on an external surface of a pre-formed face plate, and the assembly can be placed in a mold. The mold has a surface with the desired scoreline profile adjacent the polymeric material. The mold surfaces can be pressed against the thermoplastic material and the face plate at suitable temperatures and pressures so as to impress the desired scoreline profile on a thermoplastic layer, thereby forming a cover layer with a desired scoreline profile. In another example, a thermoset material can be deposited on the external surface of the face plate, and the mold pressed against the thermoset material and the face plate to form a cover layer having a desired thickness and scoreline profile. The face plate, the thermoset material, and the mold can then be raised to a suitable temperature so as to cure or otherwise fix the shape and thickness of the cover layer. Exemplary materials are described above.

In other embodiments, a composite face plate and cover layer can be formed at the same time in a mold. For example, a lay-up can be formed from a plurality of pre-preg composite sheets (as disclosed in U.S. Pat. No. 7,874,936) and a layer of polymeric material to form the cover layer of the face plate. The lay-up can be placed in a mold, which applies heat and/or pressure to the lay-up to form a molded part. The cured, molded part can then be removed from the mold and machined as needed to achieve the final shape and size of the face plate. These methods are examples only, and other methods can be used as may be convenient for forming cover layers for face plates.

In other embodiments, the desired scoreline profile can be machined or otherwise formed directly on the face plate. For example, a desired scoreline profile can be machined directly into a metal (e.g., titanium) face plate.

In one embodiment, the total mass of the golf club head is between 185 g and 215 g, or between 190 g and 210, or between 194 g and 205 g. In other embodiments, the total mass of the golf club head is between 165 g and 185 g. In similar embodiments, the volume of the golf club head as measured according to the USGA rules is between 390 cc and 475 cc, or between 410 cc and 470 cc, or greater than 400 cc. In certain embodiments, the coefficient of restitution is greater than 0.80 or 0.81, or between about 0.81 and 0.83, as measured according to the USGA rules of golf. In addition, in some embodiments, the characteristic time is greater than 230 μs, or 220 μs, or 210 μs, or between about 230 μs and 257 μs, as measured according to the USGA rules.

In the embodiments described herein, the "face size" or "striking surface area" is defined according to a specific procedure described herein. A front wall extended surface is first defined which is the external face surface that is extended outward (extrapolated) using the average bulge radius (heel-to-toe) and average roll radius (crown-to-sole). The bulge radius is calculated using five equidistant points of measurement fitted across a 2.5 inch segment along the x-axis (symmetric about the center point). The roll radius is calculated by three equidistant points fitted across a 1.5 inch segment along the y-axis (also symmetric about the center point).

The front wall extended surface is then offset by a distance of 0.5 mm towards the center of the head in a direction along an axis that is parallel to the face surface normal vector at the center of the face. The center of the face is defined according to USGA "Procedure for Measuring the Flexibility of a Golf Clubhead", Revision 2.0, Mar. 25, 2005.

In certain embodiments, the striking surface has a surface area between about 4,000 $mm^2$ and 6,200 $mm^2$ and, in certain preferred embodiments, the striking surface is at least about 5,000 $mm^2$ or between about 5,000 $mm^2$ and 5,500 $mm^2$.

In order to achieve the desired face size, mass is removed from the crown material so that the crown material is between about 0.4 mm and 0.8 mm or less than 0.7 mm over at least 50% of the crown surface area.

In some embodiments, the golf club head can have a CG with a CG x-axis coordinate between about −5 mm and about 10 mm, a CG y-axis coordinate between about 15 mm and about 50 mm, and a CG z-axis coordinate between about −10 mm and about 5 mm. In yet another embodiment, the CG y-axis coordinate is between about 20 mm and about 50 mm. A positive CG y-axis is in a rearward direction of the club head, a positive CG x-axis is in a heel-ward direction of the club head, and a positive CG z-axis is in an upward or crown-ward direction on the club head.

The CG locations described are relative to a head origin coordinate system being provided such that the location of various features of the club head can be determined. The club head origin point is positioned at the geometric center of the striking surface which can be the location of ideal impact.

In certain embodiments, the club head height is between about 63.5 mm to 71 mm (2.5" to 2.8") and the width is between about 116.84 mm to about 127 mm (4.6" to 5.0"). Furthermore, the depth dimension is between about 111.76 mm to about 127 mm (4.4" to 5.0"). The club head height, width, and depth are measured according to the USGA rules. In similar embodiments, the moment of inertia about the CG x-axis (toe to heel), the CG y-axis (back to front), and CG z-axis (sole to crown) is defined. In certain implementations, the club head can have a moment of inertia about the CG z-axis, between about 450 $kg{\cdot}mm^2$ and about 650 $kg{\cdot}mm^2$, and a moment of inertia about the CG x-axis between about 300 $kg{\cdot}mm^2$ and about 500 $kg{\cdot}mm^2$, and a moment of inertia about the CG y-axis between about 300 $kg{\cdot}mm^2$ and about 500 $kg{\cdot}mm^2$. In certain other implementations, the club head can have a moment of inertia about the CG z-axis between about 320 $kg{\cdot}mm^2$ and about 450 $kg{\cdot}mm^2$, and a moment of inertia about the CG x-axis between about 190 $kg{\cdot}mm^2$ and about 350 $kg{\cdot}mm^2$, and a moment of inertia about the CG y-axis between about 250 $kg{\cdot}mm^2$ and about 350 $kg{\cdot}mm^2$.

Whereas the invention has been described in connection with representative embodiments, it will be understood that the invention is not limited to those embodiments. On the contrary, the invention is intended to encompass all modifications, alternatives, and equivalents as may fall within the scope of the invention, as defined by the following claims.

We claim:

1. A golf club head, comprising:

a body defining an interior cavity, a sole portion positioned at a bottom portion of the golf club head, a crown portion positioned at a top portion of the golf club head, a rearward portion, a volume, and a face positioned at the forward portion and having an ideal impact location, a roll, a bulge, a face area of at least 5000 $mm^2$, a face height of no more than 70 mm, and a face width;

an adjustable head-shaft connection assembly coupled to the body and operable to adjust at least one of a loft angle or a lie angle of a golf club formed when the golf club head is attached to a golf club shaft via the head-shaft connection assembly;

the face comprises a non-metallic striking surface having a density of less than 3 g/cc, and a variable face thickness; and the golf club head has a head weight, a head height, a head width of at least 120 mm, a head depth that is greater than 85% of the head width, a Delta1 value, a Delta2 value, a CG angle that is at least 14 degrees, a head origin x-axis (CGx) coordinate, a head origin y-axis (CGy) coordinate that is at least 25 mm, a head origin z-axis (CGz) coordinate of no more than 0 mm, a Zup value of no more than 30 mm, a moment of inertia about a golf club head center-of-gravity x-axis, Ixx, that is at least 300 $kg{\cdot}mm^2$, a moment of inertia about a golf club head center-of-gravity y-axis, Iyy, that is no more than 525 $kg{\cdot}mm^2$, a moment of inertia about a golf club head center-of-gravity z-axis, Izz, that is at least 450 $kg{\cdot}mm^2$, and a hosel axis moment of inertia, Ih;

wherein:

a depth-to-Zup ratio of the head depth to the Zup value is at least 3.75;

a Ih-to-Zup ratio of the hosel axis moment of inertia, Ih, to the Zup value is at least 27 kg·mm; and a roll-to-FH ratio of the roll to the face height is no more than 6.5.

2. The golf club head of claim 1, wherein the face area is no more than 7000 $mm^2$, the head origin z-axis (CGz) coordinate is −2 mm to −12 mm, the head origin y-axis (CGy) coordinate is at least 34 mm, the CG angle is at least 16 degrees, the Delta2 value is at least 24% of the head depth, the Ixx moment of inertia is at least 320 $kg{\cdot}mm^2$, and the Iyy moment of inertia is no more than 500 $kg{\cdot}mm^2$.

3. The golf club head of claim 2, wherein the Izz moment of inertia is at least 525 $kg{\cdot}mm^2$, the Ixx moment of inertia is at least 340 $kg{\cdot}mm^2$, and the Ih moment of inertia is at least 900 $kg{\cdot}mm^2$.

4. The golf club head of claim 3, wherein a differential between the Zup value and ½ the value of the head height is less than −4.5 mm and greater than −12.0 mm, the Izz moment of inertia is at least 550 $kg{\cdot}mm^2$, the Iyy moment of inertia is no more than 475 $kg{\cdot}mm^2$, the Ih moment of inertia is at least 920 $kg{\cdot}mm^2$, and the Delta2 value is at least 26% of the head depth.

5. The golf club head of claim 4, wherein the Izz moment of inertia is at least 575 $kg{\cdot}mm^2$.

6. The golf club head of claim 4, wherein the Ih moment of inertia is no more than 1050 $kg{\cdot}mm^2$, and the Ixx moment of inertia is no more than 425 $kg{\cdot}mm^2$.

7. The golf club head of claim 4, wherein the Delta2 value is 38-46 mm, and the roll-to-FH ratio is no more than 6.25.

8. The golf club head of claim 4, wherein the head origin y-axis (CGy) coordinate is no more than 50 mm, and the roll-to-FH ratio is no more than 6.0.

9. The golf club head of claim 2, wherein the Iyy moment of inertia is no more than 475 $kg{\cdot}mm^2$, the depth-to-Zup ratio is at least 4.00, the Delta2 value is at least 26% of the head depth, and the non-metallic striking surface has a mean surface roughness of 2.5-5 μm.

10. The golf club head of claim 9, wherein the Delta2 value is at least 28% of the head depth, and the non-metallic striking surface includes a plurality of surface features that contact the golf ball at impact.

11. The golf club head of claim 10, wherein the plurality of surface features create a plurality of ridges extending in a heel-toe direction with each ridge having an upwardly facing first surface and a downwardly facing second surface creating a surface texture that is asymmetric in a sole-crown direction and having a plurality of peaks and valleys, wherein a distance X1 is the distance in the sole-crown direction between a first peak and a nearest first valley located above the first peak, a distance X2 is the distance in the sole-crown direction between the first peak and a nearest second valley located below the first peak, the distance X1 is greater than the distance X2 and creates an asymmetric-down surface texture.

12. The golf club head of claim 11, wherein the plurality of ridges comprise a periodic width distance of 0.1-0.4 mm between adjacent valleys.

13. The golf club head of claim 9, wherein the non-metallic striking surface includes a polymer cover layer having a plurality of scorelines with an average depth between 0.1 mm and 0.4 mm, at least a portion having a cover layer thickness is 0.1-3.0 mm, and a ratio of the average depth of the plurality of scorelines to the average thickness of the cover layer is between 0.5 to 0.8.

14. The golf club head of claim 2, wherein the face area is 5250-6500 $mm^2$, the roll-to-FH ratio is no more than 6.25, at least 75% of the crown portion is formed of non-metallic material having a crown density of less than 2 g/cc, at least 50% of a surface area of the body located above the height of the ideal impact location is formed of non-metallic material, and further including at least one weight port formed in the body and at least partially containing a removable weight having a weight density greater than the non-metallic striking surface.

15. The golf club head of claim 1, wherein the Iyy moment of inertia is no more than 475 $kg{\cdot}mm^2$, the Delta2 value is at least 26% of the head depth, and the non-metallic striking surface comprises a thermoplastic material.

16. The golf club head of claim 1, wherein the Iyy moment of inertia is no more than 475 $kg{\cdot}mm^2$, the Delta2 value is at least 26% of the head depth, and the non-metallic striking surface is integrally formed with either a portion of the crown or a portion of the sole.

17. The golf club head of claim 1, wherein a mass of the non-metallic material located above the height of the ideal impact location is 25-50 grams, and a surface area of the non-metallic material located above the height of the ideal impact location is at least 7500 $mm^2$.

18. The golf club head of claim 17, wherein at least 50% of the surface area of the body located below the height of the ideal impact location is formed of non-metallic material, and a mass of the non-metallic material located below the height of the ideal impact location is 10-25% of the head weight.

19. The golf club head of claim 1, wherein the Iyy moment of inertia is no more than 475 $kg{\cdot}mm^2$, the Delta2 value is at least 26% of the head depth, and the non-metal striking surface includes a plurality of composite prepreg plies.

20. The golf club head of claim 19, wherein the plurality of composite prepreg plies includes a plurality of prepreg panels and at least one cluster comprising a plurality of prepreg strips.

21. A golf club head, comprising:

a body defining an interior cavity, a sole portion positioned at a bottom portion of the golf club head, a crown portion positioned at a top portion of the golf club head, a rearward portion, a volume, and a face positioned at a forward portion and having an ideal impact location, a roll, a bulge, a face height of no more than 70 mm, and a face width;

an adjustable head-shaft connection assembly coupled to the body and operable to adjust at least one of a loft angle or a lie angle of a golf club formed when the golf club head is attached to a golf club shaft via the head-shaft connection assembly;

the face comprises a polymer cover layer; and the golf club head has a head weight, a head height, a head width, a head depth that is greater than 85% of the head width, a Delta1 value, a Delta2 value, a CG angle that is at least 14 degrees, a head origin x-axis (CGx) coordinate, a head origin y-axis (CGy) coordinate that is at least 25 mm, a head origin z-axis (CGz) coordinate of no more than 0 mm, a Zup value of no more than 30 mm, a moment of inertia about a golf club head center-of-gravity x-axis, Ixx, a moment of inertia about a golf club head center-of-gravity y-axis, Iyy, a moment of inertia about a golf club head center-of-gravity z-axis, Izz, and a hosel axis moment of inertia, Ih;

wherein:

a depth-to-Zup ratio of the head depth to the Zup value is at least 3.75;

a Ih-to-Zup ratio of the hosel axis moment of inertia, Ih, to the Zup value is at least 27 kg·mm; and a roll-to-FH ratio of the roll to the face height is no more than 6.5.

22. The golf club head of claim 21, wherein the polymer cover layer comprises a thermoplastic polymer.

23. The golf club head of claim 22, wherein the thermoplastic polymer comprises a nylon polymer.

24. The golf club head of claim 23, wherein the polymer cover layer defines a textured striking surface, at least 75% of the crown portion is formed of non-metallic material having a crown density of less than 2 g/cc, and the face has a variable face thickness.

25. The golf club head of claim 24, wherein the textured striking surface has a Shore D hardness of at least about 75 and a mean surface roughness of 2.5-5 μm.

26. The golf club head of claim 23, wherein the polymer cover layer has a plurality of scorelines, and a cover layer thickness of 0.1-3.0 mm.

27. The golf club head of claim 23, wherein the polymer cover layer has a plurality of scorelines, the plurality of scorelines have an average depth between 0.1 mm and 0.4 mm, the face has an average face thickness of 2.0-4.5 mm, at least 75% of the crown portion is formed of non-metallic material having a crown density of less than 2 g/cc, the Ixx moment of inertia is at least 300 $kg{\cdot}mm^2$, the Izz moment of inertia is at least 450 $kg{\text{-}}mm^2$, the head origin z-axis (CGz) coordinate is −2 mm to −12 mm, the head origin y-axis (CGy) coordinate is at least 34 mm, the CG angle is at least 16 degrees, and a differential between the Zup value and ½ the value of the head height is less than −4.5 mm and greater than −12.0 mm.

28. The golf club head of claim 23, wherein the polymer cover layer has a plurality of scorelines, the plurality of scorelines have an average depth, a ratio of the average depth to an average thickness of the polymer cover layer is between 0.5 to 0.8, the Delta2 value is at least 24% of the head depth, the Ixx moment of inertia is at least 340 $kg{\cdot}mm^2$, and the Izz moment of inertia is at least 550 $kg{\cdot}mm^2$, and the Ih moment of inertia is at least 900 $kg{\cdot}mm^2$.

29. A golf club head, comprising:

a body defining an interior cavity, a sole portion positioned at a bottom portion of the golf club head, a crown portion positioned at a top portion of the golf club head, a rearward portion, a volume, and a face positioned at a forward portion and having an ideal impact location, a roll, a bulge, a face height of no more than 70 mm, and a face width;

an adjustable head-shaft connection assembly coupled to the body and operable to adjust at least one of a loft angle or a lie angle of a golf club formed when the golf club head is attached to a golf club shaft via the head-shaft connection assembly;

the face comprises a non-metallic reinforcing material on an interior side of the face; and the golf club head has a head weight, a head height, a head width, a head depth that is greater than 85% of the head width, a Delta1 value, a Delta2 value, a CG angle that is at least 14 degrees, a head origin x-axis (CGx) coordinate, a head origin y-axis (CGy) coordinate that is at least 25 mm, a head origin z-axis (CGz) coordinate of no more than 0 mm, a Zup value of no more than 30 mm, a moment of inertia about a golf club head center-of-gravity x-axis, Ixx, a moment of inertia about a golf club head center-of-gravity y-axis, Iyy, a moment of inertia about a golf club head center-of-gravity z-axis, Izz, and a hosel axis moment of inertia, Ih;

wherein:

a depth-to-Zup ratio of the head depth to the Zup value is at least 3.75;

a Ih-to-Zup ratio of the hosel axis moment of inertia, Ih, to the Zup value is at least 27 kg·mm; and a roll-to-FH ratio of the roll to the face height is no more than 6.5.

30. The golf club head of claim 29, wherein the non-metallic reinforcing material comprises fiber reinforced resin, and the face has a variable face thickness.

31. The golf club head of claim 30, wherein the face has an average face thickness of 2.0-4.5 mm, and at least 75% of the crown portion is formed of non-metallic material having a crown density of less than 2 g/cc, and the non-metallic reinforcing material comprises at least one prepreg ply having a fiber areal weight of below 100 $g/m^2$.

32. The golf club head of claim 31, wherein the Delta2 value is at least 24% of the head depth, the Ixx moment of inertia is at least 300 $kg \cdot mm^2$, the Izz moment of inertia is at least 450 $kg \cdot mm^2$, the head origin z-axis (CGz) coordinate is −2 mm to −12 mm, the head origin y-axis (CGy) coordinate is at least 34 mm, the CG angle is at least 16 degrees, and a differential between the Zup value and ½ the value of the head height is less than −4.5 mm and greater than-12.0 mm, and the prepreg ply comprises carbon fiber and the fiber areal weight is below 70 $g/m^2$.

* * * * *